US007742064B2

(12) United States Patent
Kimura

(10) Patent No.: US 7,742,064 B2
(45) Date of Patent: Jun. 22, 2010

(54) SIGNAL LINE DRIVER CIRCUIT, LIGHT EMITTING DEVICE AND DRIVING METHOD THEREOF

(75) Inventor: Hajime Kimura, Kanagawa (JP)

(73) Assignee: Semiconductor Energy Laboratory Co., Ltd, Atsugi-shi, Kanagawa-ken ( * ) Notice: Subject to any disclaimer, the term of this patent is extended or adjusted under 35 U.S.C. 154(b) by 707 days.

(21) Appl. No.: 10/282,235

(22) Filed: Oct. 29, 2002

(65) Prior Publication Data

US 2003/0169250 A1 Sep. 11, 2003

(30) Foreign Application Priority Data

Oct. 30, 2001 (JP) ..... 2001-333466
Sep. 30, 2002 (JP) ..... 2002-288104

(51) Int. Cl.
*G09G 5/10* (2006.01)
*G09G 5/00* (2006.01)

(52) U.S. Cl. ..... 345/690; 345/76; 345/82; 345/211; 315/160; 315/163; 315/172

(58) Field of Classification Search ..... 345/204, 345/211–213, 98, 39, 44, 46, 76, 82, 690; 315/201, 169.1, 160, 163, 172
See application file for complete search history.

(56) References Cited

U.S. PATENT DOCUMENTS 4,967,140 A 10/1990 Groeneveld et al.
5,041,823 A 8/1991 Johnson et al.
5,138,310 A * 8/1992 Hirane et al. ..... 345/82
5,266,936 A * 11/1993 Saitoh ..... 345/98
5,517,207 A 5/1996 Kawada et al.
5,594,463 A 1/1997 Sakamoto
5,680,149 A 10/1997 Koyama et al.
5,783,952 A 7/1998 Kazazian
5,793,163 A 8/1998 Okuda
5,844,368 A 12/1998 Okuda et al.

(Continued)

FOREIGN PATENT DOCUMENTS

CN 1287656 3/2001

(Continued)

OTHER PUBLICATIONS

Reiji Hattori et al., "Analog-Circuit Simulation of the Current-Programmed Active-Matrix Pixel Electrode Circuits Based on Poly-Si TFT for Organic Light-Emitting Displays," The Japan Society of Applied Physics, AM-LCD '01, Jul. 11-13, 2001, pp. 223-226.

(Continued)

*Primary Examiner*—Henry N Tran
(74) *Attorney, Agent, or Firm*—Eric J. Robinson; Robinson Intellectual Property Law Office, P.C.

(57) ABSTRACT

Variation occurs in transistor characteristics. The present invention relates to a signal line driver circuit comprising a plurality of current source circuits respectively corresponding to a plurality of wirings, characterized in that: the plurality of current source circuits each comprise capacitor means and supply means; and the plurality of current source circuits each convert a supplied current into a voltage in accordance with a video signal, and supply a current corresponding to the converted voltage.

33 Claims, 84 Drawing Sheets

U.S. PATENT DOCUMENTS

| | | | | |
|---|---|---|---|---|
| 5,923,309 | A | 7/1999 | Ishizuka et al. | |
| 5,952,789 | A | 9/1999 | Stewart et al. | |
| 5,953,003 | A * | 9/1999 | Kwon et al. | 345/204 |
| 6,091,203 | A | 7/2000 | Kawashima et al. | |
| 6,097,359 | A | 8/2000 | Kwon et al. | |
| 6,201,822 | B1 | 3/2001 | Okayasu | |
| 6,222,357 | B1 | 4/2001 | Sakuragi | |
| 6,229,506 | B1 | 5/2001 | Dawson et al. | |
| 6,268,842 | B1 | 7/2001 | Yamazaki et al. | |
| 6,310,589 | B1 | 10/2001 | Nishigaki et al. | |
| 6,331,844 | B1 * | 12/2001 | Okumura et al. | 345/87 |
| 6,344,843 | B1 | 2/2002 | Koyama et al. | |
| 6,369,516 | B1 | 4/2002 | Iketsu et al. | |
| 6,373,454 | B1 | 4/2002 | Knapp et al. | |
| 6,426,743 | B1 | 7/2002 | Yeo et al. | |
| 6,473,064 | B1 * | 10/2002 | Tsuchida et al. | 345/82 |
| 6,498,438 | B1 | 12/2002 | Edwards | |
| 6,501,466 | B1 | 12/2002 | Yamagishi et al. | |
| 6,535,185 | B2 * | 3/2003 | Kim et al. | 345/76 |
| 6,545,651 | B2 | 4/2003 | Nishigaki et al. | |
| 6,548,960 | B2 | 4/2003 | Inukai | |
| 6,552,702 | B1 * | 4/2003 | Abe et al. | 345/75.2 |
| 6,556,646 | B1 | 4/2003 | Yeo et al. | |
| 6,650,060 | B2 | 11/2003 | Okuda | |
| 6,714,091 | B2 * | 3/2004 | Norskov et al. | 331/185 |
| 6,731,264 | B2 | 5/2004 | Koyama et al. | |
| 6,756,740 | B2 | 6/2004 | Inukai | |
| 6,765,560 | B1 | 7/2004 | Ozawa | |
| 6,788,231 | B1 | 9/2004 | Hsueh | |
| 6,806,857 | B2 | 10/2004 | Sempel et al. | |
| 8,809,320 | * | 10/2004 | Iida et al. | 250/338.4 |
| 6,859,193 | B1 * | 2/2005 | Yumoto | 345/82 |
| 6,876,350 | B2 * | 4/2005 | Koyama | 345/92 |
| 6,936,846 | B2 | 8/2005 | Koyama et al. | |
| 6,937,233 | B2 * | 8/2005 | Sakuma et al. | 345/211 |
| 6,963,336 | B2 | 11/2005 | Kimura | |
| 6,985,072 | B2 | 1/2006 | Omidi et al. | |
| 6,999,048 | B2 * | 2/2006 | Sun et al. | 345/82 |
| 7,015,882 | B2 | 3/2006 | Yumoto | |
| 7,023,482 | B2 | 4/2006 | Sakuragi | |
| 7,049,991 | B2 | 5/2006 | Kimura | |
| 7,142,781 | B2 | 11/2006 | Koyama et al. | |
| 7,180,479 | B2 | 2/2007 | Kimura | |
| 7,193,591 | B2 | 3/2007 | Yumoto | |
| 7,193,619 | B2 | 3/2007 | Kimura | |
| 7,256,756 | B2 | 8/2007 | Abe | |
| 7,271,784 | B2 | 9/2007 | Koyama | |
| 7,379,039 | B2 | 5/2008 | Yumoto | |
| 7,388,564 | B2 | 6/2008 | Yumoto | |
| 2001/0048410 | A1 | 12/2001 | Nishigaki et al. | |
| 2002/0047555 | A1 | 4/2002 | Inukai | |
| 2002/0057244 | A1 * | 5/2002 | Koyama et al. | 345/87 |
| 2002/0135309 | A1 * | 9/2002 | Okuda | 315/169.1 |
| 2003/0048669 | A1 | 3/2003 | Abe | |
| 2003/0128199 | A1 | 7/2003 | Kimura | |
| 2003/0128200 | A1 | 7/2003 | Yumoto | |
| 2003/0146712 | A1 | 8/2003 | Inukai | |
| 2003/0156012 | A1 | 8/2003 | Omidi et al. | |
| 2003/0156102 | A1 | 8/2003 | Kimura | |
| 2004/0056705 | A1 | 3/2004 | Dabral | |
| 2004/0085029 | A1 | 5/2004 | Kimura | |
| 2004/0085270 | A1 | 5/2004 | Kimura | |
| 2004/0174282 | A1 * | 9/2004 | Sun et al. | 341/136 |
| 2004/0207578 | A1 * | 10/2004 | Koyama | 345/76 |
| 2004/0207615 | A1 | 10/2004 | Yumoto | |
| 2004/0222985 | A1 * | 11/2004 | Kimura | 345/212 |
| 2005/0001794 | A1 | 1/2005 | Nakanishi et al. | |
| 2005/0190177 | A1 | 9/2005 | Yumoto | |
| 2005/0200300 | A1 | 9/2005 | Yumoto | |
| 2006/0028413 | A1 | 2/2006 | Kimura | |
| 2006/0103610 | A1 | 5/2006 | Kimura | |
| 2006/0119552 | A1 | 6/2006 | Yumoto | |
| 2007/0146249 | A1 | 6/2007 | Kimura | |
| 2007/0217275 | A1 | 9/2007 | Abe | |
| 2009/0033649 | A1 | 2/2009 | Kimura | |

FOREIGN PATENT DOCUMENTS

| | | | |
|---|---|---|---|
| CN | 1404600 | | 3/2003 |
| EP | 0 359 315 | | 3/1990 |
| EP | 1 039 440 | | 9/2000 |
| EP | 1 063 630 | A2 | 12/2000 |
| EP | 1 102 234 | | 5/2001 |
| EP | 1111574 | | 6/2001 |
| EP | 1 130 565 | | 9/2001 |
| EP | 1 333 422 | | 8/2003 |
| EP | 1 447 787 | | 8/2004 |
| EP | 1 450 342 | | 8/2004 |
| EP | 1 463 026 | | 9/2004 |
| GB | 2 343 067 | | 4/2000 |
| GB | 2 360 651 | | 9/2001 |
| JP | 62-122488 | | 8/1987 |
| JP | 02-105907 | | 4/1990 |
| JP | 05-042488 | | 10/1993 |
| JP | 06-118913 | | 4/1994 |
| JP | 07-036409 | | 2/1995 |
| JP | 08-095522 | | 4/1996 |
| JP | 08-101669 | | 4/1996 |
| JP | 08-106075 | | 4/1996 |
| JP | 09-244590 | | 9/1997 |
| JP | 09-329806 | | 12/1997 |
| JP | 10-312173 | | 11/1998 |
| JP | 11-045071 | | 2/1999 |
| JP | 11-231834 | | 8/1999 |
| JP | 11-282419 | | 10/1999 |
| JP | 2000-039926 | | 2/2000 |
| JP | 2000039926 | * | 2/2000 |
| JP | 2000-081920 | | 3/2000 |
| JP | 2000-105574 | | 4/2000 |
| JP | 2000-122607 | | 4/2000 |
| JP | 2000-122608 | | 4/2000 |
| JP | 2000105574 | * | 4/2000 |
| JP | 2000122608 | * | 4/2000 |
| JP | 2000-305522 | | 11/2000 |
| JP | 2001-034221 | | 2/2001 |
| JP | 2001-042822 | | 2/2001 |
| JP | 2001-056667 | | 2/2001 |
| JP | 2001-56667 | | 2/2001 |
| JP | 2001-147659 | | 5/2001 |
| JP | 2001-290469 | | 10/2001 |
| JP | 2001-005426 | | 1/2002 |
| JP | 2002-152565 | | 5/2002 |
| JP | 2002-514320 | | 5/2002 |
| JP | 2002-517806 | | 6/2002 |
| JP | 2002-215095 | | 7/2002 |
| JP | 2002-278497 | | 9/2002 |
| JP | 2003-150112 | | 5/2003 |
| JP | 2003-195812 | | 7/2003 |
| JP | 2003-195815 | | 7/2003 |
| KR | 0137475 | | 6/1998 |
| KR | 10-0250411 | | 4/2000 |
| KR | 2001-085788 | | 9/2001 |
| TW | 477156 | | 2/2002 |
| TW | 493153 | | 7/2002 |
| WO | WO 1997/022134 | | 6/1997 |
| WO | WO 1998/011554 | | 3/1998 |
| WO | WO 1998//011554 | * | 3/1998 |
| WO | WO98/48403 | | 10/1998 |
| WO | WO99/65011 | | 12/1999 |
| WO | WO 2001/006484 | | 1/2001 |
| WO | WO 2001/06484 | * | 1/2001 |
| WO | WO 2001/026088 | | 4/2001 |
| WO | WO 2001/091095 | | 11/2001 |

WO WO 02/39420 5/2002

OTHER PUBLICATIONS

International Preliminary Examination Report, Application No. PCT/JP2002/011279, Oct. 14, 2004.
R. Hattori, *Circuit Simulation of Poly-Si TFT Based Current-Writing Active-Matrix Organic LED Display*, The Institute of Electronics, Information and Communication Engineers, Technical Report of IEICE, ED2001-8, SDM2001-8, Apr., 2001, pp. 7-14.
Office Action dated Aug. 25, 2005 for U.S. Appl. No. 10/282,234 filed Oct. 29, 2002 to Kimura.
Abe et al., *16-l: A Poly-Si TFT 6-Bit Current Data Driver for Active Matrix Organic Light Emitting Diode Displays*, Eurodisplay 2002, pp. 279-282.
Hattori, *Data-Line Driver Circuits for Current-Programmed Active-Matrix OLED Based on Poly-Si TFTs*, AM-LCD '02, pp. 17-20.
Yumoto et al., *Pixel-Driving Methods for Large-Sized Poly-Si AM-OLED Displays*, Asia Display/IDW '01, pp. 1395-1398.
International Preliminary Examination Report dated Oct. 14, 2004 for Application No. PCT/JP2002/011278.
International Preliminary Examination Report dated Oct. 14, 2004 for Application No. PCT/JP 2002/011280.
International Preliminary Examination Report dated Oct. 14, 2004 for Application No. PCT/JP2002/011354.
International Preliminary Examination Report dated Oct. 14, 2004 for Application No. PCT/JP2002/011355.
Morosawa.K et al., "A Novel Poly-Si TFT Current DAC Circuit for AM-OLED Displays,", AM-LCD '03 Digest Of Technical Papers, 2003, pp. 301-304.
Tseng.J et al., "A New 6-Bit Digital-Type Current Driven Structure of OLED Display,", IDW '03 : Proceedings of the 10th International Display Workshops, 2003, pp. 271-274.
Tseng.J et al., "An Active Matrix Oled Display Employing An Improving Gray Scale Structure,", IDW '03 : Proceedings of the 10th International Display Workshops, 2003, pp. 523-526.
Search Report (Application No. 02775425.8) Dated Dec. 4, 2007.
Office Action (Application No. 95121256) Dated May 22, 2008.
Search Report (Application No. 02775426.6) Dated Aug. 29, 2008.
Inukai et al., "4.0-in. TFT-OLED Displays And A Novel Digital Driving Method," SID Digest '00: SID International Symposium Digest of Technical Papers, vol. XXXI, 2000, pp. 924-927.
'Search Report and Written Opinion (Application No. 200602530-8) Dated Jan. 21, 2009.
'Office Action (Application No. 200.4-7006382) Dated Dec. 11, 2008.
'Office Action (Application No. 2007-7024315) Dated Dec. 11, 2008.
'Office Action (Application No. 2004-7006293) Dated Dec. 18, 2008.
'Office Action (Application No. 2004-7006165) Dated Dec. 18, 2008.
'Office Action (Application No. 2004-7006576) Dated Dec. 19, 2008.
Office Action (Application No. 10-2004-7006499) dated Dec. 19, 2008.
Search Report (Application No. 02775443.1) Dated Feb. 9, 2009.
Search Report (Application No. 02775442.3) Dated Jun. 22, 2009.
Search Report (Application No. 200602382-4) Dated Mar. 13, 2009.
'Office Action (Application No. 200810128378.4) Dated Dec. 4, 2009.

* cited by examiner

[FIG. 1]
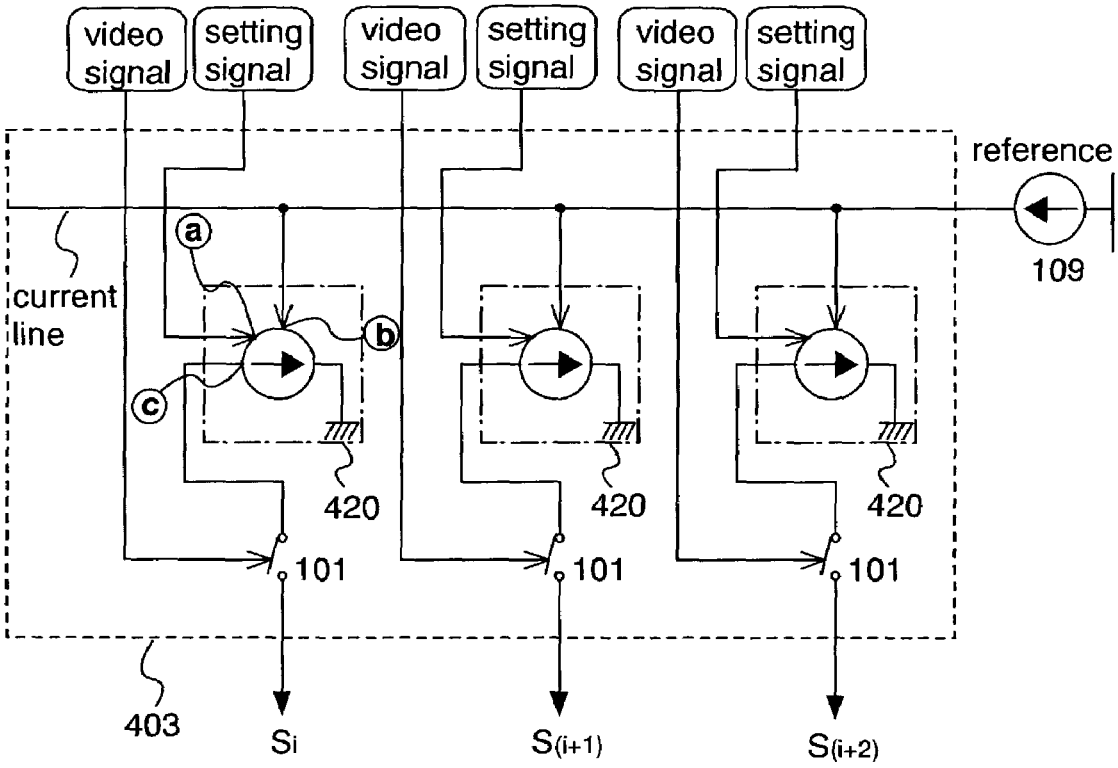

[FIG. 2]
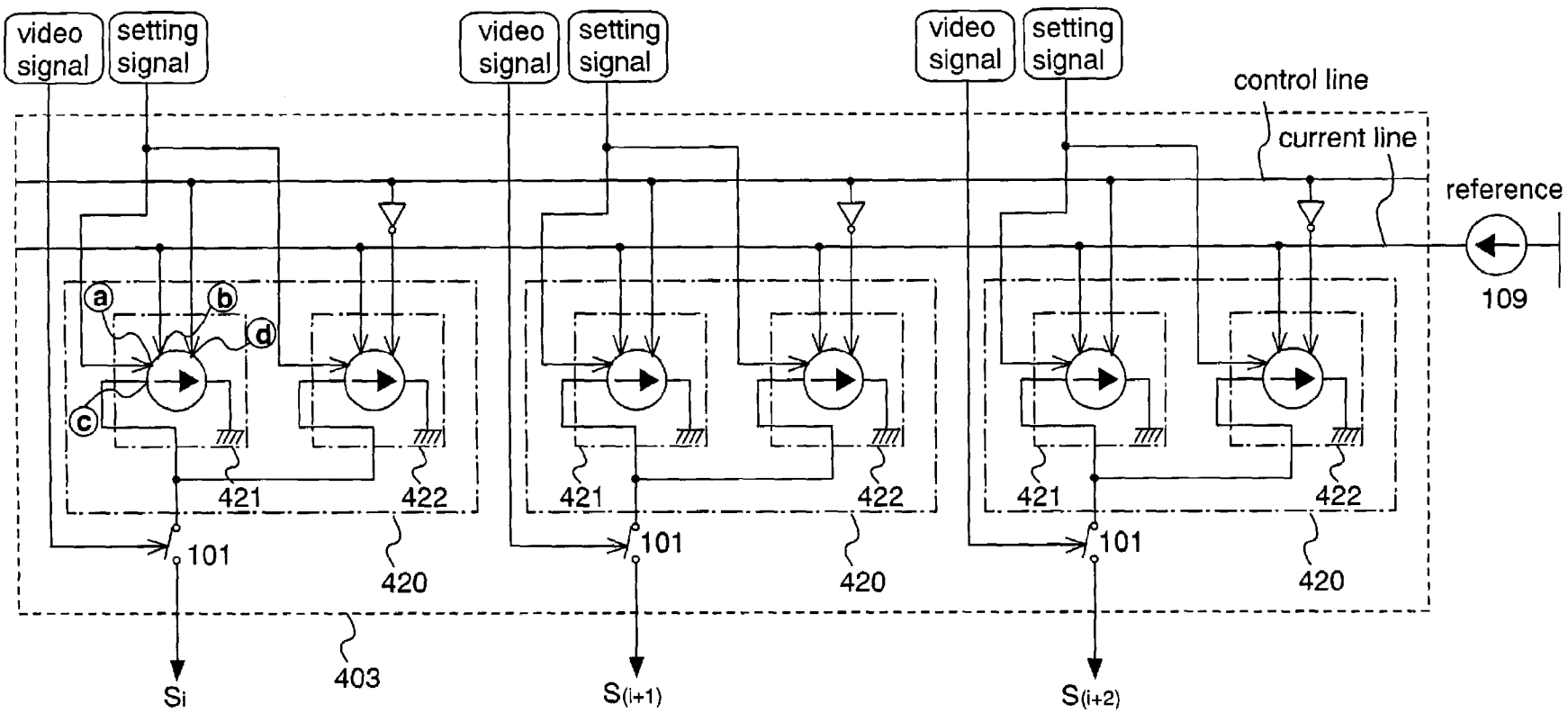

[FIG. 3]
(A)
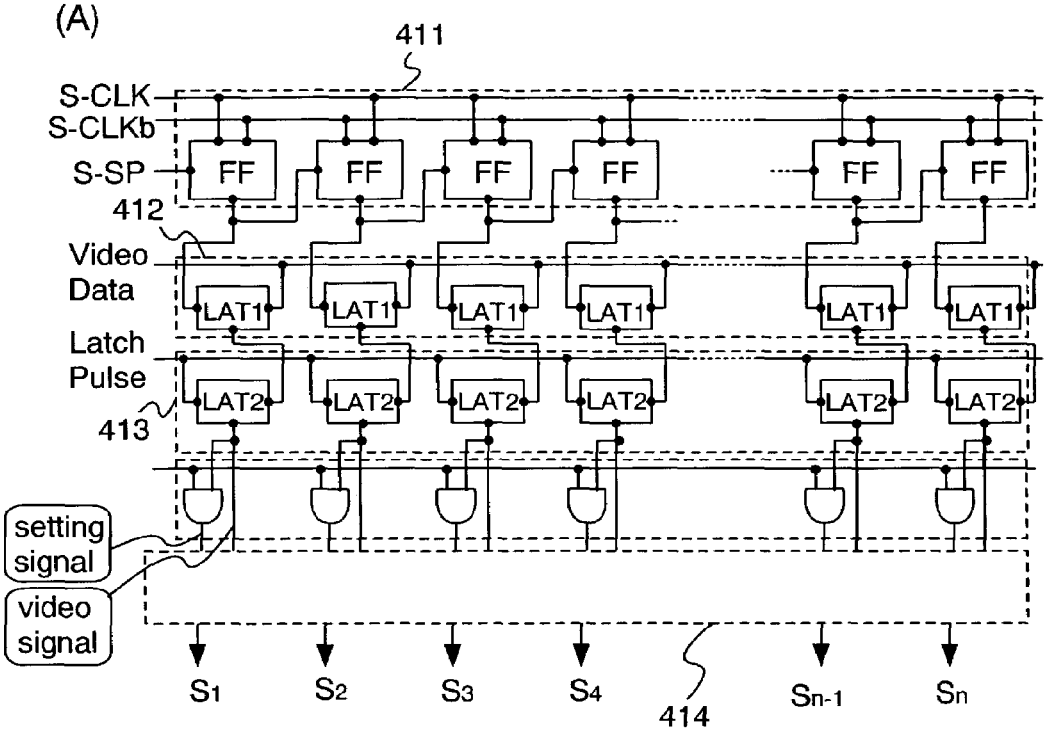
(B)
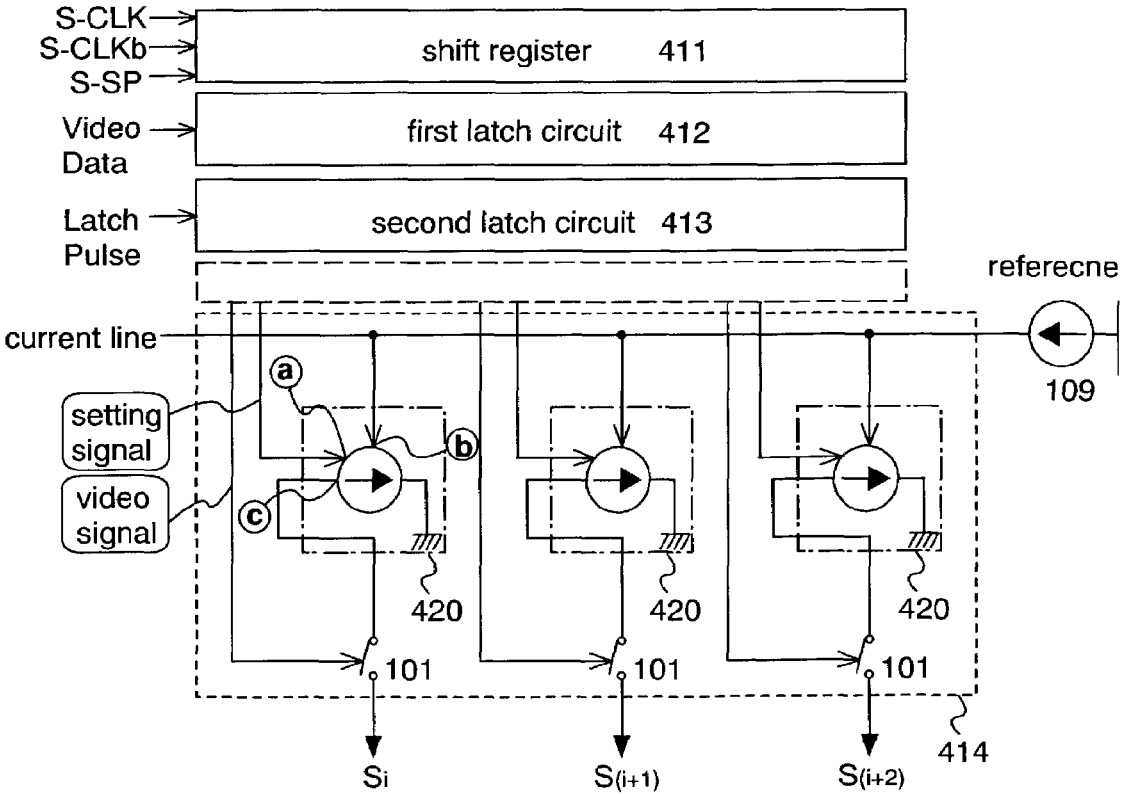

[FIG. 4]
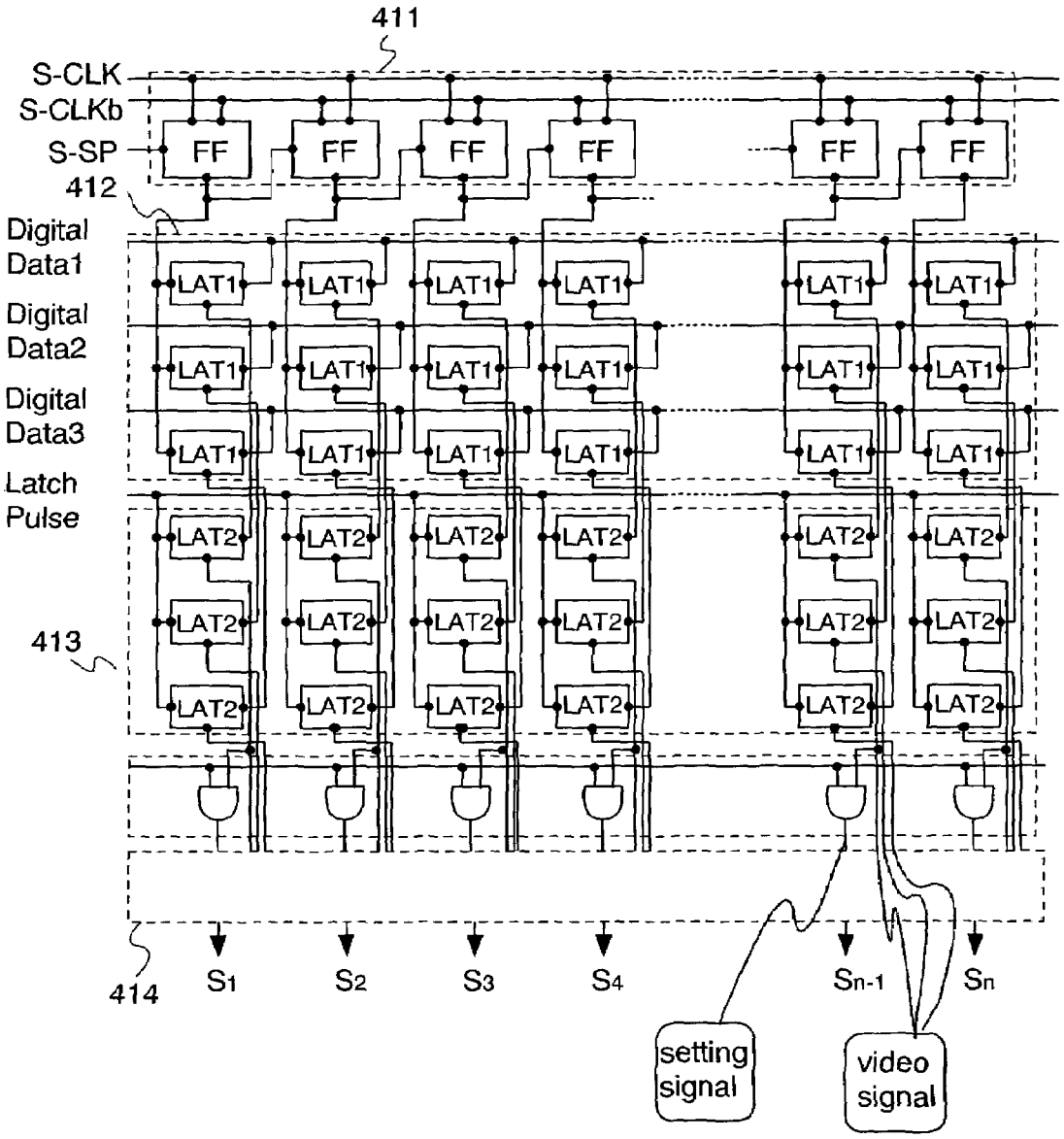

[FIG. 5]
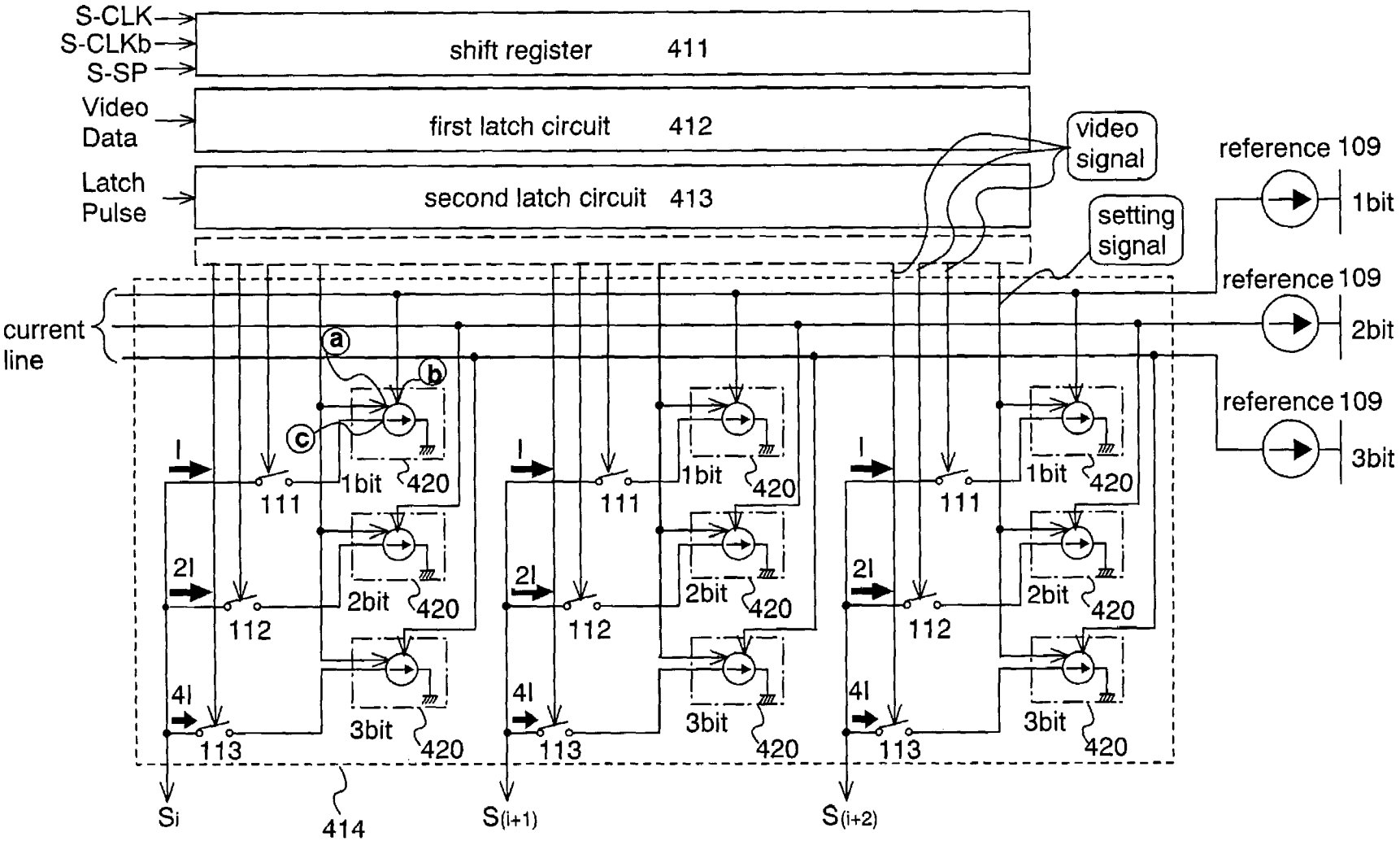

[FIG. 6]
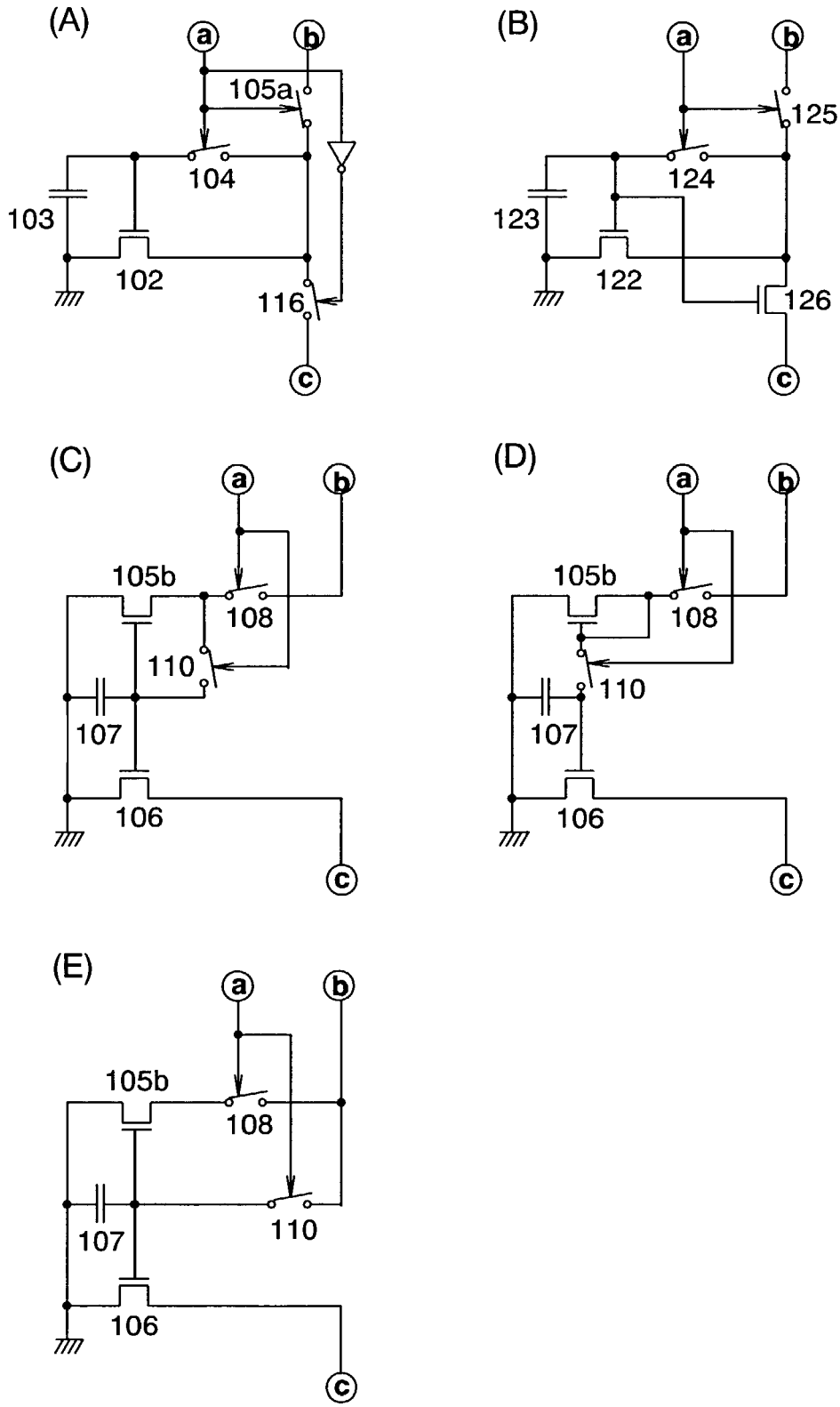

[FIG. 7]
(A)
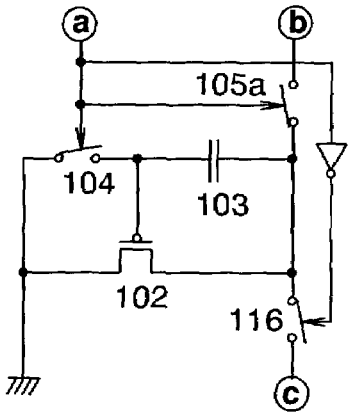
(B)
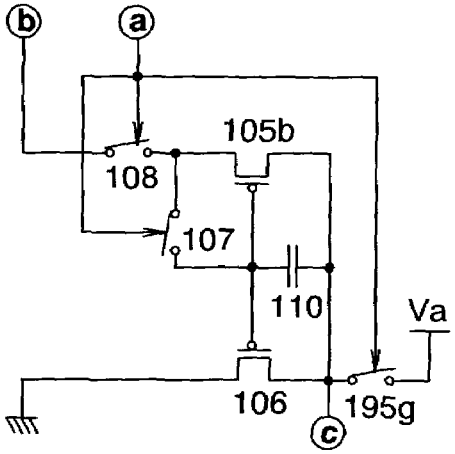
(C)
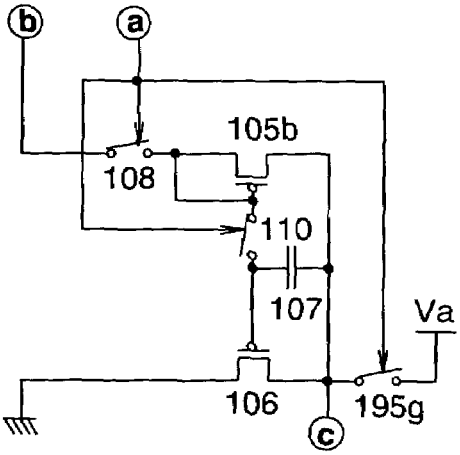
(D)
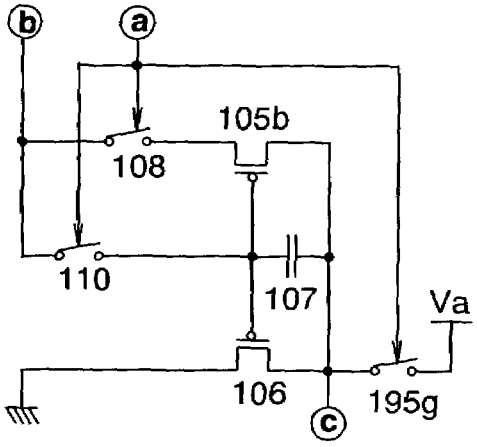

[FIG. 8]
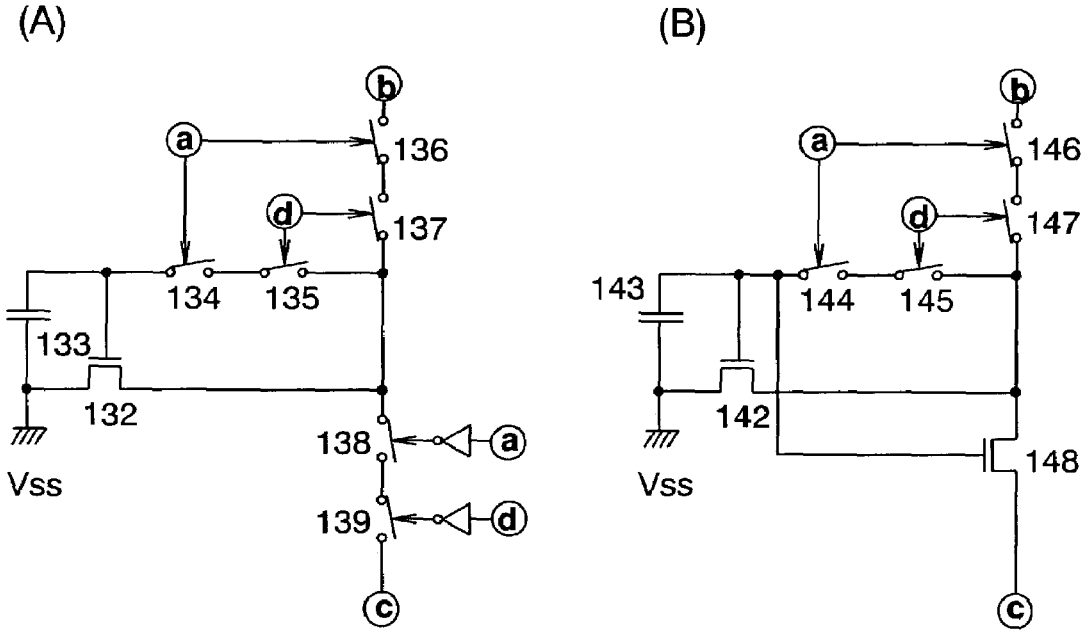

[FIG. 9]
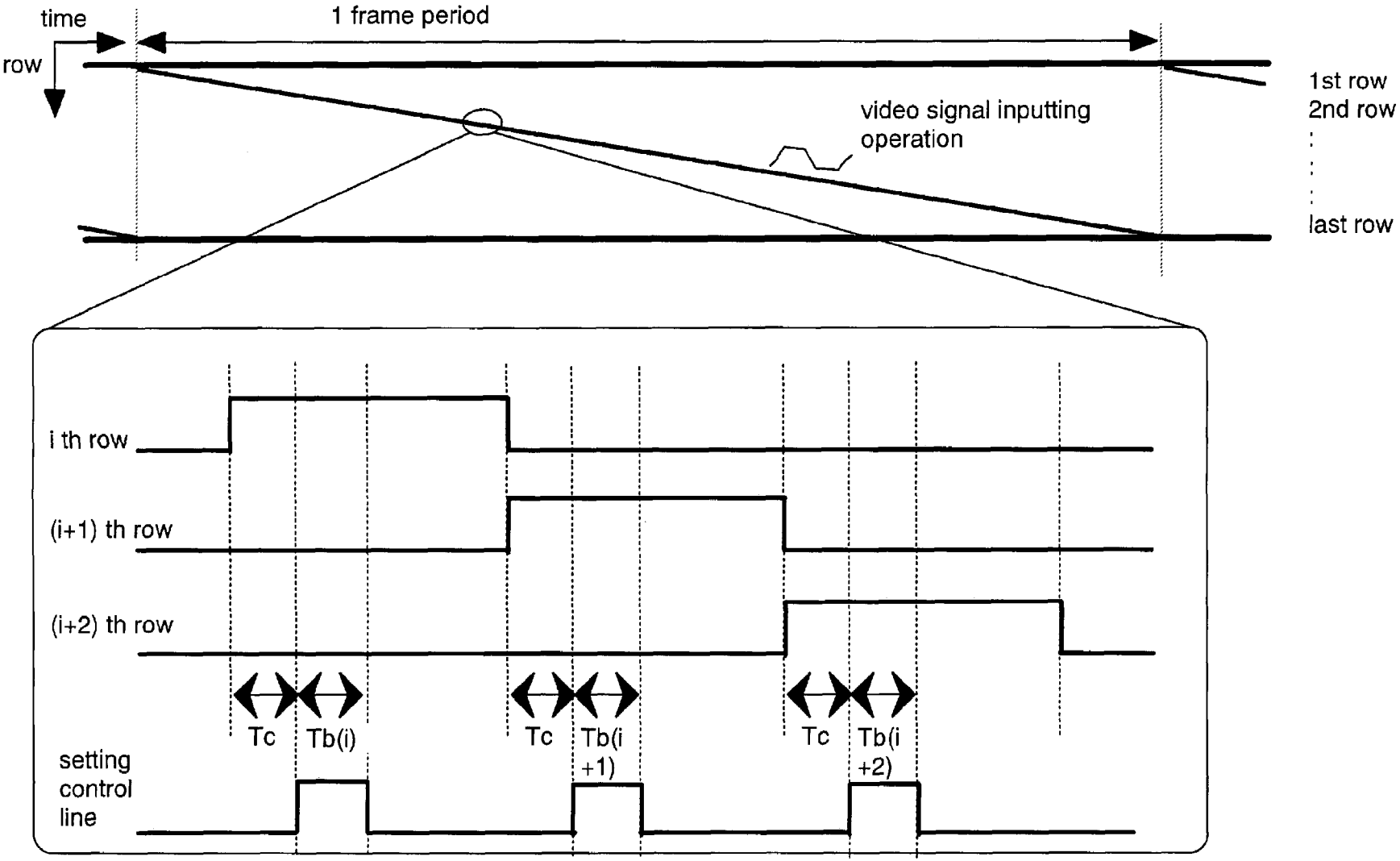

[FIG. 10]
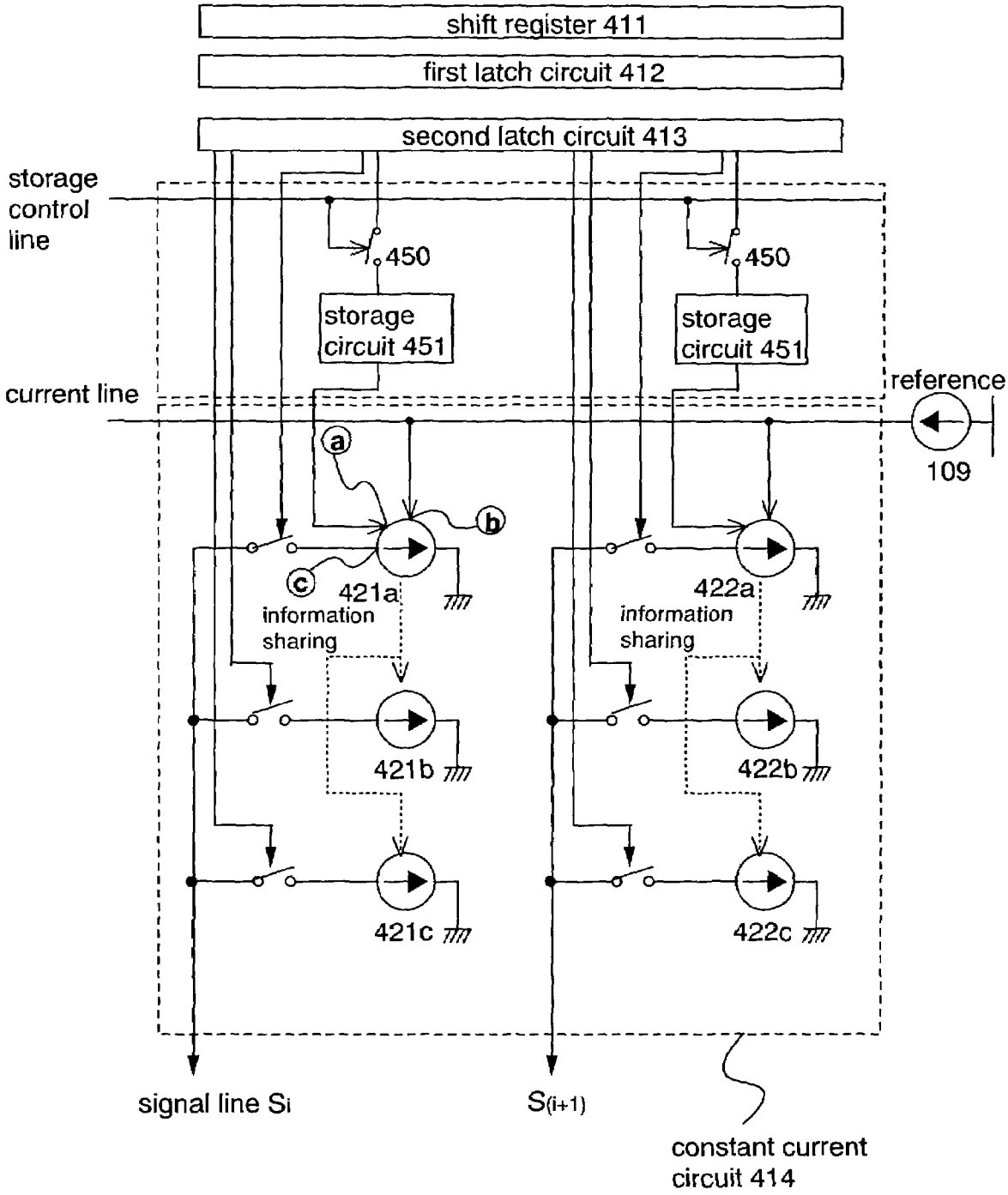

[FIG. 11]
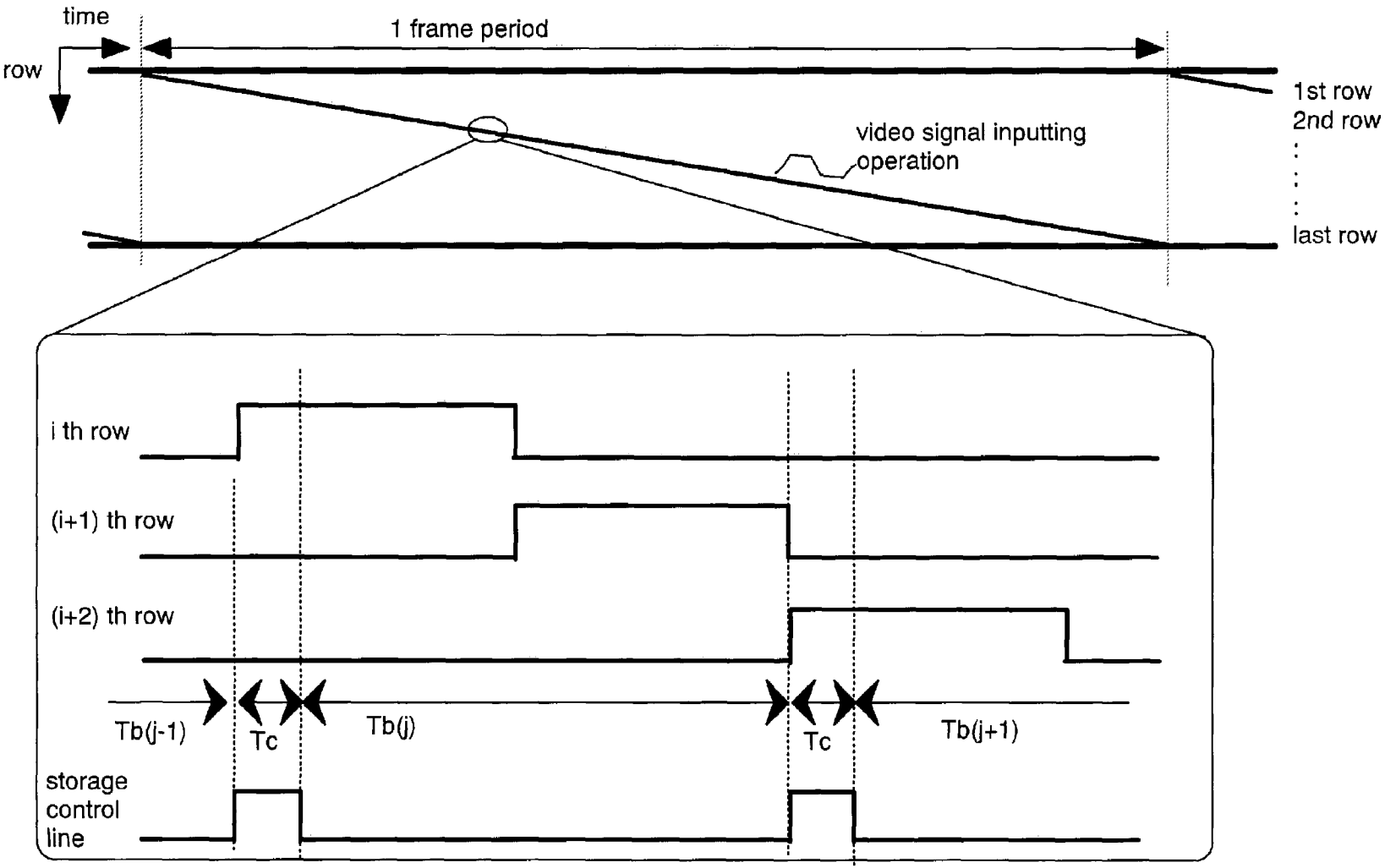

[FIG. 12]
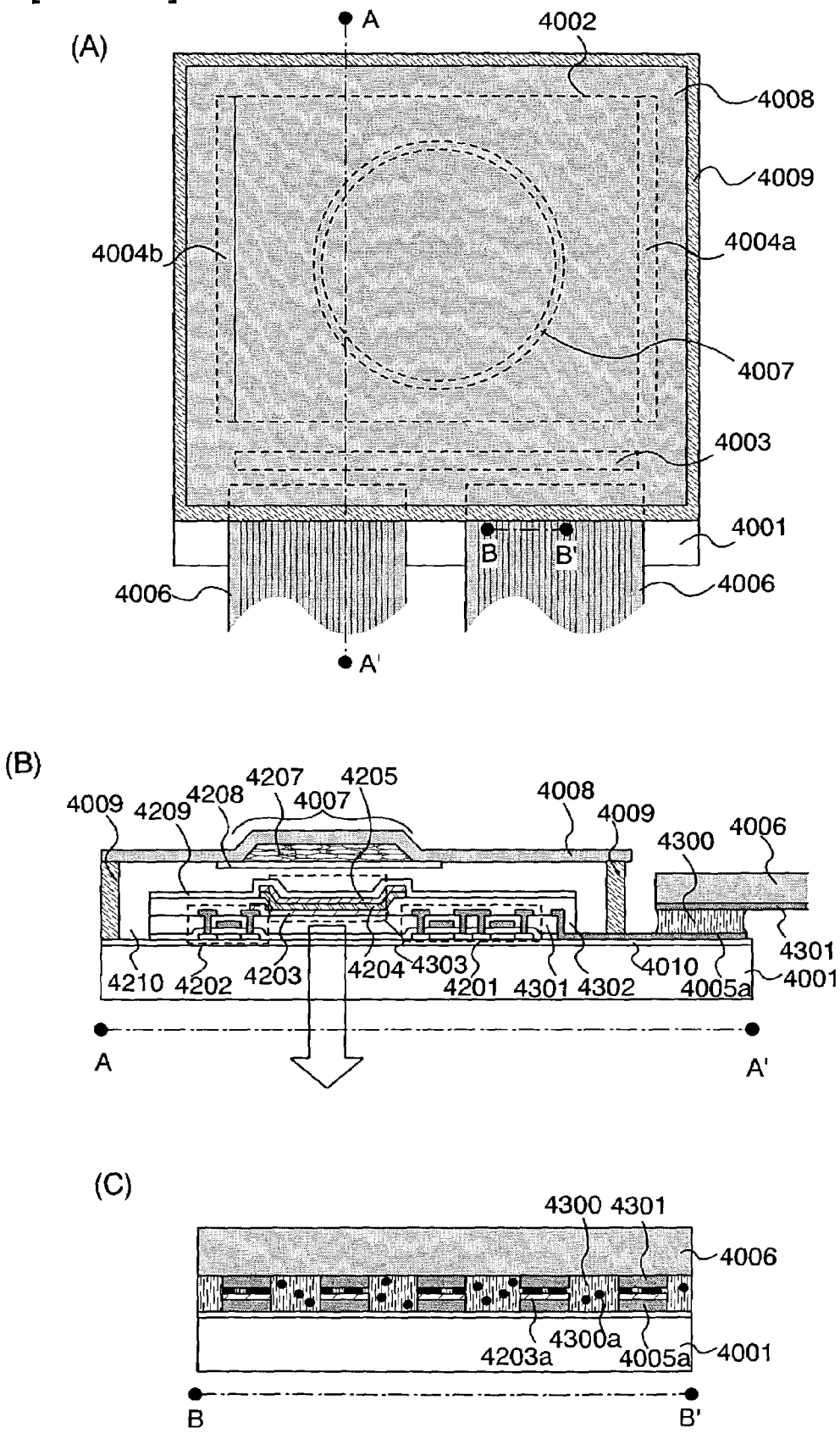

[FIG. 13]
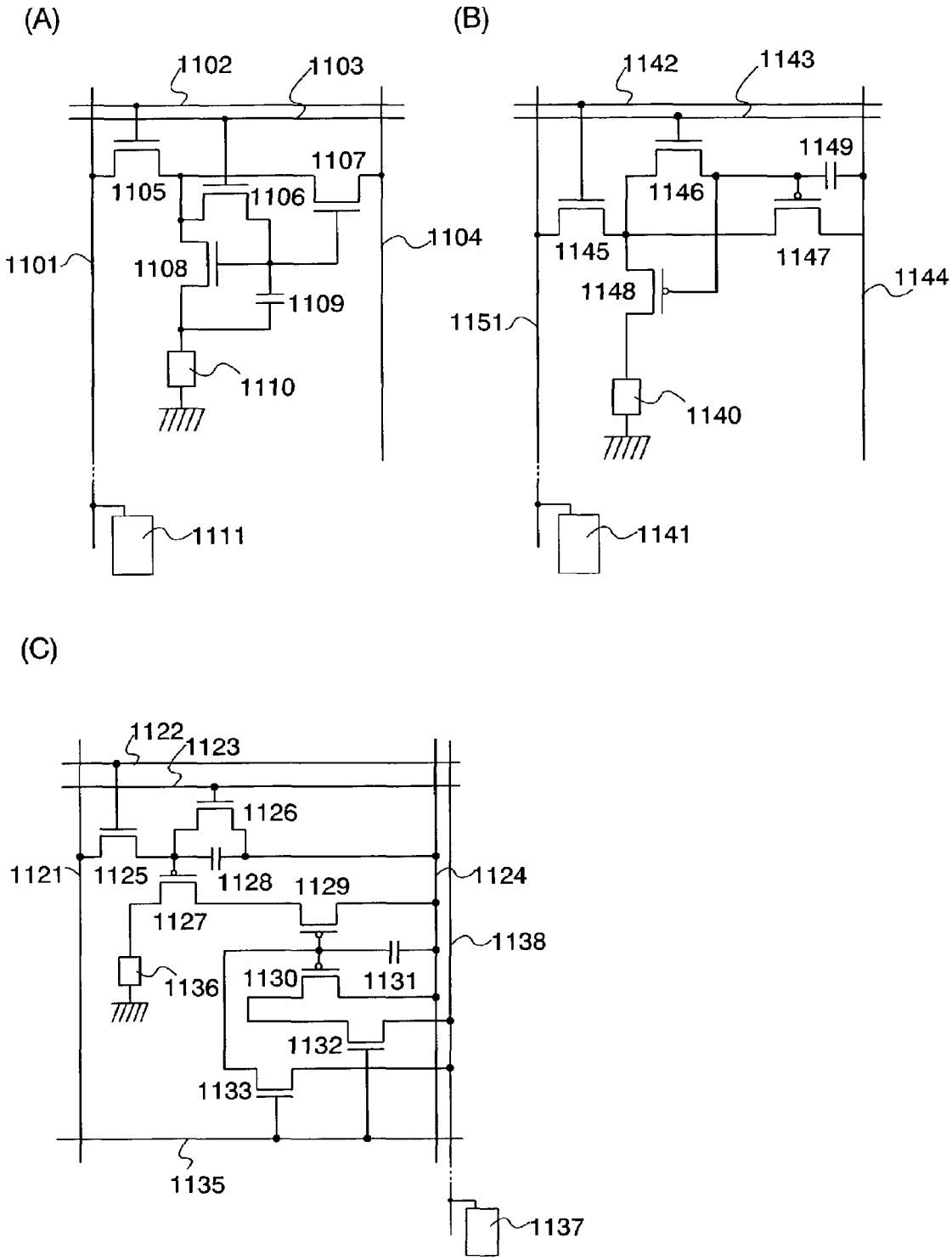

[FIG. 14]
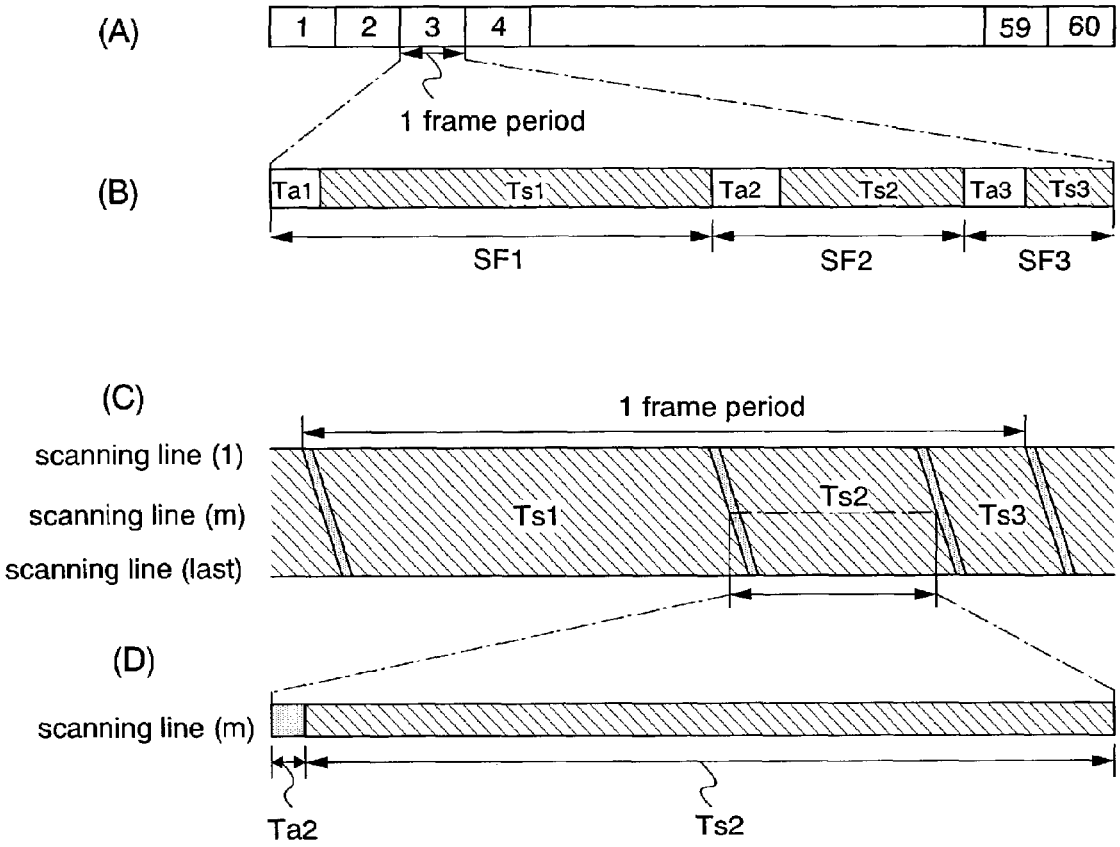
[FIG. 15]
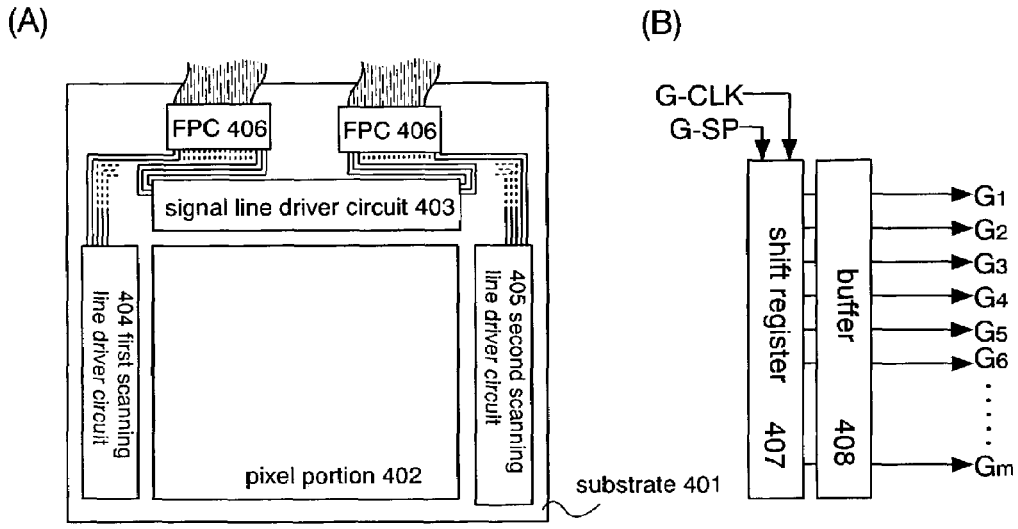

[FIG. 16] Prior Art
(A)
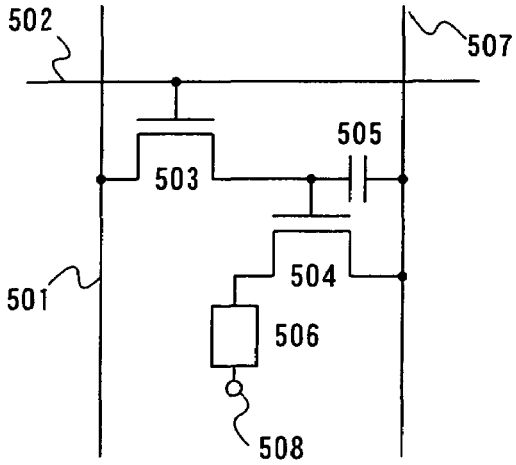
501: signal line
502: scanning line
503: switching TFT
504: driving TFT
505: capacitor element
506: light emitting element
507, 508: power sources
(B)
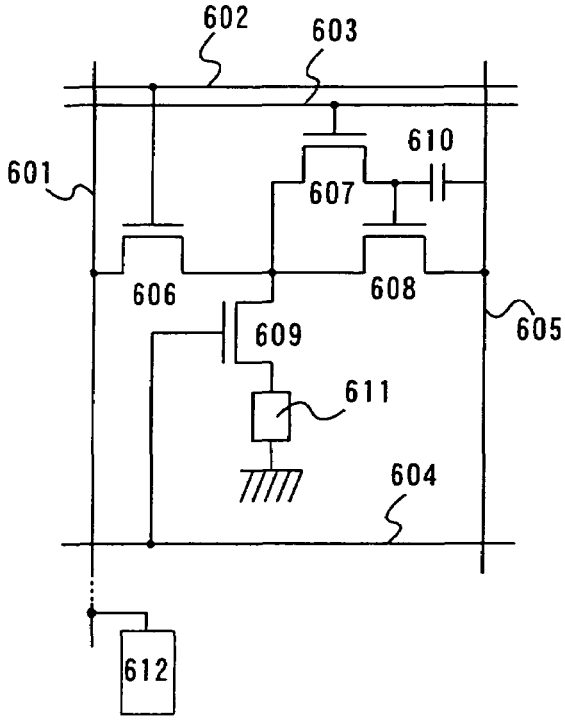
601: signal line
602: 1st scanning line
603: 2nd scanning line
604: 3rd scanning line
605: current line
606 to 609: TFT
610: capacitor element
611: light emitting lement
612: current source circuit

[FIG. 17] Prior Art
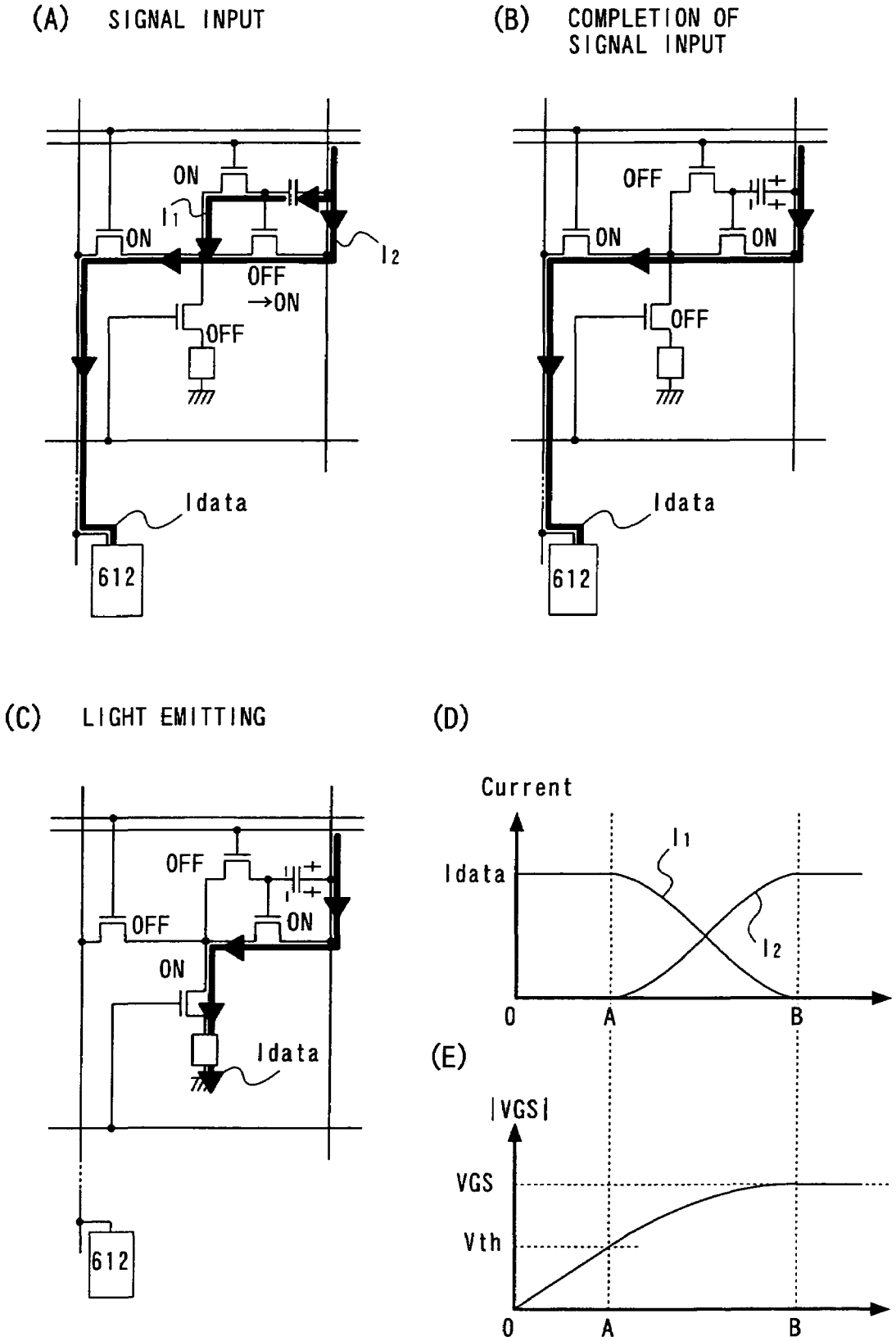

[FIG. 18] Prior Art
(A)
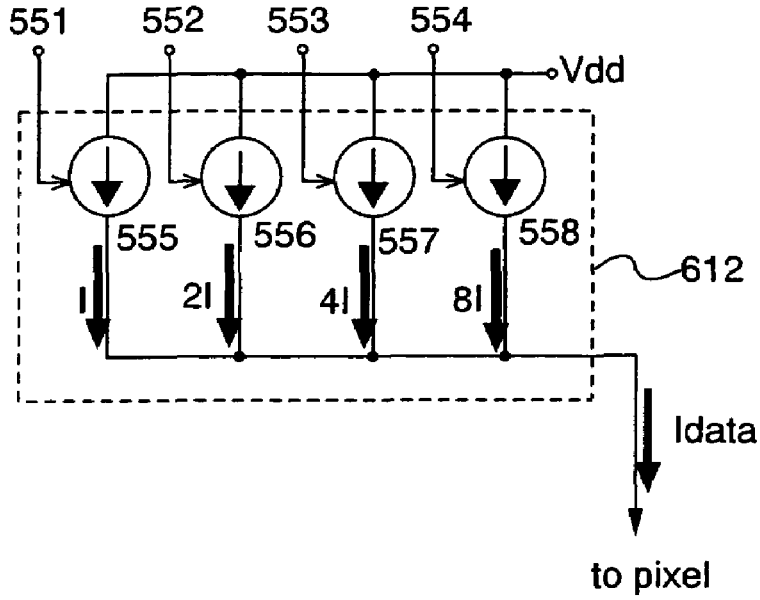
(B)
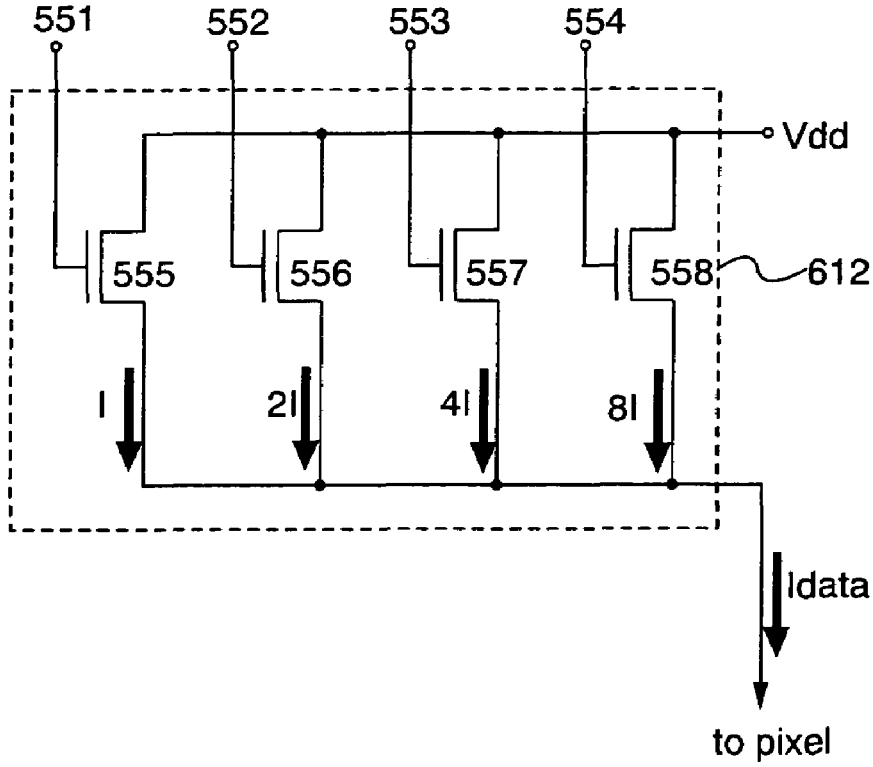

[FIG. 19]
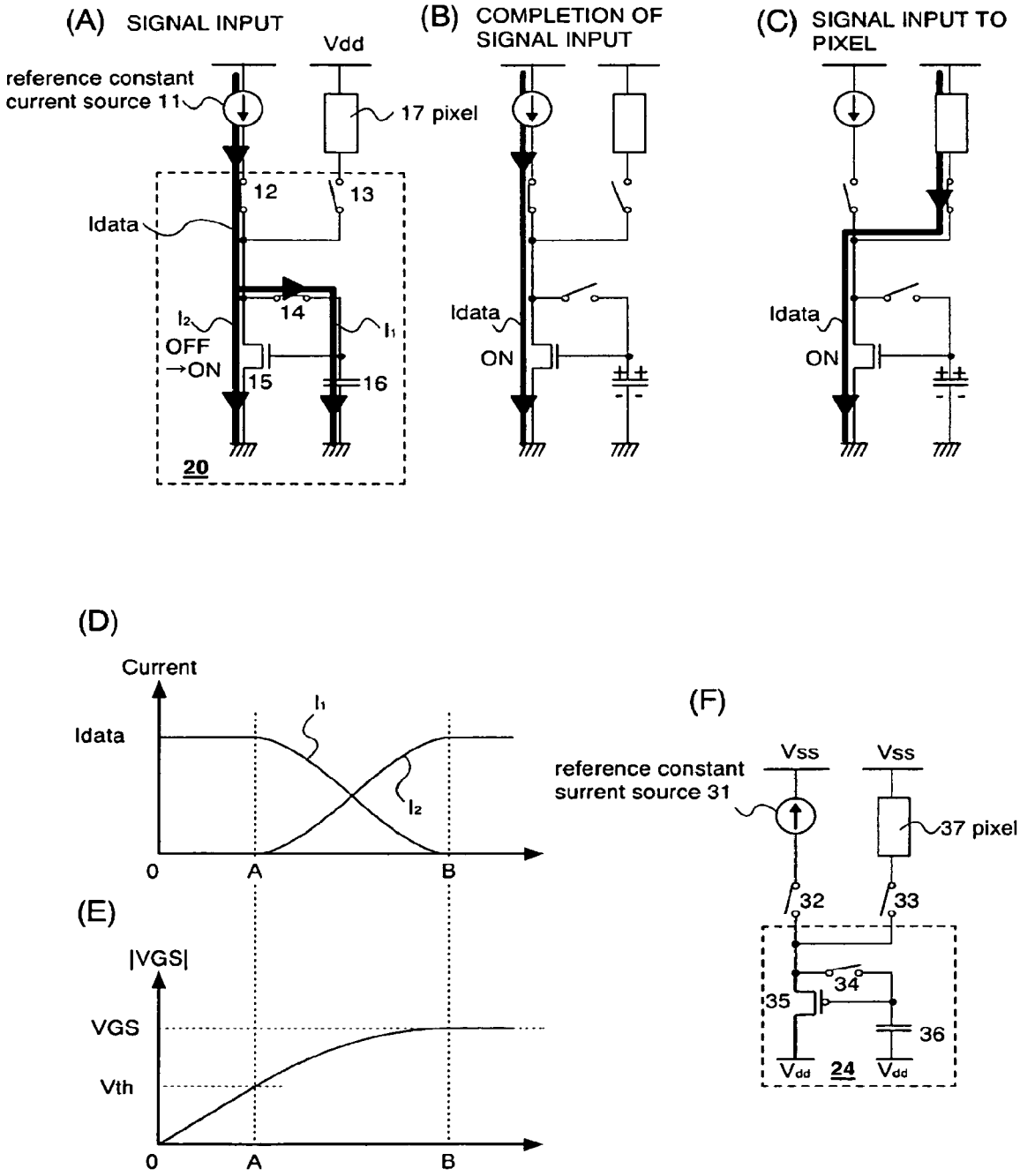

[FIG. 20]
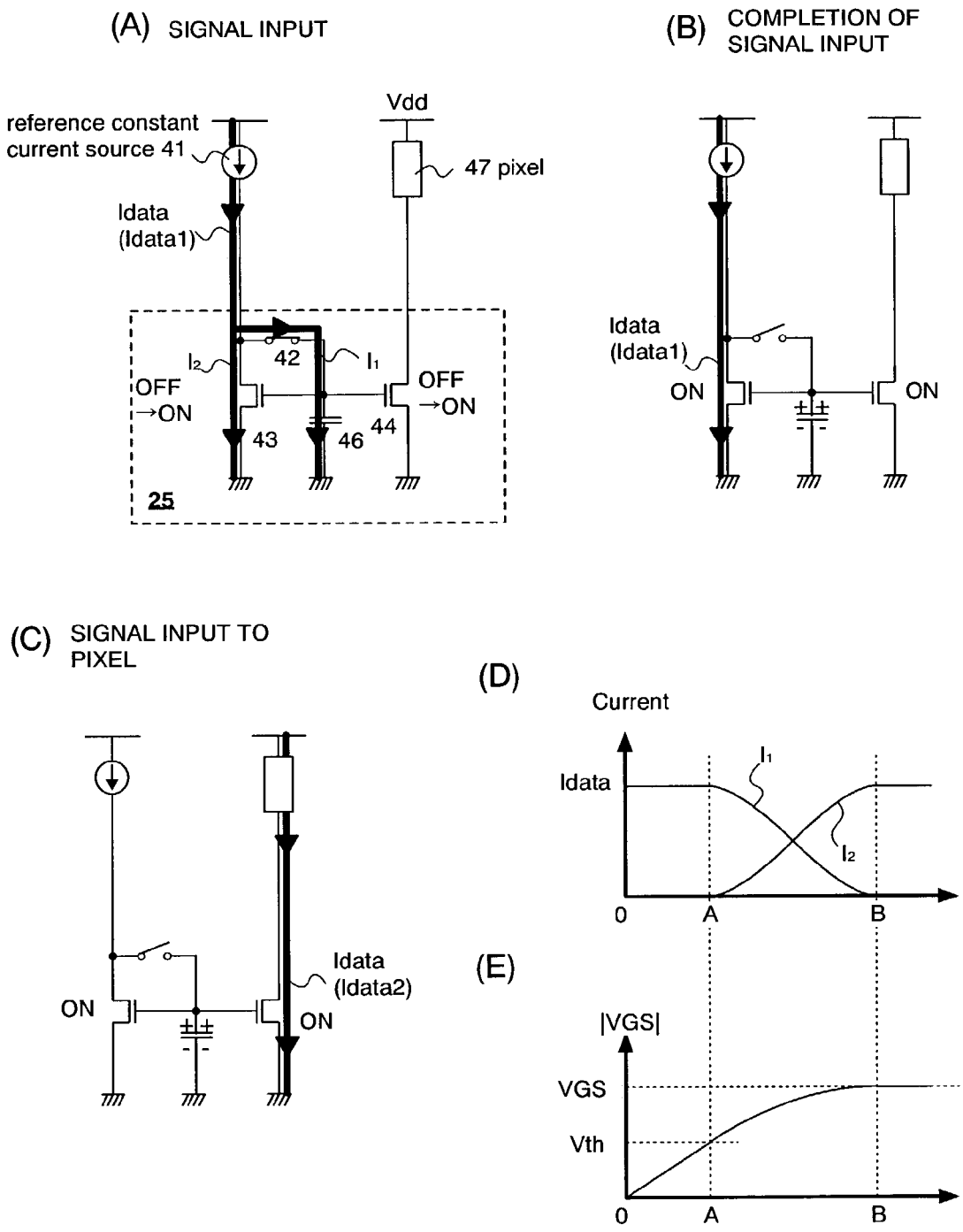

[FIG. 21]
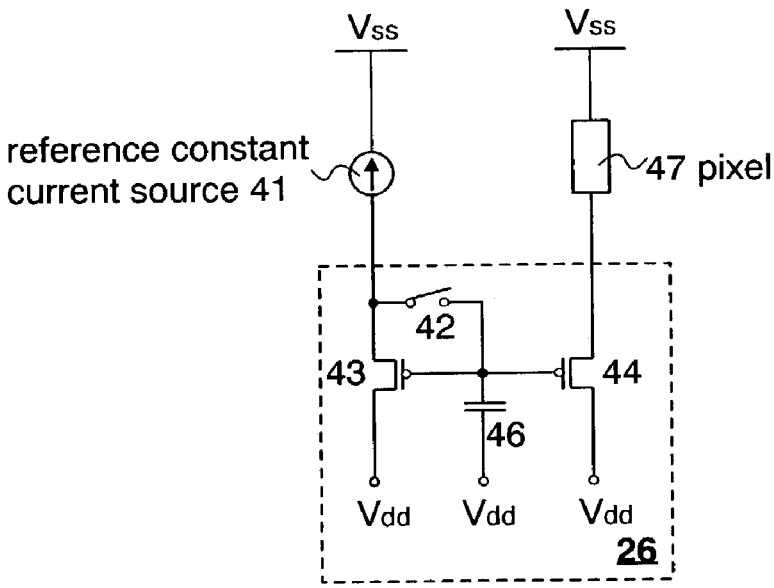

[FIG. 22]
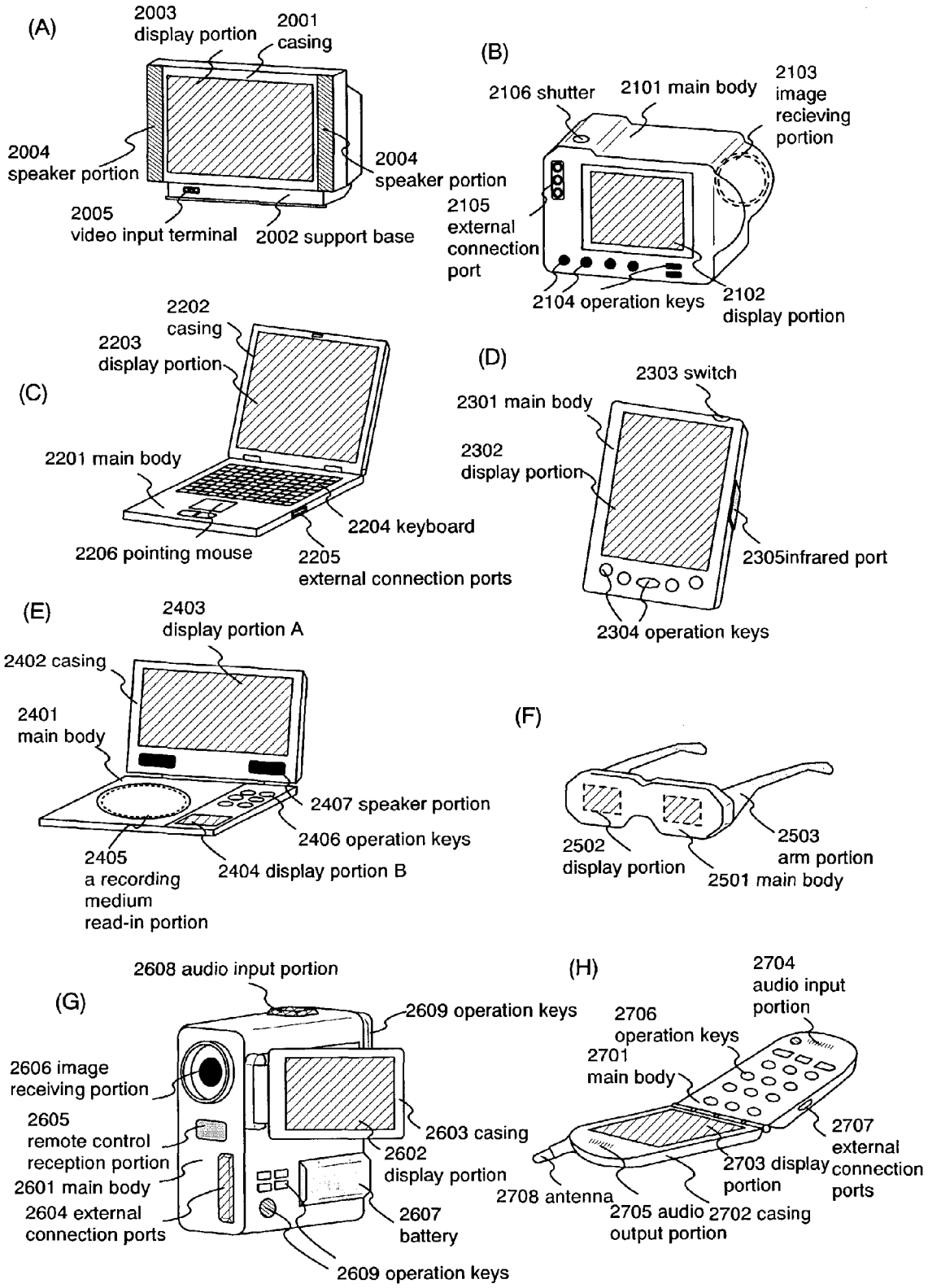

[FIG. 23]
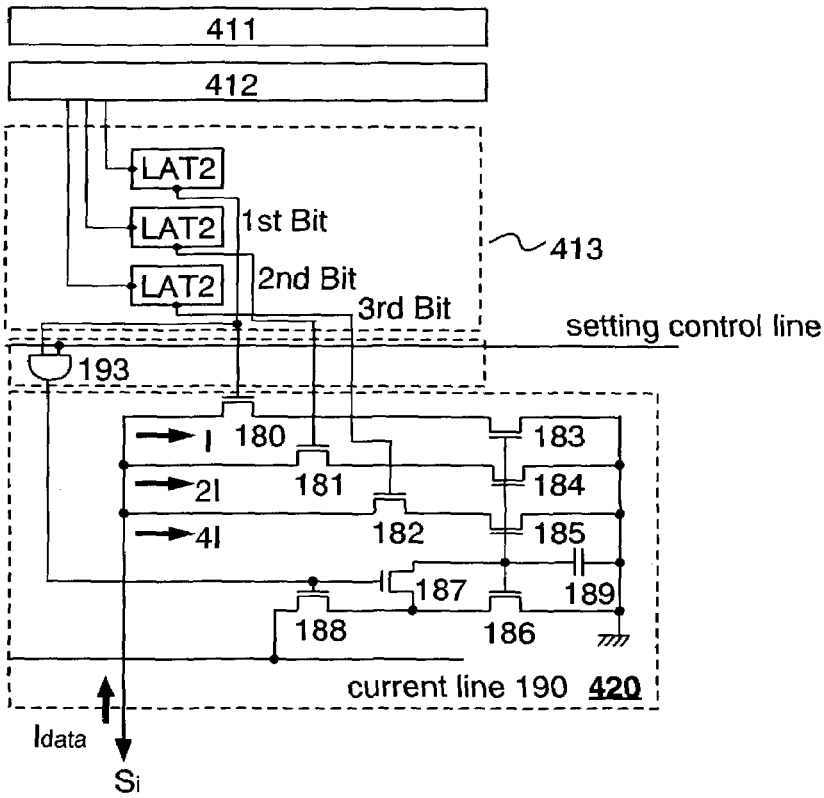
[FIG. 24]
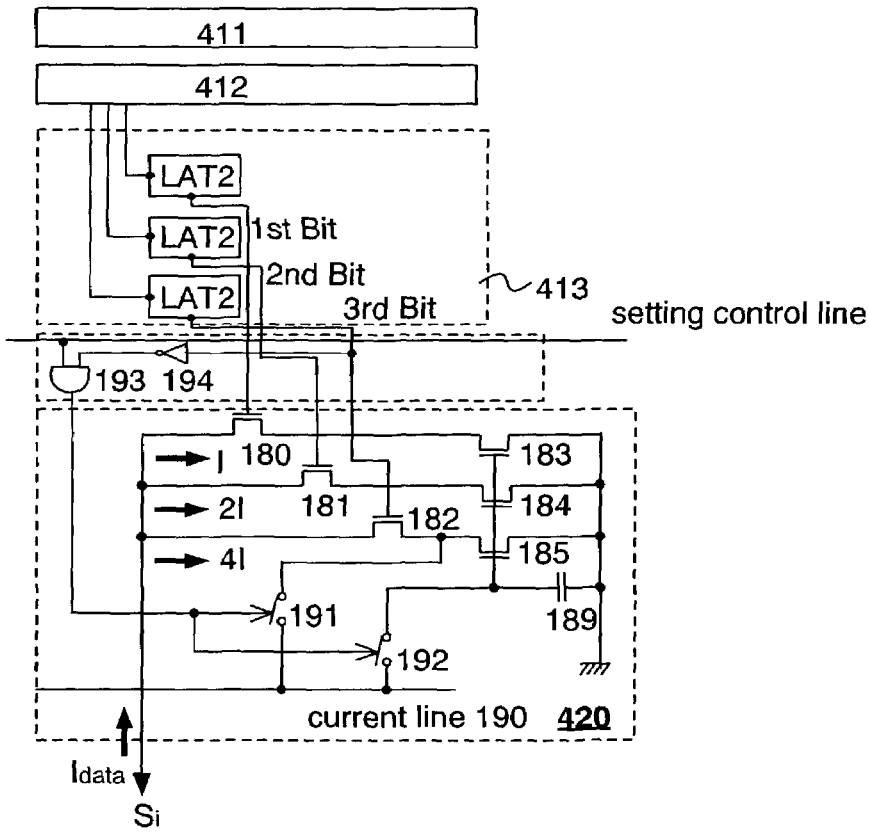

[FIG. 25]
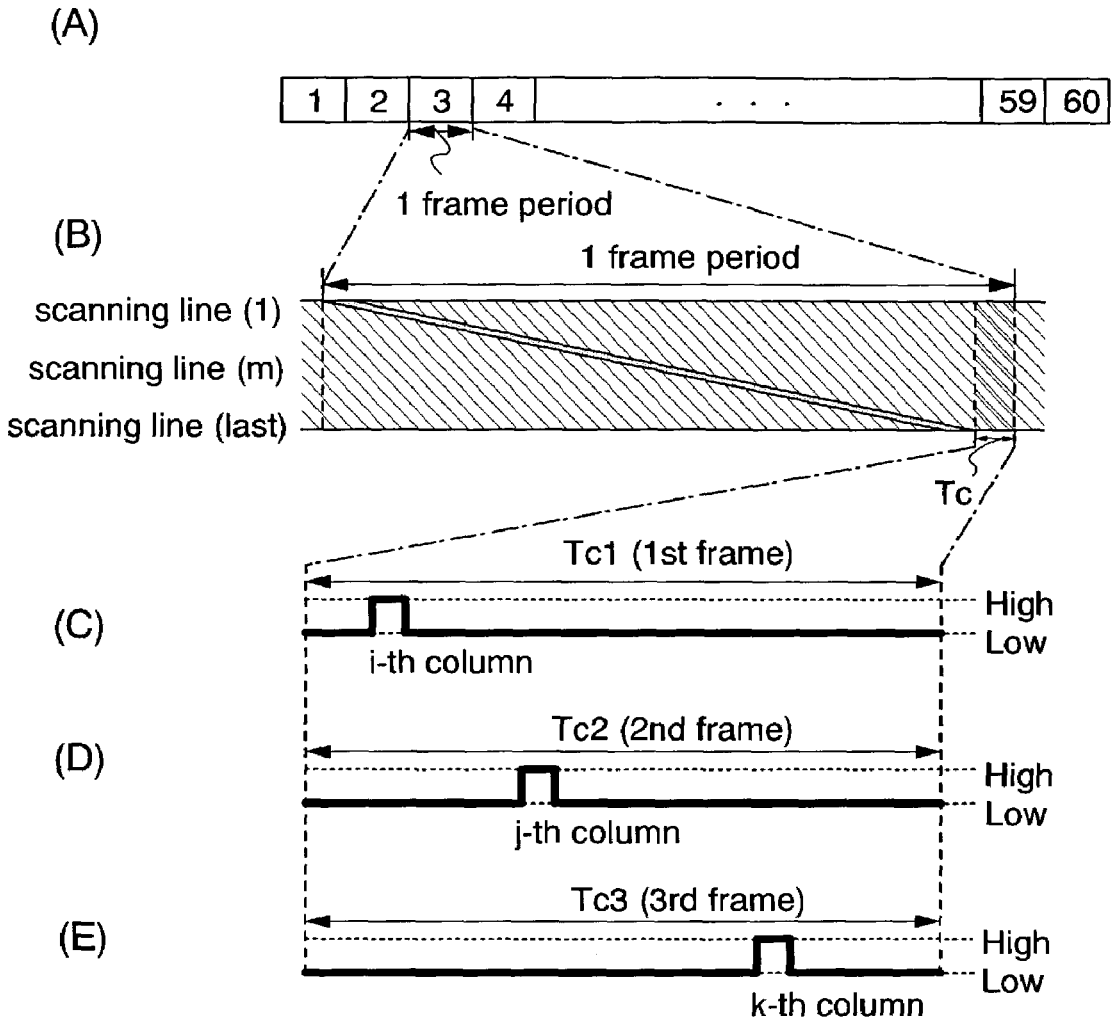

[FIG. 26]
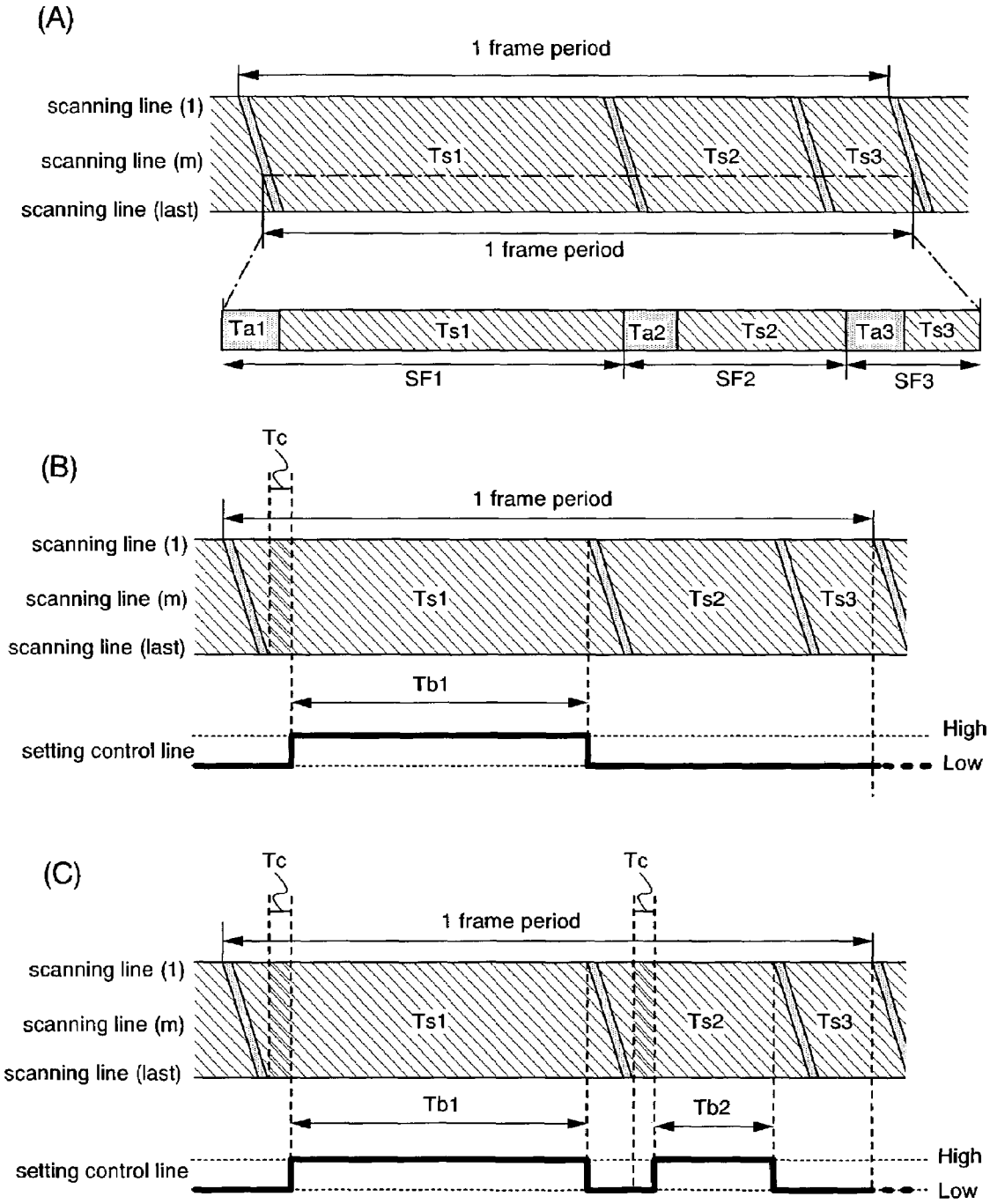

[FIG. 27]
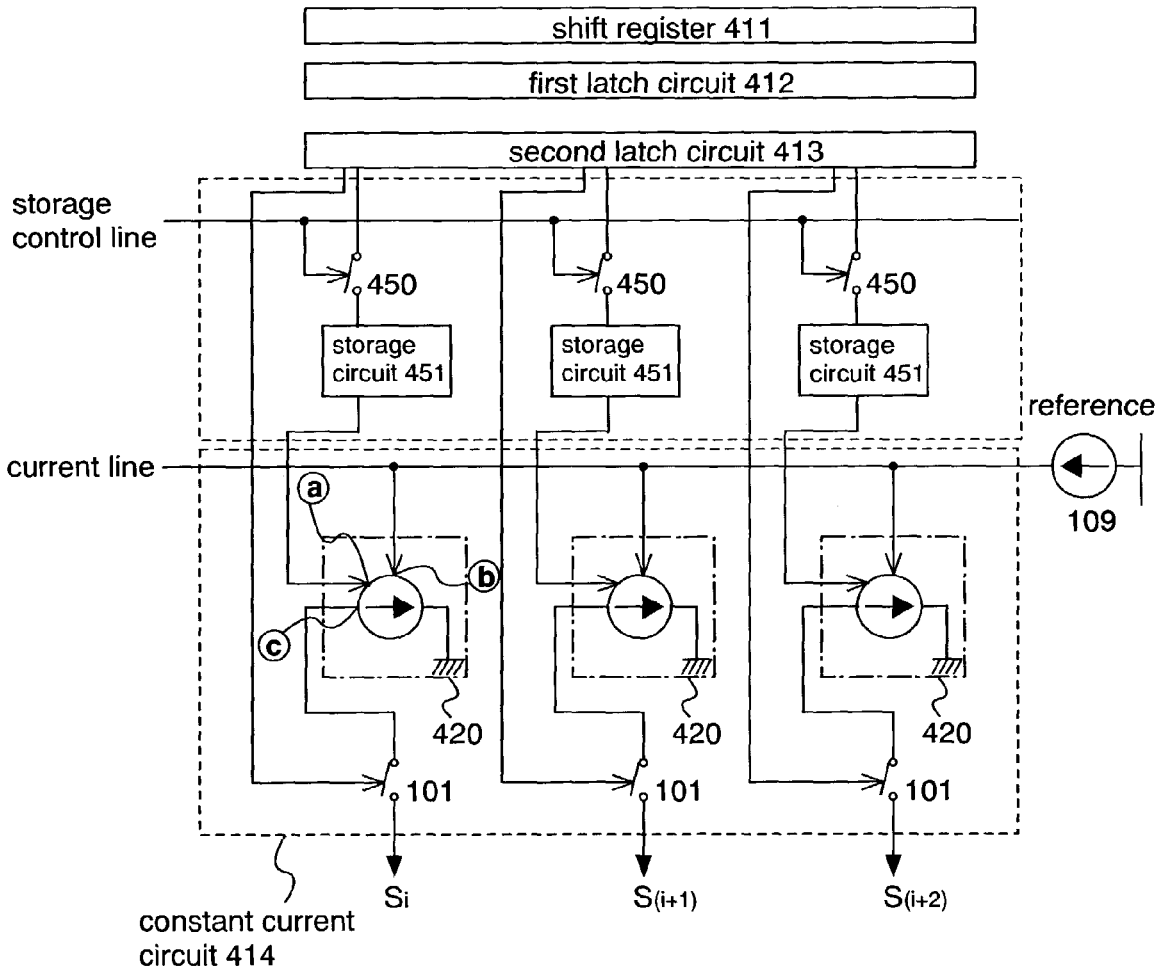

[FIG. 28]
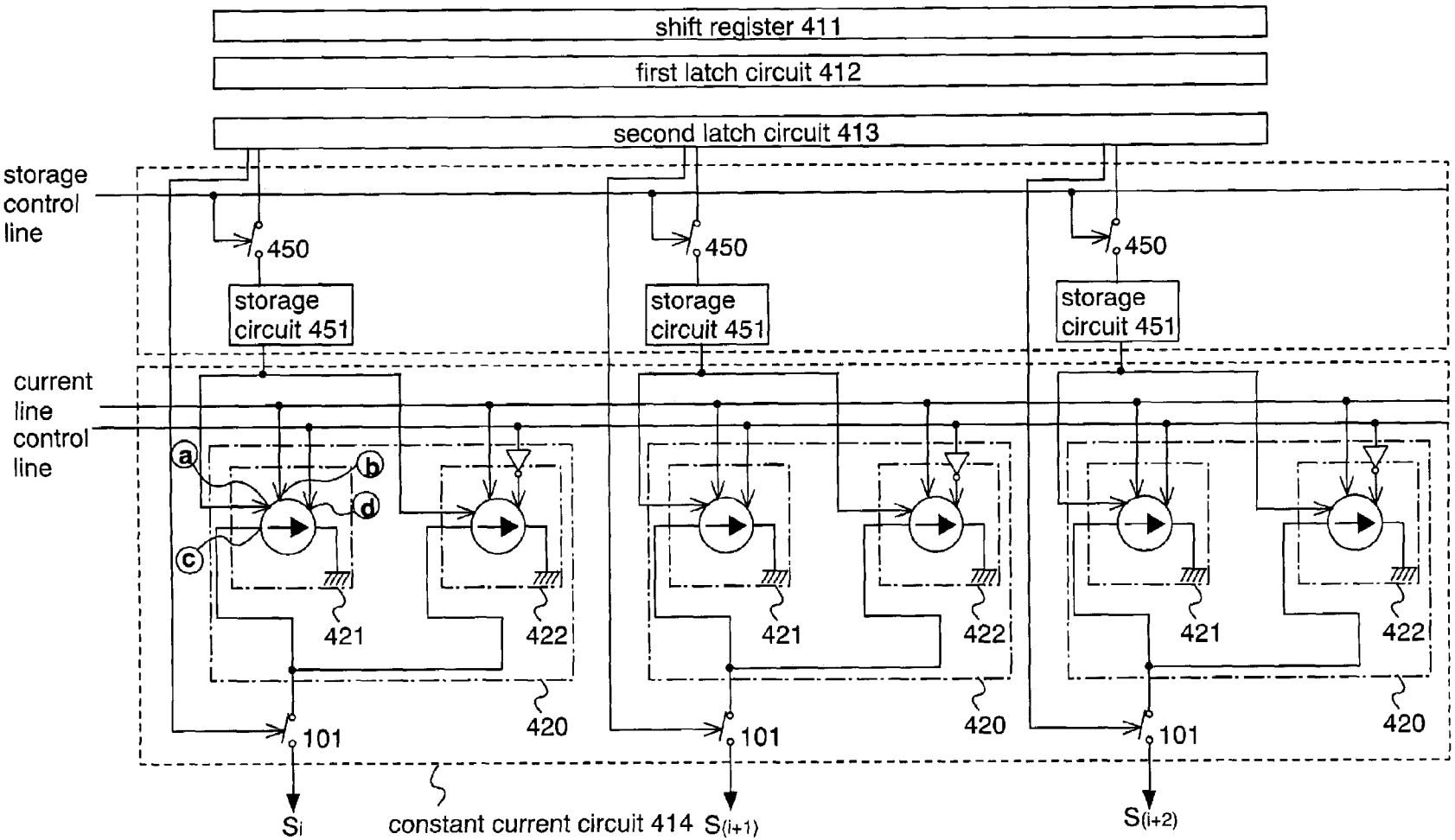

[FIG. 29]
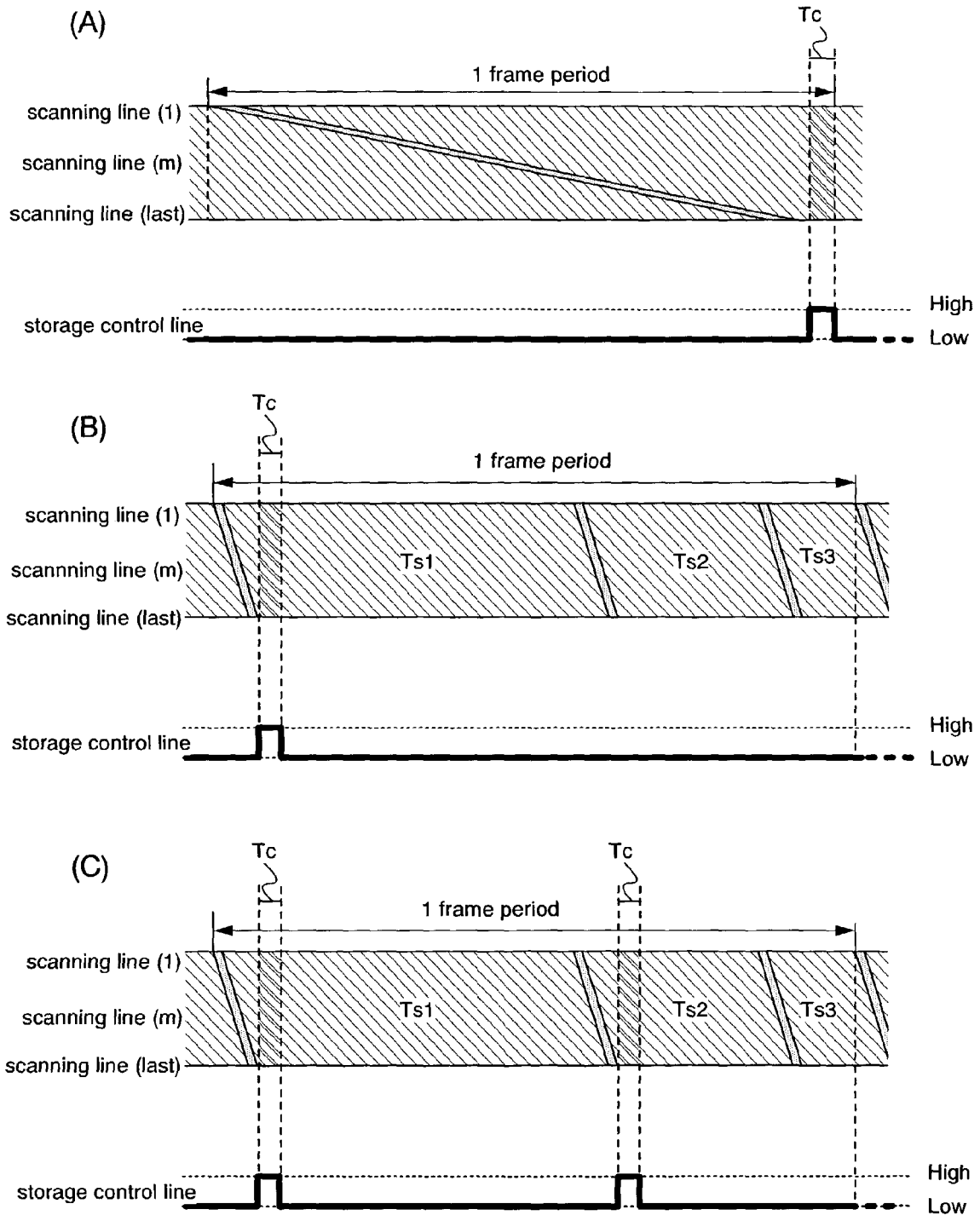

[FIG. 30]
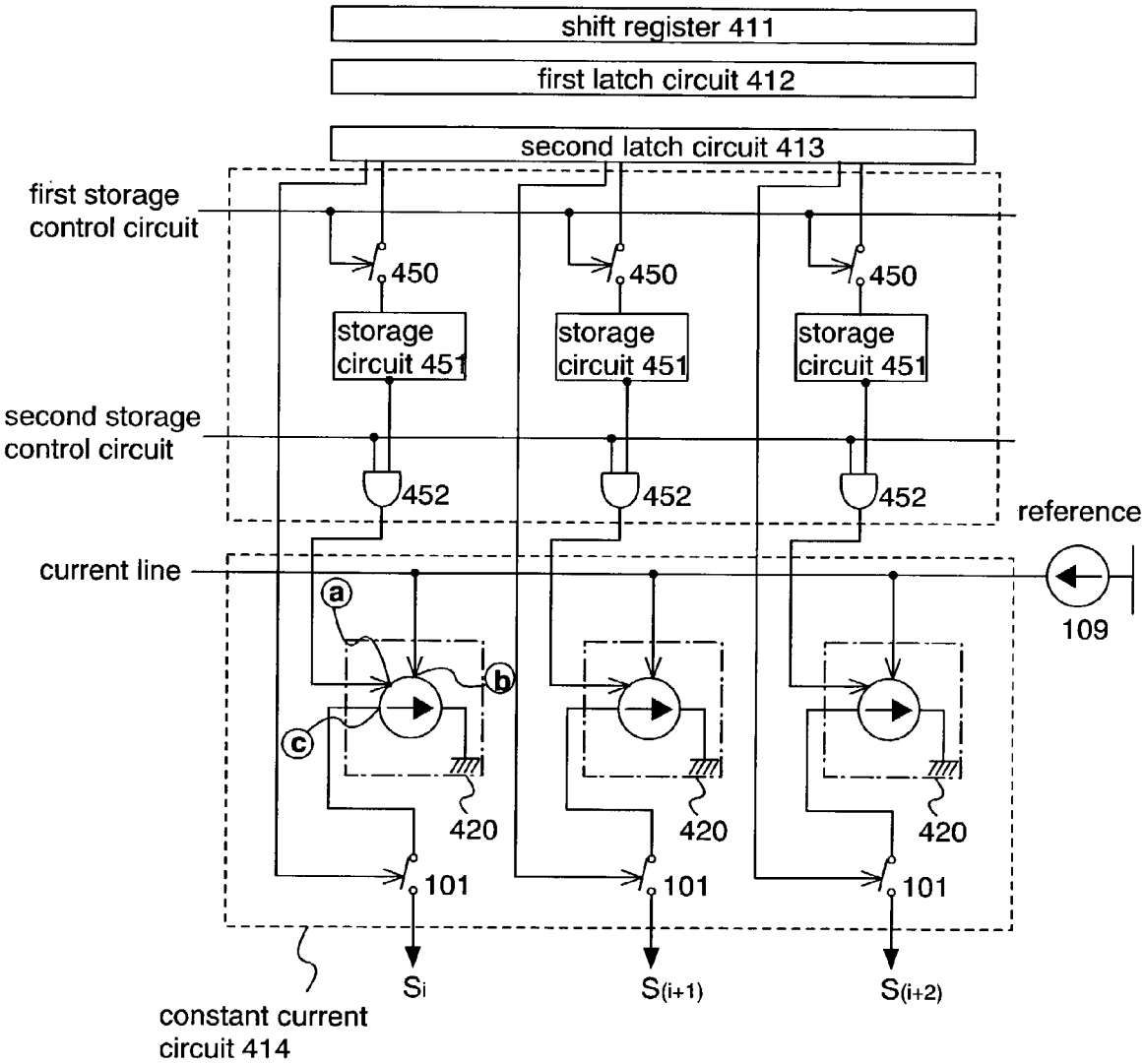

[FIG. 31]
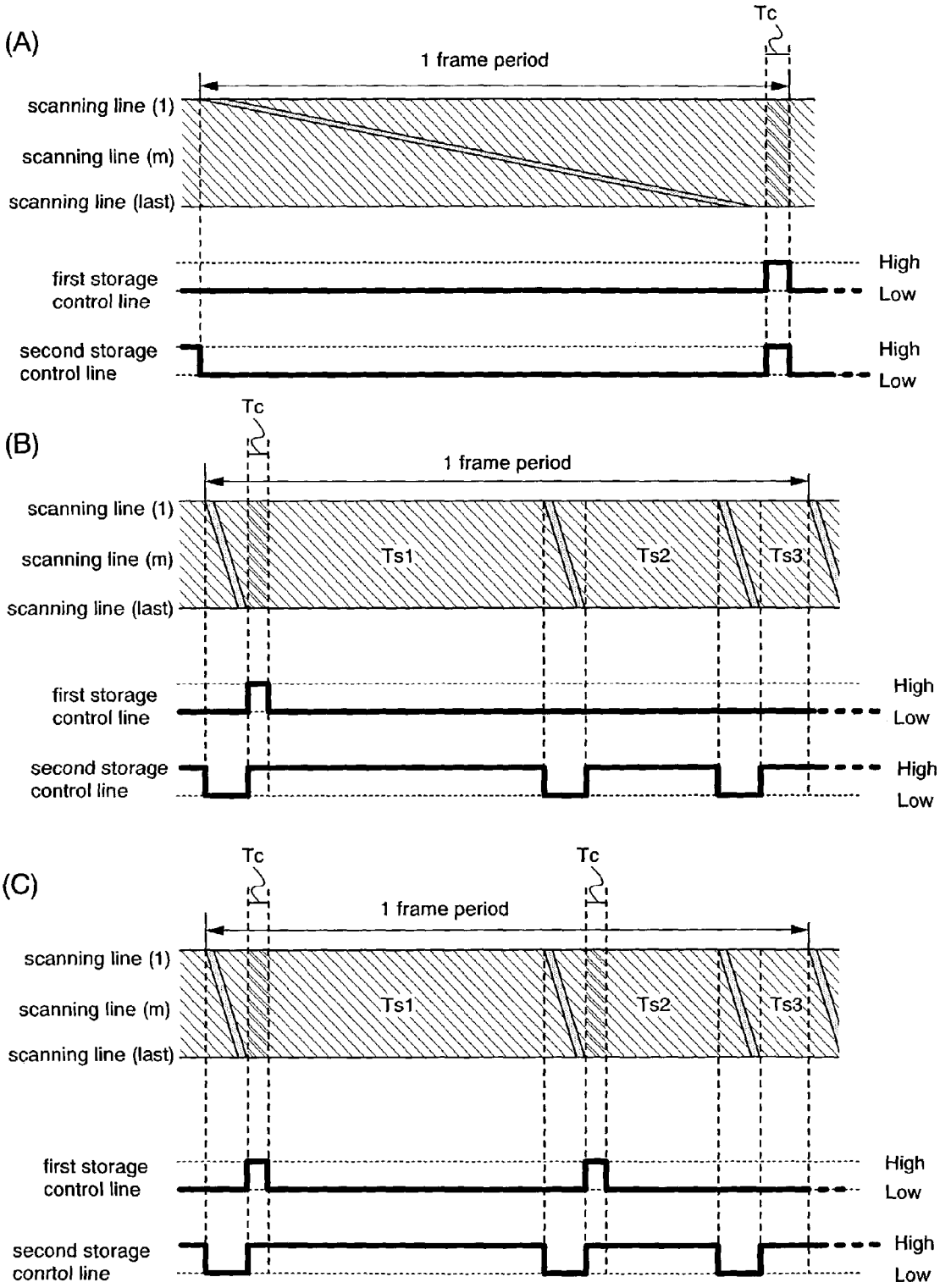

[FIG. 32]
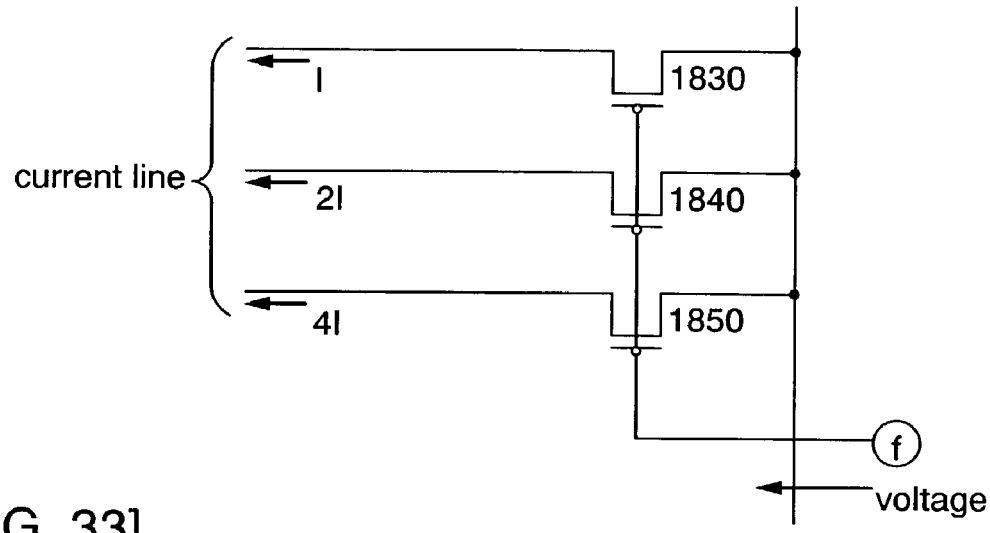
[FIG. 33]
(A)
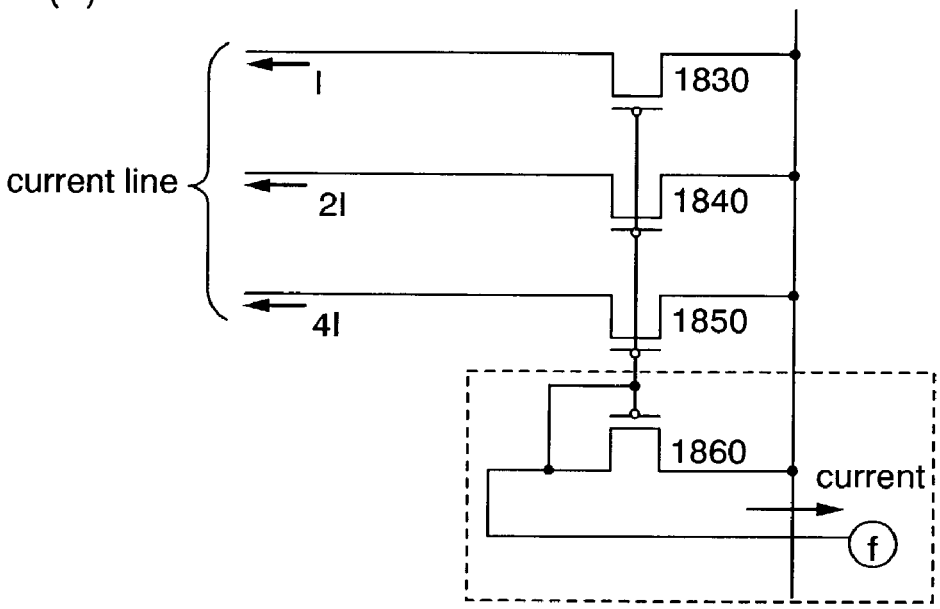
(B)
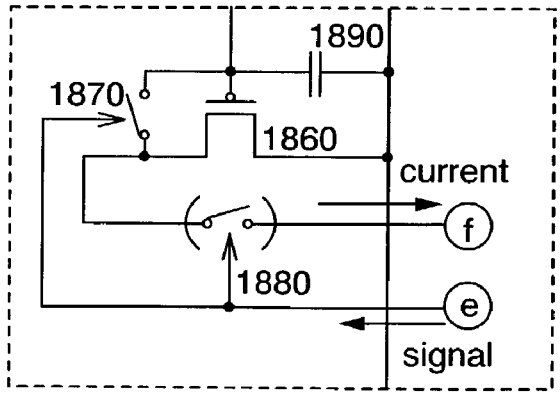

[FIG. 34]
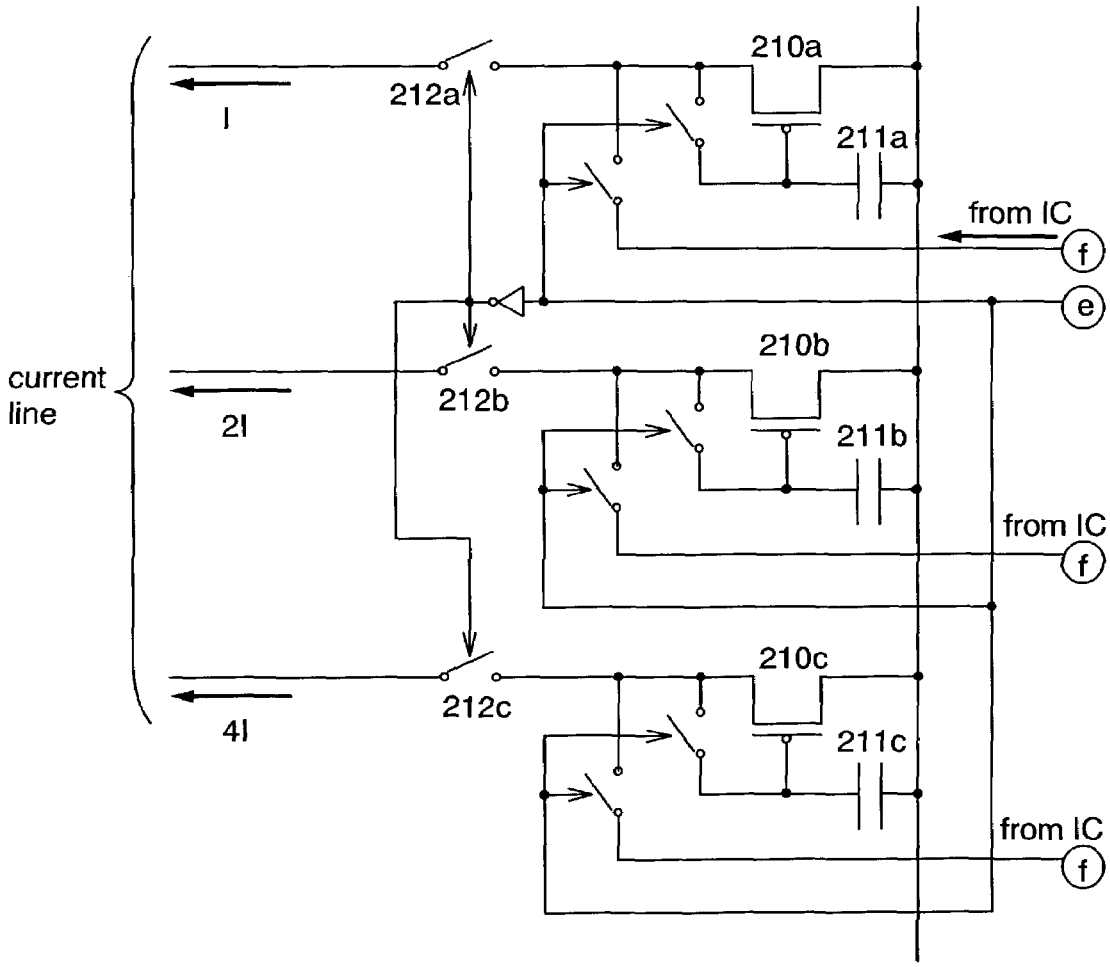

[FIG. 35]
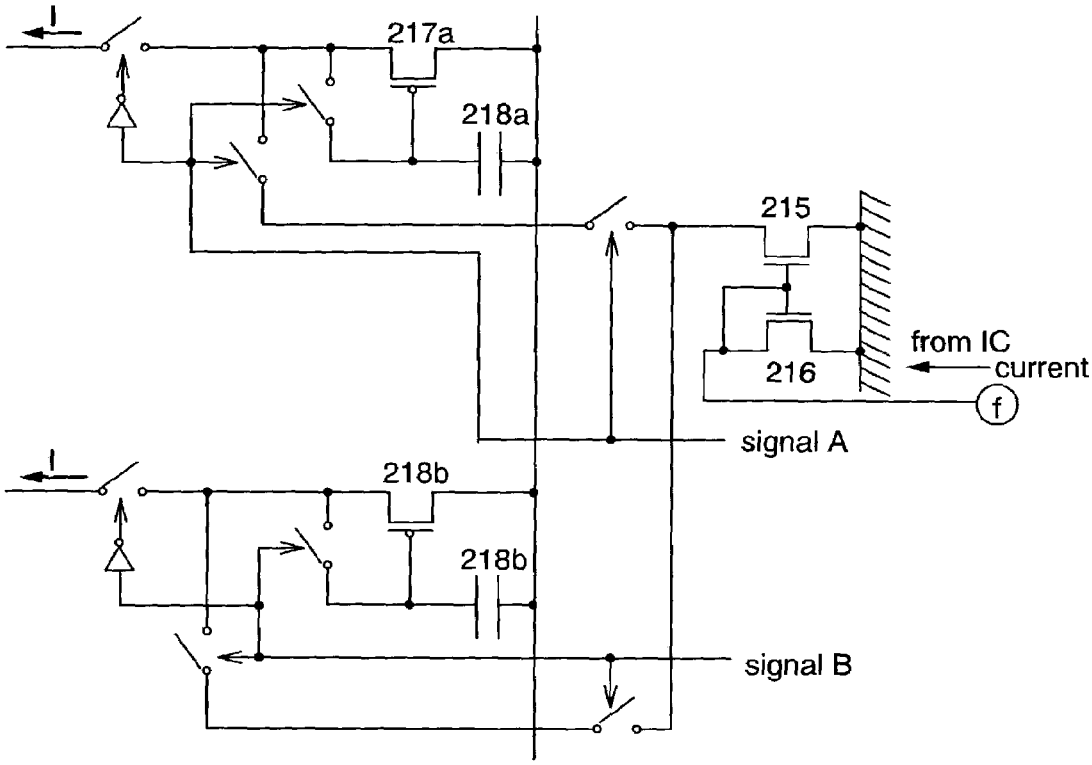
[FIG. 36]
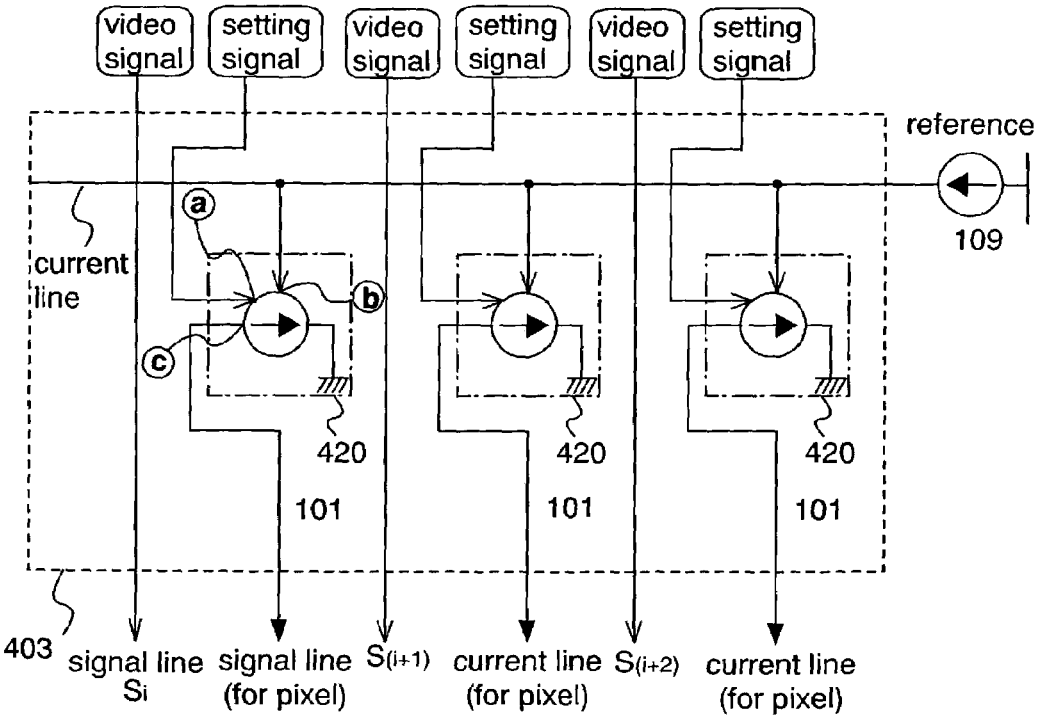

[FIG. 37]
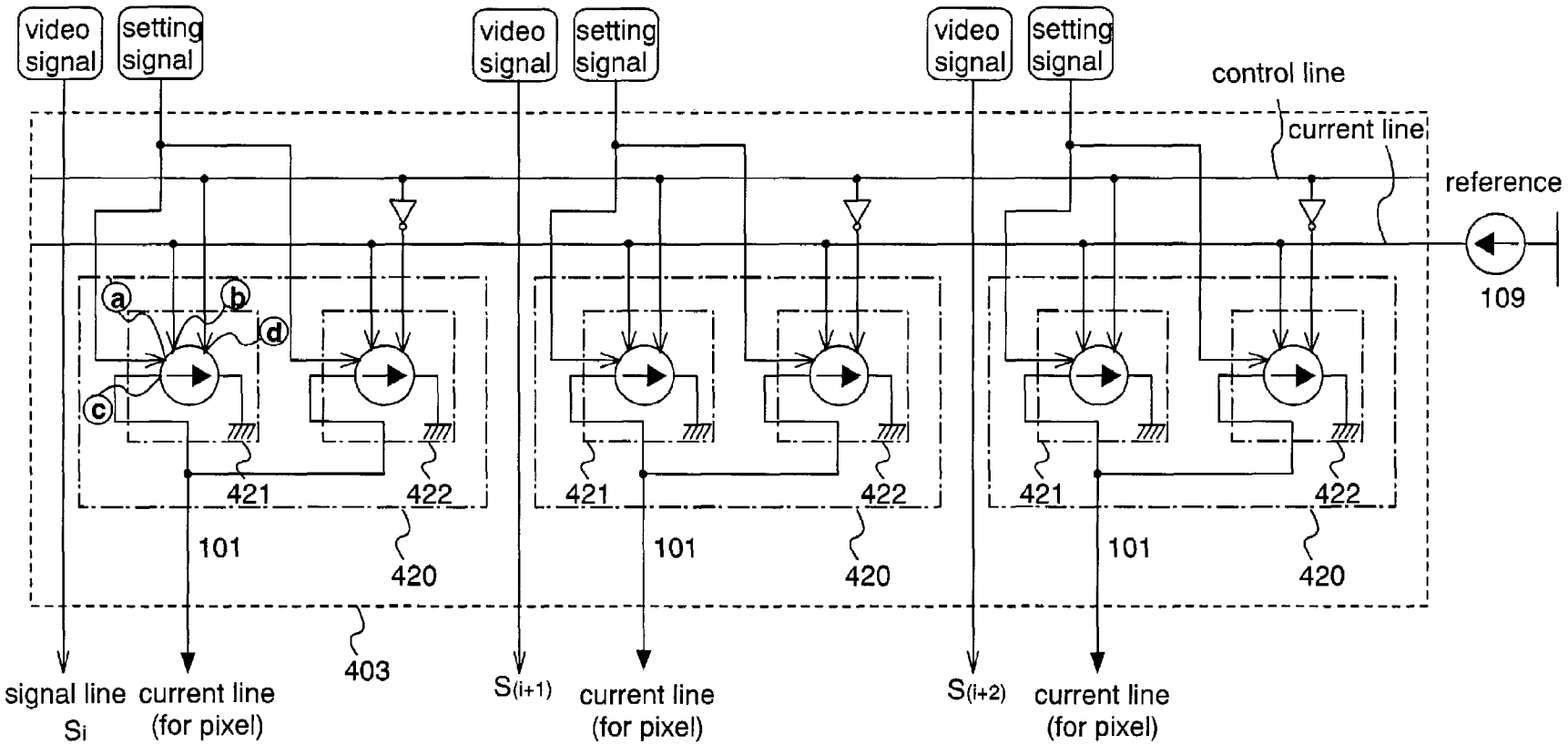

[FIG. 38]
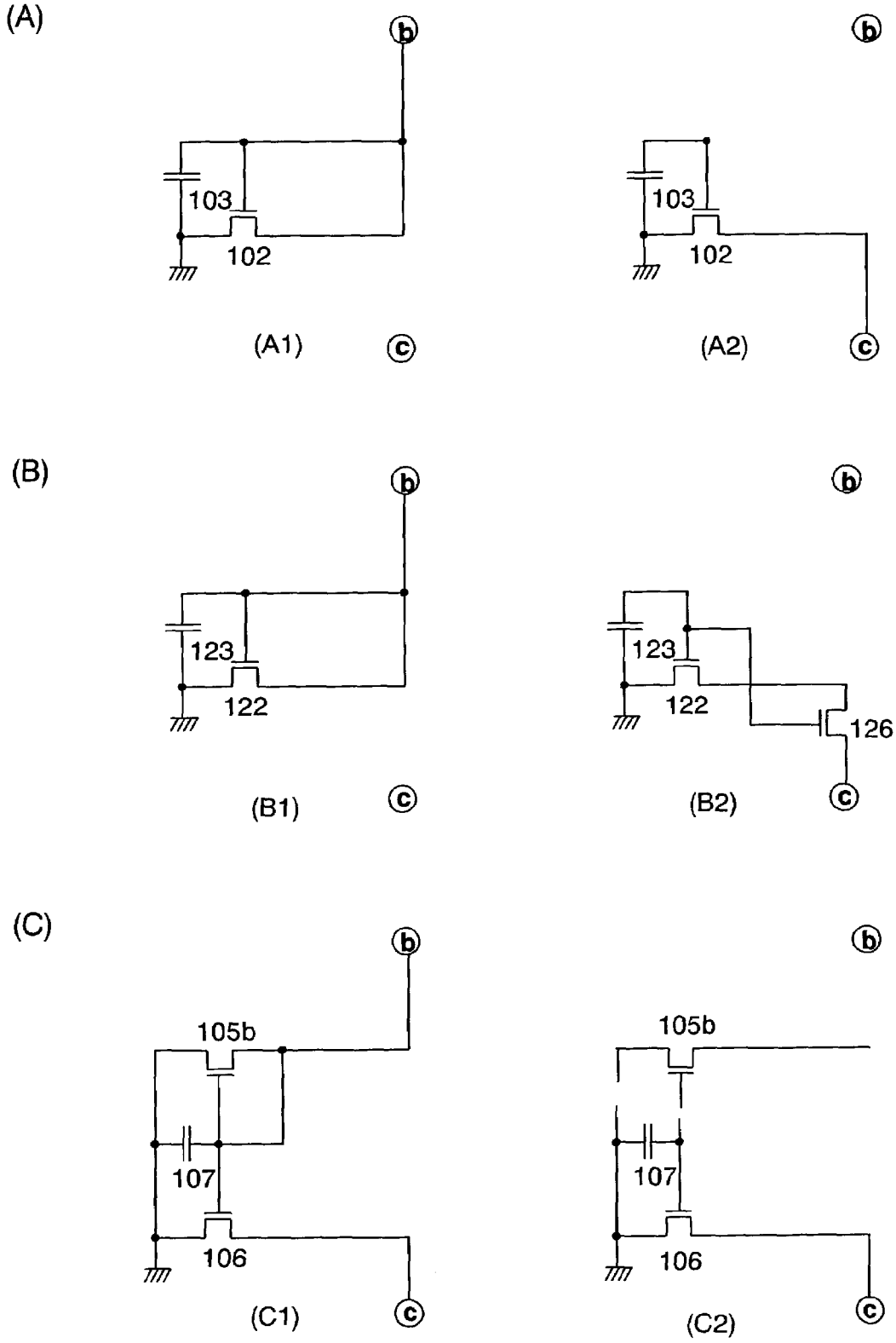

[FIG. 39]
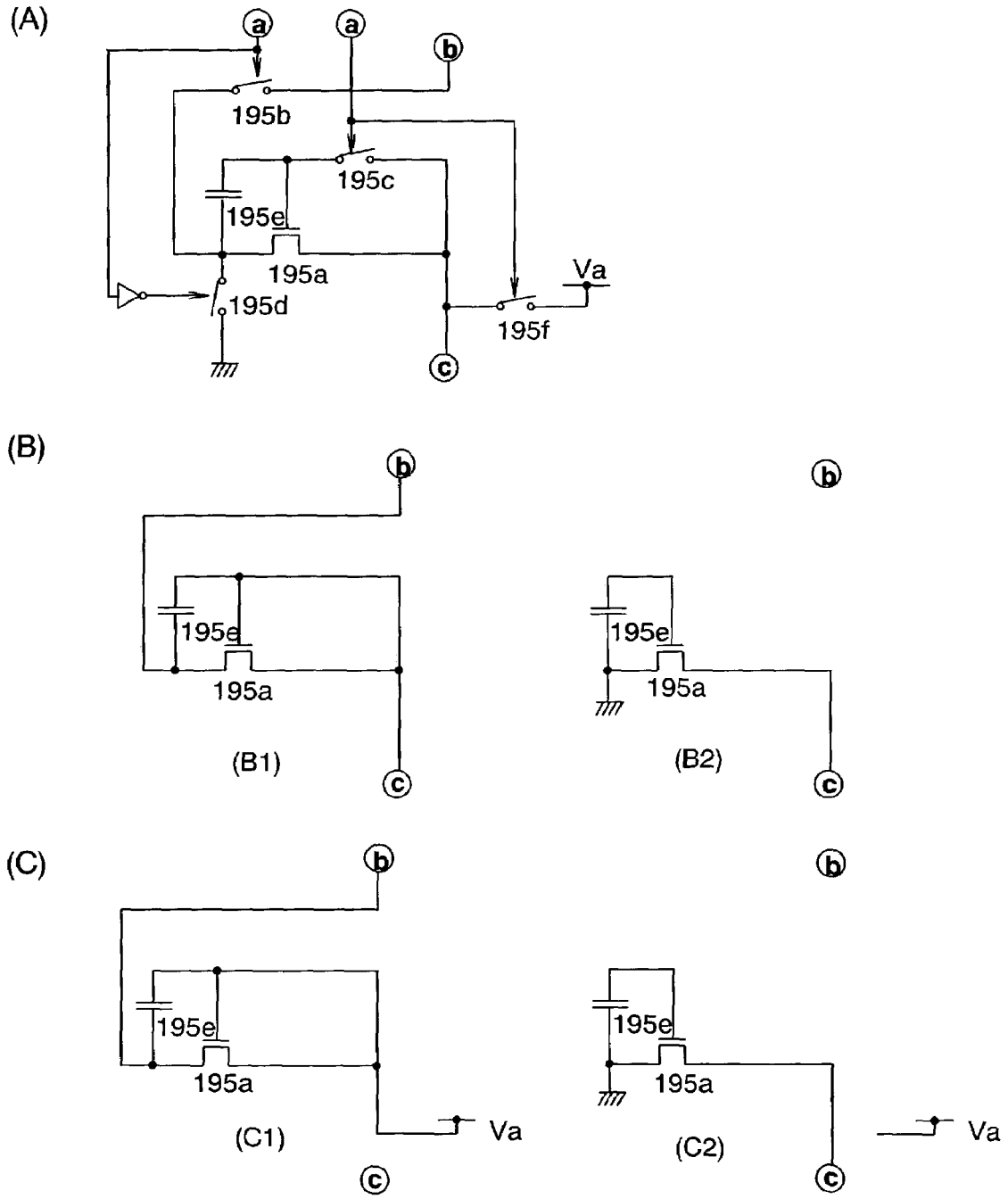

[FIG. 40]
(A)
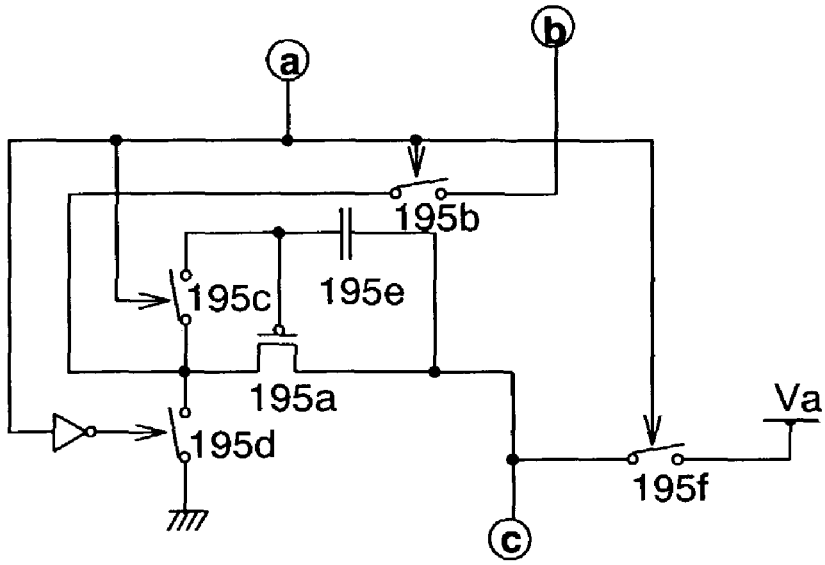
(B)
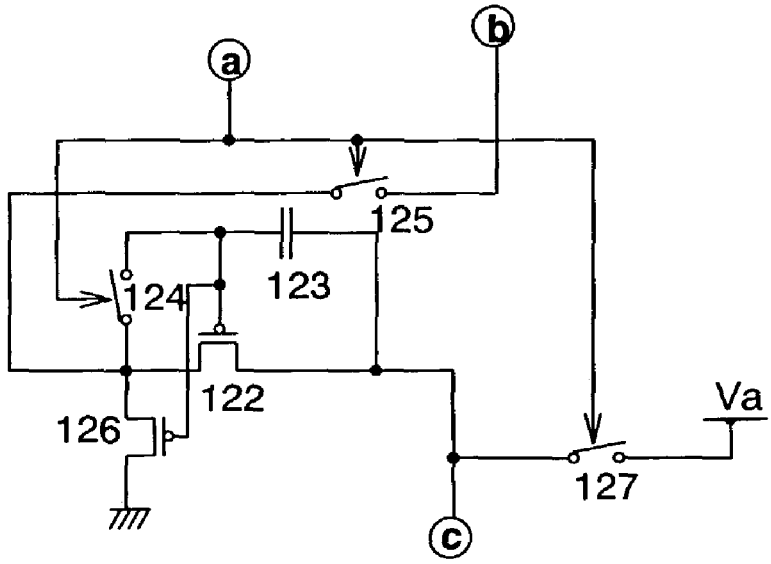

[FIG. 41]
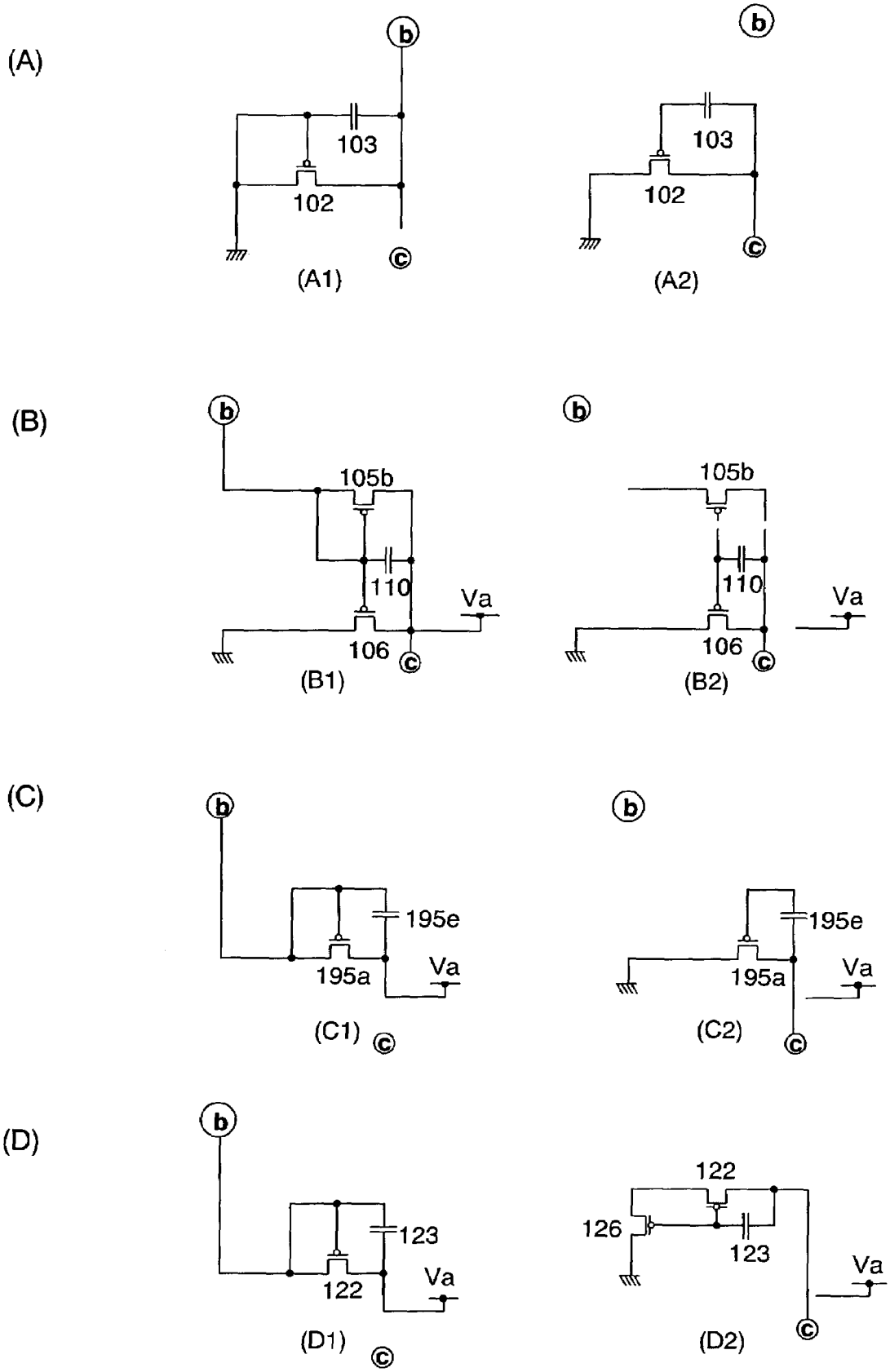

[FIG. 42]
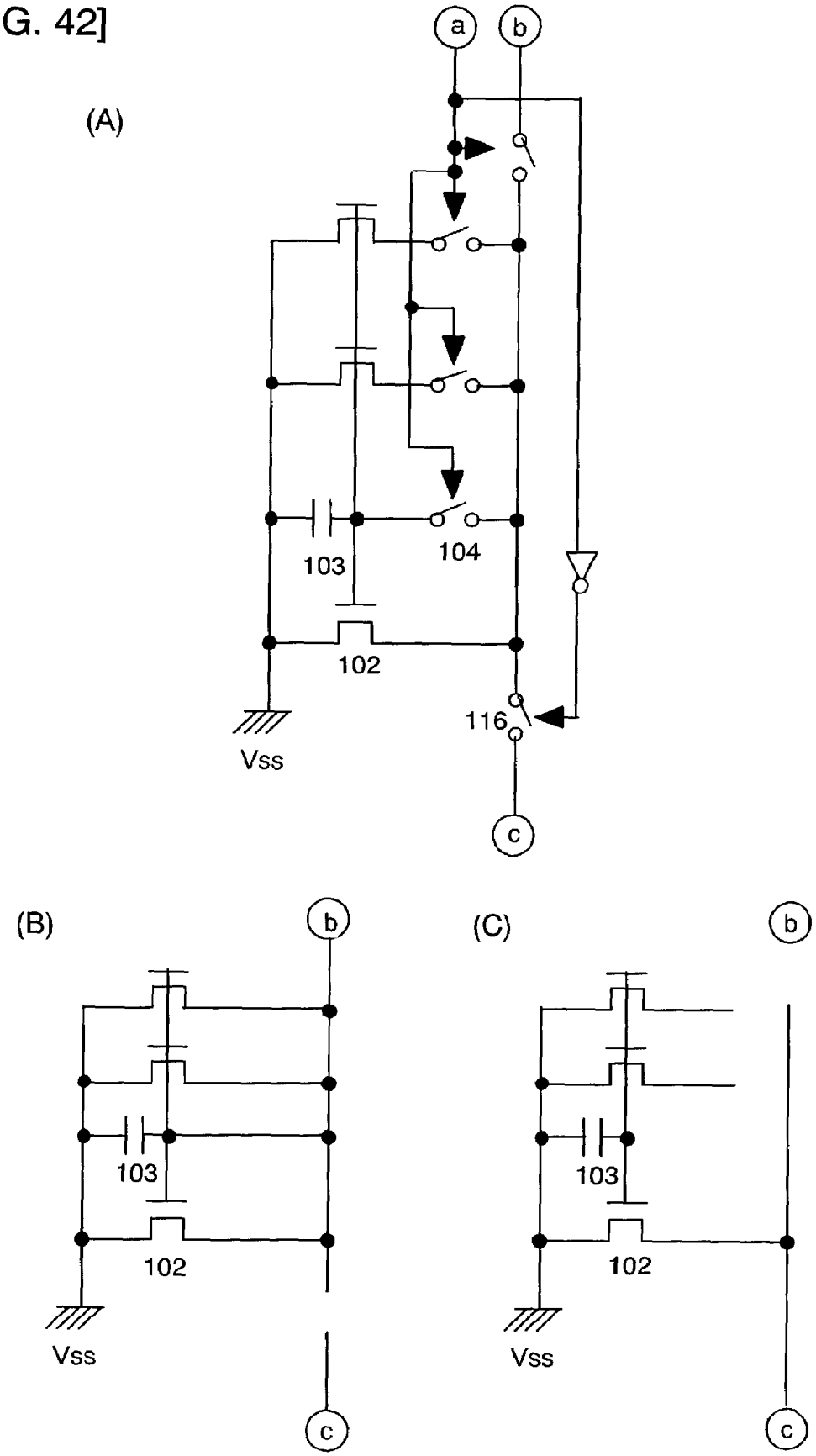

[FIG. 43]
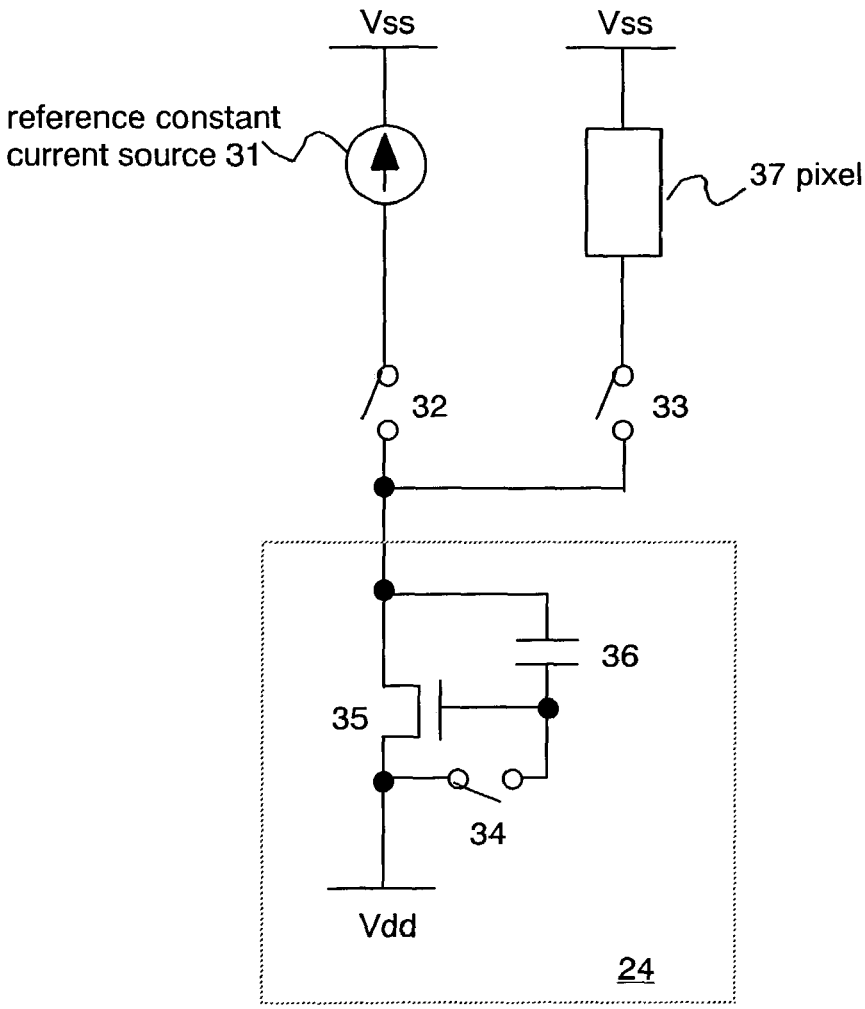

[FIG. 44]
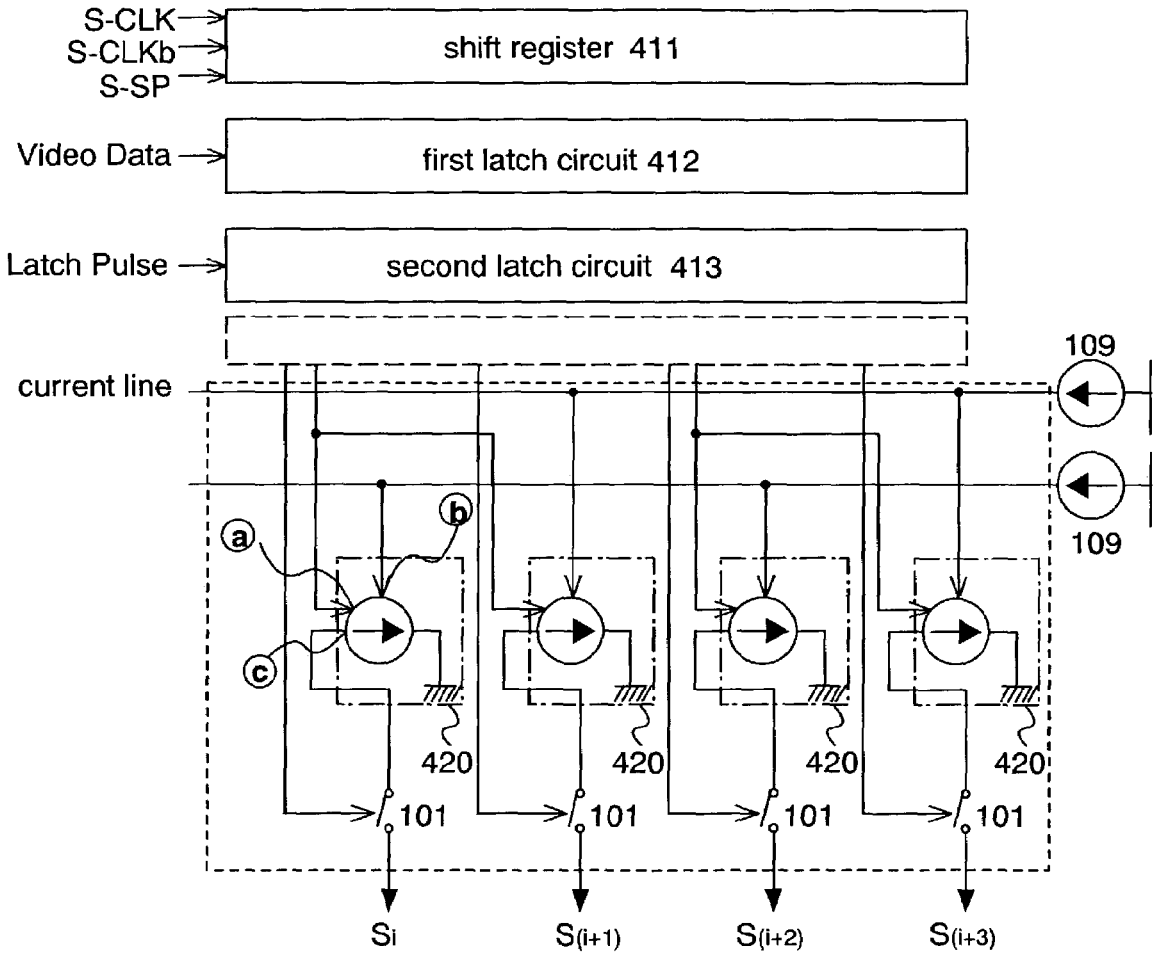

[FIG. 45]
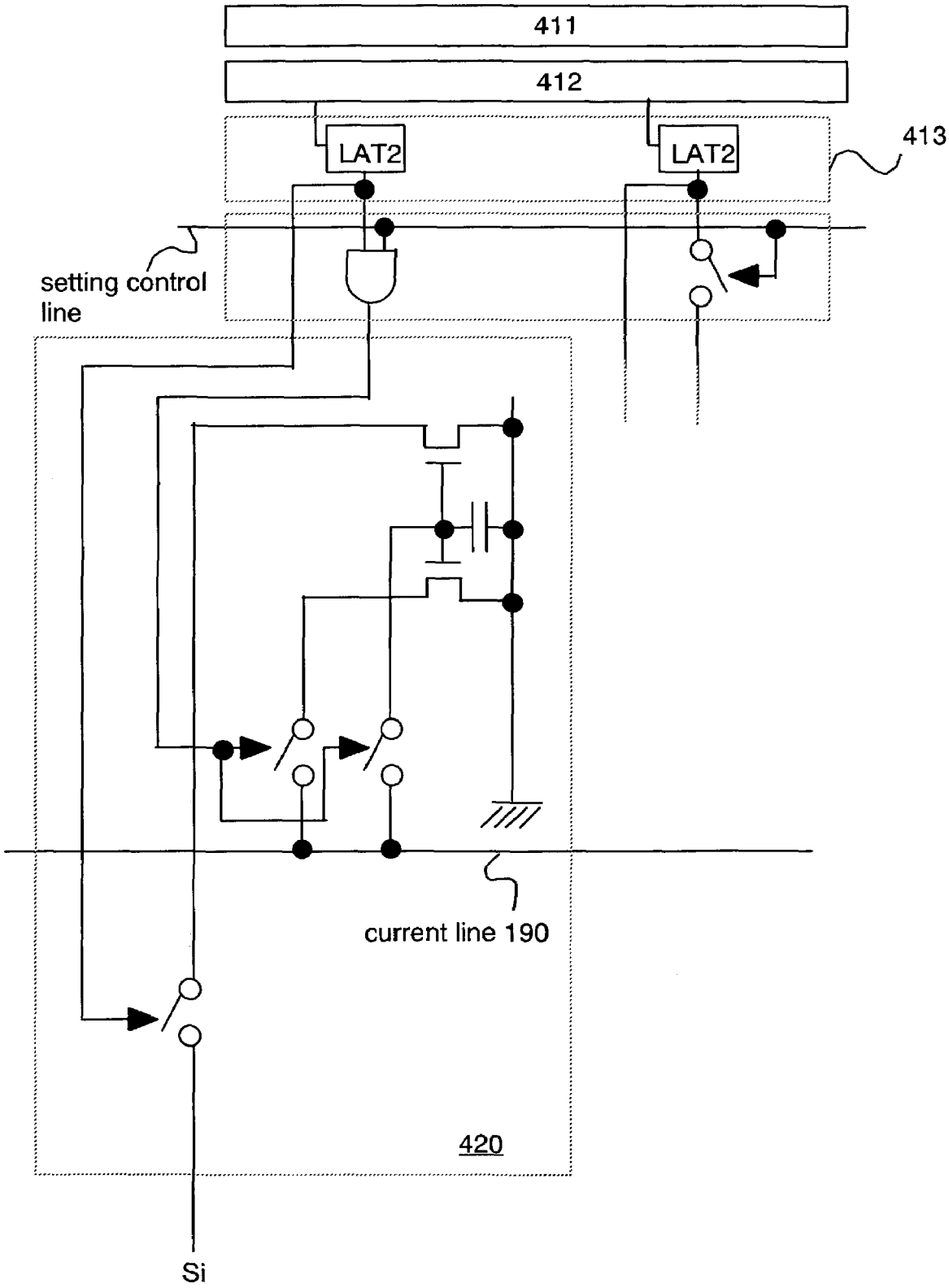

[FIG. 46]
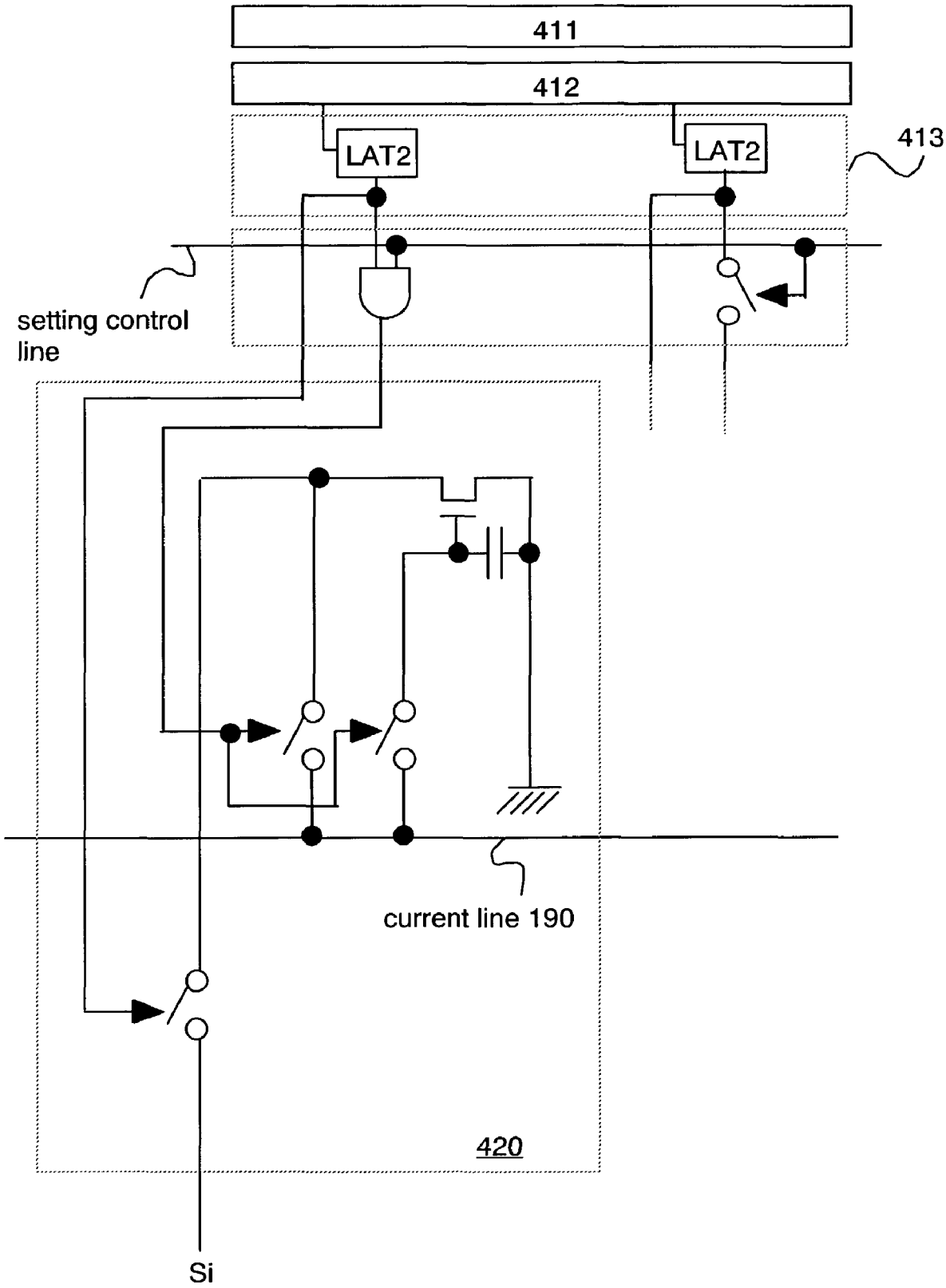

[FIG. 47] (A)
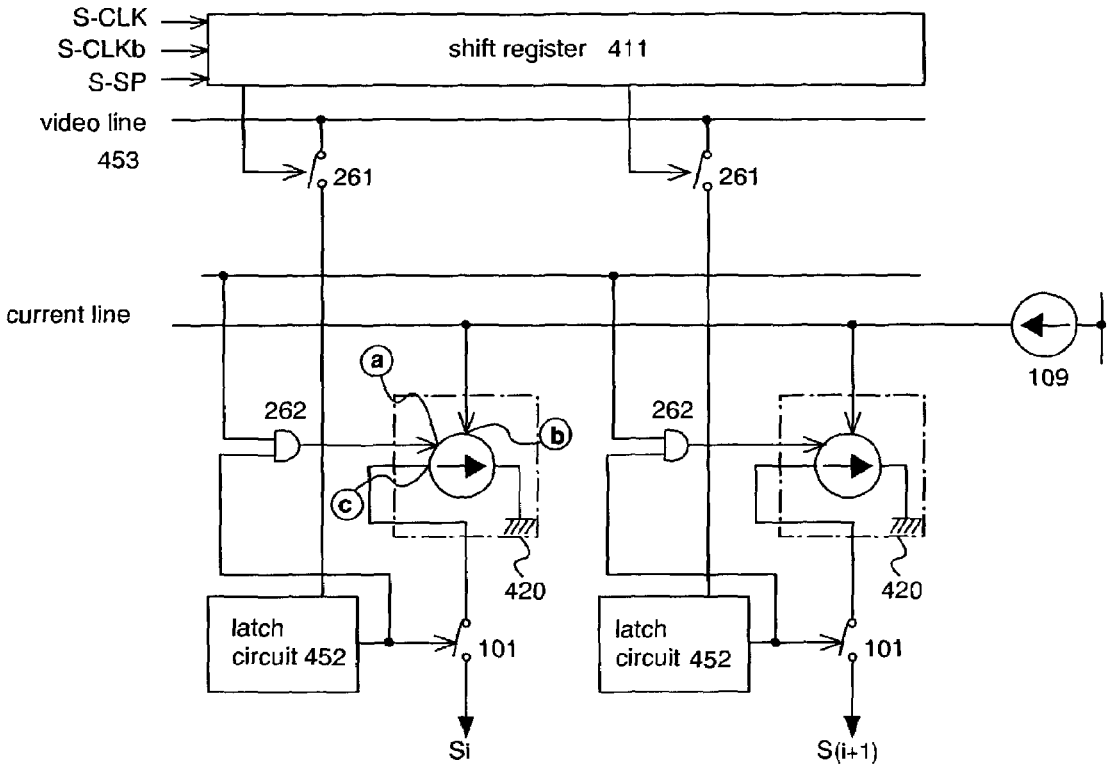
(B)
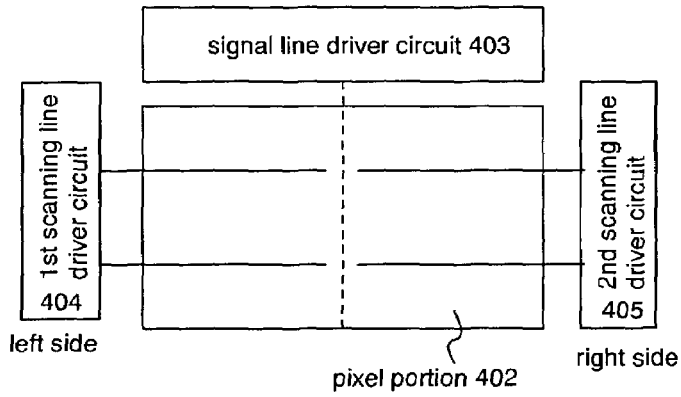
(C)
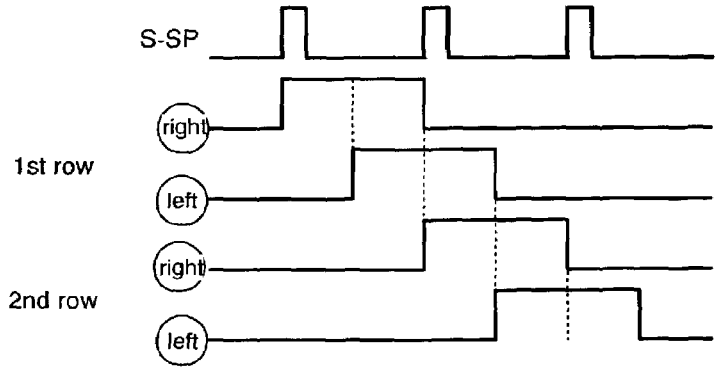

[FIG. 48]
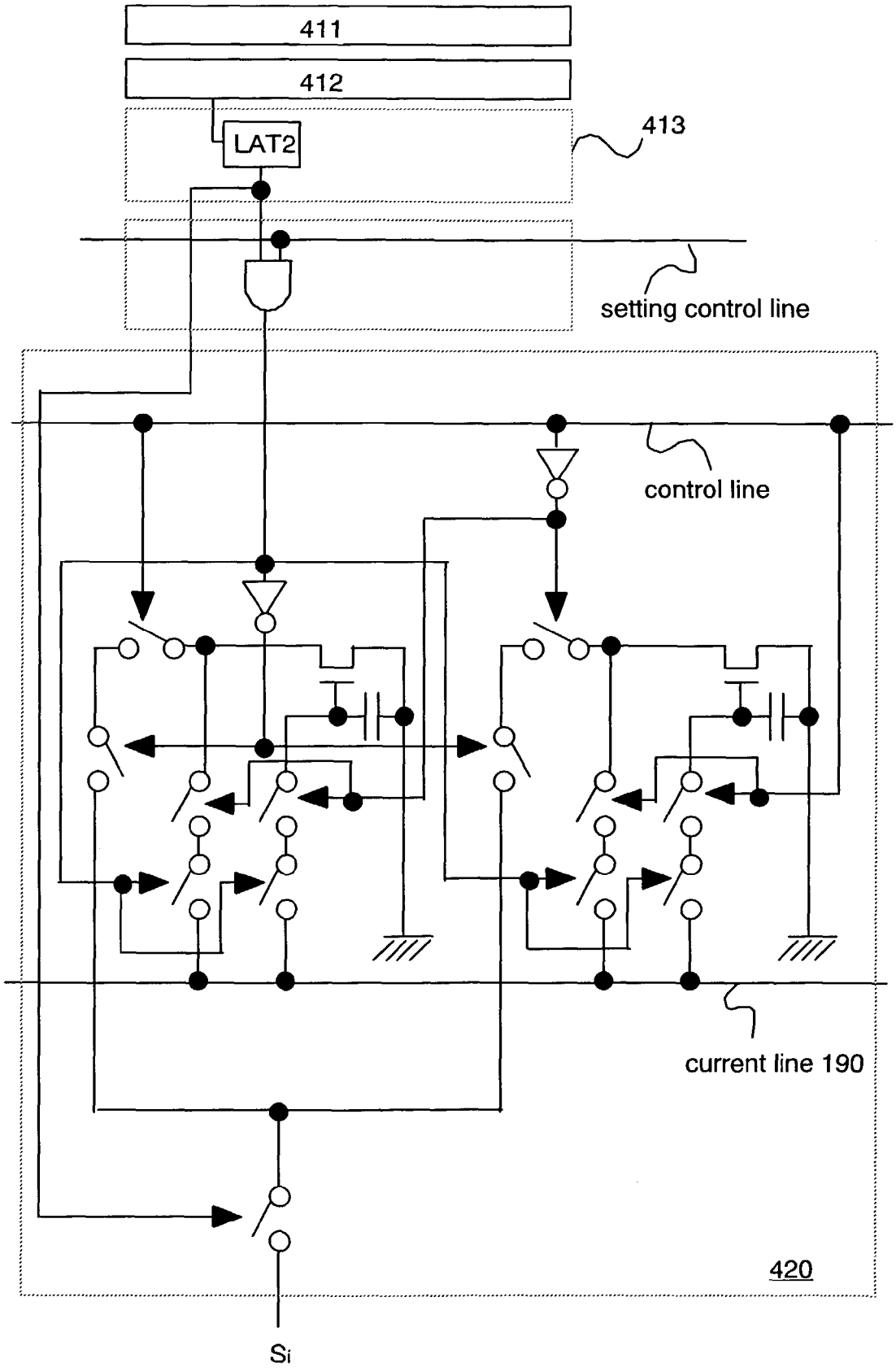

[FIG. 49]
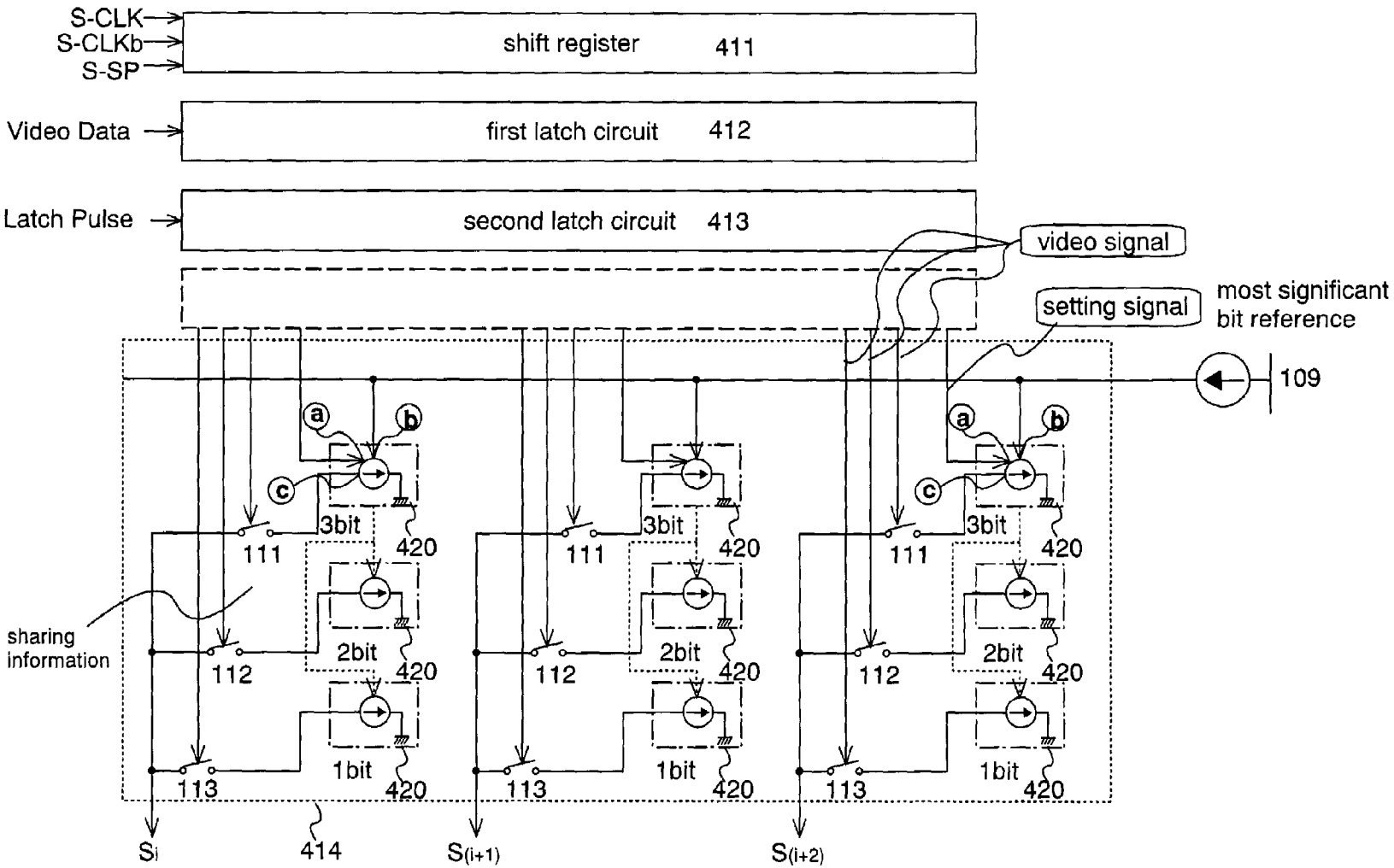

[FIG. 50]
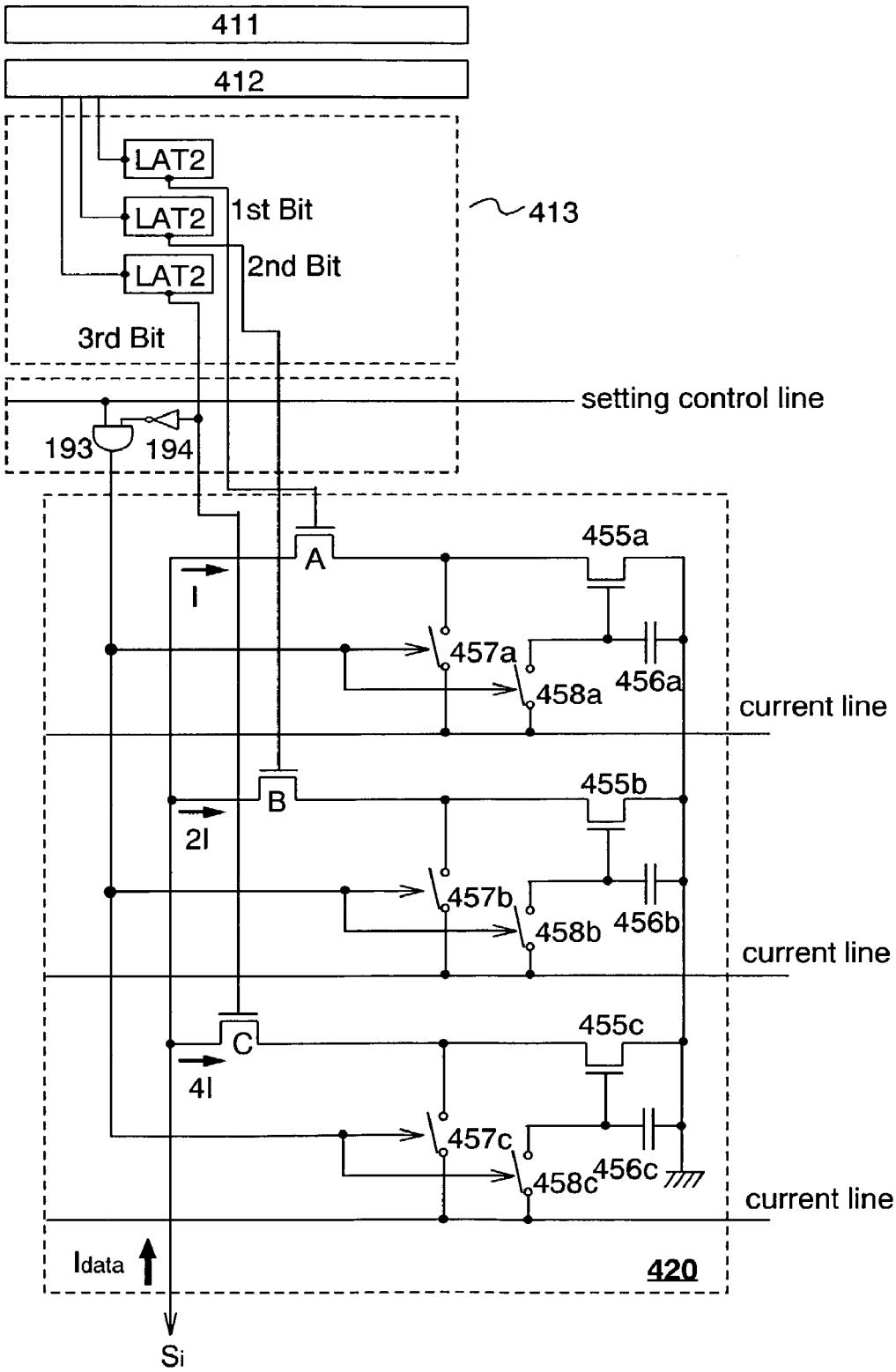

[FIG. 51]
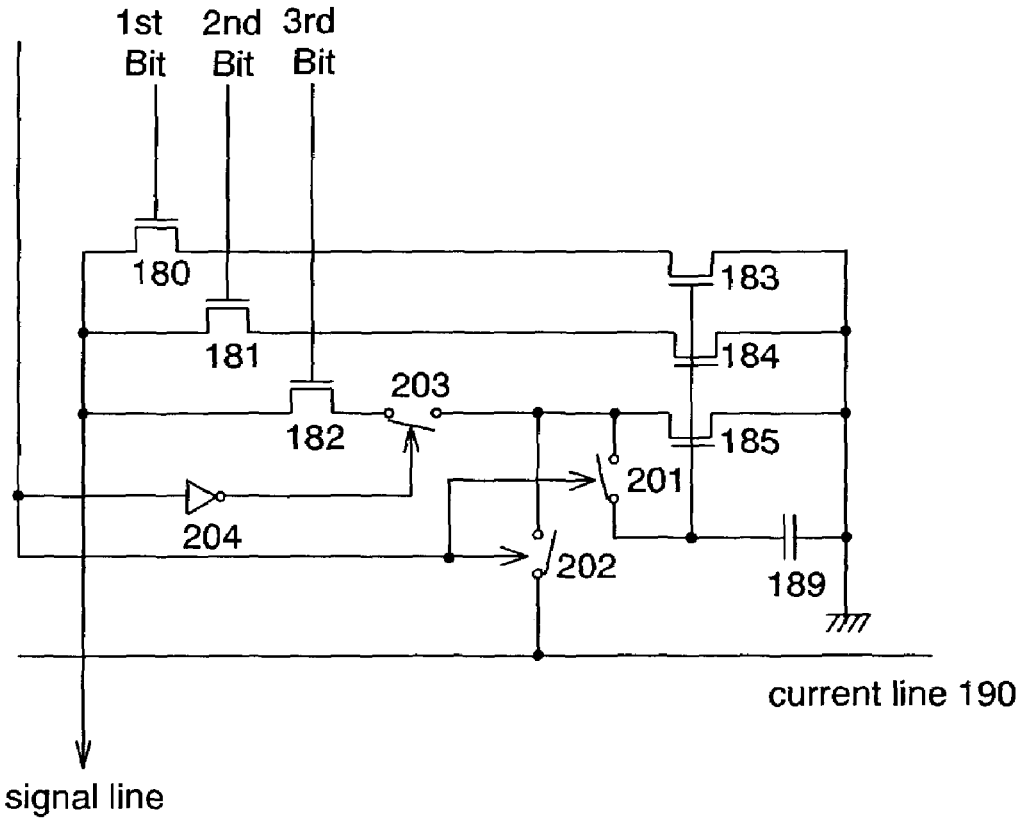

[FIG. 52]
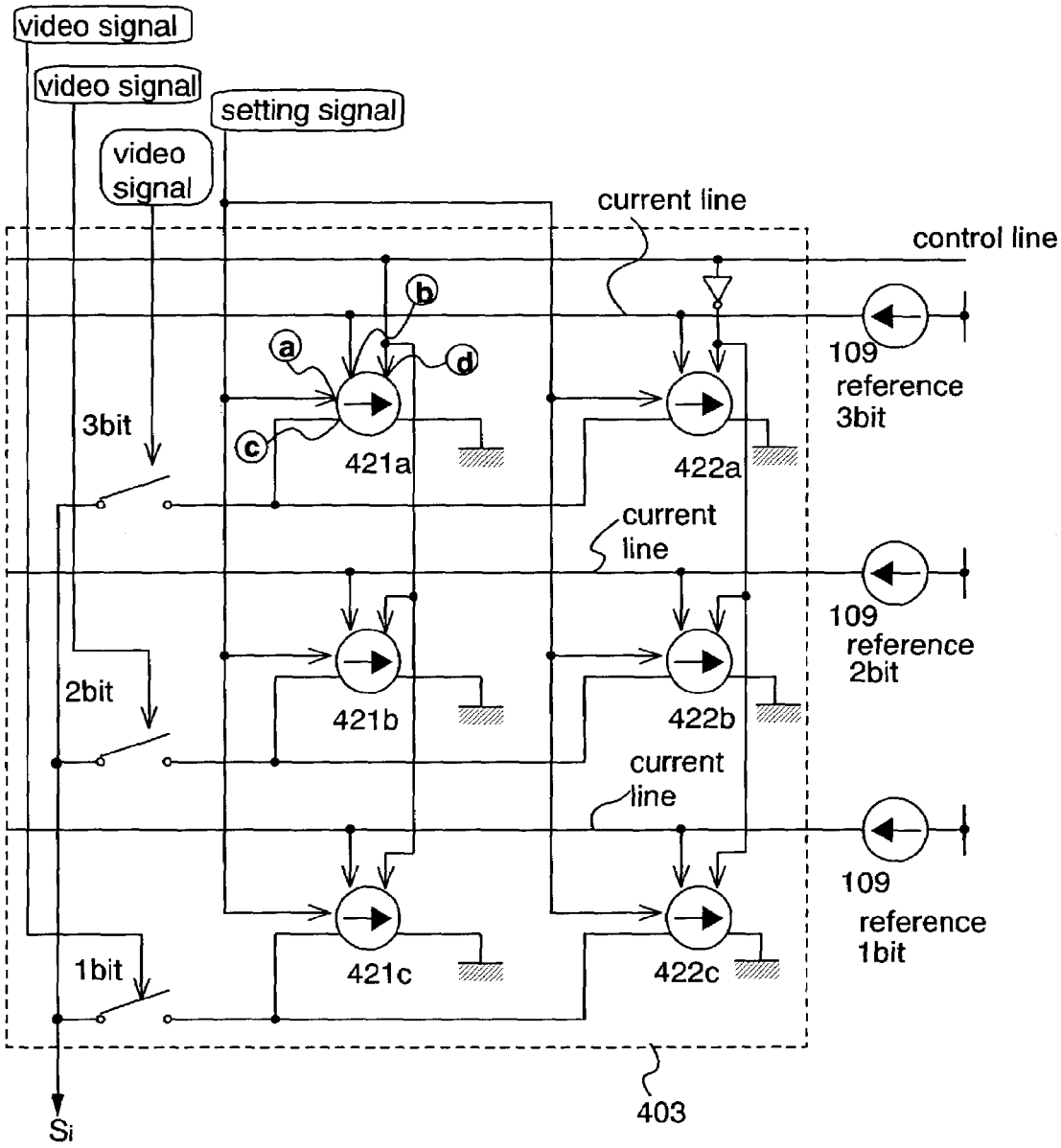

[FIG. 53]
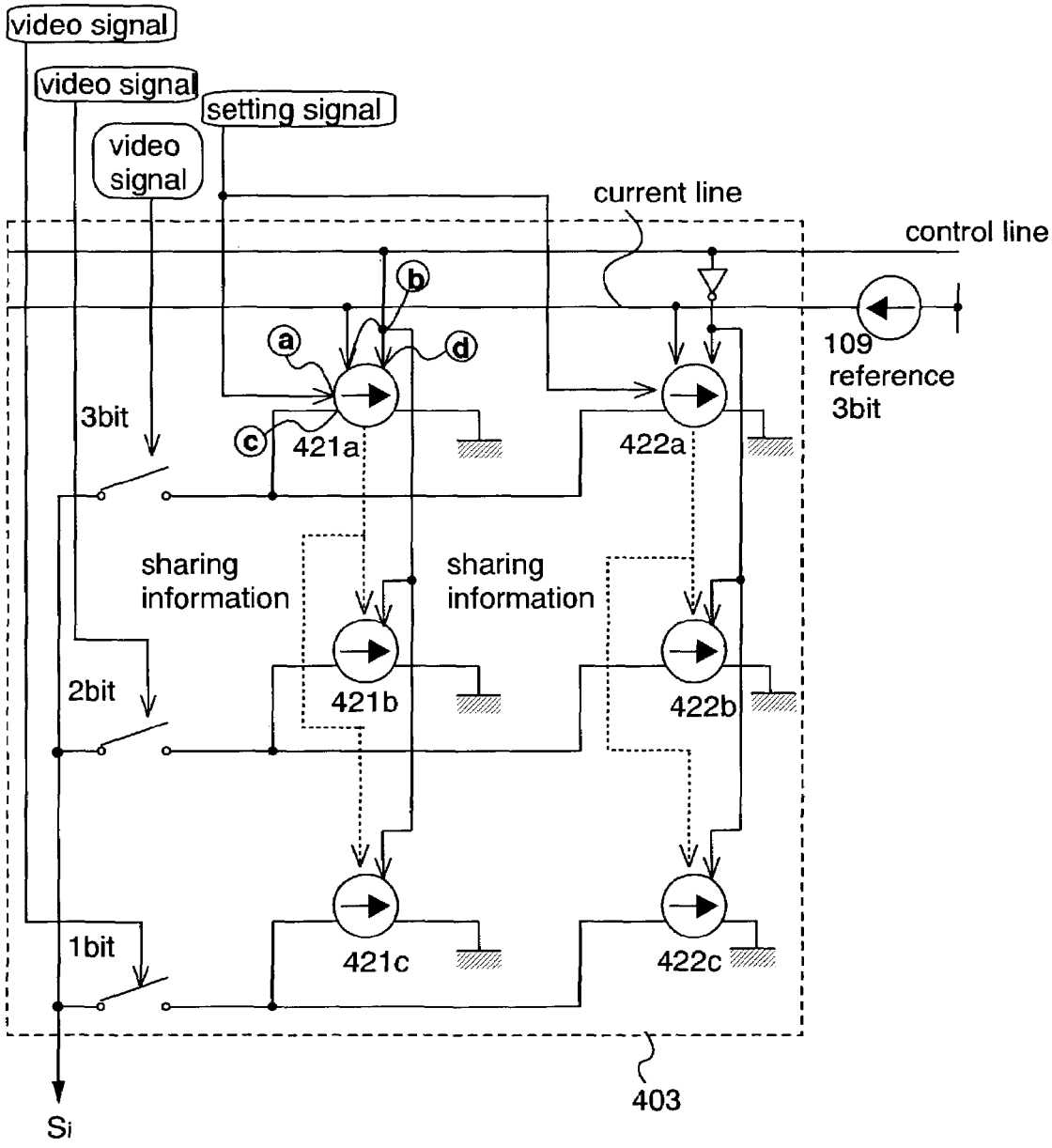

[FIG. 54]
(A)
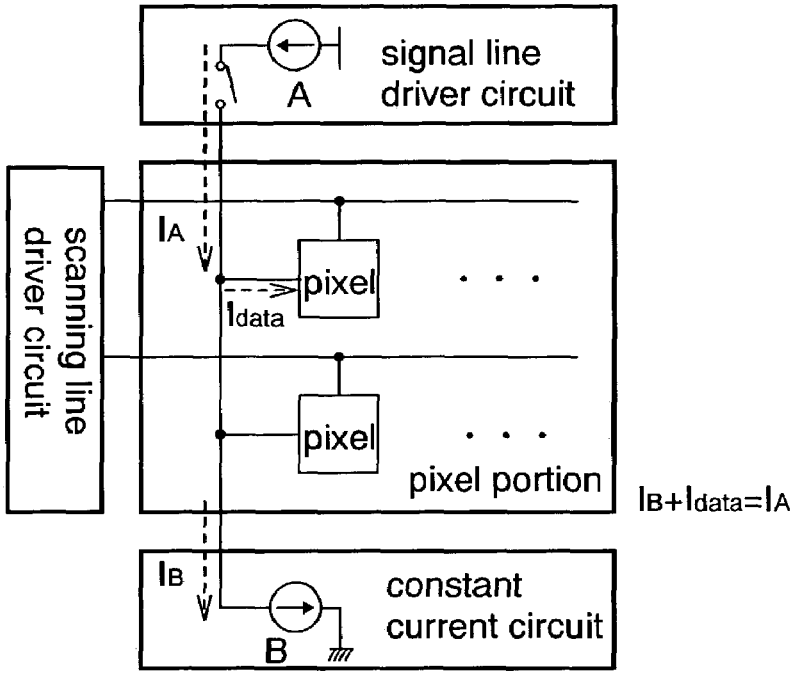
(B)
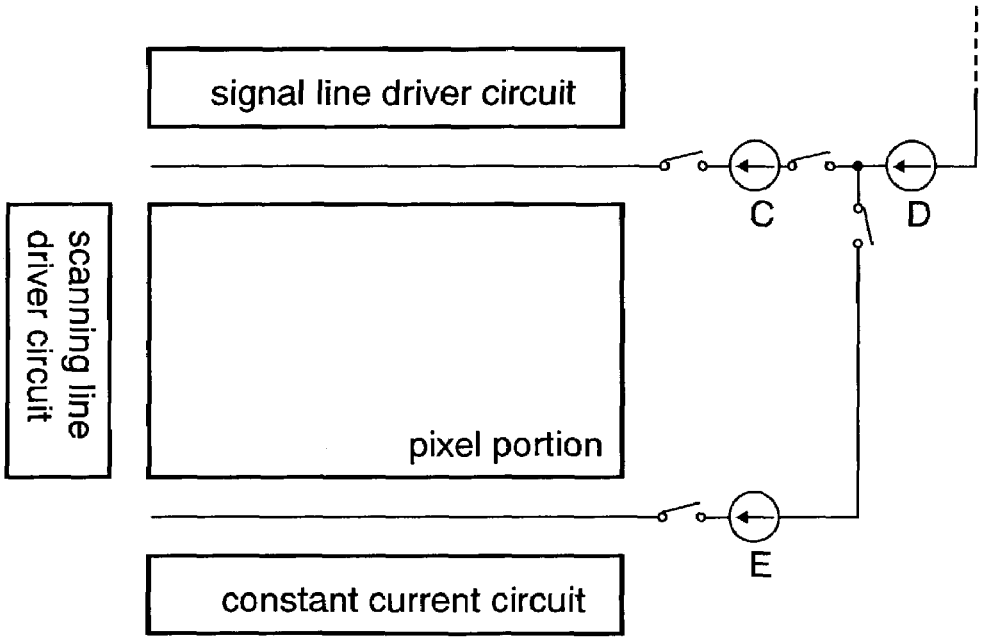

[FIG. 55]
(A)
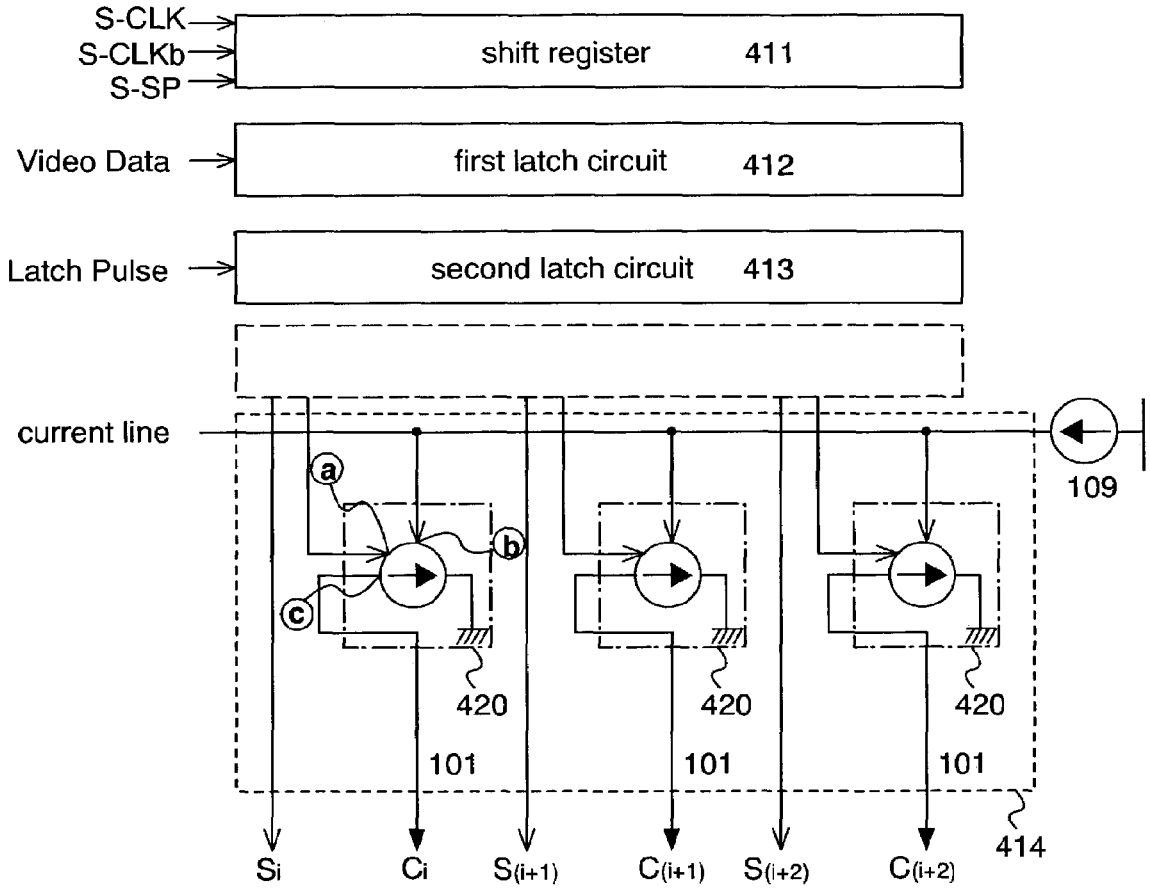
(B)
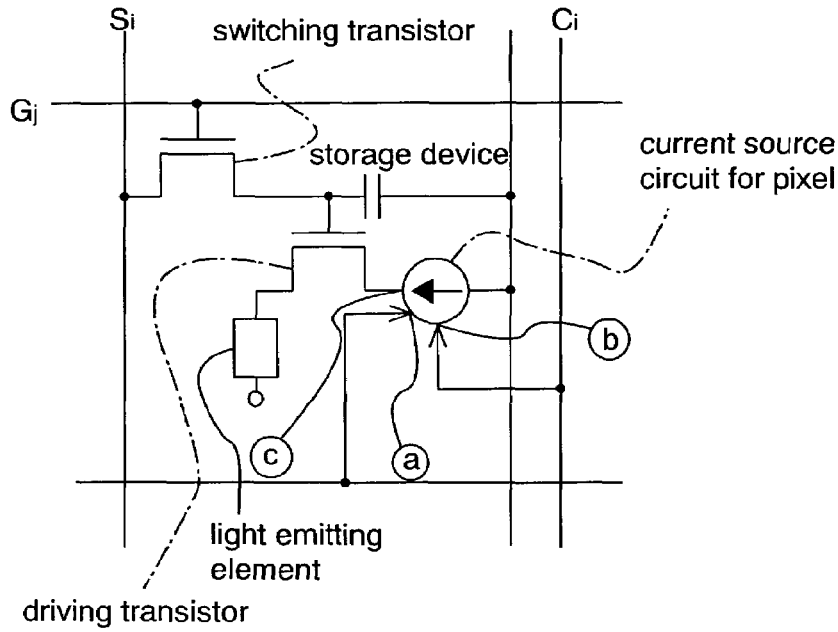

[FIG. 56]
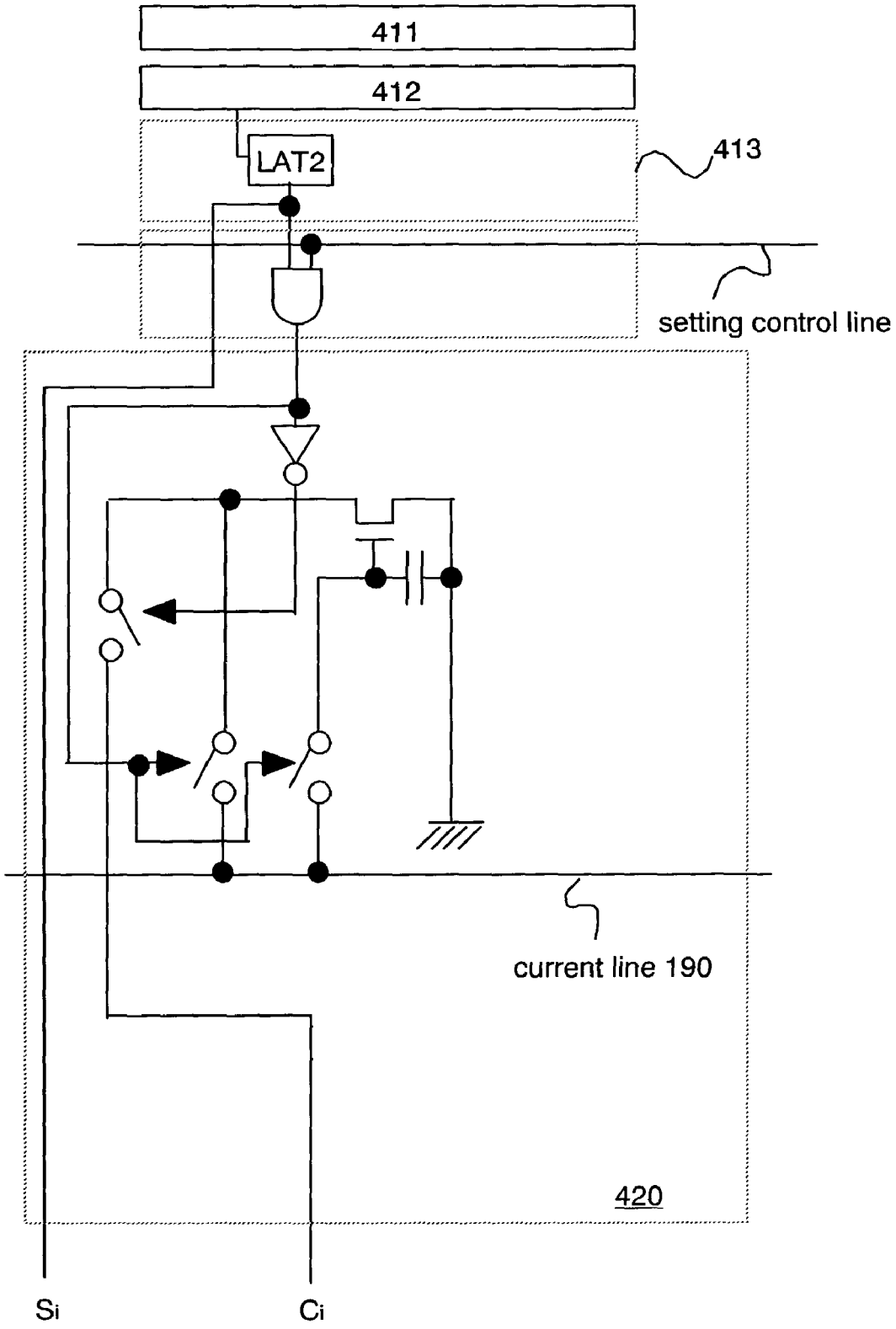

[FIG. 57]
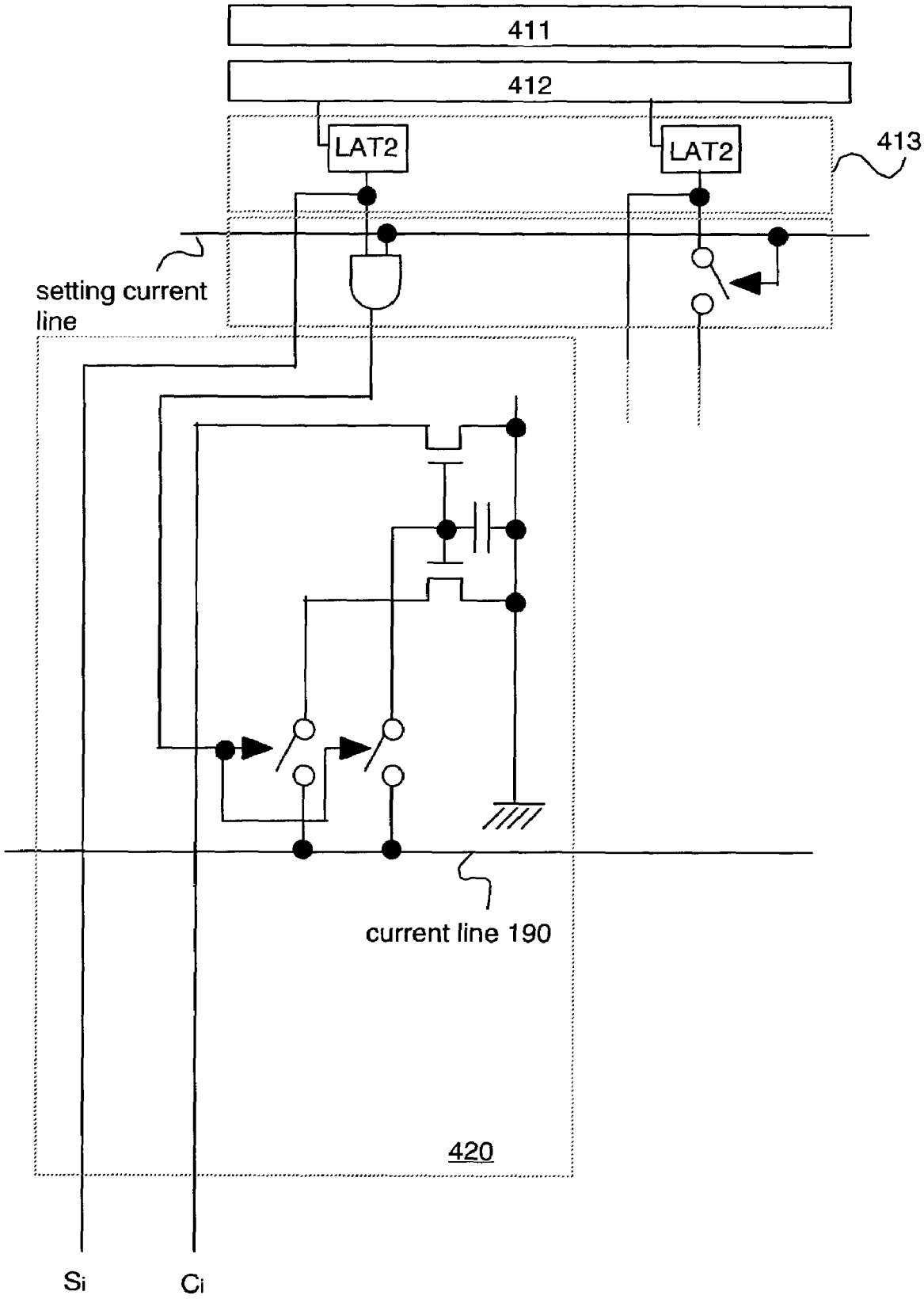

[FIG. 58]
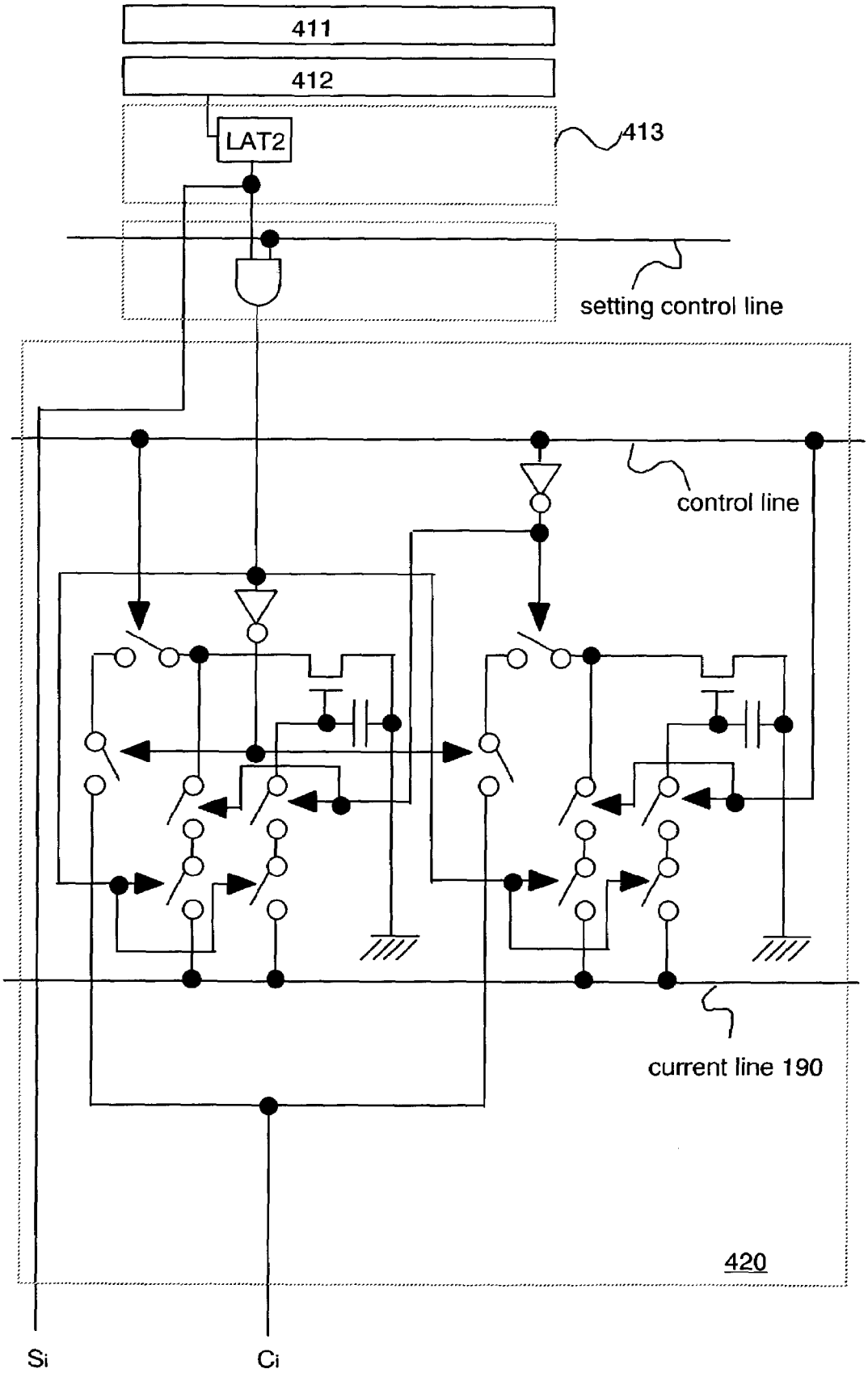

[FIG. 59]
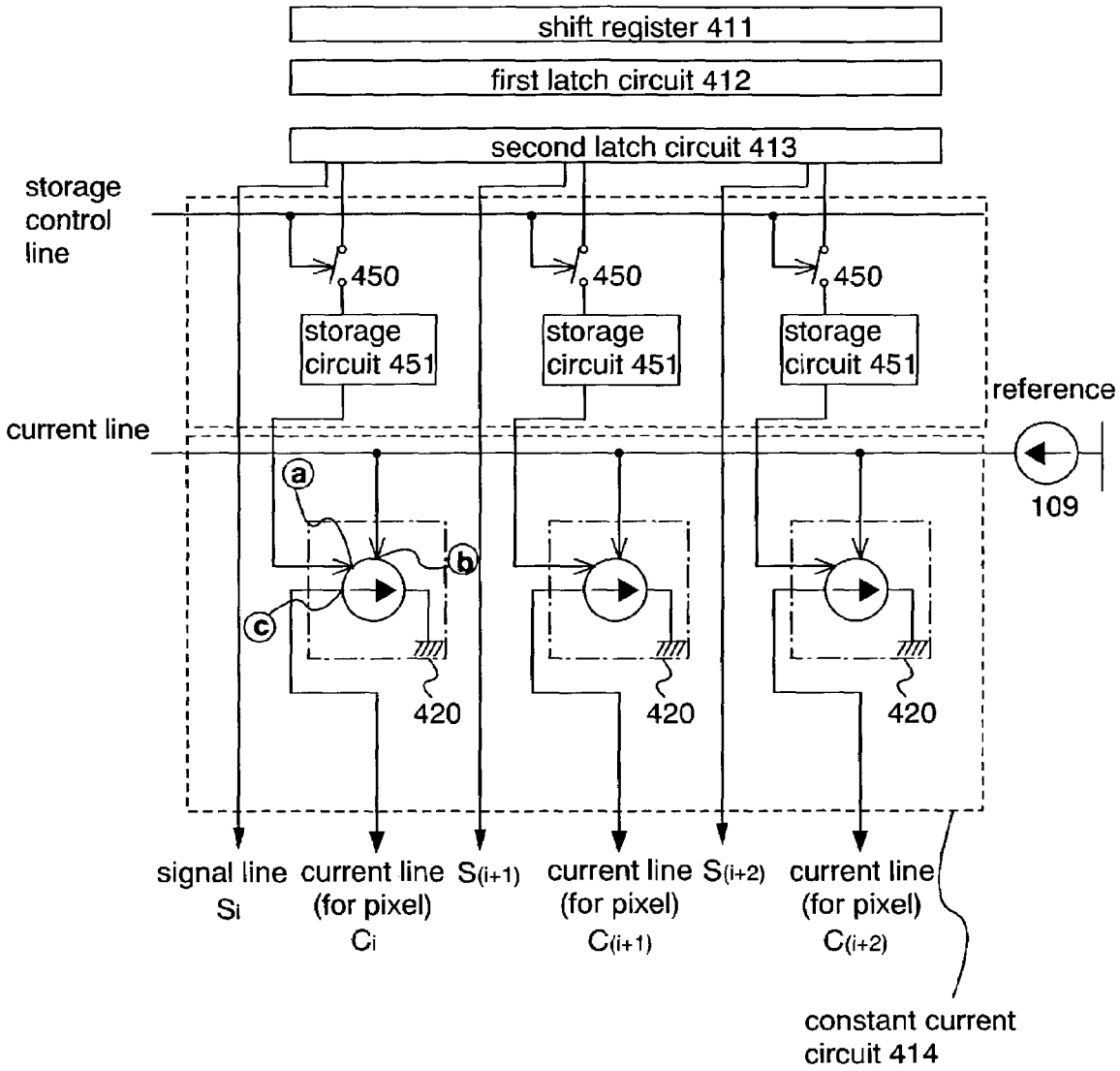

[FIG. 60]
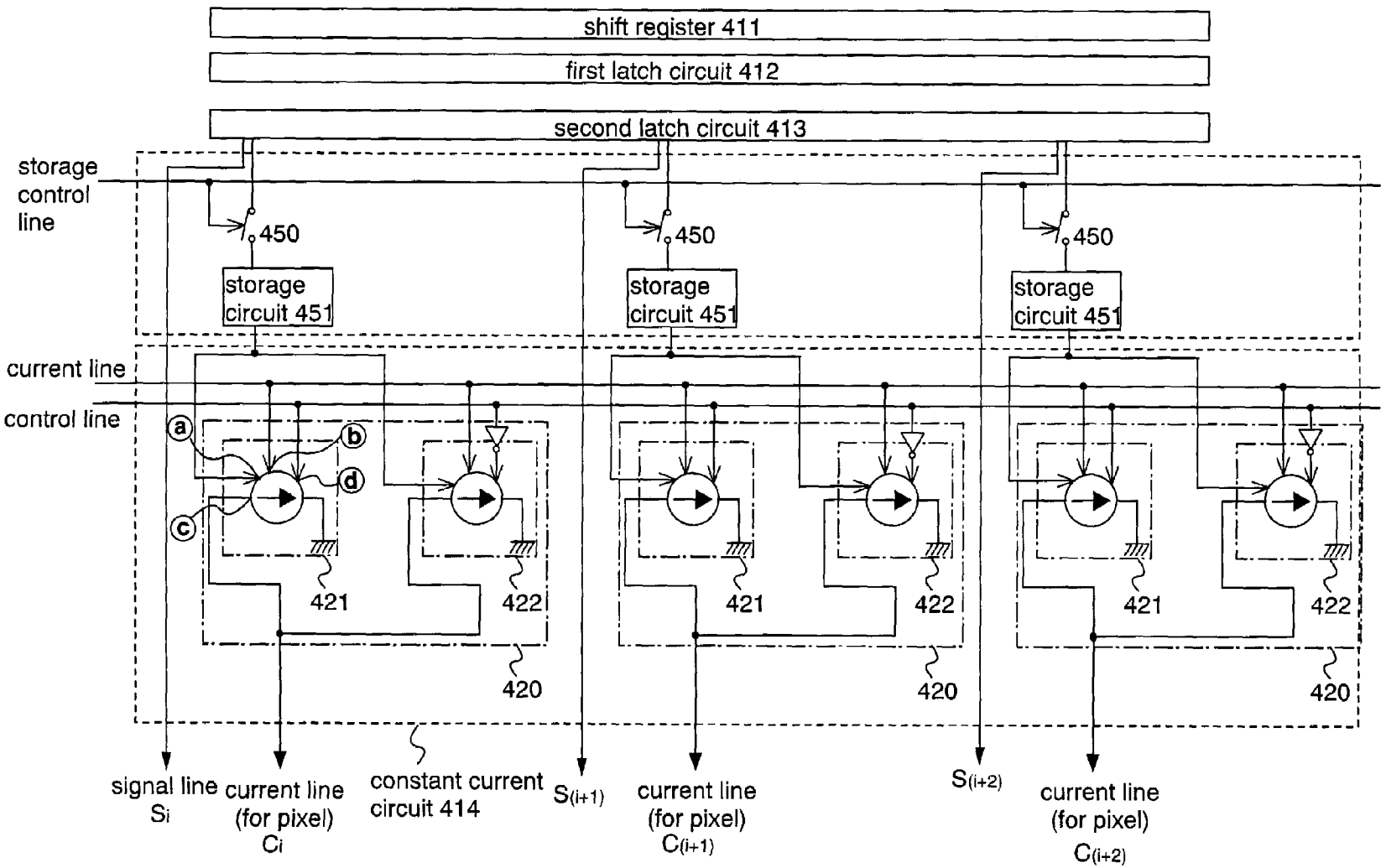

[FIG. 61]
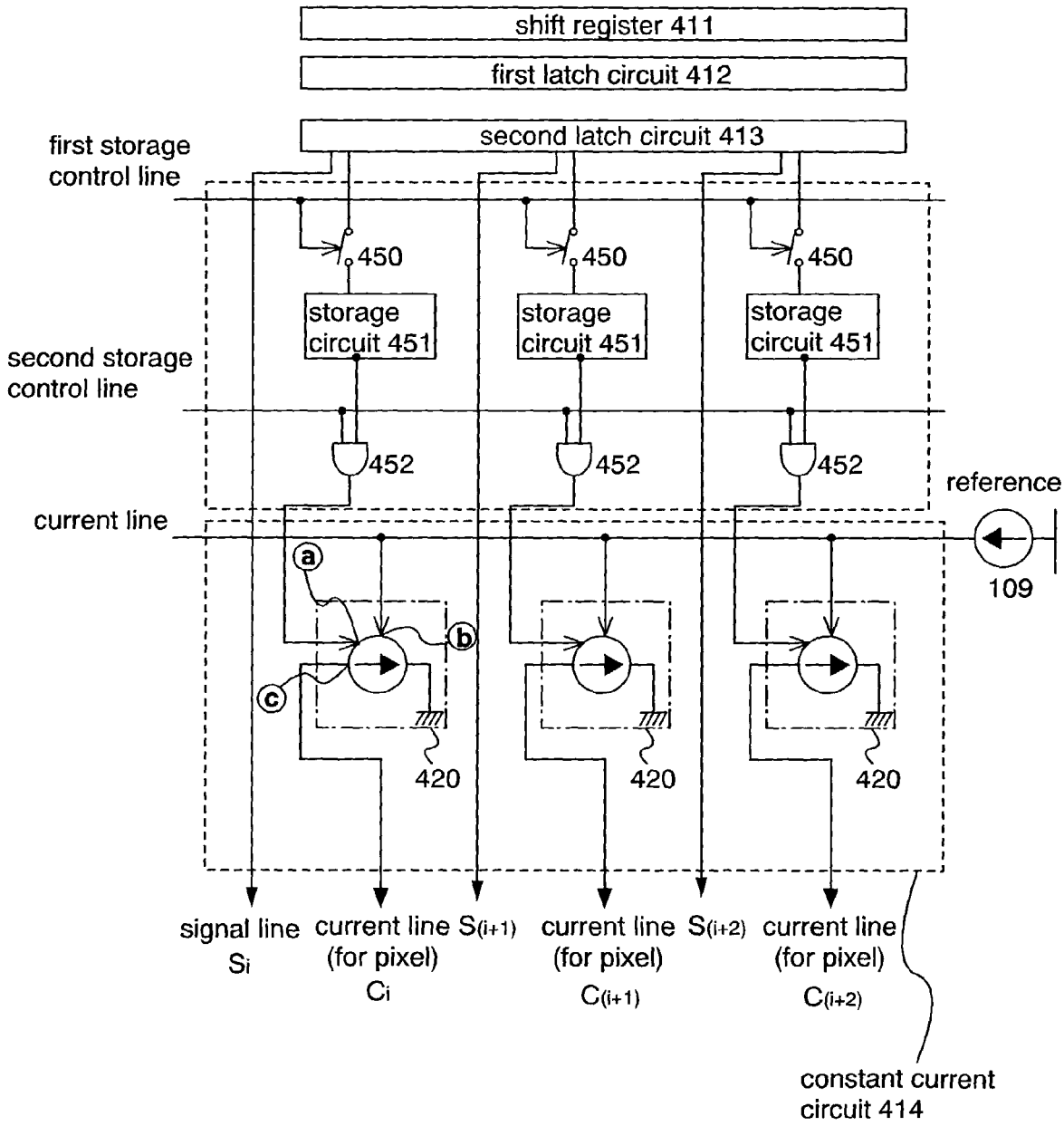

[FIG. 62]
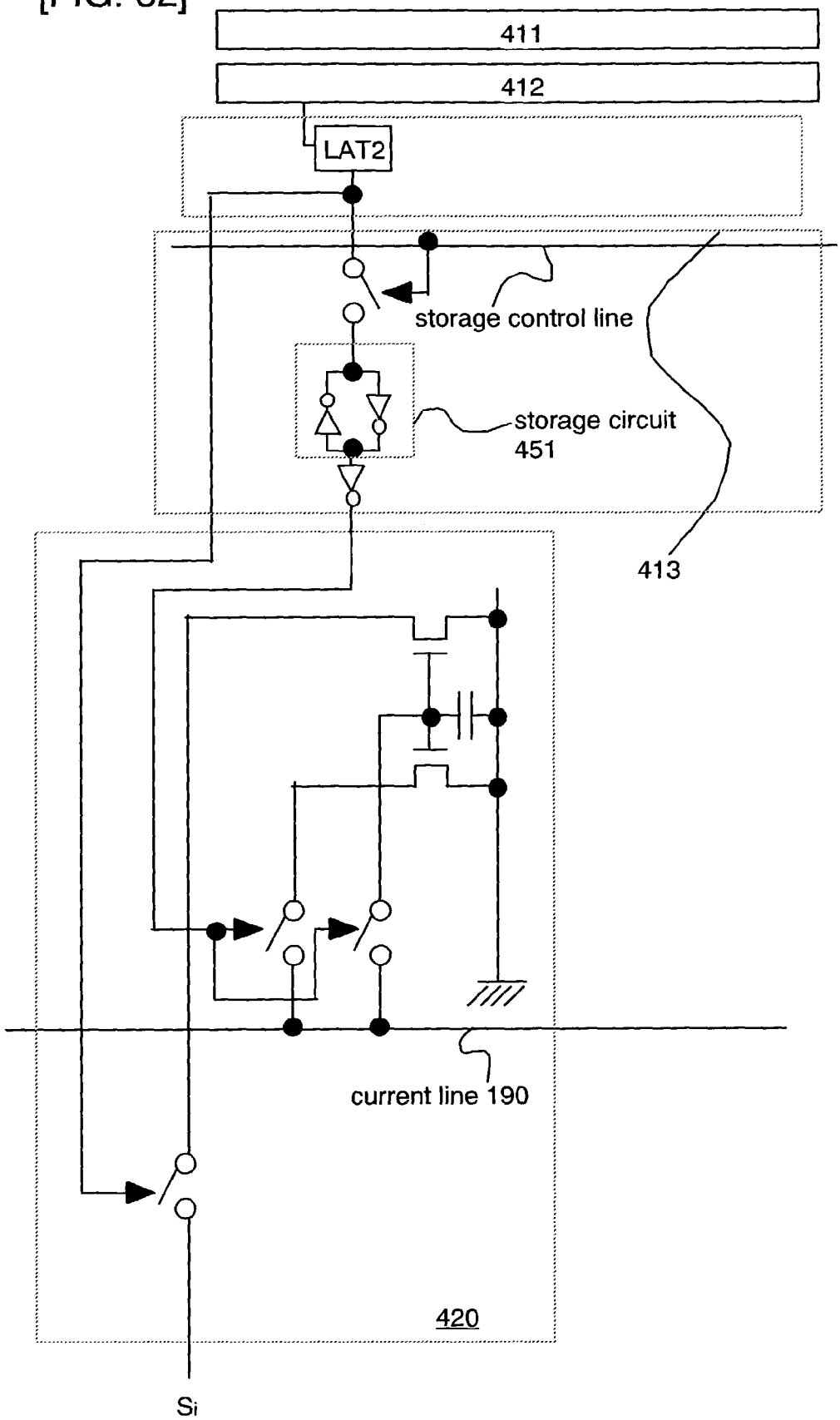

[FIG. 63]
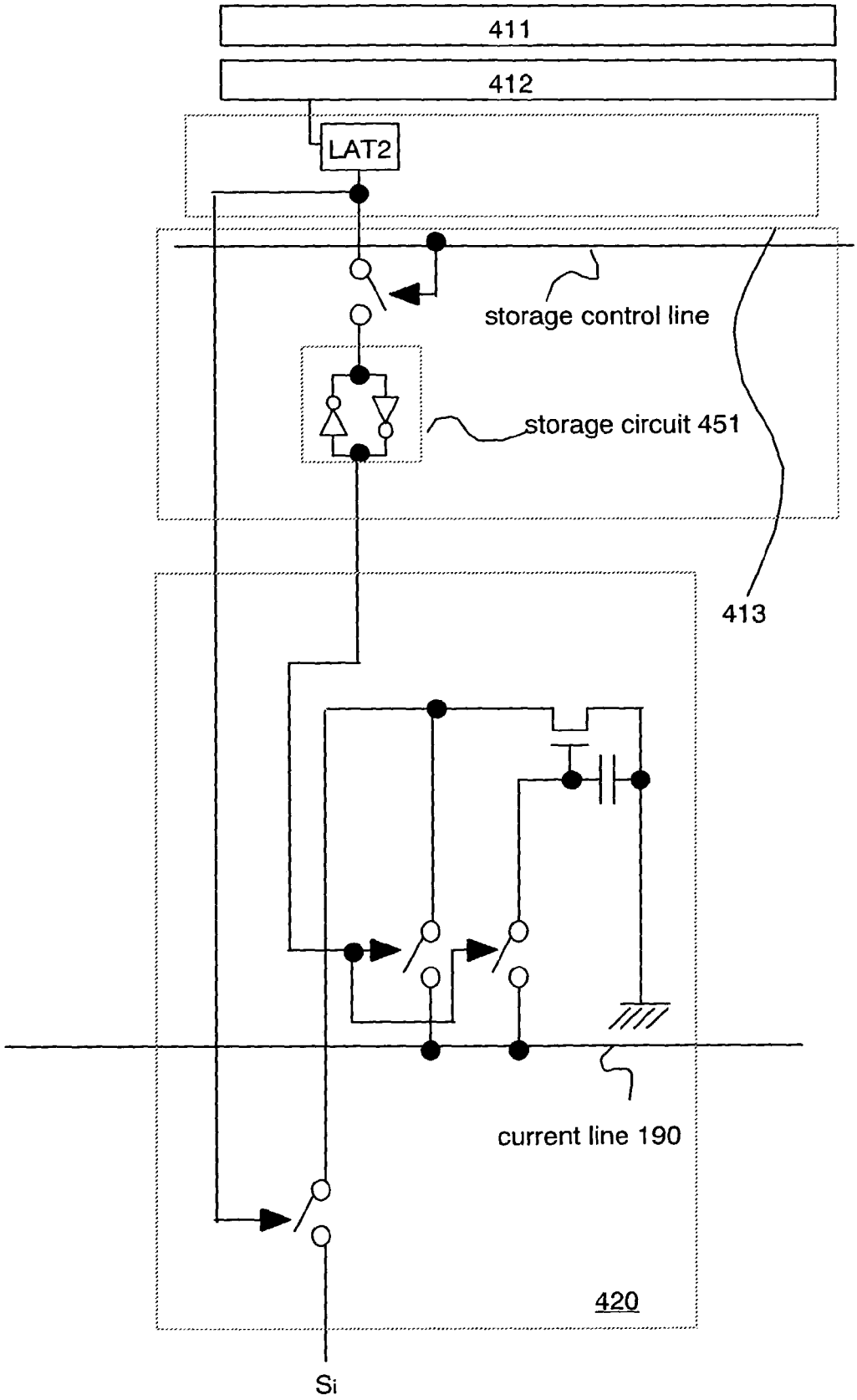

[FIG. 64]
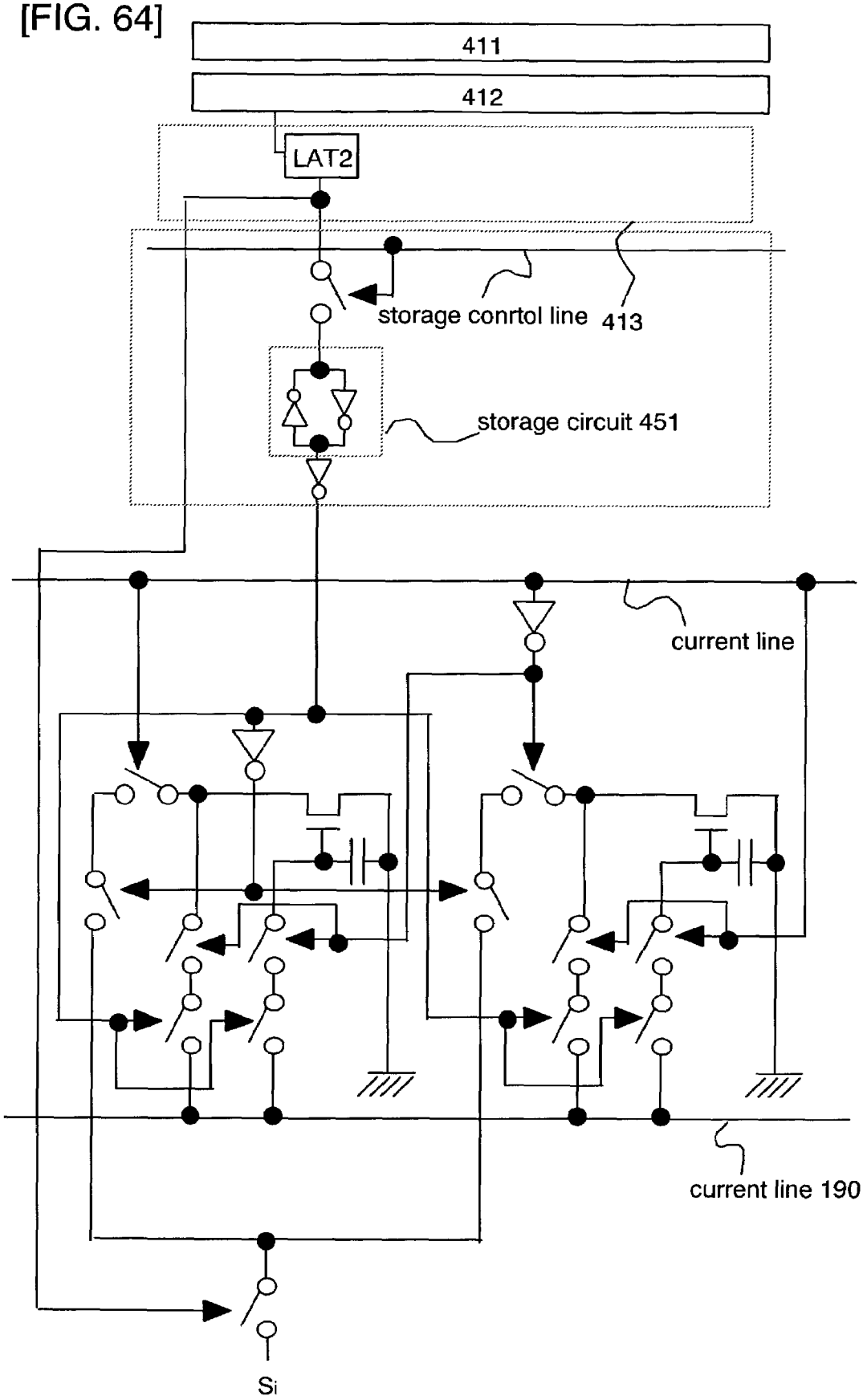

[FIG. 65]
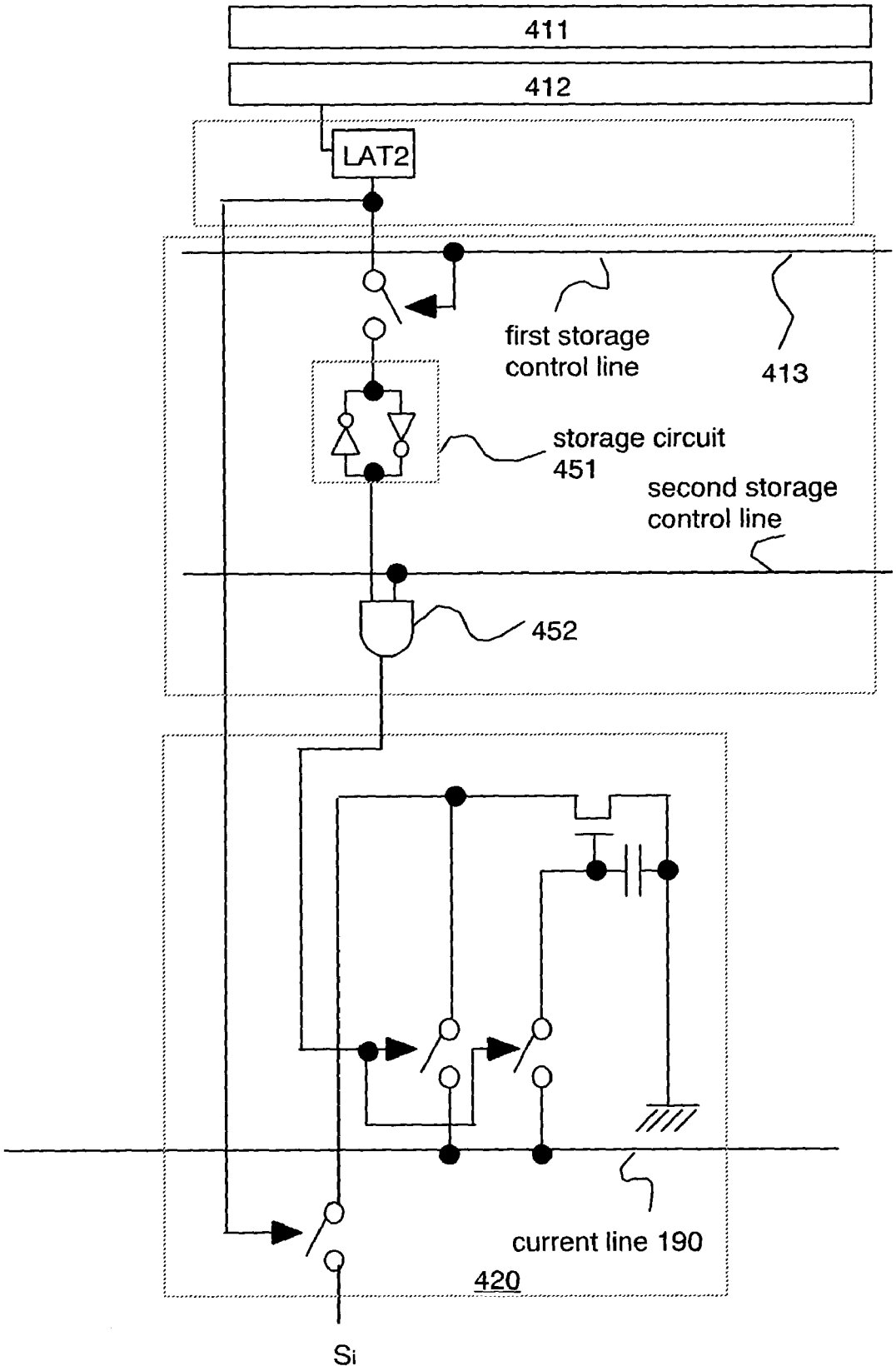

[FIG. 66]
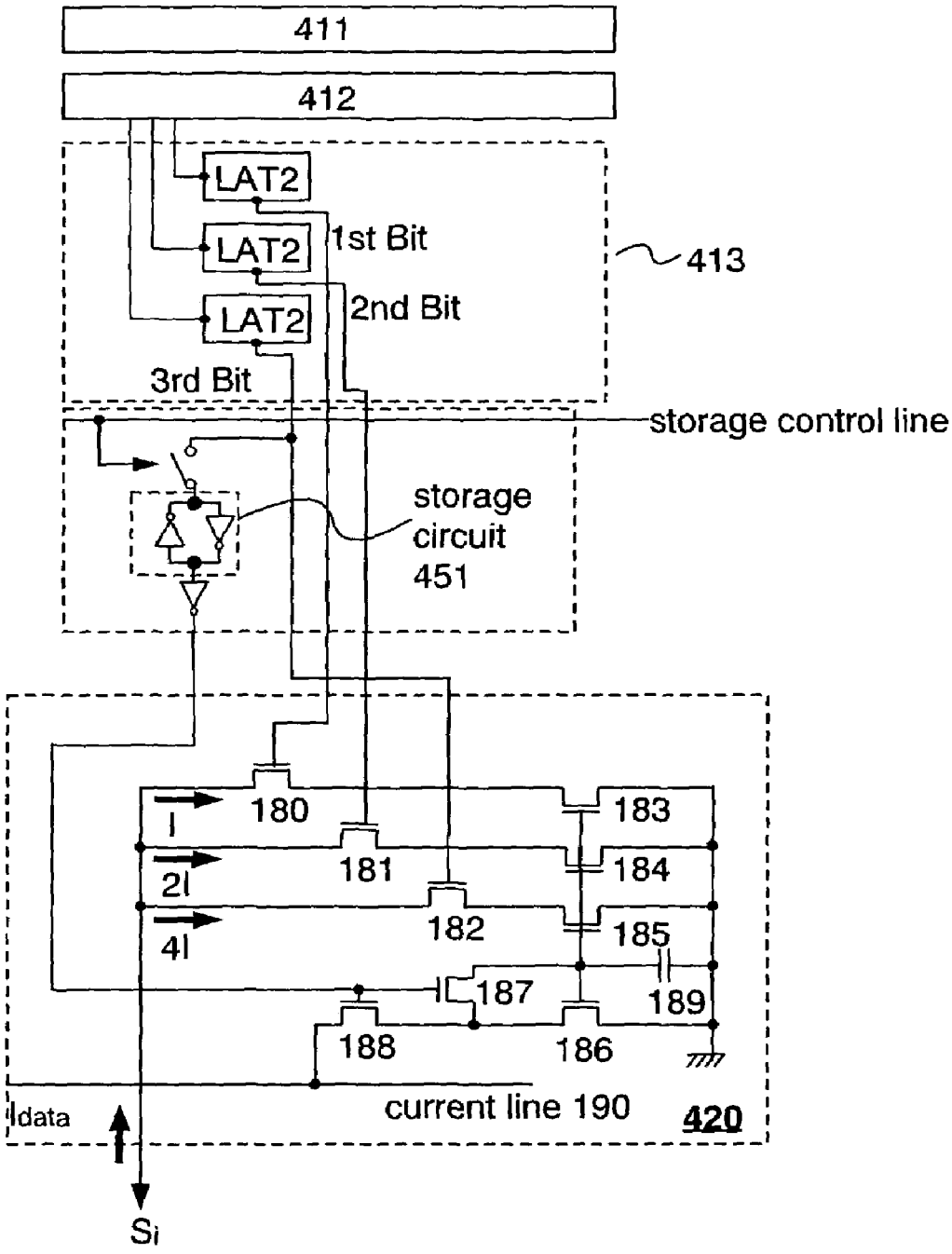

[FIG. 67]
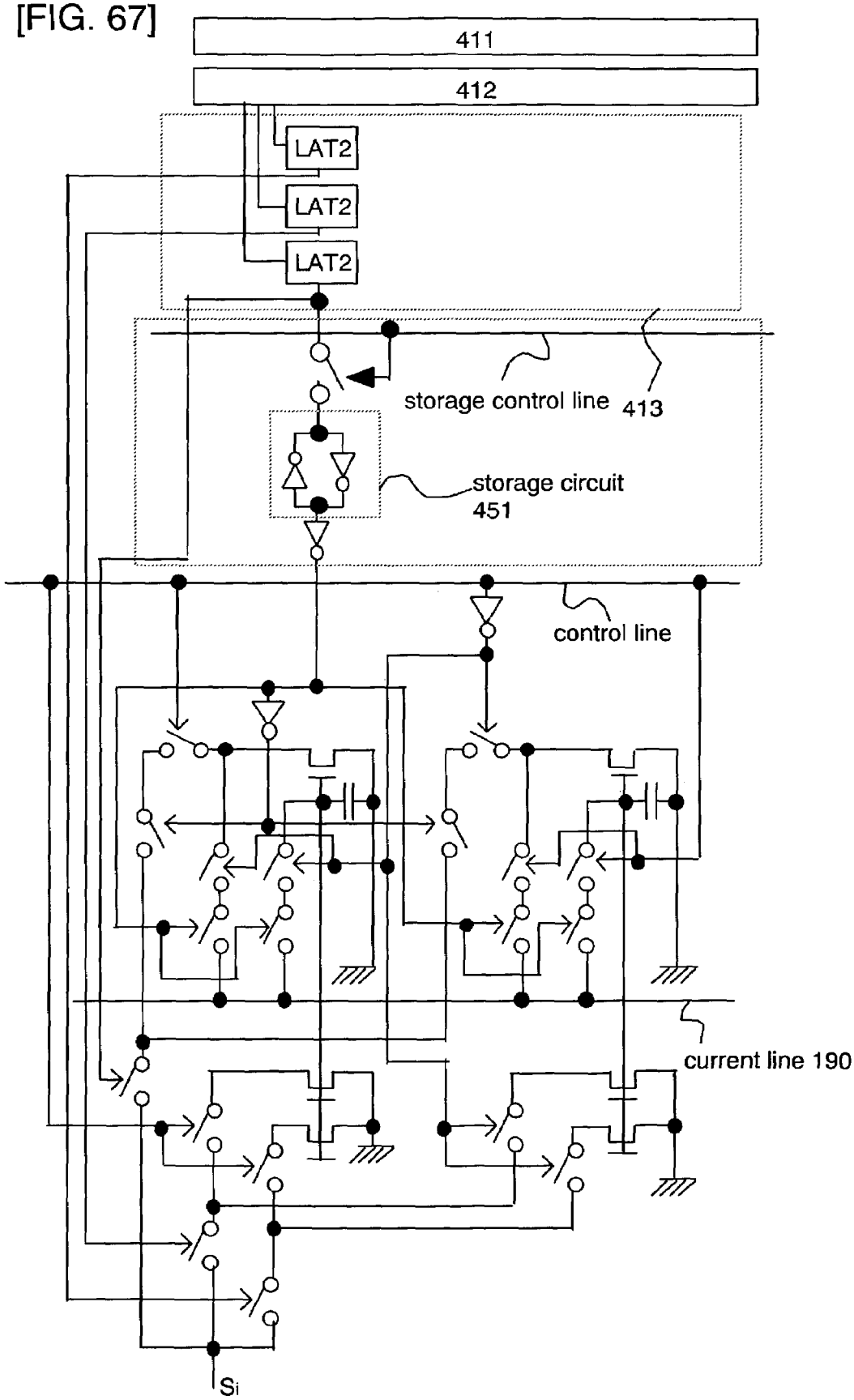

[FIG. 68]
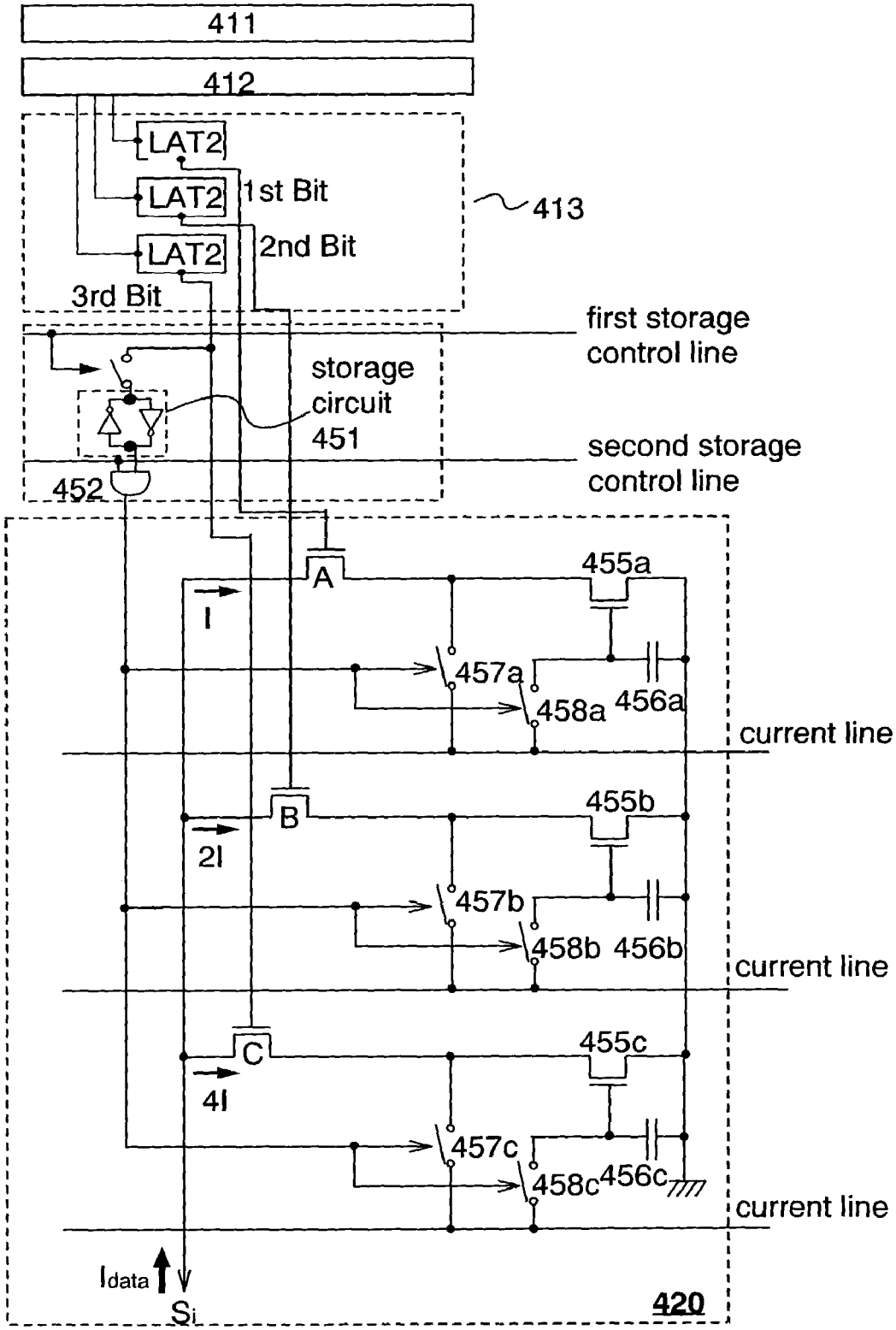

[FIG. 69]
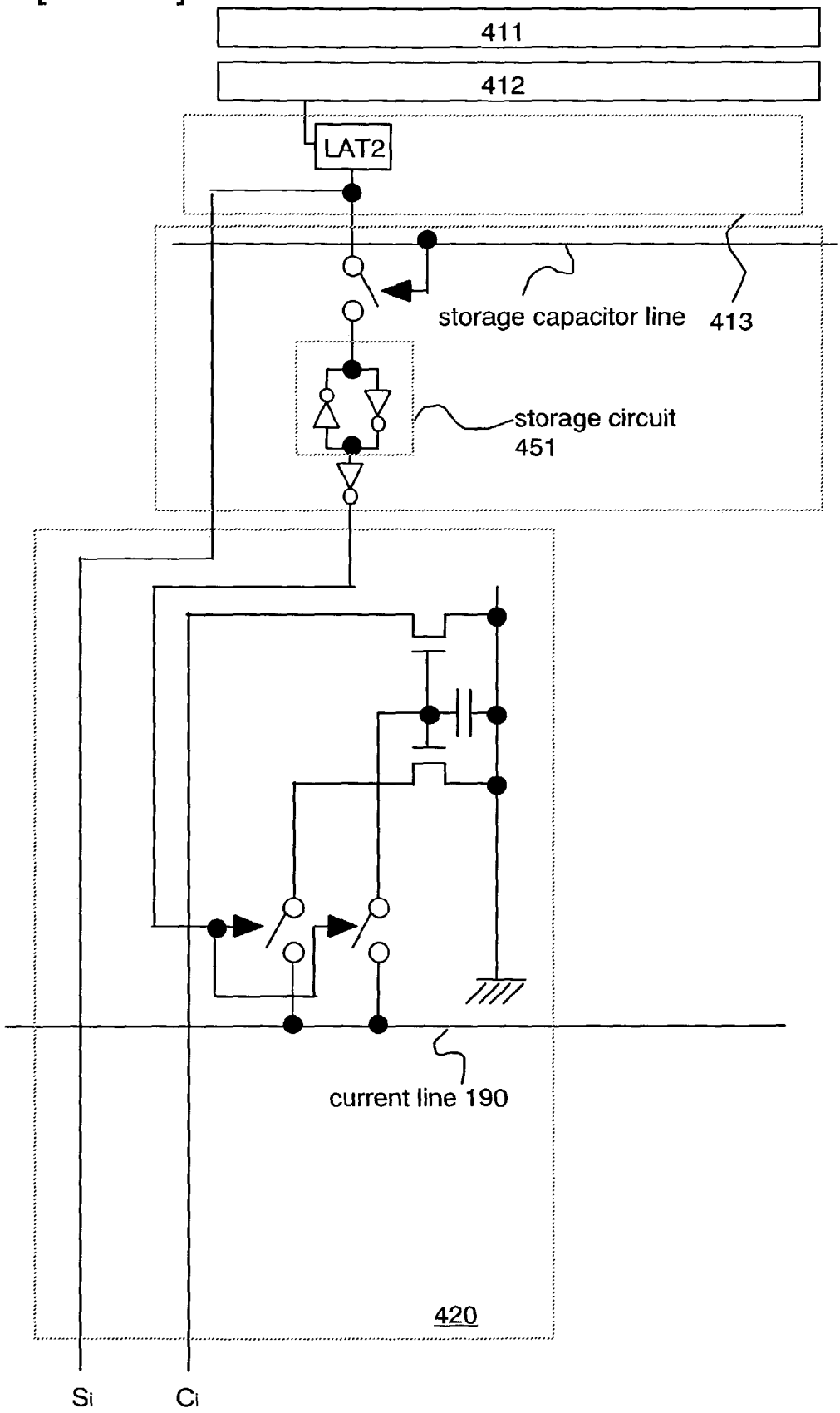

[FIG. 70]
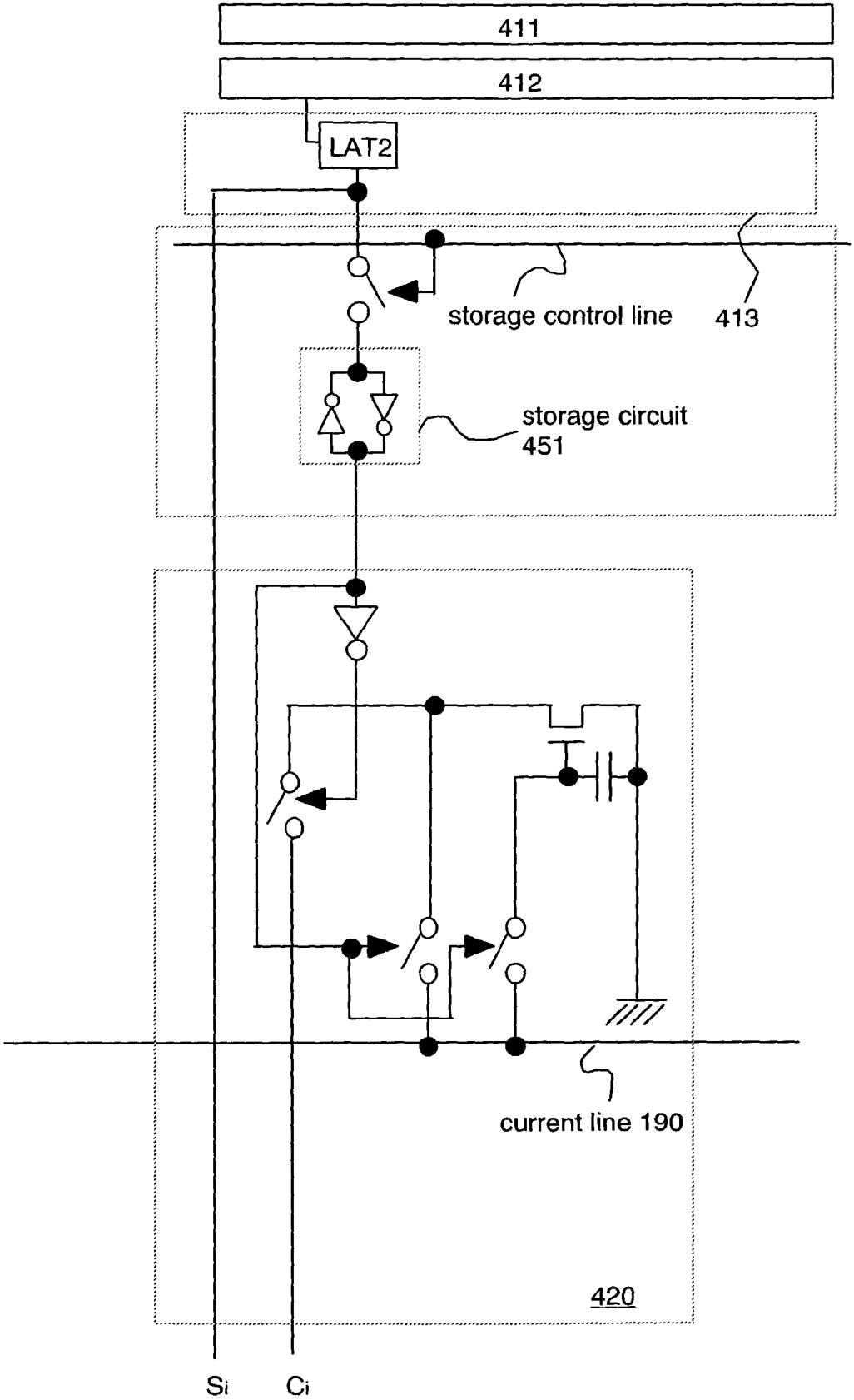

[FIG. 71]
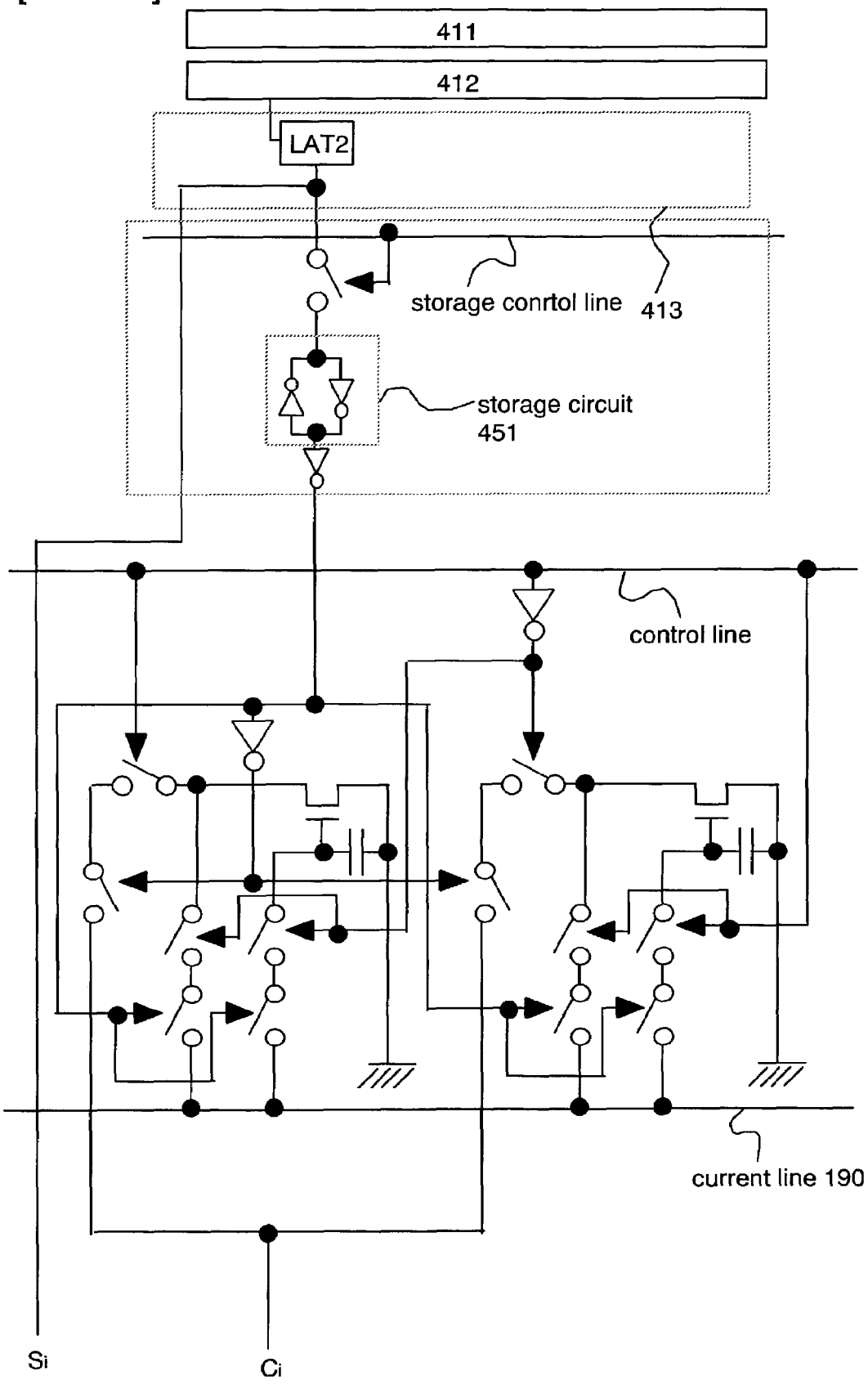

[FIG. 72]
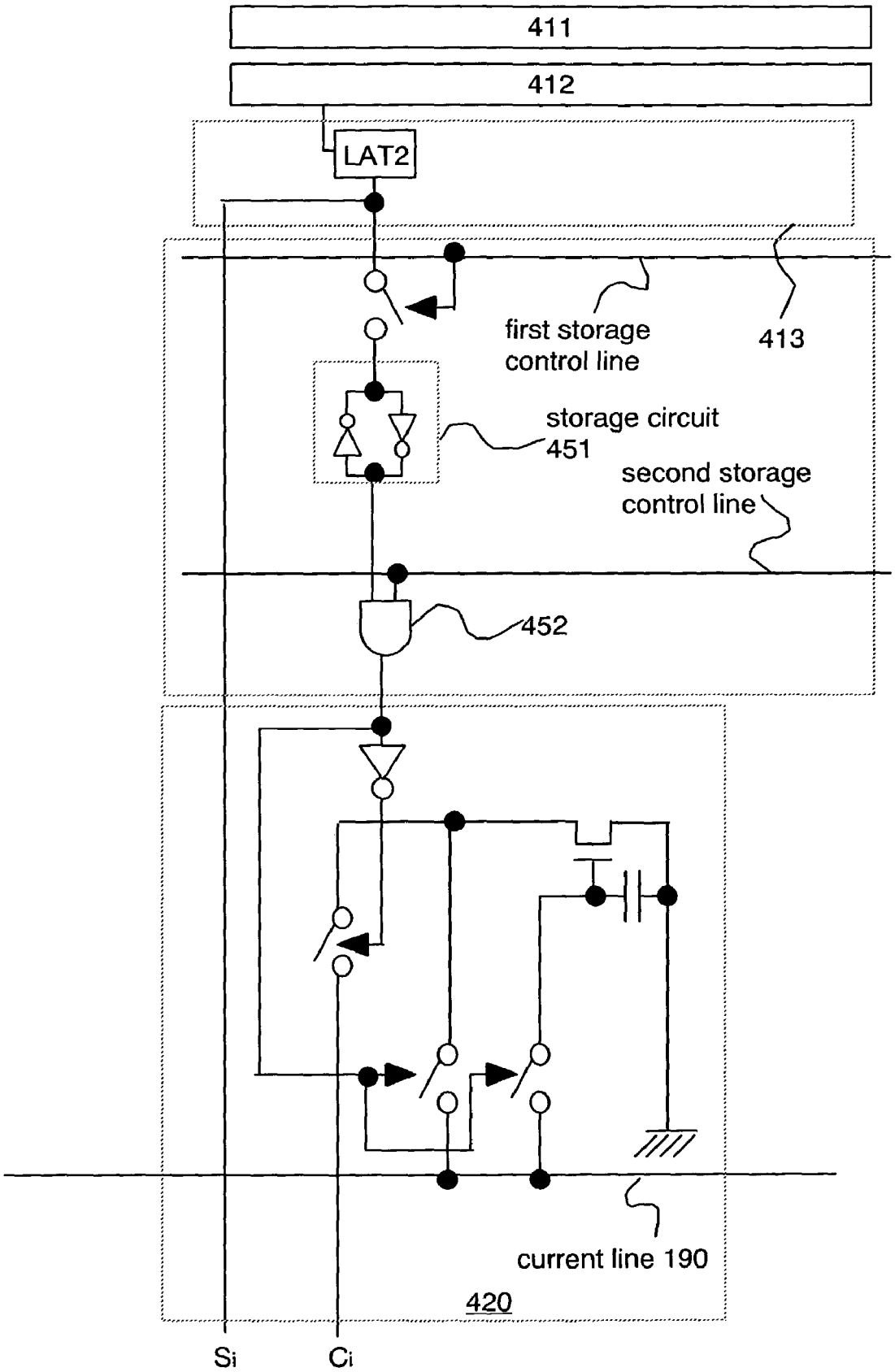

[FIG. 73A]
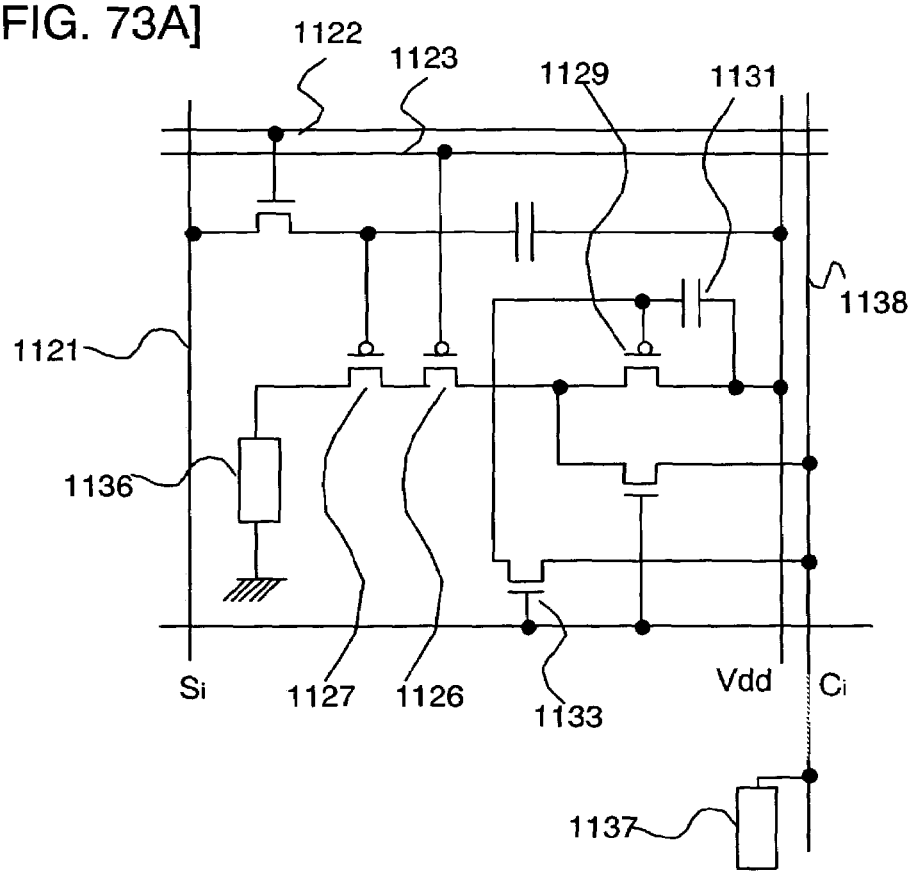
[FIG. 73B]
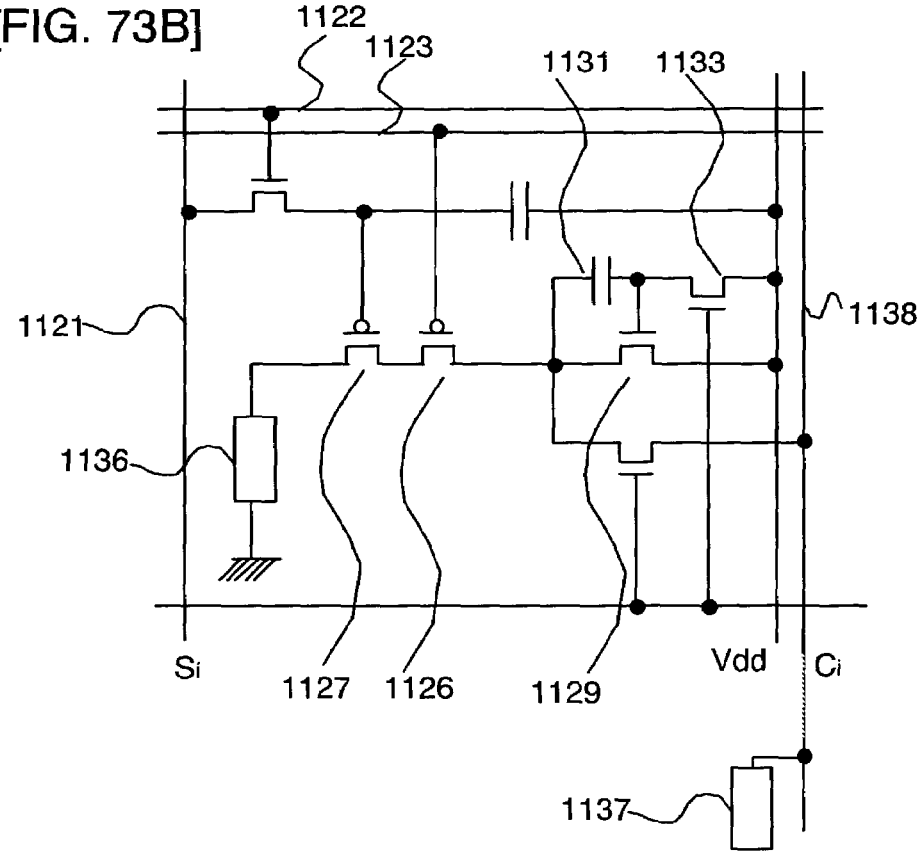

[FIG. 74]
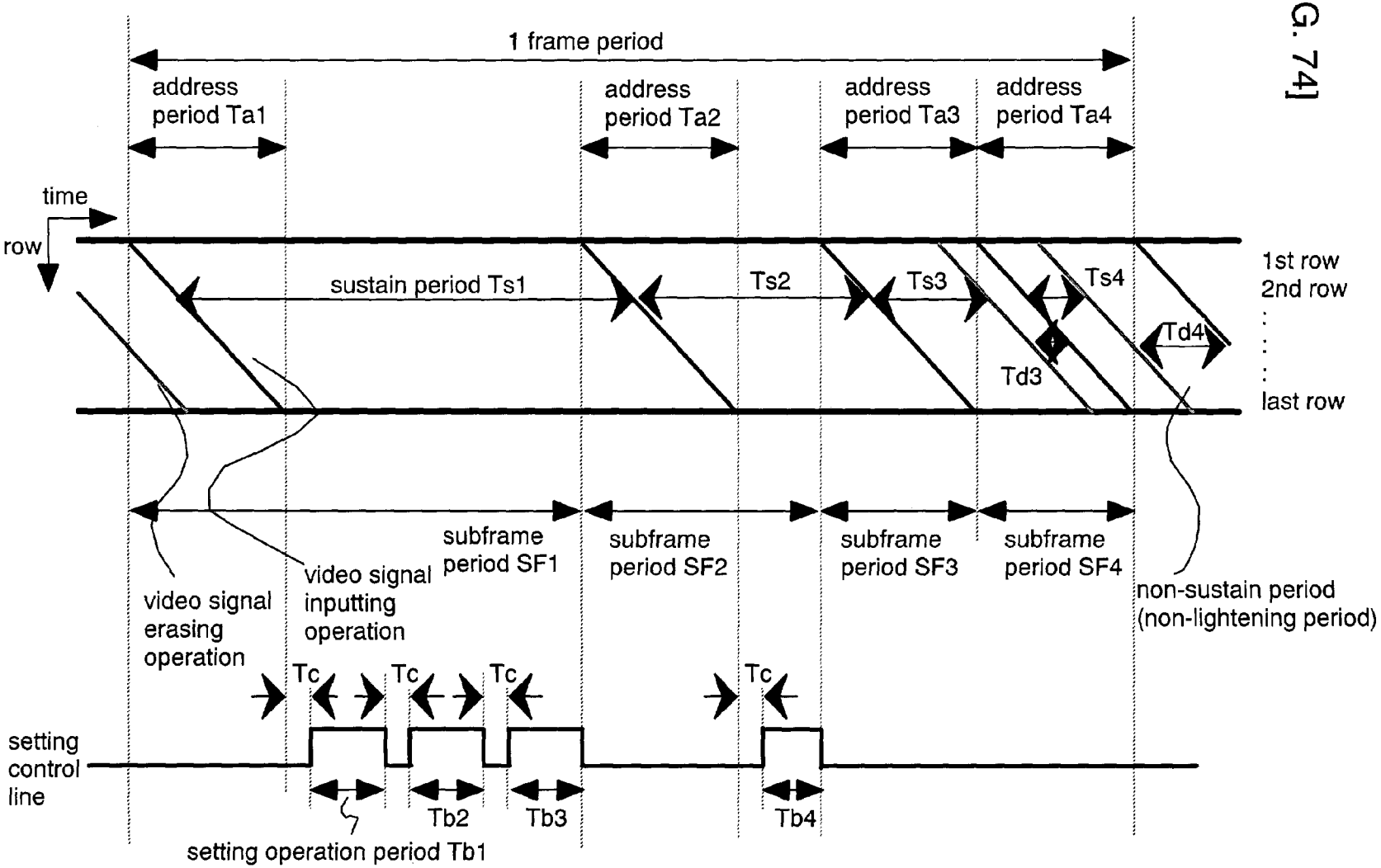

[FIG. 75]
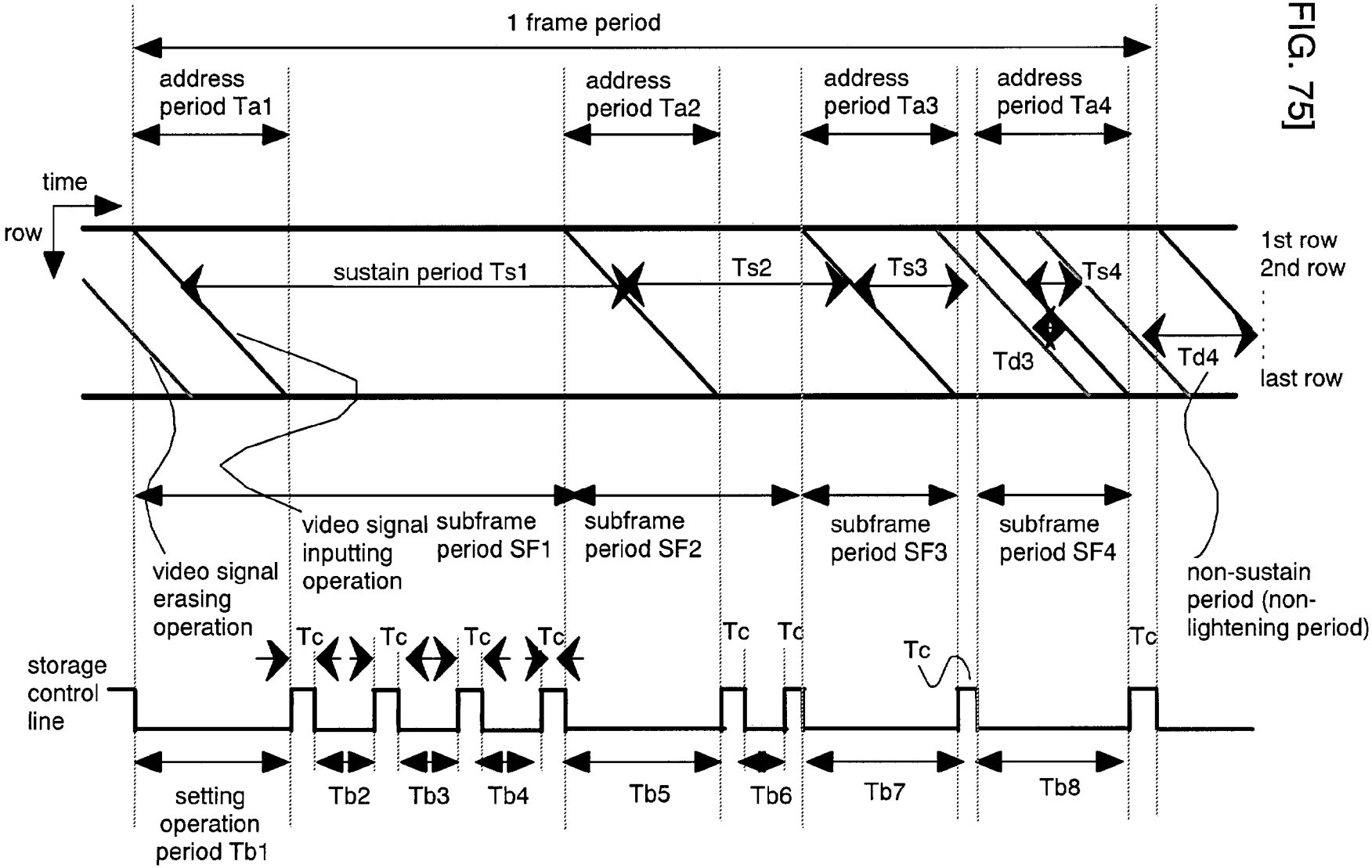

[FIG. 76]
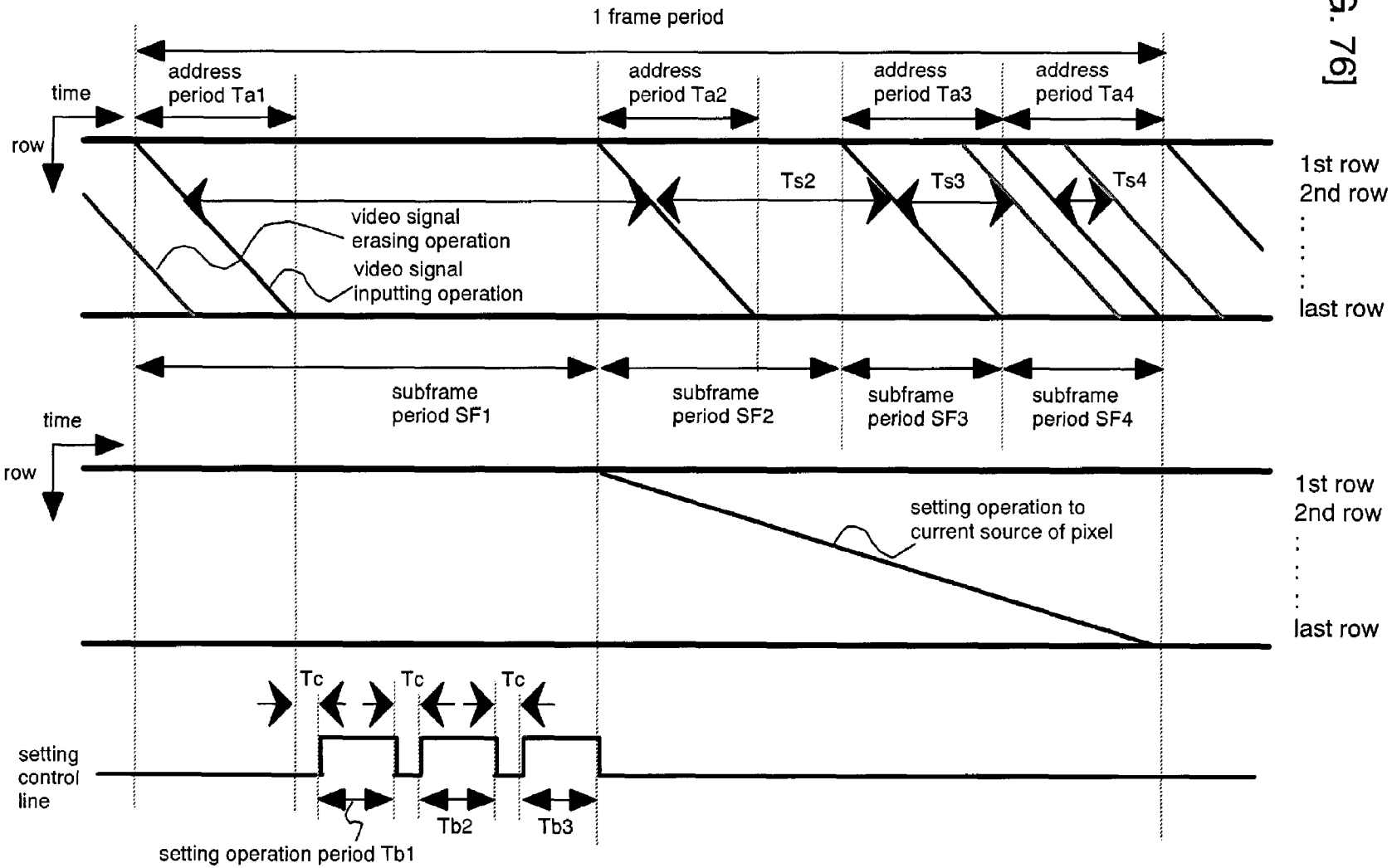

[FIG. 77]
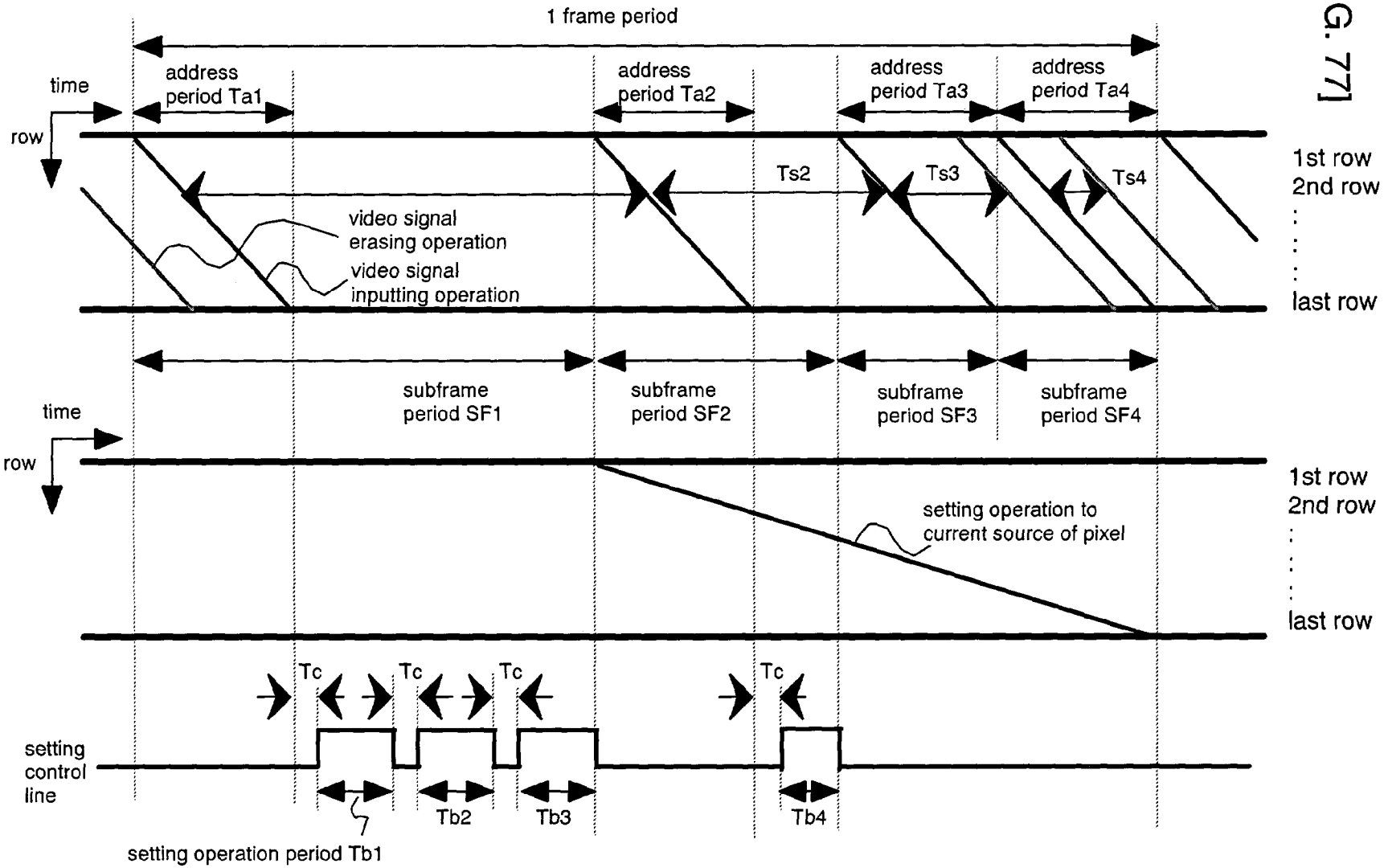

[FIG. 78]
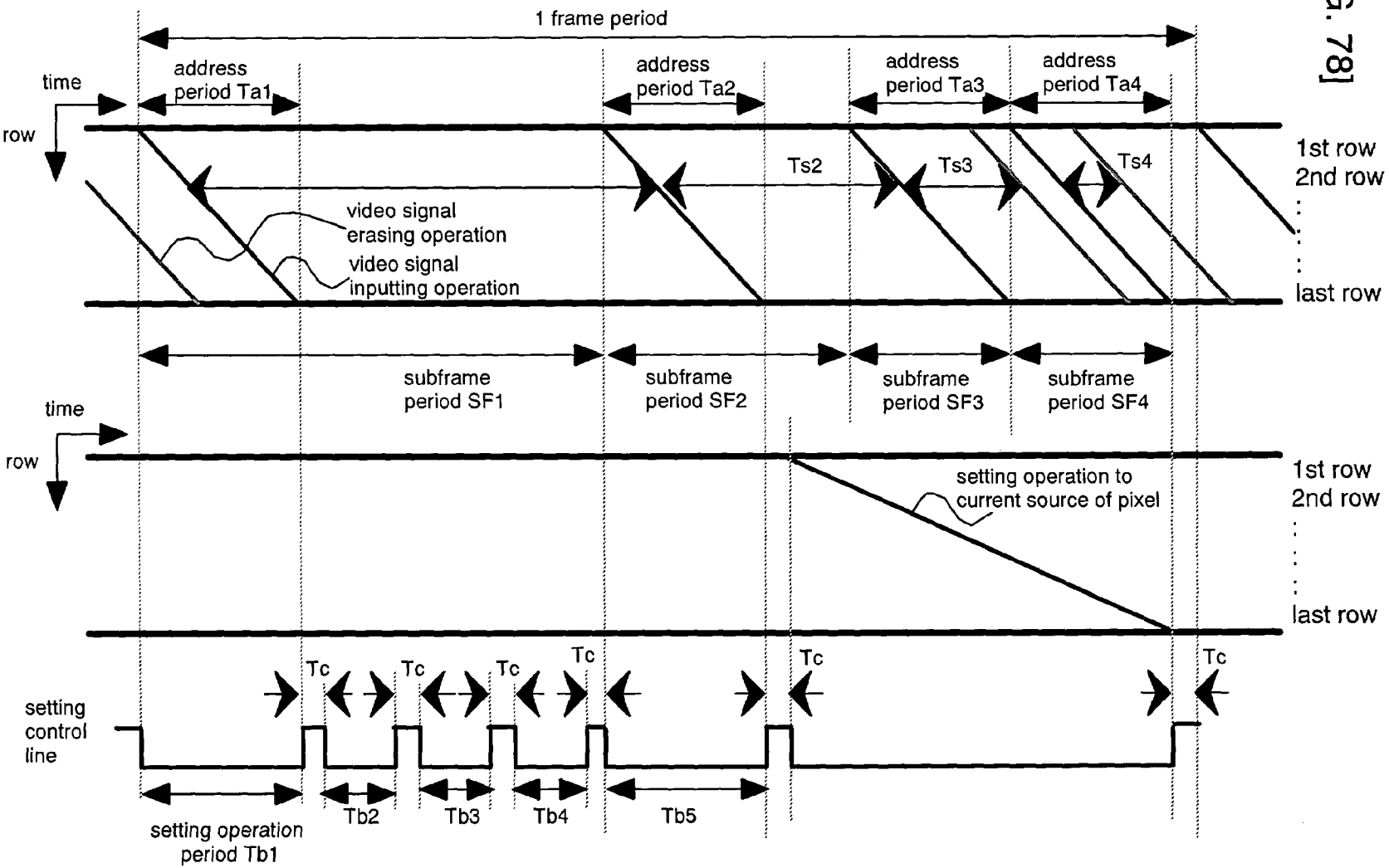

[FIG. 79]
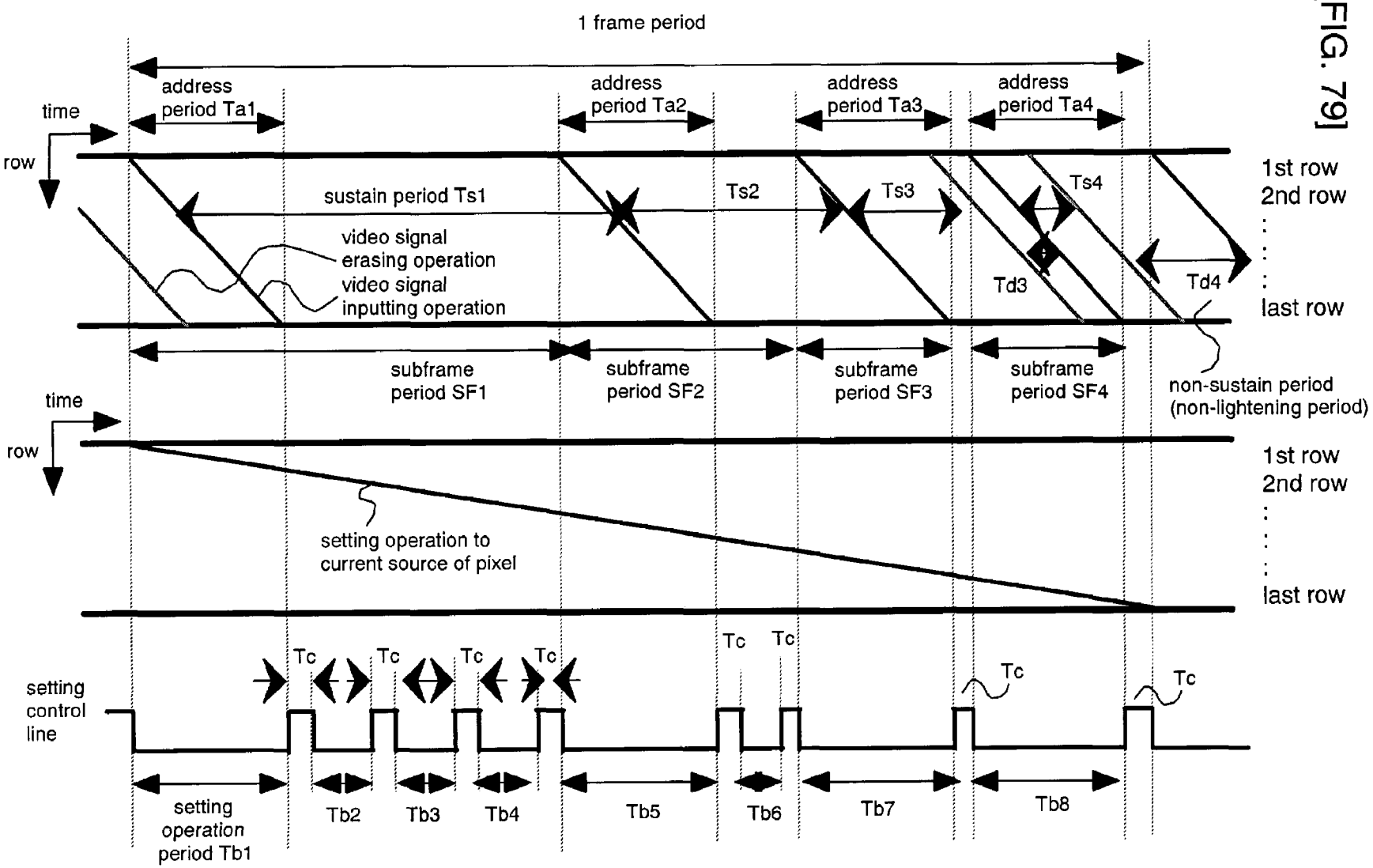

[FIG. 80]
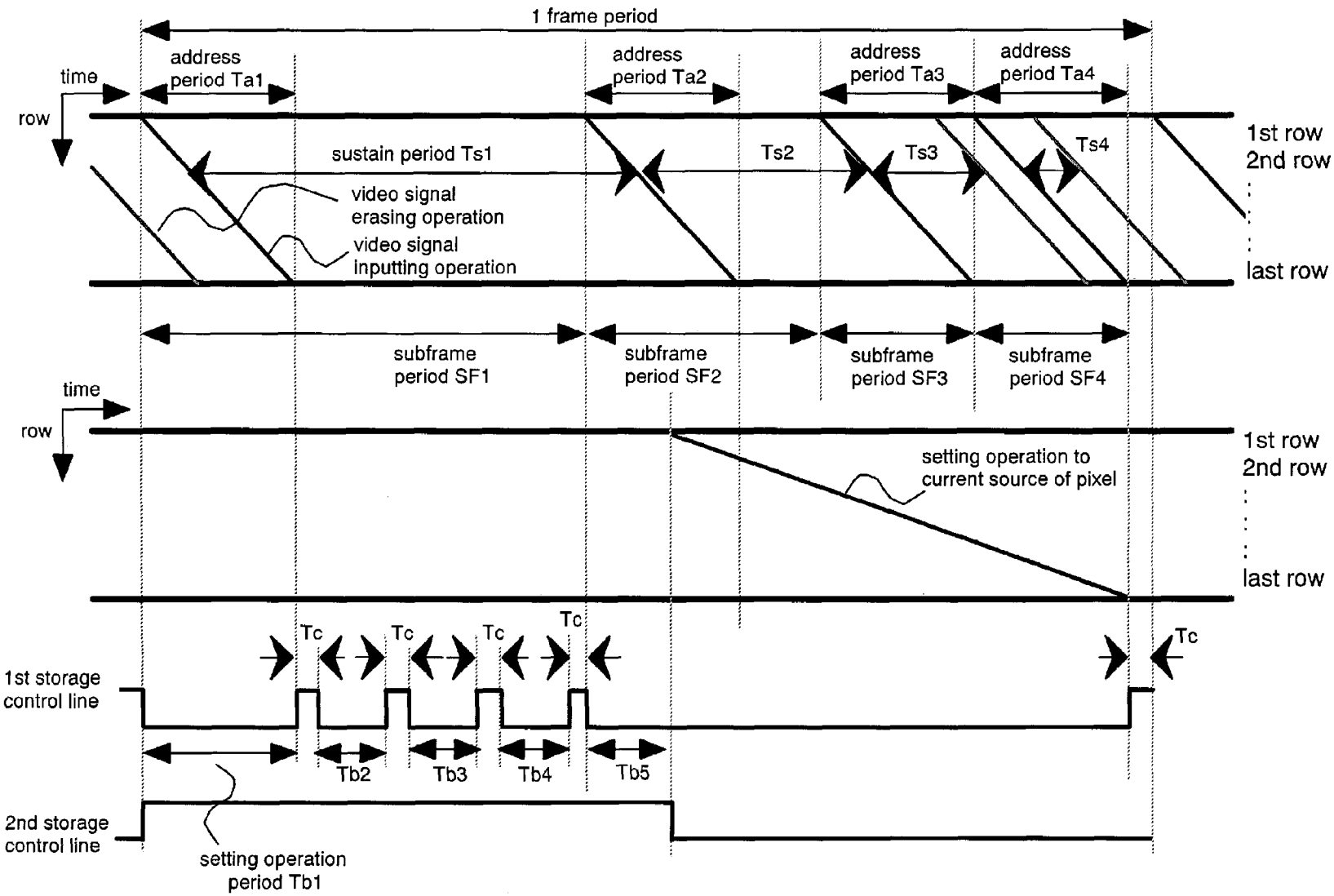

[FIG. 81]
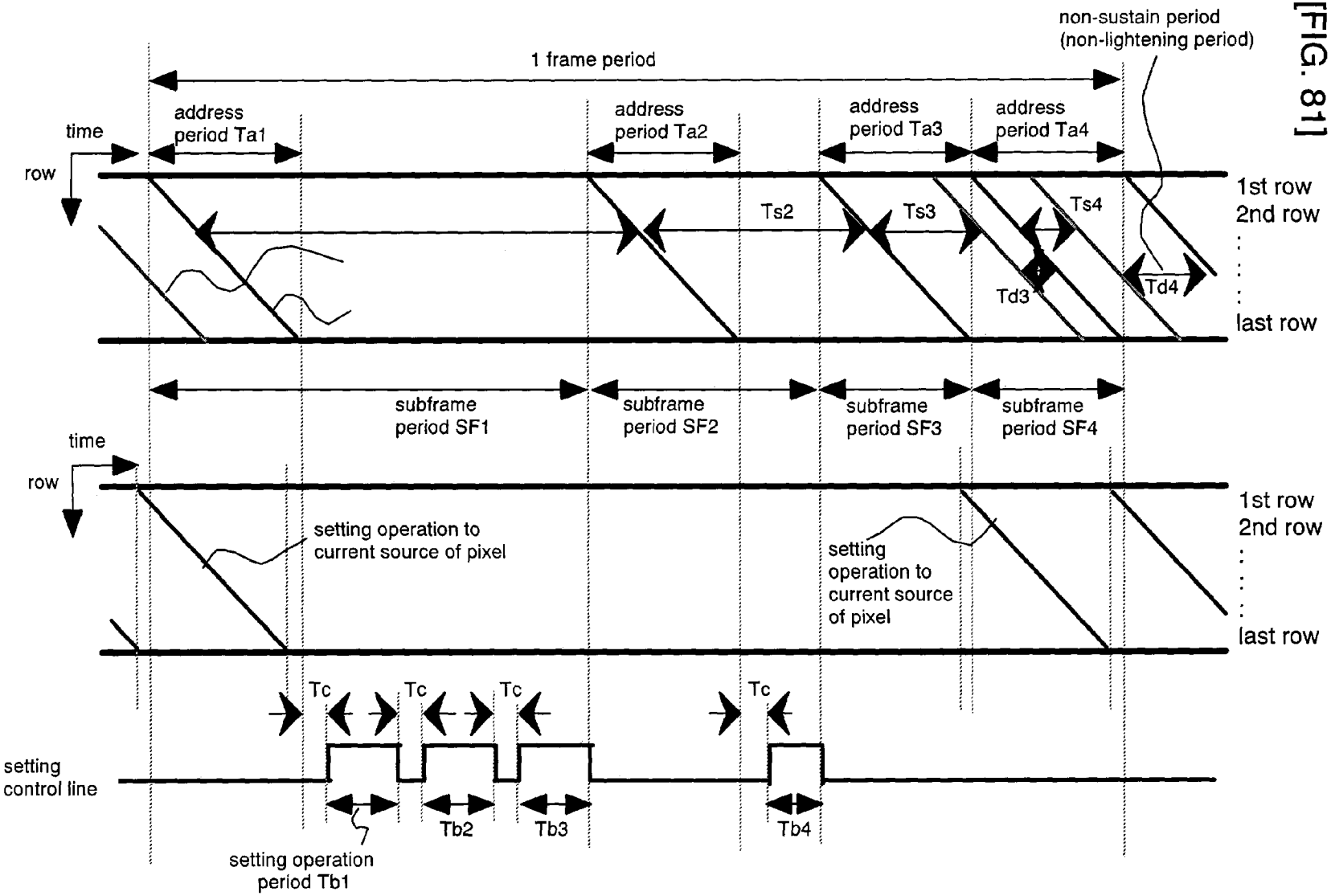

[FIG. 82]
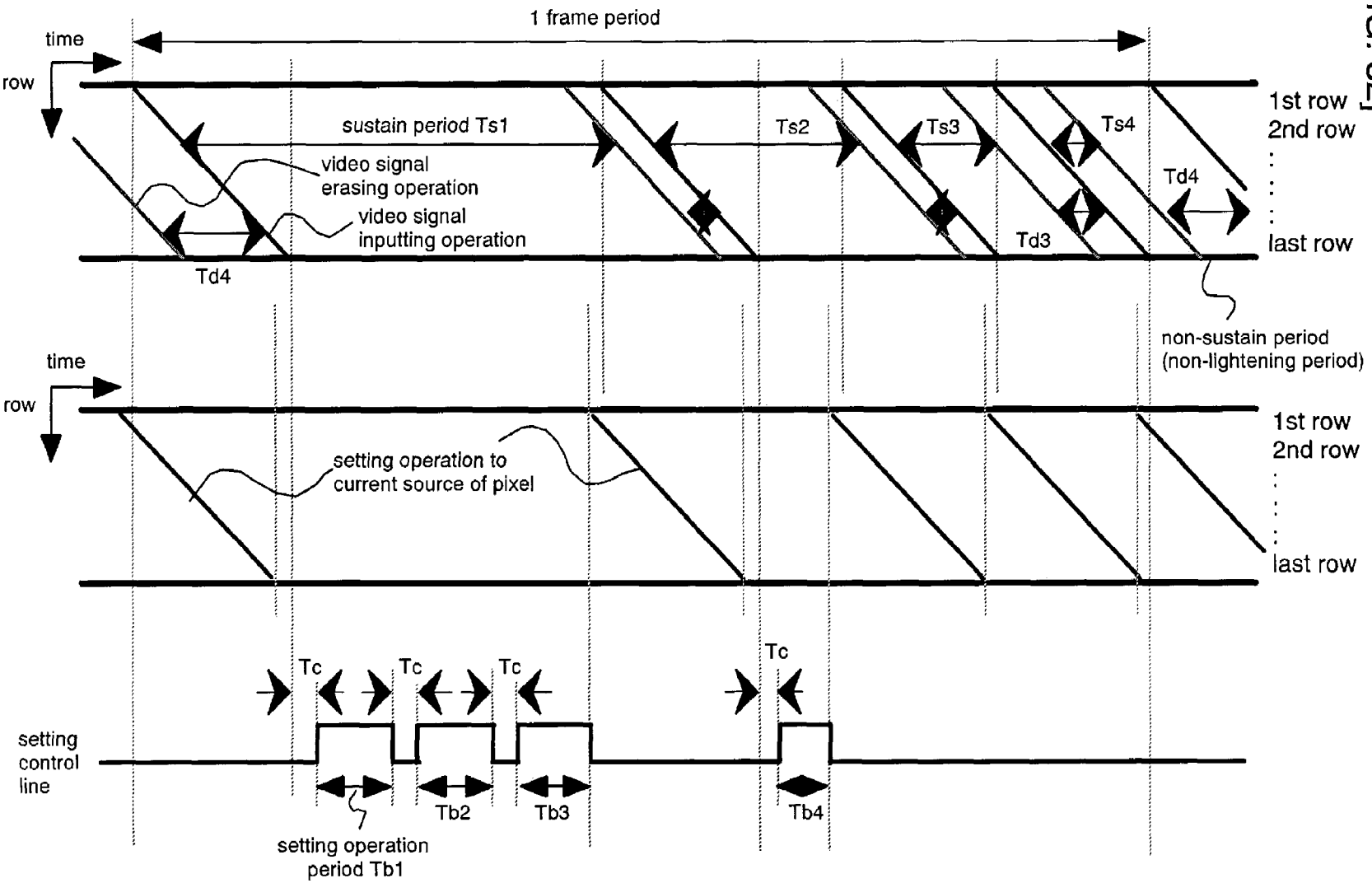

[FIG. 83]
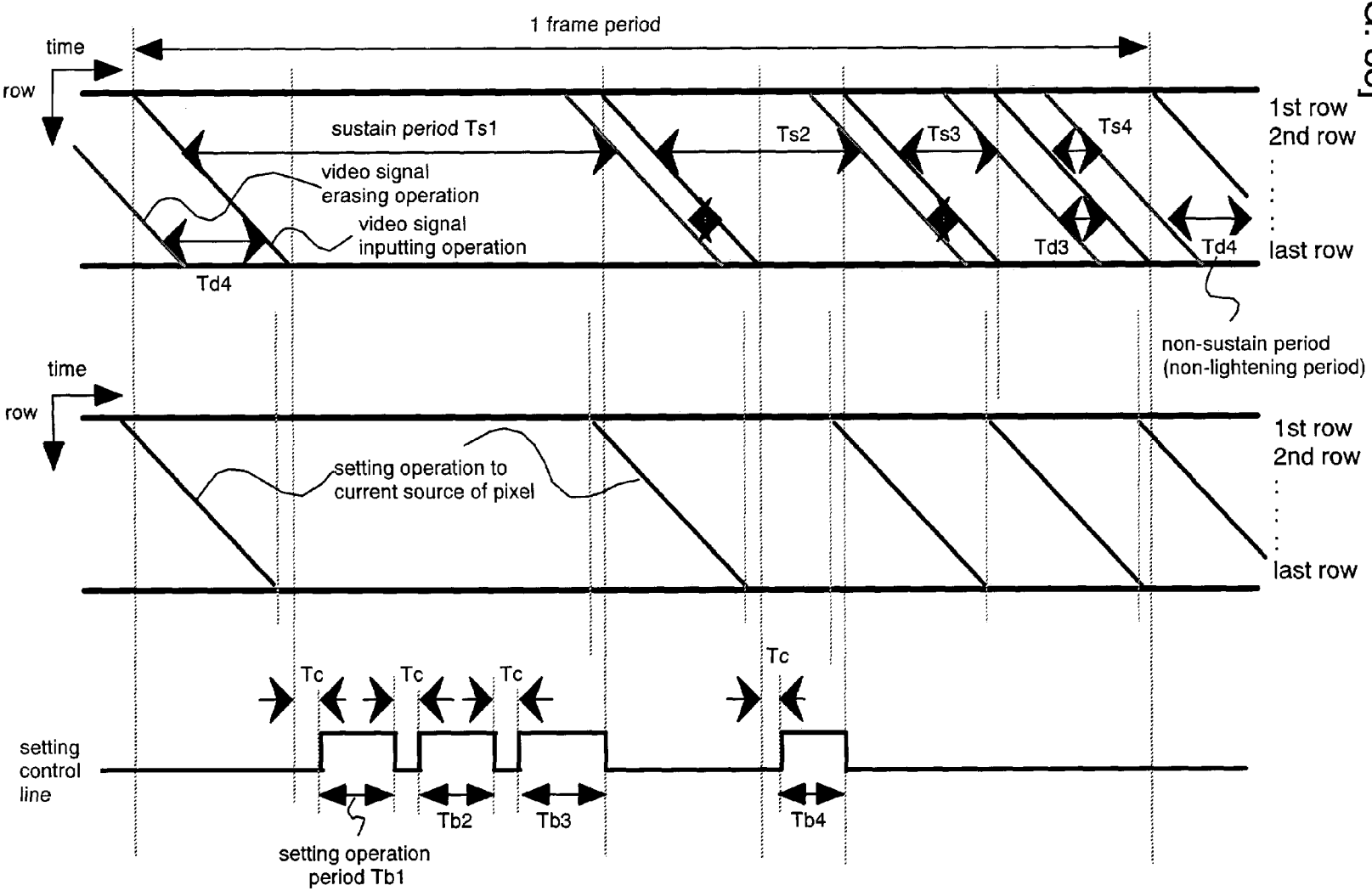

[FIG. 84]
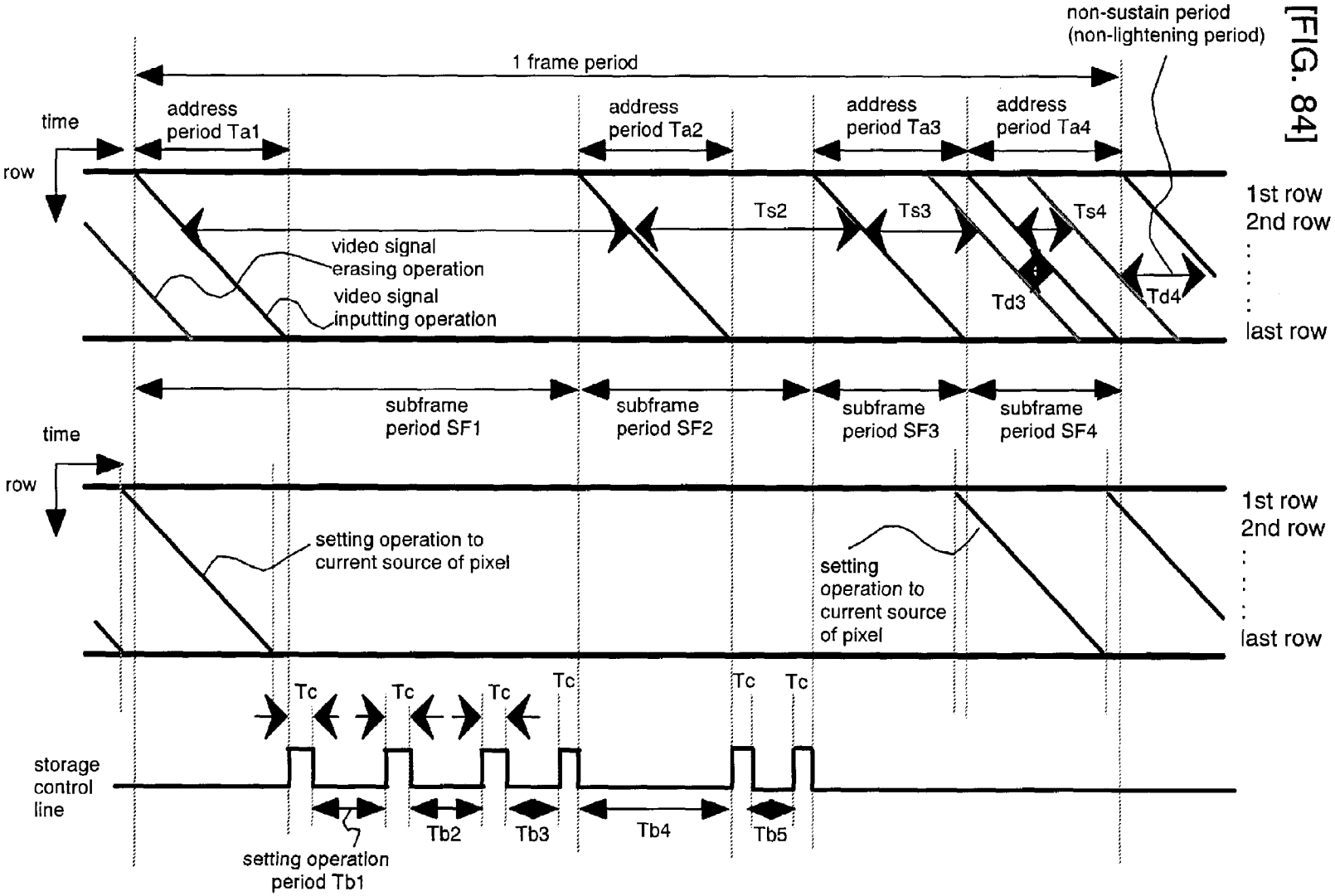

[FIG. 85]
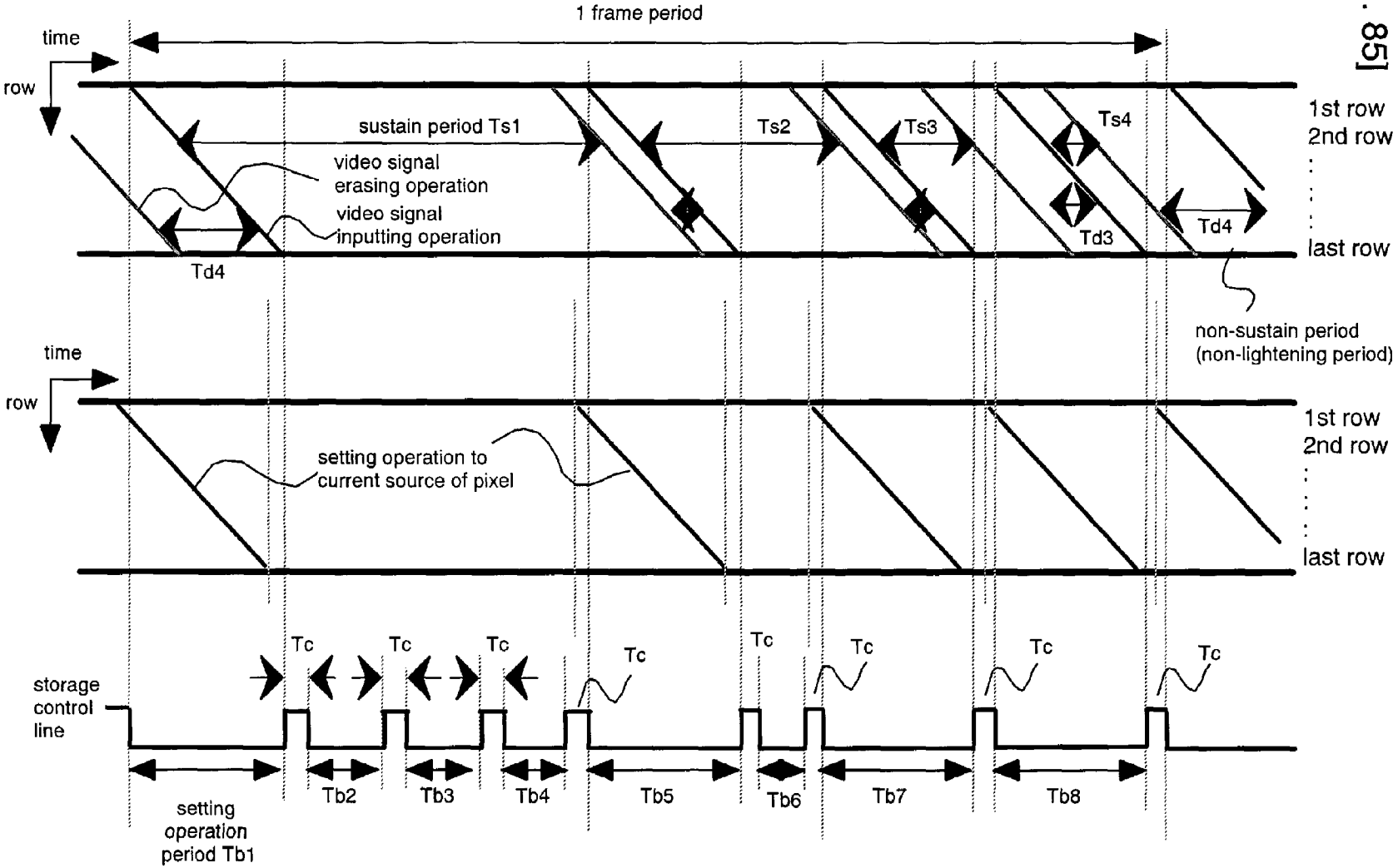

[FIG. 86]
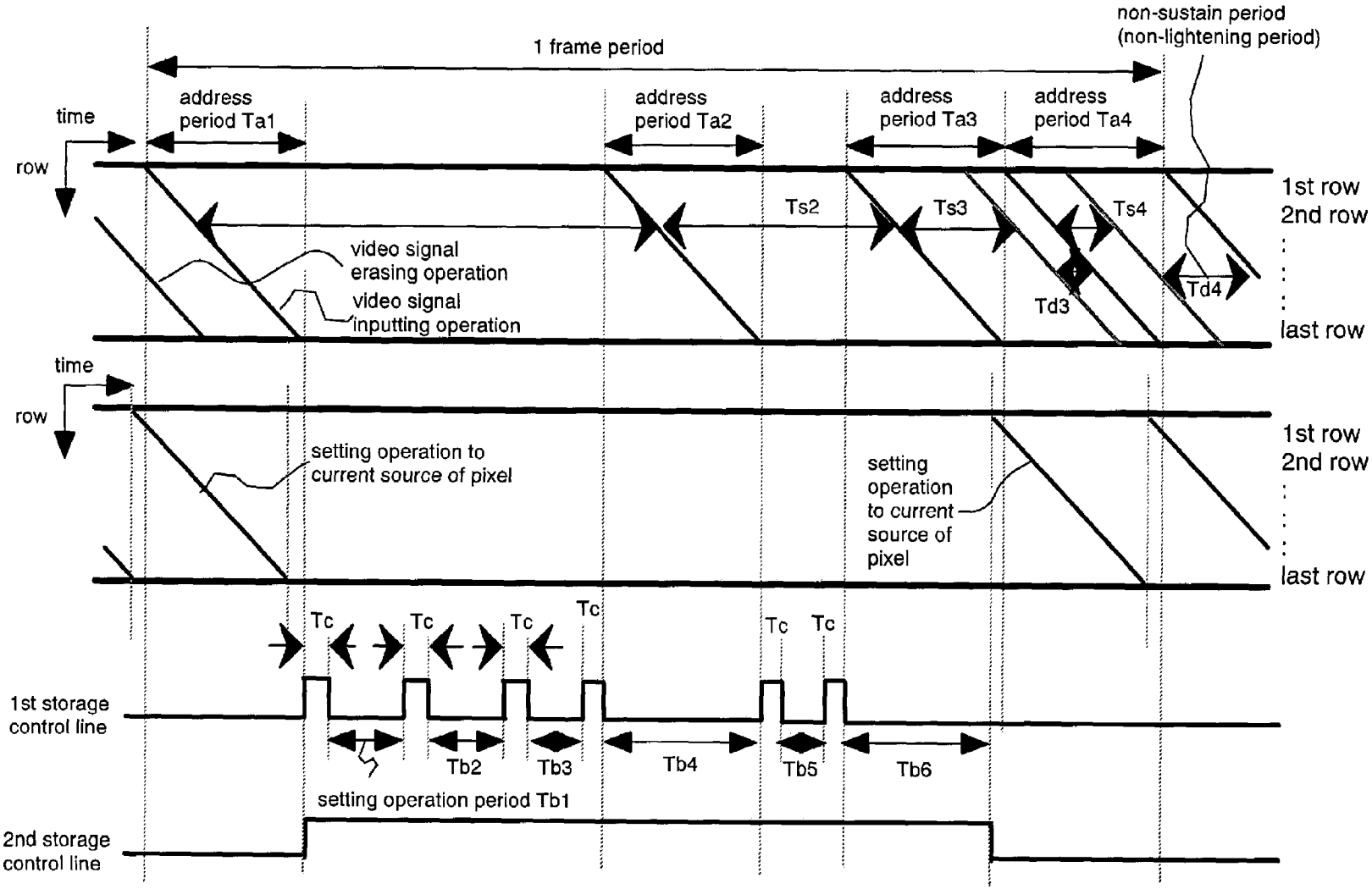

[FIG. 87]
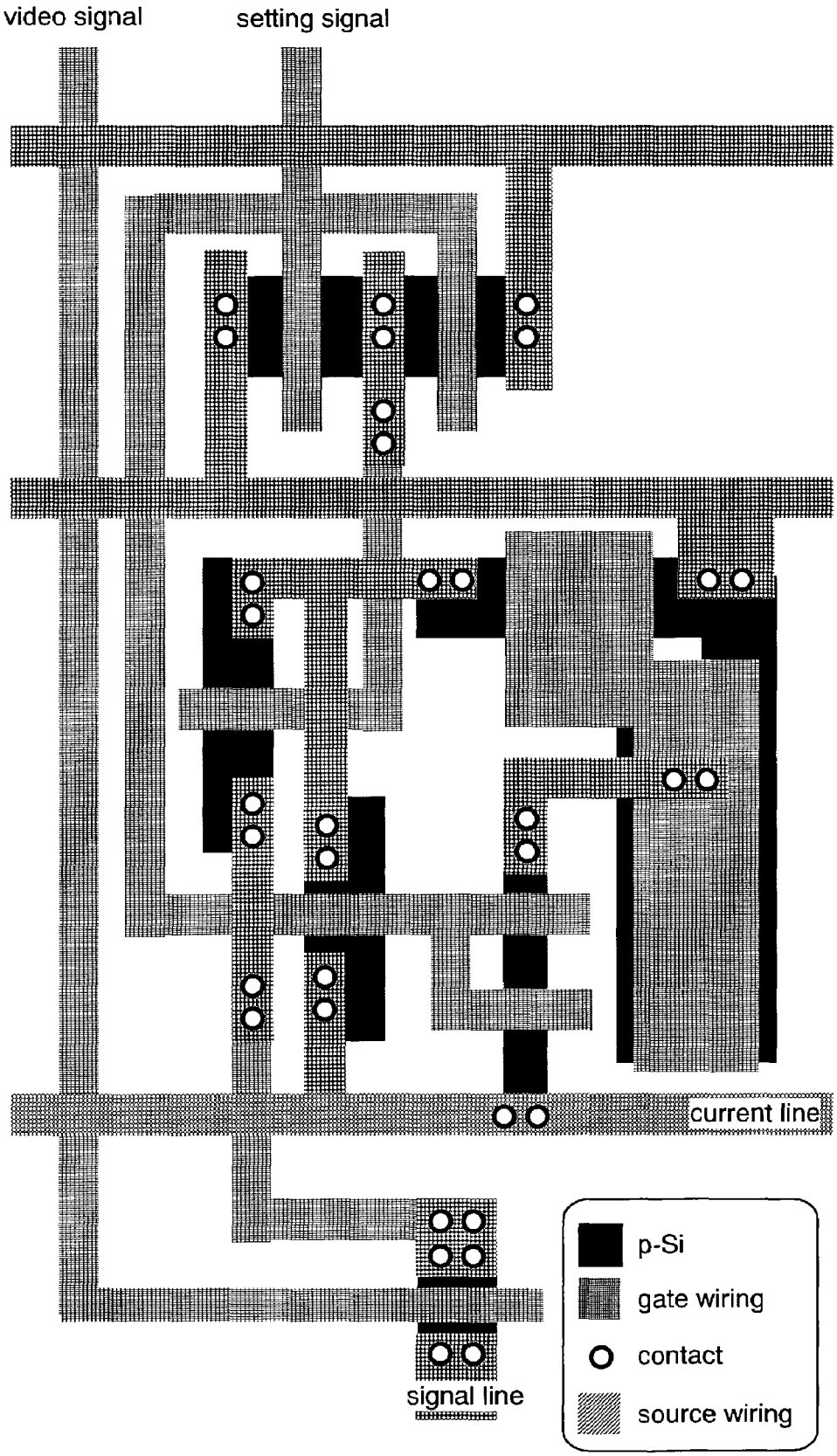

[FIG. 88]
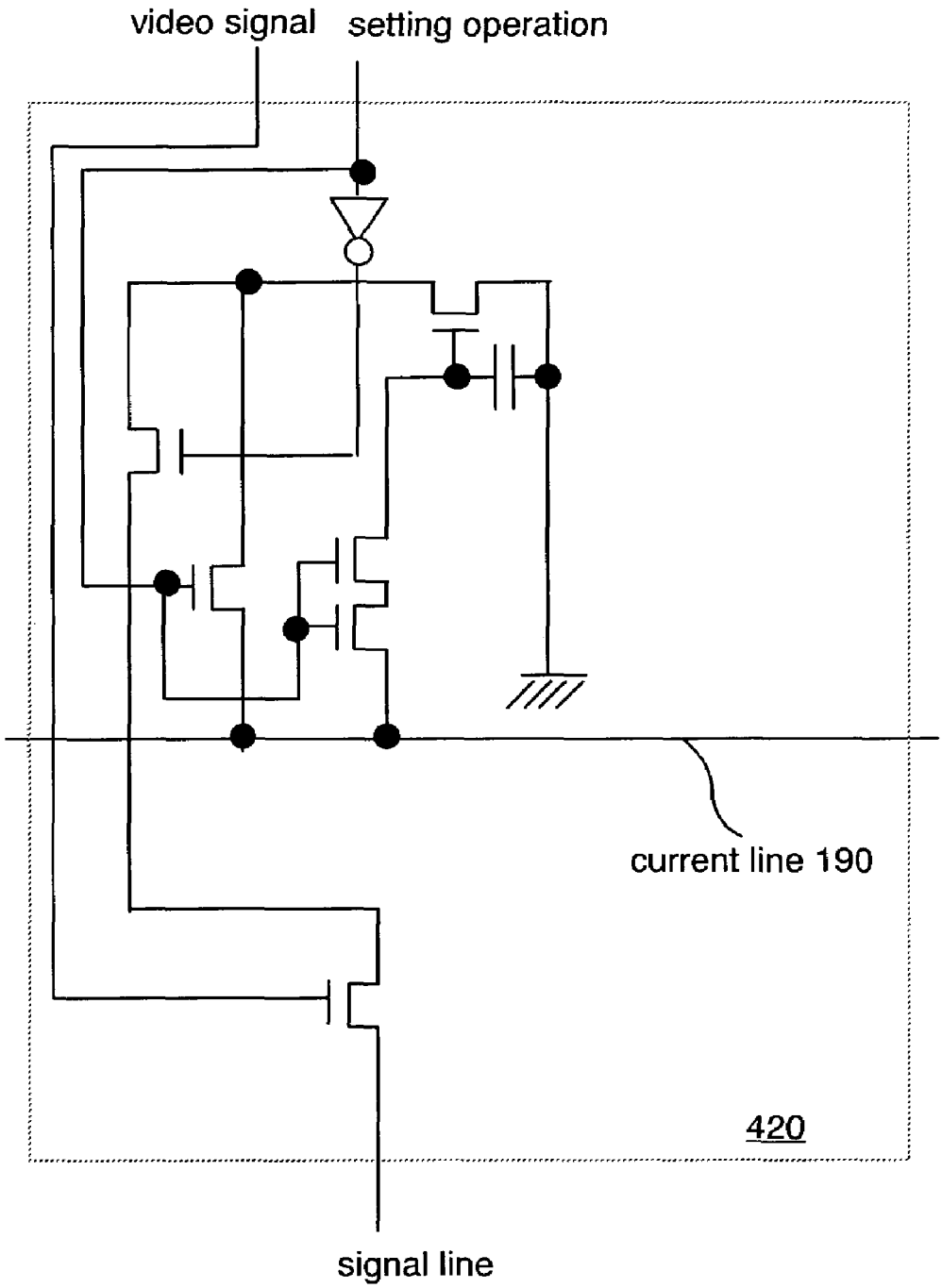

SIGNAL LINE DRIVER CIRCUIT, LIGHT EMITTING DEVICE AND DRIVING METHOD THEREOF

TECHNICAL FIELD

The present invention relates to a technique of a signal line driver circuit. Further, the present invention relates to a light emitting device including the signal line driver circuit.

BACKGROUND ART

Recently, display devices for performing image display are being developed. Liquid crystal display devices that perform image display by using a liquid crystal element are widely used as display devices because of advantages of high image quality, thinness, lightweight, and the like.

In addition, light emitting devices using self-light emitting elements as light emitting elements are recently being developed. The light emitting device has characteristics of, for example, a high response speed suitable for motion image display, low voltage, and low power consumption, in addition to advantages of existing liquid crystal display devices, and thus, attracts a great deal of attention as the next generation display device.

As gradation representation methods used in displaying a multi-gradation image on a light emitting device, an analog gradation method and a digital gradation method are given. The former analog gradation method is a method in which the gradation is obtained by analogously controlling the magnitude of a current that flows to a light emitting element. The latter digital gradation method is a method in which the light emitting element is driven only in two states thereof: an ON state (state where the luminance is substantially 100%) and an OFF state (state where the luminance is substantially 0%). In the digital gradation method, since only two gradations can be displayed, a method configured by combining the digital gradation method and a different method to display multi-gradation images has been proposed.

When classification is made based on the type of a signal that is input to pixels, a voltage input method and a current input method are given as pixel-driving methods. The former voltage input method is a method in which: a video signal (voltage) that is input to a pixel is input to a gate electrode of a driving element; and the driving element is used to control the luminance of a light emitting element. The latter current input method is a method in which the set signal current is flown to a light emitting element to control the luminance of the light emitting element.

Hereinafter, referring to FIG. 16(A), a brief description will be made of an example of a circuit of a pixel in a light emitting device employing the voltage input method and a driving method thereof. The pixel shown in FIG. 16(A) includes a signal line 501, a scanning line 502, a switching TFT 503, a driving TFT 504, a capacitor element 505, a light emitting element 506, and power sources 507 and 508.

When the potential of the scanning line 502 varies, and the switching TFT 503 is turned ON, a video signal that has been input to the signal line 501 is input to a gate electrode of the driving TFT 504. According to the potential of the input video signal, a gate-source voltage of the driving TFT 504 is determined, and a current flowing between the source and the drain of the driving TFT 504 is determined. This current is supplied to the light emitting element 506, and the light emitting element 506 emits light. As a semiconductor device for driving the light emitting element, a polysilicon transistor is used. However, the polysilicon transistor is prone to variation in electrical characteristics, such as a threshold value and an ON current, due to defects in a grain boundary. In the pixel shown in FIG. 16(A), if characteristics of the driving TFT 504 vary in units of the pixel, even when identical video signals have been input, the magnitudes of the corresponding drain currents of the driving TFTs 504 are different. Thus, the luminance of the light emitting element 506 varies.

To solve the problems described above, a desired current may be input to the light emitting element, regardless of the characteristics of the TFTs for driving the light emitting element. From this viewpoint, the current input method has been proposed which can control the magnitude of a current that is supplied to a light emitting element regardless of the TFT characteristics.

Next, referring to FIGS. 16(B) and 17, a brief description will be made of a circuit of a pixel in a light emitting device employing the current input method and a driving method thereof. The pixel shown in FIG. 16(B) includes a signal line 601, first to third scanning lines 602 to 604, a current line 605, TFTs 606 to 609, a capacitor element 610, and a light emitting element 611. A current source circuit 612 is disposed to each signal line (each column).

Operations of from video signal-writing to light emission will be described by using FIG. 17. In FIG. 17, reference numerals denoting respective portions conform to those shown in FIG. 16. FIGS. 17(A) to 17(C) schematically show current paths. FIG. 17(D) shows the relationship between currents flowing through respective paths during a write of a video signal, and FIG. 17(E) shows a voltage accumulated in the capacitor element 610 also during the write of a video signal, that is, a gate-source voltage of the TFT 608.

First, a pulse is input to the first and second scanning lines 602 and 603 to turn the TFTs 606 and 607 ON. A signal current flowing through the signal line 601 at this time will be referred to as $I_{data}$. As shown in FIG. 17(A), since the signal current $I_{data}$ is flowing through the signal line 601, the current separately flows through current paths $I_1$ and $I_2$ in the pixel. FIG. 17(D) shows the relationship between the currents. Needless to say, the relationship is expressed as $I_{data}=I_1+I_2$.

The moment the TFT 606 is turned ON, no charge is yet accumulated in the capacitor element 610, and thus, the TFT 608 is OFF. Accordingly, $I_2=0$ and $I_{data}=I_1$ are established. In the moment, the current flows between electrodes of the capacitor element 610, and charge accumulation is performed in the capacitor element 610.

Charge is gradually accumulated in the capacitor element 610, and a potential difference begins to develop between both the electrodes (FIG. 17(E)). When the potential difference of both the electrodes has reached $V_{th}$ (point A in FIG. 17(E)), the TFT 608 is turned ON, and $I_2$ occurs. As described above, since $I_{data}=I_1+I_2$ is established, while $I_1$ gradually decreases, the current keeps flowing, and charge accumulation is continuously performed in the capacitor element 610.

In the capacitor element 610, charge accumulation continues until the potential difference between both the electrodes, that is, the gate-source voltage of the TFT 608 reaches a desired voltage. That is, charge accumulation continues until the voltage reaches a level at which the TFT 608 can allow the current $I_{data}$ to flow. When charge accumulation terminates (B point in FIG. 17(E)), the current $I_1$ stops flowing. Further, since the TFT 608 is fully ON, $I_{data}=I_2$ is established (FIG. 17(B)). According to the operations described above, the operation of writing the signal to the pixel is completed. Finally, selection of the first and second scanning lines 602 and 603 is completed, and the TFTs 606 and 607 are turned OFF.

Subsequently, a pulse is input to the third scanning line 604, and the TFT 609 is turned ON. Since VGS that has been just written is held in the capacitor element 610, the TFT 608 is already turned ON, and a current identical to $I_{data}$ flows thereto from the current line 605. Thus, the light emitting element 611 emits light. At this time, when the TFT 608 is set to operate in a saturation region, even if the source-drain voltage of the TFT 608 varies, a light emitting current IEL flowing to the light emitting element 611 flows continuously.

As described above, the current input method refers to a method in which the drain current of the TFT 609 is set to have the same current value as that of the signal current $I_{data}$ set in the current source circuit 612, and the light emitting element 611 emits light with the luminance corresponding to the drain current. By using the thus structured pixel, influence of variation in characteristics of the TFTs constituting the pixel is suppressed, and a desired current can be supplied to the light emitting clement.

Incidentally, in the light emitting device employing the current input method, a signal current corresponding to a video signal needs to be precisely input to a pixel. However, when a signal line driver circuit (corresponding to the current source circuit 612 in FIG. 16) used to input the signal current to the pixel is constituted by polysilicon transistors, variation in characteristics thereof occurs, thereby also causing variation in characteristics of the signal current.

That is, in the light emitting element employing the current input method, variation in characteristics of TFTs constituting the pixel and the signal line driver circuit need to be suppressed. However, while the influence of variation in characteristics of the TFTs constituting the pixel can be suppressed by using the pixel having the structure of FIG. 16(B), suppression of the influence of variation in characteristics of the TFTs constituting the signal line driver circuit is difficult.

Hereinafter, using FIG. 18, a brief description will be made of the structure and operation of a current source circuit disposed in the signal line driver circuit that drives the pixel employing the current input method.

The current source circuit 612 shown in FIGS. 18(A) and 18(B) corresponds to the current source circuit 612 of FIG. 16(B). The current source circuit 612 includes constant current sources 555 to 558. The constant current sources 555 to 558 are controlled by signals that are input via respective terminals 551 to 554. The magnitudes of currents supplied from the constant current sources 555 to 558 are different from one another, and the ratio thereof is set to 1:2:4:8.

FIG. 18(B) shows a circuit structure of the current source circuit 612, in which the constant current sources 555 to 558 shown therein correspond to transistors. The ratio of ON currents of the transistors 555 to 558 is set to 1:2:4:8 according to the ratio (1:2:4:8) of the value of L (gate length)/W (gate width). The current source circuit 612 then can control the current magnitudes at $2^4$=16 levels. Specifically, currents having 16-gradation analog values can be output for 4-bit digital video signals. Note that the current source circuit 612 is constituted by polysilicon transistors, and is integrally formed with the pixel portion on the same substrate.

As described above, conventionally, a signal line driver circuit incorporated with a current source circuit has been proposed (for example, refer to Non-patent Documents 1 and 2).

In addition, digital gradation methods include a method in which a digital gradation method is combined with an area gradation method to represent multi-gradation images (hereinafter, referred to as area gradation method), and a method in which a digital gradation method is combined with a time gradation method to represent multi-gradation images (hereinafter, referred to as time gradation method). The area gradation method is a method in which one pixel is divided into a plurality of sub-pixels, emission or non-emission is selected in each of the sub-pixels, and the gradation is represented according to a difference between a light emitting area and the other area in a single pixel. The time gradation method is a method in which gradation representation is performed by controlling the emission period of a light emitting element. To be more specific, one frame period is divided into a plurality of subframe periods having mutually different lengths, emission or non-emission of a light emitting element is selected in each period, and the gradation is presented according to a difference in length of light emission time in one frame period. In the digital gradation method, the method in which a digital gradation method is combined with a time gradation method (hereinafter, referred to as time gradation method) is proposed. (For example, refer to Patent Document 1).

[Non-Patent Document 1]

Reiji Hattori & three others, "Technical Report of Institute of Electronics, Information and Communication Engineers", ED 2001–8, pp. 7–14, "Circuit Simulation of Current Specification Type Polysilicon TFT Active Matrix-Driven Organic LED Display"

[Non-Patent Document 2]

Reiji H et al.; "AM-LCD'01", OLED-4, pp. 223–226

[Patent Document 1]

JP 2001-5426 A

DISCLOSURE OF THE INVENTION

In the above-described current source circuit 612, the ON currents of the transistors are set to a ratio of 1:2:4:8 by designing the L/W values. However, in the transistors 555 to 558, variations occur in the threshold value and mobility due to a number of factors for variations in the gate length, gate width, and thickness of a gate insulating film, which are attributed to differences in manufacturing steps and substrates used. This makes it difficult to precisely set the ON currents of the transistors 555 to 558 to 1:2:4:8. That is, depending on the column, variation occurs in the value of the current to be supplied to the pixel.

To precisely set the ON currents of the transistors 555 to 558 to 1:2:4:8 as designed, current source circuits disposed to all the columns need to be identical in characteristics to one another. Specifically, the characteristics of transistors in all current source circuits of the signal line driver circuit need to be arranged identical to one another. However, such arrangement is extremely difficult to be realized.

The present invention has been made in view of the problems described above, and therefore provides a signal line driver circuit capable of suppressing the influence of variation in characteristics of TFTs to thereby supply a desired signal current to a pixel. In addition, the present invention provides a light emitting element capable of suppressing the influence of variation in characteristics of TFTs constituting both the pixel and the driver circuit to thereby supply a desired signal current to a light emitting element by using the pixel having a circuit structure suppressing the influence of variation in characteristics of TFTs.

The present invention provides a signal line driver circuit having a novel structure which is provided with an electric circuit (referred to as current source circuit in this specification) that suppresses the influence of variation in characteristics of TFTs to flow a desired constant current. In addition, the present invention provides a light emitting device including the signal line driver circuit.

The present invention provides a signal line driver circuit in which a current source circuit is disposed in each column (each signal line or the like).

According to the present invention, the current source circuit disposed in each signal line (each column) is set to supply a predetermined signal current by using a reference constant current source. The current source circuit set as above has a capability of supplying a current proportional to the reference constant current source. Consequently, using the current source circuit, the influence of variation in characteristics of the TFTs constituting the signal line driver circuit can be suppressed. A switch for determining whether the set signal current is supplied from the current source circuit to the pixel is controlled by a video signal.

To be more specific, in the case where a signal current proportional to a video signal is required to flow to a signal line, a switch is controlled to determine as to whether the signal current is supplied from the current source circuit to the signal line driver circuit, and the switch is controlled by the video signal. Note that, in this specification, the switch for determining as to whether the signal current is supplied from the current source circuit to the signal line driver circuit is referred to as a signal current control switch.

Note that the reference constant current source may either be formed integrally with the signal line driver circuit on a substrate or be disposed on the outside of the substrate by using an IC. In this case, a constant current serving as a reference current is supplied to the signal line driver circuit from the outside of the substrate.

The outline of the signal line driver circuit of the present invention will be described with reference to FIGS. 1 and 2. FIGS. 1 and 2 each show a signal line driver circuit in the periphery of three signal lines of i-th to (i+2)-th columns.

First, a case where signal currents proportional to video signals are needed to flow to the signal lines will be described.

In FIG. 1, current source circuits 420 are disposed in the respective signal lines (respective columns) in a signal line driver circuit 403. The current source circuits 420 each include a terminal a, a terminal b, and a terminal c. A setting signal is input to the terminal a. A current (reference current) is supplied to the terminal b from a reference constant current source 109 connected to a current line. The terminal c outputs a signal held in the current source circuit 420 via a switch 101 (signal current control switch). That is, the current source circuit 420 is controlled by the setting signal input from the terminal a, the current (reference current) is supplied from the terminal b, and the current proportional to the current (reference current) is output from the terminal c. Note that the switch 101 (signal current control switch) is provided between the current source circuit 420 and a pixel connected to the signal line, and ON/OFF of the switch 101 (signal current control switch) is controlled by the video signal.

Next, using FIG. 2, a description will be made of a signal line driver circuit of the present invention that has a structure different from that shown in FIG. 1. In FIG. 2, two or more current source circuits 420 are disposed for each signal line (each column) in a signal line driver circuit 403. The current source circuit 420 includes a plurality of current source circuits. Here, the current source circuit 420 is assumed to include two current source circuits, namely, a first current source circuit 421 and a second current source circuit 422. The first current source circuit 421 and the second current source circuit 422 each include a terminal a, a terminal b, terminal c, and a terminal d. A setting signal is input to the terminal a. A current (reference current) is supplied to the terminal b from a reference constant current source 109 connected to a current line. Further, the terminal c outputs signals (signal currents) held in the first current source circuit 421 and the second current source circuit 422 via a switch 101 (signal current control switch). That is, the current source circuit 420 is controlled by the setting signal input from the terminal a and a control signal input from the terminal d, the current (reference current) is supplied from the terminal b, and the current proportional to the current (reference current) is output from the terminal c. Note that the switch (signal current control switch) 101 is provided between the current source circuit 420 and a pixel connected to the signal line, and ON/OFF of the switch (signal current control switch) 101 is controlled by the video signal.

In this specification, an operation (for setting a signal current, setting the signal current according to a reference current, and performing setting to enable the current source circuit 420 to output a signal current) for completing a write of the signal current to the current source circuit 420 is referred to as a setting operation. In addition, an operation for inputting a signal current to a pixel (operation of the current source circuit 420 to output the signal current) is referred to as an input operation. In FIG. 2, the control signals input to the first current source circuit 421 and the second current source circuit 422 are different from each other. Therefore, one of the first current source circuit 421 and the second current source circuit 422 performs the setting operation, and the other performs the input operation. Thus, the two operations can be executed at the same time.

Note that the setting operations may be performed at an arbitrary number of times, at arbitrary time and at arbitrary timing. The timing of the setting operation can be arbitrarily adjusted in accordance with the pixel structure (such as the current source circuit disposed in the pixel) or the structure of the current source circuit disposed in the signal line driver circuit. The number for performing setting operations may be at least one when supplying power to the signal line driver circuit to start the operation. In practice, however, for example, a case can occur where information obtained by the setting operation leaks. Thus, the setting operation may be performed again with timing when a need arises again for the information.

Each of the signal line driver circuits of FIGS. 1 and 2 has been described for the case where the signal current proportional to the video signal is supplied to the signal line. However, the present invention is not limited to this. For example, a current may be supplied to a wiring different from the signal line. In this case, the switch 101 (signal current control switch) does not need to be disposed. A case where the switch 101 is not disposed is shown in FIG. 36 as to FIG. 1, and the case is shown in FIG. 37 as to FIG. 2. In these cases, a current is output to a pixel current line. The video signal is output to the signal line.

According to the present invention, a video signal is used in two cases: one case where the signal is used to control the pixel; and the other case where the signal is used as a setting signal for a current source circuit. Specifically, a video signal is used not only for image display, but also for the setting operation of the current source circuit. In the case where the video signal is used for control of the pixel (display of an image), the current source circuit performs the input operation (output of the current to the pixel). Further, in the case where the video signal is used as the setting signal for the current source circuit, the current source circuit performs the setting operation.

Note that the current is output either the signal line or the pixel current line. In the case where the current is output to the signal line, when the video signal is used for the pixel control (image display), the current source circuit performs the input operation (output of the current to the pixel). This is because the current output to the signal line is the video signal itself. On the other hand, in the case where the current is output to the pixel current line, when the video signal is used for pixel control (image display), the current source circuit disposed in the signal line driver circuit does not always perform the input operation. This is because the video signal is already input to the signal line when being used for pixel control (image display), and the video signal has nothing to do with current that is output when the current source circuit disposed in the signal line driver circuit performs the input operation. The current source circuit disposed in the signal line driver circuit performs the input operation when the setting operation of the current source circuit disposed in the pixel is executed.

In the present invention, when performing the setting operation, the video signal is used to specify a current source circuit disposed in an arbitrary column from among the first column to the last column. In addition, the current source circuit is specified only in an arbitrary period. Thus, a current source circuit requiring the setting operation can be specified among current source circuits disposed in a plurality of columns. Further, since the setting operation can be performed spending time for the specified current source circuit, the setting operation can be precisely performed.

If a current source circuit in an arbitrary column cannot be specified, and current source circuits need to be sequentially specified from the first column to the last column, the per-column time of the setting operation is shortened. Specifically, since the setting operations need to be performed in a predetermined time for the current source circuits in the first column to the last column, the per-column time of the setting operation is shortened. Consequently, the setting operation cannot be sufficiently performed.

In the current source circuits disposed in the plurality of columns, setting operations for the current source circuits may be sequentially performed from the first column to the last column. However, when setting operations are not sequentially performed for the current source circuits from the first column, but the setting operations can be performed at random for the current source circuits, various advantages are exhibited. For example, a sufficient time can be arbitrarily used to perform the setting operation for the current source circuit. Further, in the case where periods during which the setting operation can be performed are dotted in one frame, when an arbitrary column can be selected, the degree of freedom is increased, and a setting operation period can be set long. For example, in the period during which the setting operation can be performed and which is dotted in one frame, the setting operation can be performed for the one-column current source circuit by making full use of the period. One of other advantages is that the influence of charge leakage in a capacitor element disposed in the current source circuit can be made inconspicuous. Thus, when a defect has occurred in accordance with the setting operation, the defect can be made inconspicuous.

According to the present invention, the video signal is used to control the current source circuit, thereby obviating the necessity of dedicated circuits to perform control of the setting operation for the current source circuit and specification of the current source circuit. Consequently, since the number of circuits to be disposed is reduced, the defect-occurrence ratio in the manufacture can be minimized, and the yield can be improved. In addition, since the number of circuits to be disposed can be reduced, the layout area can be reduced. Thus, the frame area can be reduced, and the device can be miniaturized.

Note that the present invention may be applied by replacing TFTs with transistors using ordinary monocrystal, transistors using SOI, organic transistors, or the like.

In addition, in the present invention, the category of the light emitting device includes, for example, a panel in which a pixel portion including light emitting elements and signal line driver circuits are enclosed between a substrate and a covering material, a module in which ICs and the like are mounted to the aforementioned panel, and a display. That is, the light emitting device is equivalent to a generic term referring to a panel, a module, a display, and the like.

The present invention provides a signal line driver circuit including the current source circuit described above. Further, the present invention provides a light emitting device capable of suppressing the influence of variation in characteristics of TFTs constituting both pixels and driver circuits to enable a desired signal current $I_{data}$ to be supplied to light emitting elements by using pixels each having a circuit structure not influenced by the TFT characteristics.

BRIEF DESCRIPTION OF THE DRAWINGS

FIG. 1 is a view of a signal line driver circuit.

FIG. 2 is a view of a signal line driver circuit.

FIG. 3 is views of a signal line driver circuit (1-bit).

FIG. 4 is a view of a signal line driver circuit (3-bit).

FIG. 5 is a view of a signal line driver circuit (3-bit).

FIG. 6 is circuit diagrams of current source circuits.

FIG. 7 is circuit diagrams of current source circuits.

FIG. 8 is circuit diagrams of current source circuits.

FIG. 9 is a timing chart.

FIG. 10 is a view of a signal line driver circuit.

FIG. 11 is a timing chart.

FIG. 12 is views of the appearance of a light emitting device.

FIG. 13 is circuit diagrams of pixels of a light emitting device.

FIG. 14 is explanatory views of a driving method.

FIG. 15 is views of a light emitting device.

FIG. 16 is circuit diagrams of pixels of a light emitting device.

FIG. 17 is explanatory views of operations of a pixel of the light emitting device.

FIG. 18 is views of a current source circuit.

FIG. 19 is explanatory views of operations of a current source circuit.

FIG. 20 is explanatory views of operations of a current source circuit.

FIG. 21 is an explanatory view of operations of a current source circuit.

FIG. 22 is views of electronic devices to which the present invention is applied.

FIG. 23 is a view of a signal line driver circuit (3-bit).

FIG. 24 is a view of a signal line driver circuit (3-bit).

FIG. 25 is explanatory views of a driving method.

FIG. 26 is explanatory views of a driving method.

FIG. 27 is a view of a signal line driver circuit.

FIG. 28 is a view of a signal line driver circuit.

FIG. 29 is explanatory views of a driving method.

FIG. 30 is a view of a signal line driver circuit.

FIG. 31 is explanatory views of a driving method.

FIG. 32 is a circuit diagram of a reference constant current source.

FIG. 33 is circuit diagrams of a reference constant current source.

FIG. 34 is a circuit diagram of a reference constant current source.

FIG. 35 is a circuit diagram of a reference constant current source.

FIG. 36 is a signal line driver circuit.

FIG. 37 is a signal line driver circuit.

FIG. 38 is circuit diagrams of a current source circuit.

FIG. 39 is circuit diagrams of a current source circuit.

FIG. 40 is circuit diagrams of a current source circuit.

FIG. 41 is circuit diagrams of a current source circuit.

FIG. 42 is circuit diagrams of a current source circuit.

FIG. 43 is a circuit diagram of a current source circuit.

FIG. 44 is a view of a signal line driver circuit.

FIG. 45 is a view of a signal line driver circuit.

FIG. 46 is a view of a signal line driver circuit.

FIG. 47 is views of a signal line driver circuit.

FIG. 48 is a view of a signal line driver circuit.

FIG. 49 is a view of a signal line driver circuit.

FIG. 50 is a view of a signal line driver circuit.

FIG. 51 is a view of a signal line driver circuit.

FIG. 52 is a view of a signal line driver circuit.

FIG. 53 is a view of a signal line driver circuit.

FIG. 54 is views of a light emitting device.

FIG. 55 is views of a signal line driver circuit.

FIG. 56 is a view of a signal line driver circuit.

FIG. 57 is a view of a signal line driver circuit.

FIG. 58 is a view of a signal line driver circuit.

FIG. 59 is a view of a signal line driver circuit.

FIG. 60 is a view of a signal line driver circuit.

FIG. 61 is a view of a signal line driver circuit.

FIG. 62 is a view of a signal line driver circuit.

FIG. 63 is a view of a signal line driver circuit.

FIG. 64 is a view of a signal line driver circuit.

FIG. 65 is a view of a signal line driver circuit.

FIG. 66 is a view of a signal line driver circuit.

FIG. 67 is a view of a signal line driver circuit.

FIG. 68 is a view of a signal line driver circuit.

FIG. 69 is a view of a signal line driver circuit.

FIG. 70 is a view of a signal line driver circuit.

FIG. 71 is a view of a signal line driver circuit.

FIG. 72 is a view of a signal line driver circuit.

FIG. 73 is circuit diagrams of a pixel of a light emitting device.

FIG. 74 is a timing chart.

FIG. 75 is a timing chart.

FIG. 76 is a timing chart.

FIG. 77 is a timing chart.

FIG. 78 is a timing chart.

FIG. 79 is a timing chart.

FIG. 80 is a timing chart.

FIG. 81 is a timing chart.

FIG. 82 is a timing chart.

FIG. 83 is a timing chart.

FIG. 84 is a timing chart.

FIG. 85 is a timing chart.

FIG. 86 is a timing chart.

FIG. 87 is a layout view of a current source circuit.

FIG. 88 is a circuit diagram of a current source circuit.

BEST MODE FOR CARRYING OUT THE INVENTION

Embodiment Mode 1

In this embodiment mode, a description will be made of an example of a circuit structure of a current source circuit 420 shown in FIG. 1, which is provided in a signal line driver circuit of the present invention.

Referring to FIG. 1, a setting signal input from a terminal a corresponds to a video signal supplied from a second latch circuit 413. However, since the video signal is also used to control a pixel, the video signal is not directly input to the current source circuit 420, but input thereto via a logical operator. The logical operator enables switching between the case of using the video signal to control the pixel (to display an image) and the case of using the video signal to control the current source circuit. Specifically, the setting signal input from the terminal a corresponds to the signal supplied from an output terminal of the logical operator that is connected to a setting control line (not shown in FIG. 1). The present invention performs setting of the current source circuit 420 in accordance with the signal supplied from the output terminal of the logical operator connected to the setting control line.

One of two input terminals of the logical operator is input with the signal (corresponding to the video signal) supplied from the second latch circuit, and the other input terminal is input with the signal from the setting control line. The logical operator performs a logic operation of the input two signals, and outputs a signal from the output terminal. Then, the current source circuit 420 performs either a setting operation or an input operation according to the signal supplied from the output terminal of the logical operator. This enables the video signal to be prevented from influencing the current source circuit while the video signal is used for pixel control (image display).

Assuming that the logical operator is not arranged, and the setting operation or the input operation of the current source circuit 420 is performed in accordance with the signal (corresponding to the video signal) supplied from the second latch circuit, even while the video signal is used for the pixel control (image display), the setting operation, the input operation, or the like of the current source circuit 420 is performed. Thus, to which current source circuit 420 the setting operation, the input operation, or the like is performed differs depending on the image display pattern. That is, the setting operation, the input operation, or the like of the current source circuit 420 cannot be properly performed. However, when the above-described logical operator is disposed, even while the video signal is used for pixel control (image display), for example, variation in a signal of the output terminal of the logical operator can be prevented by using the signal input from the setting control line to the logical operator. Consequently, the setting operation, the input operation, or the like of the current source circuit 420 can be precisely performed.

According to the present invention, the signal (corresponding to the video signal) output from the second latch circuit is used for two cases: one case where the signal is used as the video signal that is input to the pixel; and the other case where the signal is used as the setting signal for the current source circuit. Specifically, when the signal (corresponding to the video signal) output from the second latch circuit is used as the video signal that is input to the pixel, the current source circuit of the signal line driver circuit performs the input operation. Further, when the signal (corresponding to the video signal) output from the second latch circuit, is used as the setting signal for the current source circuit, the current source circuit performs the setting operation.

Thus, if the video signal that is output from the second latch circuit is input, as it is, to the terminal a of the current source circuit, when the video signal is input to the pixel, the current source circuit of the signal line driver circuit simultaneously performs the setting operation. That is, the current source circuit of the signal line driver circuit performs the setting operation and the input operation simultaneously. In this case, since the video signal varies depending on the image to be displayed, the setting operation cannot be precisely performed.

From the above, in the present invention, the timing of the setting operation performed by the current source circuit is controlled by using the signal supplied from the setting control line. In addition, control is conducted concerning in which column-current source circuit the setting operation is conducted. As a result, when the video signal is used as the video signal to be input to the pixel, the current source circuit in the signal line driver circuit is not influenced. In addition, when the video signal is used as the setting signal for the current source circuit in the signal line driver circuit to perform the setting operation, control is performed for the setting control line so that the current source circuit does not perform an input operation, whereby the setting operation of the current source circuit can be precisely performed.

Note that a shift register has a structure including, for example, flip-flop circuits (FFs) in a plurality of columns. A clock signal (S-CLK), a start pulse (S-SP), and an inverted clock signal (S-CLKb) are input to the shift register, and signals serially output according to the timing of the input signals are called sampling pulses.

In FIG. 6(A), a circuit including switches 104, 105*a*, and 116, a transistor 102 (n-channel type), and a capacitor element 103 for retaining a gate-source voltage VGS of the transistor 102 corresponds to the current source circuit 420.

In the current source circuit 420, the switch 104 and the switch 105*a* are turned ON by a signal input via the terminal a. Then, a current (reference current) is supplied via the terminal b from the reference constant current source 109 (hereinafter referred to as constant current source 109) connected to the current line, and a predetermined charge is retained in the capacitor element 103. The charge is retained until the current (reference current) supplied from the constant current source 109 becomes identical with a drain current of the transistor 102.

Then, the switch 104 and the switch 105*a* are turned OFF by a signal input via the terminal a. As a result, since the predetermined charge is retained in the capacitor element 103, the transistor 102 is imparted with a capability of flowing a current having a magnitude corresponding to that of the signal current $I_{data}$. If the switch 101 (signal current control switch) and the switch 116 are turned into a conductive state, a current flows to a pixel connected to the signal line via the terminal c. At this time, since the gate voltage of the transistor 102 is maintained by the capacitor element 103 at a predetermined gate voltage, a drain current corresponding to the signal current $I_{data}$ flows to the drain region of the transistor 102. Thus, the magnitude of the current input to the pixel can be controlled without being influenced by the variation in characteristics of the transistors constituting the signal line driver circuit.

In the case where the switch 101 (signal current control switch) is not disposed, when the switch 116 is turned into a conductive state, a current flows to the pixel connected to the signal line via the terminal c.

The connection structure of the switch 104 and the switch 105*a* is not limited to the structures shown in FIG. 6(A). For example, the structure may be such that one of terminals of the switch 104 is connected to the terminal b, and the other terminal is connected between itself and the gate electrode of the transistor 102; and one of terminals of the switch 105*a* is connected to the terminal b via the switch 104, and the other terminal is connected to the switch 106. Then, the switch 104 and the switch 105*a* are controlled by a signal input from the terminal a.

Alternatively, the switch 104 may be disposed between the terminal b and the gate electrode of the transistor 102, and the switch 105*a* may be disposed between the terminal b and the switch 116. Specifically, referring to FIG. 38(A), wirings, switches, and the like may be disposed such that the connection is structured as shown in FIG. 38(A1) in the setting operation, and the connection is structured as shown in FIG. 38(A2) in the input operation. The number of wirings, the number of switches, and the structure are not particularly limited.

In the current source circuit 420 of FIG. 6(A), the signal setting operation (setting operation) cannot be performed simultaneously with the signal inputting operation (input operation) to the pixel.

Referring to FIG. 6(B), a circuit including a switch 124, a switch 125*a*, a transistor 122 (n-channel type), a capacitor element 123 for retaining a gate-source voltage VGS of the transistor 122, and a transistor 126 (n-channel type) corresponds to the current source circuit 420.

The transistor 126 functions as either a switch or a part of a current source transistor.

In the current source circuit 420, the switch 124 and the switch 125 are turned ON by a signal input via the terminal a. Then, a current (reference current) is supplied via the terminal b from the constant current source 109 connected to the current line, and a predetermined charge is retained in the capacitor element 123. The charge is retained until the current (reference current) flown from the constant current source 109 becomes identical with a drain current of the transistor 122. Note that, when the switch 124 is turned ON, since a gate-source voltage VGS of the transistor 126 is set to 0 V, the transistor 126 is turned OFF.

Subsequently, the switch 124 and the switch 125 are turned OFF. As a result, since the predetermined charge is retained in the capacitor element 123, the transistor 122 is imparted with a capability of flowing a current having a magnitude corresponding to that of the signal current $I_{data}$. If the switch 101 (signal current control switch) is turned into the conductive state, a current flows to a pixel connected to the signal line via the terminal c. At this time, since the gate voltage of the transistor 122 is maintained by the capacitor element 123 at a predetermined gate voltage, a drain current corresponding to the signal current $I_{data}$ flows to the drain region of the transistor 122. Thus, the magnitude of the current that is input to the pixel can be controlled without being influenced by the variation in characteristics of the transistors constituting the signal line driver circuit.

When the switches 124 and 125 have been turned OFF, gate and source potentials of the transistor 126 are varied not to be the same. As a result, since the charge retained in the capacitor element 123 is distributed also to the transistor 126, and the transistor 126 is automatically turned ON. Here, the transistors 122 and 126 are connected in series, and the gates thereof are connected. Accordingly, the transistors 122 and 126 each serve as a multi-gate transistor. That is, a gate length L of the transistor varies between the setting operation and the input operation. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the reference constant current source can be charged even faster. Consequently, the setting operation can be completed quickly. In the case where the switch 101 (signal current control switch) is not disposed, when the switch 126 is turned into the conductive state, a current flows via the terminal c to the pixel connected to the signal line.

The number of wirings, the number of switches, and the structures are not particularly limited. Specifically, referring to FIG. 38(B), wirings and switches may be disposed such that the connection is structured as shown in FIG. 38(B1) in the setting operation, and the connection is structured as shown in FIG. 38(B2) in the input operation. In particular, in FIG. 38(C2), it is sufficient that the charge accumulated in a capacitor element 107 does not leak.

Note that, in the current source circuit 420 of FIG. 6(B), the signal setting operation (setting operation) cannot be performed simultaneously with the signal inputting operation (input operation) to the pixel.

Referring to FIG. 6(C), a circuit including a switch 108, a switch 110, transistors 105*b*, 106 (n-channel type), and a capacitor element 107 for retaining gate-source voltages VGS of the transistors 150*b* and 106 corresponds to the current source circuit 420.

In the current source circuit 420, the switch 108 and the switch 110 are turned ON by a signal input via the terminal a. Then, a current (reference current) is supplied via the terminal b from the constant current source 109 connected to the current line, and a predetermined charge is retained in the capacitor element 107. The charge is retained until the current (reference current) flown from the constant current source 109 becomes identical with a drain current of the transistor 105*b*. At this time, since the gate electrodes of the transistor 105*b* and of the transistor 106 are connected to each other, the gate voltages of the transistor 105*b* and the transistor 106 are retained by the capacitor element 107.

Then, the switch 108 and the switch 110 are turned OFF by a signal input via the terminal a. As a result, since the predetermined charge is retained in the capacitor element 107, the transistor 106 is imparted with a capability of flowing a current having a magnitude corresponding to that of the current (reference current). If the switch 101 (signal current control switch) is turned to the conductive state, a current flows to a pixel connected to the signal line via the terminal c. At this time, since the gate voltage of the transistor 106 is maintained by the capacitor element 107 at a predetermined gate voltage, a drain current corresponding to the current (reference current) flows to the drain region of the transistor 106. Thus, the magnitude of the current input to the pixel can be controlled without being influenced by the variation in characteristics of the transistors constituting the signal line driver circuit.

Note that, in the case where the switch 101 (signal current control switch) is not disposed, a current flows to the pixel connected to the signal line via the terminal c.

At this time, characteristics of the transistor 105*b* and the transistor 106 need to be the same to cause the drain current corresponding to the signal current $I_{data}$ to flow precisely to the drain region of the transistor 106. To be more specific, values such as mobilities and thresholds of the transistor 105*b* and the transistor 106 need to be the same. In addition, in FIG. 6(C), the value of W (gate width)/L (gate length) of each of the transistor 105*b* and the transistor 106 may be arbitrarily set, and a current proportional to the current supplied from the constant current source 109 may be flown to the pixel.

Further, the value of W/L of the transistor 105*b* or the transistor 106 that is connected to the constant current source 109 is set high, whereby the write speed can be increased by supplying a large current from the constant current source 109.

With the current source circuit 420 shown in FIG. 6(B), the signal setting operation (setting operation) can be performed simultaneously with the signal inputting operation (input operation) to the pixel.

Each of the current source circuits 420 of FIGS. 6(D) and 6(E) has the same circuit element connection structures as that of the current source circuit 420 of FIG. 6(C), except for the connection structure of the switch 110. In addition, since the operation of the current source circuit 420 of each of FIGS. 6(D) and 6(E) conforms to the operation of the current source circuit 420 of FIG. 6(C), a description thereof will be omitted here.

Note that, the number of wirings, the number of switches, and the structures are not particularly limited. Specifically, referring to FIG. 38(C), wirings and switches may be disposed such that the connection is structured as shown in FIG. 38(C1) in the setting operation, and the connection is structured as shown in FIG. 38(C2) in the input operation. In particular, in FIG. 38(C2), it is sufficient that the charge accumulated in the capacitor element 107 does not leak.

Referring to FIG. 39(A), a circuit including switches 195*b*, 195*c*, 195*d*, and 195*f*, a transistor 195*a*, and a capacitor element 195*e* corresponds to the current source circuit. In the current source circuit shown in FIG. 39(A), the switches 195*b*, 195*c*, 195*d*, and 195*f* are turned ON by a signal input via the terminal a. Then, a current is supplied via the terminal b from the constant current source 109 connected to the current line. A predetermined charge is retained in the capacitor element 195*e* until the signal current supplied from the constant current source 109 becomes identical with a drain current of the transistor 195*a*.

Then, the switches 195*b*, 195*c*, 195*d*, and 195*f* are turned OFF by a signal input via the terminal a. At this time, since the predetermined charge is retained in the capacitor element 195*e*, the transistor 195*a* is imparted with a capability of flowing a current having a magnitude corresponding to that of the signal current. This is because the gate voltage of the transistor 195*a* is set by the capacitor element 195*a* to a predetermined gate voltage, and a drain current corresponding to a current (reference current) flows to the drain region of the transistor 195*a*. In this state, a current is supplied to the outside via the terminal c. Note that, in the current source circuit shown in FIG. 39(A), the operation for setting the current source circuit to have a capability of flowing a signal current cannot be performed simultaneously with the input operation for inputting the signal current to the pixel. In addition, when a switch controlled by the signal input via the terminal a is ON, and also, when a current is controlled not to flow from the terminal c, the terminal c needs to be connected to another wiring of the other potential. Here, the wiring potential is represented by Va. Va may be a potential sufficient to flow a current flowing from the terminal b as it is, and may be a power supply voltage Vdd as an example.

Note that, the number of wirings, the number of switches, and the structures are not particularly limited. Specifically, referring to FIGS. 39(B) and 39(C), wirings and switches may be disposed such that the connection is structured as shown in either FIG. 39(B1) or 39(C1) in the setting operation, and the connection is structured as shown in either FIG. 39(B2) or 39(C2) in the input operation.

Further, in the current source circuits of FIGS. 6(A) and 6(C) to 6(E), the current-flow directions (directions from the pixel to the signal line driver circuit) are the same. The polarity (conductivity type) of each of the transistor 102, the transistor 105*b*, and the transistor 106 can be of p-channel type.

FIG. 7(A) shows a circuit structure in which the current-flow direction (direction from the pixel to the signal line driver circuit) is the same, and the transistor 102 shown in FIG. 6(A) is set to be of p-channel type. In FIG. 6(A), with the capacitor element disposed between the gate and the source, even when the source potential varies, the gate-source voltage can be maintained. Further, FIGS. 7(B) to 7(D) show circuit diagrams in which the current-flow directions (directions from the pixel to the signal line driver circuit) are the same, and the transistor 105*b* and the transistor 106 shown in FIGS. 6(C) to 6(E) are set to be of p-channel type.

Further, FIG. 40(A) shows a case where the transistor 195*a* is set to be of p-channel type in the structure of FIG. 39. FIG. 40(B) shows a case where the transistors 122 and 126 are set to be of p-channel type in the structure of FIG. 6(B).

Referring to FIG. 42, a circuit including switches 104 and 116, a transistor 102, a capacitor element 103, and the like corresponds to the current source circuit.

FIG. 42(A) corresponds to the circuit of FIG. 6(A) that is partly modified. In the current source circuit of FIG. 42(A), the transistor gate width W varies between the setting operation of the current source and the input operation. Specifically, in the setting operation, the connection is structured as shown in FIG. 42(B), in which the gate width W is large. In the input operation, the connection is structured as shown in FIG. 42(C), in which the gate width W is small. Therefore, the value of the current supplied from the terminal b at the time of the setting operation can be made larger than the value of the current supplied from the terminal c at the time of the input operation. Thus, various loads (such as wiring resistances and cross capacitances) disposed between the terminal b and the reference constant current source can be charged even faster. Consequently, the setting operation can be completed quickly.

Note that, FIG. 42 shows the circuit of FIG. 6(A) that is partly modified. In addition, the circuit can be easily applied to, for example, other circuits shown in FIG. 6 and to the circuits shown in FIG. 7, FIG. 39, FIG. 40, and FIG. 41.

Note that, in each of the current source circuits shown in FIGS. 6, 7, and 39, a current flows from the pixel to the signal line driver circuit. However, the current not only flows from the pixel to the signal line driver circuit, but also may flow from the signal line driver circuit to the pixel. The direction of the current flow depends on the pixel structure. In the case where the current flows from the signal line driver circuit to the pixel, Vss (low potential power source) may be changed to Vdd (high potential power source), and the transistors 102, 105*b*, 106, 122, and 126 may be set to be of p-channel type in FIG. 6. Also in FIG. 7, Vss may be changed to Vss, and the transistors 102, 105*b*, and 106 may be of n-channel type.

Note that, in all the current source circuits described above, the disposed capacitor element may not be disposed by being substituted by, for example, a gate capacitance of a transistor.

In the circuits of FIGS. 7(A) to 7(D) and 40(A) and 40(B), wirings and switches may be disposed such that the connection is structured as shown in FIGS. 41(A1) to 41(D1) in the setting operation, and the connection is structured as shown in FIGS. 41(A2) to 41(D2) in the input operation. The number of wirings and the number of switches are not particularly limited.

Hereinafter, a description will be made in detail regarding the operations of the current source circuits of FIGS. 6(A), 7(A), 6(C) to 6(E), and 7(B) to 7(D) among those described above by using FIGS. 6 and 7. To begin with, the operations of the current source circuits of FIGS. 6(A) and 7(A) will be described with reference to FIG. 19.

FIGS. 19(A) to 19(C) schematically show paths of a current flowing among circuit elements. FIG. 19(D) shows the relationship between the current flowing through each path and the time in writing the signal current $I_{data}$ to the current source circuit. FIG. 19(E) shows the relationship between the voltage accumulated in a capacitor element 16, that is, the gate-source voltage of a transistor 15, and the time in writing the signal current $I_{data}$ to the current source circuit. In the circuit diagrams of FIGS. 19(A) to 19(C), numeral 11 denotes a reference constant current source, switches 12 to 14 each are a semiconductor device having a switching function, numeral 15 denotes a transistor (n-channel type), numeral 16 denotes a capacitor element, and numeral 17 denotes a pixel. In this embodiment mode, the switch 14, the transistor 15, and the capacitor element 16 form an electric circuit corresponding to a current source circuit 20. Drawing wirings and reference symbols are shown in FIG. 19(A). Since drawing wirings and reference symbols shown in FIGS. 19(B) and 19(C) are similar to those shown in FIG. 19(A), they are omitted here.

A source region of the n-channel transistor 15 is connected to Vss, and a drain region thereof is connected to the reference constant current source 11. One of electrodes of the capacitor element 16 is connected to Vss (the source of the transistor 15), and the other electrode is connected to the switch 14 (the gate of the transistor 15). The capacitor element 16 plays a role of holding the gate-source voltage of the transistor 15.

The pixel 17 is formed of a light emitting element, a transistor, or the like. The light emitting element includes an anode, a cathode, and a light emitting layer sandwiched between the anode and the cathode. In this specification, when the anode is used as a pixel electrode, the cathode is referred to as an opposing electrode; in contrast, when the cathode is used as a pixel electrode, the anode is referred to as an opposing electrode. The light emitting layer can be formed of a known light emitting material. The light emitting layer has two structures: a single layer structure and a laminate structure, and the present invention may use any one of known structures. Luminescence in the light emitting layer includes light emission (fluorescence) in returning from a singlet excited state to a normal state and light emission (phosphorescence) in returning from a triplet excited state to a normal state. The present invention may be applied to a light emitting device using either one or both of the two types of light emission. Further, the light emitting layer is formed of a known material such as an organic material or an inorganic material.

Note that, in practice, the current source circuit 20 is provided in the signal line driver circuit. A current corresponding to the signal current $I_{data}$ flows via, for example, a circuit element included in the signal line or the pixel from the current source circuit 20 provided in the signal line driver circuit. However, since FIG. 19 is a diagram for briefly explaining the outline of the relationship among the reference constant current source 11, the current source circuit 20, and the pixel 17, a detailed illustration of the structure is omitted.

First, an operation (setting operation) of the current source circuit 20 for retaining the signal current $I_{data}$ will be described by using FIGS. 19(A) and 19(B). Referring to FIG.

19(A), the switch 12 and the switch 14 are turned ON, and the switch 13 is turned OFF. In this state, the signal current $I_{data}$ is output from the reference constant current source 11, and flows to the current source circuit 20 from the reference constant current source 11. At this time, since the signal current $I_{data}$ is flowing from the reference constant current source 11, the current flows separately through current paths $I_1$ and $I_2$ in the current source circuit 20, as shown in FIG. 19(A). FIG. 19(D) shows the relationship at this time. Needless to say, the relationship is expressed as $I_{data}=I_1+I_2$.

The moment the current starts to flow from the reference constant current source 11, since no charge is accumulated in the capacitor element 16, the transistor 15 is OFF. Accordingly, $I_2=0$ and $I_{data}=I_1$ are established.

Charge is gradually accumulated into the capacitor element 16, and a potential difference begins to occur between both electrodes of the capacitor element 16 (FIG. 19(E)). When the potential difference of both the electrodes has reached $V_{th}$ (point A in FIG. 19(E)), the transistor 15 is turned ON, and $I_2>0$ is established. As described above, since $I_{data}=I_1+I_2$, while $I_1$ gradually decreases, the current keeps flowing. Charge accumulation is continuously performed in the capacitor element 16.

The potential difference between both the electrodes of the capacitor element 16 serves as the gate-source voltage of the transistor 15. Thus, charge accumulation in the capacitor element 16 continues until the gate-source voltage of the transistor 15 reaches a desired voltage, that is, a voltage (VGS) that allows the transistor is to be flown with the current $I_{data}$. When charge accumulation terminates (B point in FIG. 19(E)), the current $I_1$ stops flowing. Further, since the TFT 15 is ON, $I_{data}=I_2$ is established (FIG. 19(B)).

Next, an operation (input operation) for inputting the signal current $I_{data}$ to the pixel will be described by using FIG. 19(C). When the signal current $I_{data}$ is input to the pixel, the switch 13 is turned ON, and the switch 12 and the switch 14 are turned OFF. Since VGS written in the above-described operation is held in the capacitor element 16, the transistor 15 is ON. A current identical with the signal current $I_{data}$ flows to Vss via the switch 13 and transistor 15, and the input of the signal current $I_{data}$ to the pixel is then completed. At this time, when the transistor 15 is set to operate in a saturation region, even if the source-drain voltage of the transistor 15 varies, a constant current is supplied to the light emitting element.

In the current source circuit 20 shown in FIG. 19, as shown in FIGS. 19(A) to 19(C), the operation is divided into an operation (setting operation; corresponding to FIGS. 19(A) and 19(B)) for completing a write of the signal current $I_{data}$ to the current source circuit 20, and an operation (input operation; corresponding to FIG. 19(C)) for inputting the signal current $I_{data}$ to the pixel). Then, in the pixel, a current is supplied to the light emitting element in accordance with the input signal current $I_{data}$.

The current source circuit 20 of FIG. 19 is not capable of performing the setting operation and the input operation simultaneously. In the case where the setting operation and the input operation need to be performed simultaneously, at least two current source circuits are preferably provided to each of a plurality of signal lines each of which is connected with a plurality of pixels and which are provided in a pixel portion. However, if the setting operation can be performed within a period during which the signal current $I_{data}$ is not input to the pixel, only one current source circuit may be provided for each signal line (each column).

Although the transistor 15 of the current source circuit 20 shown in each of FIGS. 19(A) to 19(C) is of n-channel type, the transistor 15 of the current source circuit 20 may be of p-channel type, of course. Here, a circuit diagram for the case where the transistor 15 is of p-channel type is shown in FIG. 19. Referring to FIG. 19(F), numeral 31 denotes a reference constant current source, switches 32 to 34 each are a semiconductor device (transistor) having a switching function, numeral 35 denotes a transistor (p-channel type), numeral 36 denotes a capacitor element, and numeral 37 denotes a pixel. In this embodiment mode, the switch 34, the transistor 35, and the capacitor element 36 form an electric circuit corresponding to a current source circuit 24.

The transistor 35 is of p-channel type. One of a source region and a drain region of the transistor 35 is connected to Vdd, and the other is connected to the constant current source 31. One of electrodes of the capacitor element 36 is connected to Vdd, and the other electrode is connected to the switch 36. The capacitor element 36 plays a role of holding the gate-source voltage of the transistor 35.

Operation of the current source circuit 24 of FIG. 19(F) is similar to the operation of the current source circuit 20 described above, except for the current-flow direction, and thus, a description thereof will be omitted here. In the case of designing the current source circuit in which the polarity of the transistor 15 is changed without changing the current-flow direction, the circuit diagram of FIG. 7(A) may be referenced.

Note that in FIG. 43, the current-flow direction is the same as in FIG. 19(F), in which the transistor 35 is of n-channel type. The capacitor element 36 is connected between the gate and the source of the transistor 35. The source potential of the transistor 35 varies between the setting operation and the input operation. However, even when the source potential varies, since the gate-source voltage is retained, a normal operation is implemented.

Next, operations of the current source circuits shown in FIGS. 6(C) to 6(E) and FIGS. 7(B) to 7(D) will be described by using FIGS. 20 and 21. FIGS. 20(A) to 20(C) schematically show paths through which a current flows among circuit elements. FIG. 20(D) shows the relationship between the current flowing through each path and the time in writing the signal current $I_{data}$ to the current source circuit. FIG. 20(E) shows the relationship between the voltage accumulated in a capacitor element 46, that is, the gate-source voltages of transistor 43, 44, and the time in writing the signal current $I_{data}$ to the current source circuit. Further, in the circuit diagrams of FIGS. 20(A) to 20(C), numeral 41 denotes a reference constant current source, a switch 42 is a semiconductor device having a switching function, numerals 43 and 44 denote transistors (n-channel type), numeral 46 denotes a capacitor element, and numeral 47 denotes a pixel. In this embodiment mode, a circuit including the switch 42, the transistors 43 and 44, and the capacitor element 46 is an electric circuit corresponding to a current source circuit 25. Note that drawing wirings and reference symbols are shown in FIG. 20(A), and since drawing wirings and reference symbols shown in FIGS. 20(B) and 20(C) conform to those shown in FIG. 20(A), they are omitted.

A source region of the n-channel transistor 43 is connected to Vss, and a drain region thereof is connected to the reference constant current source 41. A source region of the n-channel transistor 44 is connected to Vss, and a drain region thereof is connected to a terminal 48 of the light emitting element 47. One of electrodes of the capacitor element 46 is connected to Vss (the sources of the transistors 43 and 44), and the other electrode thereof is connected to the gate electrodes of the transistors 43 and 44. The capacitor element 46 plays a role of holding gate-source voltages of the transistors 43 and 44.

Note that, in practice, the current source circuit 25 is provided in the signal line driver circuit. A current corresponding to the signal current $I_{data}$ flows via, for example, a circuit element included in the signal line or the pixel, from the current source circuit 25 provided in the signal line driver circuit. However, since FIG. 20 is a diagram for briefly explaining the outline of the relationship among the reference constant current source 41, the current source circuit 25, and the pixel 47, a detailed illustration of the structure is omitted.

In the current source circuit 25 of FIG. 20, the sizes of the transistors 43 and 44 are important. Hereinafter, using different reference symbols, a case where the sizes of the transistors 43 and 44 are identical and a case the sizes are mutually different will be described. Referring to FIGS. 20(A) to 20(C), the case where the sizes of the transistors 43 and 44 are mutually identical will be described by using the signal current $I_{data}$. The case where the sizes of the transistors 43 and 44 are mutually different will be described by using a signal current $I_{data1}$ and a signal current $I_{data}2$. Note that the sizes of the transistors 43 and 44 are determined using the value of W (gate width)/L (gate length) of each transistor.

First, the case where the sizes of the transistors 43 and 44 are mutually identical will be described. To begin with, operation for retaining the signal current $I_{data}$ in the current source circuit 20 will be described by using FIGS. 20(A) and 20(B). Referring to FIG. 20(A), when the switch 42 is turned ON, the signal current $I_{data}$ is set in the reference constant current source 41, and flows from the reference constant current source 41 to the current source circuit 25. At this time, since the signal current $I_{data}$ is flowing from the reference constant current source 41, the current flows separately through current paths $I_1$ and $I_2$ in the current source circuit 20, as shown in FIG. 20(A). FIG. 20(D) shows the relationship at this time. Needless to say, the relationship is expressed as $I_{data}=I_1+I_2$.

The moment the current starts to flow from the reference constant current source 41, since no charge is yet accumulated in the capacitor element 46, the transistors 43 and 44 are OFF. Accordingly, $I_2=0$ and $I_{data}=I_1$ are established.

Then, charge is gradually accumulated into the capacitor element 46, and a potential difference begins to occur between both electrodes of the capacitor element 46 (FIG. 20(E)). When the potential difference of both the electrodes has reached $V_{th}$ (point A in FIG. 20)), the transistors 43 and 44 are turned ON, and $I_2>0$ is established. As described above, since $I_{data}=I_1+I_2$, while $I_1$ gradually decreases, the current keeps flowing. Charge accumulation is continuously performed in the capacitor element 46.

The potential difference between both the electrodes of the capacitor element 46 serves as the gate-source voltage of each of the transistors 43 and 44. Thus, charge accumulation in the capacitor element 46 continues until the gate-source voltages of the transistors 43 and 44 each reach a desired voltage, that is, a voltage (VGS) that allows the transistor 44 to be flown with the current $I_{data}$. When charge accumulation terminates (B point in FIG. 20(E)), the current $I_1$ stops flowing. Further, since the transistors 43 and 44 are ON, $I_{data}=I_2$ is established (FIG. 20(B)).

Next, operation for inputting the signal current $I_{data}$ to the pixel will be described by using FIG. 20(C). First, the switch 42 is turned OFF. Since predetermined charge is retained in the capacitor element 46, the transistors 43 and 44 are ON. A current identical with the signal current $I_{data}$ flows from the pixel 47. Thus, the signal current $I_{data}$ is input to the pixel. At this time, when the transistor 44 is set to operate in a saturation region, even if the source-drain voltage of the transistor 44 varies, the current flowing in the pixel can be flown without variation.

In the case of a current mirror circuit shown in FIG. 6(C), even when the switch 42 is not turned OFF, a current can be flown to the pixel 47 by using the current supplied from the reference constant current source 41. That is, the setting operation for setting a signal for the current source circuit 20 can be implemented simultaneously with the operation (input operation) for inputting a signal to the pixel.

Next, a case where the sizes of the transistors 43 and 44 are mutually different will be described. An operation of the current source circuit 25 is similar to the above-described operation; therefore, a description thereof will be omitted here. When the sizes of the transistors 43 and 44 are mutually different, the signal current $I_{data1}$ set in the reference constant current source 41 is inevitably different from the signal current $I_{data2}$ that flows to the pixel 47. The difference therebetween depends on the difference between the values of W (gate width)/L (gate length) of the transistors 43 and 44.

In general, the W/L value of the transistor 43 is preferably set larger than the W/L value of the transistor 44. This is because the signal current $I_{data1}$ can be increased when the W/L value of the transistor 43 is set large. In this case, when the current source circuit is set with the signal current $I_{data1}$, Loads (cross capacitances, wiring resistances) can be charged. Thus, the setting operation can be completed quickly.

The transistors 43 and 44 of the current source circuit 25 in each of FIGS. 20(A) to 20(C) are of n-channel type, but the transistors 43 and 44 of the current source circuit 25 may be of p-channel type. Here, FIG. 21 shows a circuit diagram in which the transistors 43 and 44 are of p-channel type.

Referring to FIG. 21, numeral 41 denotes a constant current source, a switch 42 is a semiconductor device having a switching function, numerals 43 and 44 denote transistors (p-channel type), numeral 46 denotes a capacitor element, and numeral 47 denotes a pixel. In this embodiment mode, the switch 42, the transistors 43 and 44, and the capacitor element 46 form an electric circuit corresponding to a current source circuit 26.

A source region of the p-channel transistor 43 is connected to Vdd, and a drain region thereof is connected to the constant current source 41. A source region of the p-channel transistor 44 is connected to Vdd, and a drain region thereof is connected to a terminal 48 of the light emitting element 47. One of electrodes of the capacitor element 46 is connected to (source), and the other electrode is connected to the gate electrodes of the transistors 43 and 44. The capacitor element 46 plays a role of holding gate-source voltages of the transistors 43 and 44.

Operation of the current source circuit 24 of FIG. 21 is similar to that shown in each of FIGS. 20(A) to 20(C) except for the current-flow direction, and thus, a description thereof will be omitted here. In the case of designing the current source circuit in which the polarities of the transistors 43 and 44 are changed without changing the current-flow direction, the circuit diagram of FIG. 7(B) may be referenced.

In addition, the transistor polarity can be changed without changing the current-flow direction. This conforms to the operation illustrated in FIG. 43, so that a description thereof will be omitted here.

In summary, in the current source circuit of FIG. 19, the current having the same magnitude as that of the signal current $I_{data}$ set in the current source flows to the pixel. In other words, the signal current $I_{data}$ set in the constant current source is identical in value with the current flowing to the pixel. The current is not influenced by variation in characteristics of the transistors provided in the current source circuit.

In each of the current source circuits of FIG. 19 and FIG. 6(B), the signal current $I_{data}$ cannot be output to the pixel from the current source circuit in a period during which the setting operation is performed. Thus, two current source circuits are preferably provided for each signal line, in which an operation (setting operation) for setting a signal is performed to one of the current source circuits, and an operation (input operation) for inputting $I_{data}$ to the pixel is performed using the other current source circuit.

However, in the case where the setting operation and the input operation are not performed at the same time, only one current source circuit may be provided for each column. The current source circuit of each of FIGS. 39(A) and 40(A) is similar to the current source circuit of FIG. 19, except for the connection and current-flow paths. The current source circuit of FIG. 42(A) is similar, except for the difference in magnitude between the current supplied from the constant current source and the current flowing from the current source circuit. The current source circuits of FIGS. 6(B) and 40(B) are similar, except for the difference in magnitude between the current supplied from the constant current source and the current flowing from the current source circuit. Specifically, in FIG. 42(A), only the gate width W of the transistor is different between the setting operation and the input operation; in FIGS. 6(B) and 40(B), only the gate length L is different between the setting operation and the input operation; and others are similar to those of the structure of the current source circuit in FIG. 19.

In each of the current source circuits of FIGS. 20 and 21, the signal current $I_{data}$ set in the constant current source and the value of the current flowing to the pixel are dependent on the sizes of the two transistors provided in the current source circuit. In other words, the signal current $I_{data}$ set in the constant current source and the current flowing to the pixel can be arbitrarily changed by arbitrarily designing the sizes (W (gate width)/L (gate length)) of the two transistors provided in the current source circuit. However, output of precise signal current $I_{data}$ to the pixel is difficult in the case where variation is caused in the characteristics of the two transistors, such as threshold values and mobilities.

Further, in each of the current source circuits of FIGS. 20 and 21, the signal can be input to the pixel during the setting operation. That is, the setting operation for setting the signal can be performed simultaneously with the operation (input operation) for inputting the signal to the pixel. Thus, unlike the current source circuit of FIG. 19, two current source circuits do not need to be provided in a single signal line.

The present invention with the above structure can suppress the influence of variation in the TFT characteristics and supply a desired current to the outside.

Embodiment Mode 2

The above has described that, for the current source circuit shown in FIG. 19 (or, FIG. 6(B), 40(B), 42(A), or the like), preferably, two current source circuits are provided for each signal line (each column), in which one of the current source circuits is used to perform the setting operation, and the other current source circuit is used to perform the setting operation. This is because the setting operation and the input operation cannot be performed simultaneously. In this embodiment mode, the structure and operation of either the first current source circuit 421 or the second current source circuit 422 shown in FIG. 2 will be described with reference to FIG. 8.

Note that the signal line driver circuit includes the current source circuit 420, the shift register, the latch circuits, and the like.

In the present invention, a setting signal input from a terminal a corresponds to a video signal supplied from a second latch circuit 413. That is, the setting signal in FIG. 2 corresponds to the video signal supplied from the second latch circuit 413. However, since the video signal is also used to control a pixel, the video signal is not directly input to the current source circuit 420, but input thereto via a logical operator. The logical operator enables switching between the case of using the video signal to control the pixel (to display an image) and the case of using the video signal to control the current source circuit. Specifically, the setting signal input from the terminal a corresponds to the signal supplied from an output terminal of the logical operator that is connected to a setting control line (not shown in FIG. 1). The present invention performs setting of the current source circuit 420 in accordance with the timing of the signal supplied from the output terminal of the logical operator and the control line.

One of two input terminals of the logical operator is input with the signal (corresponding to the video signal) supplied from the second latch circuit, and the other input terminal is input with the signal from the setting control line. The logical operator performs a logic operation of the input two signals, and outputs a signal from the output terminal. Then, the current source circuit performs either a setting operation or an input operation according to the signal input from the output terminal of the logical operator.

The current source circuit 420 is controlled by a setting signal input via the terminal a and a signal input via the terminal d, is supplied with a current (reference current) from the terminal b, and outputs a current proportional to the current (reference current) from the terminal c.

Referring to FIG. 8(A), a circuit including switches 134 to 139, a transistor 132 (n-channel type), and a capacitor element 133 for retaining a gate-source voltage VGS of the transistor 132 corresponds to the first current source circuit 421 or the second current source circuit 422.

In the first current source circuit 421 or the second current source circuit 422, the switch 134 and the switch 136 are turned ON by the signal input via the terminal a. Further, the switch 135 and the switch 137 are turned ON by the signal input from the control line via the terminal d. Then, a current (reference current) is supplied via the terminal b from the reference constant current source 109 connected to the current line, and a predetermined charge is retained in the capacitor element 133. The charge is retained in the capacitor element 133 until the current (reference current) that flows from the constant current source 109 becomes identical with a drain current of the transistor 132.

Subsequently, the switches 134 to 137 are turned OFF by the signals input through the terminals a and d. As a result, since the predetermined charge is retained in the capacitor element 133, the transistor 132 has a capability of flowing a current having a magnitude corresponding to that of the signal current $I_{data}$. If the switch 101 (signal current control switch), the switch 138, and the switch 139 are turned to the conductive state, current flows to a pixel connected to the signal line via a terminal c. At this time, since the gate voltage of the transistor 132 is maintained at a predetermined gate voltage by the capacitor element 133, a drain current corresponding to the signal current $I_{data}$ flows to the drain region of the transistor 132. Thus, the magnitude of the current flown through the pixel can be controlled without being influenced by the variation in characteristics of the transistors constituting the signal line driver circuit.

In the case where the switch 101 (signal current control switch) is not disposed, when the switches 138 and 139 are turned to the conductive state, current flows to the pixel connected to the signal line via the terminal c.

Referring to FIG. 8(B), a circuit including switches 144 to 147, a transistor 142 (n-channel type), a capacitor element 143 for retaining a gate-source voltage VGS of the transistor 142, and a transistor 148 (n-channel type) corresponds to the first current source circuit 421 or the second current source circuit 422.

In the first current source circuit 421 or the second current source circuit 422, the switch 144 and the switch 146 are turned ON by the signal input via the terminal a. Further, the switch 145 and the switch 147 are turned ON by the signal input from the control line via the terminal d. Then, a current (reference current) is supplied via the terminal b from the constant current source 109 connected to the current line, and a charge is retained in the capacitor element 143. The charge is retained in the capacitor element 143 until the current (reference current) that is flown from the constant current source 109 becomes identical with a drain current of the transistor 142. When the switch 144 and the switch 145 are turned ON, since a gate-source voltage VGS of the transistor 148 is set to 0 V, the transistor 148 is automatically turned OFF.

Subsequently, the switches 144 to 147 are turned OFF by the signals input via the terminals a and d. As a result, since the predetermined charge is retained in the capacitor element 143, the transistor 142 has a capability of flowing a current having a magnitude corresponding to that of the signal current $I_{data}$. If the switch 101 (signal current control switch) is turned to the conductive state, current is supplied to a pixel connected to the signal line via the terminal c. At this time, the gate voltage of the transistor 142 is previously set to a predetermined gate voltage by the capacitor element 143, and a drain current corresponding to the signal current $I_{data}$ flows to the drain region of the transistor 142. Thus, the magnitude of the current flown through the pixel can be controlled without being influenced by the variation in characteristics of the transistors constituting the signal line driver circuit.

When the switches 144 and 145 are turned OFF, a gate and a source of the transistor 142 do not have the same potential. As a result, since the charge retained in the capacitor element 143 is distributed also to the transistor 148, and the transistor 148 is automatically turned ON. Here, the transistors 142 and 148 are coupled in series, and the gates thereof are connected to each other. Therefore, the transistors 142 and 148 each operate as a multi-gate transistor. That is, a gate length L of the transistor differs between the setting operation and the input operation. Thus, the value of current supplied from the terminal b in the setting operation can be made larger than the value of current supplied from the terminal c in the input operation. Thus, various loads (such as wiring resistance and cross capacitance) disposed between the terminal b and the reference constant current source can be charged even faster. Consequently, the setting operation can be completed quickly. In the case where the switch 101 (signal current control switch) is not disposed, when the switches 144 and 145 are turned OFF, current flows to the pixel connected to the signal line via the terminal c.

Note that FIG. 8(A) corresponds to a structure in which the terminal d is added to the structure of FIG. 6(A). FIG. 8(B) corresponds to a structure in which the terminal d is added to the structure of FIG. 6(B). Thus, the structures of FIGS. 6(A) and 6(B) are added with switches arranged in series, thereby being modified to those of FIGS. 8(A) and 8(B) each of which is added with the terminal d. The structure of the current source circuit shown in, for example, FIG. 6, 7, 39, 40, or 42 can be arbitrarily used by arranging two switches in series in the first current source circuit 421 or the second current source circuit 422.

The structure in which the current source circuit 420 including for each signal line the two current source circuits, namely, the first and second current source circuits 421 and 422, is shown in FIG. 2. However, the present invention is not limited to this. The number of current source circuits per one signal line is not particularly limited, and can be set arbitrarily. A plurality of current source circuits may be set such that constant current sources are provided corresponding thereto, and that signal currents are set to the current source circuits by the constant current sources. For example, three current source circuits 420 may be provided for each signal line. Then, a signal current may be set by different reference constant current sources 109 for the respective current source circuits 420. For example, it may be such that a 1-bit reference constant current source is used to set a signal current for one of the current source circuits 420, a 2-bit reference constant current source is used to set a signal current for one of the current source circuits 420, and a 3-bit reference constant current source is used to set a signal current for one of the current source circuits 420. Thus, 3-bit display can be performed.

The present invention with the above structure can suppress the influence of variation in TFT characteristics and supply a desired current to the outside.

This embodiment mode may be arbitrarily combined with Embodiment Mode 1.

Embodiment Mode 3

In this embodiment mode, the structure of a light emitting device including the signal line driver circuit of the present invention will be described using FIG. 15.

Referring to FIG. 15(A), the light emitting device includes a pixel portion 402 including a plurality of pixels arranged in matrix on a substrate 401, and includes a signal line driver circuit 403 and first and second scanning line driver circuits 404 and 405 in the periphery of the pixel portion 402. While the signal line driver circuit 403 and the two scanning line driver circuits 404 and 405 are provided in FIG. 15(A), the present invention is not limited to this. The number of driver circuits may be arbitrarily designed depending on the pixel structure. Signals are supplied from the outside to the signal line driver circuit 403 and the first and second scanning line driver circuits 404 and 405 via FPCs 406.

The structures and operations of the first and second scanning line driver circuits 404 and 405 will be described using FIG. 15(B). The first and second scanning line driver circuits 404 and 405 each include a shift register 407 and a buffer 408. The shift register 407 sequentially outputs sampling pulses in accordance with a clock signal (G-CLK), a start pulse (S-SP), and an inverted clock signal (G-CLKb). Thereafter, the sampling pulses amplified in the buffer 408 are input to scanning lines, and the scanning lines are set to be in a selected state for each line. Signals are sequentially written to pixels controlled by the selected signal lines.

Note that the structure may be such that a level shifter circuit is disposed between the shift register 407 and the buffer 408. Disposition of the level shifter circuit enables the voltage amplitude to be increased.

This embodiment mode may be arbitrarily combined with Embodiment Modes 1 and 2.

Embodiment Mode 4

In this embodiment mode, the structure and operation of the signal line driver circuit 403 shown in FIG. 15(A) will be described. In this embodiment mode, the signal line driver circuit 403 used in the case of performing 1-bit digital gradation display will be described by using FIG. 3.

First, the case corresponding to FIG. 1 will be described. In addition, a case of line-sequential drive will be described.

FIG. 3(A) is a schematic view of the signal line driver circuit 403 used in the case of performing 1-bit digital gradation display. The signal line driver circuit 403 includes a shift register 411, a first latch circuit 412, a second latch circuit 413, and a constant current circuit 414.

Operations will be briefly described. The shift register 411 is constituted by, for example, a plurality of flip-flop circuits (FF), and a clock signal (S-CLK), a start pulse (S-SP), and an inverted clock signal (S-CLKb) are input thereto. In accordance with the timing of these signals, sampling pulses are sequentially output therefrom.

The sampling pulses that have been output from the shift register 411, are input to the first latch circuit 412. Digital video signals have been input to the first latch circuit 412, and a video signal is retained in each column in accordance with the input timing of the sampling pulse.

In the first latch circuit 412, upon completion of video-signal retaining operations in columns to the last column, during a horizontal return period, a latch pulse is input to the second latch circuit 413, and video signals retained in the first latch circuit 412 are transferred in batch to the second latch circuit 413. As a result, one-line video signals retained in the second latch circuit 413 are input to the constant current circuit 414 at the same time.

While the video signals retained in the second latch circuit 413 are being input to the constant current circuit 414, sampling pulses are again output in the shift register 411. Thereafter, the operation is iterated, and one-frame video signals are processed. There may be a case where the constant current circuit 414 plays a role of converting a digital signal into an analog signal.

In the constant current circuit 414, a plurality of current source circuits 420 are provided. FIG. 3(B) outlines the signal line driver circuit in the periphery of three signal lines in i-th to (i+2)-th columns.

The current source circuit 420 is controlled by a signal input from a terminal a. In addition, the current source circuit 420 is supplied with a current via a terminal b from a reference constant current source 109 connected to a current line. A switch 101 (signal current control switch) is provided between the current source circuit 420 and a pixel connected to a signal line Sn and ON/OFF of the switch 101 (signal current control switch) is controlled by the video signal. When the video signal is a bright signal, a signal current is supplied from the current source circuit 420 to the pixel. Further, when the video signal is a dark signal, the switch 101 (signal current control switch) is controlled not to supply a current to the pixel. That is, the current source circuit 420 has a capability of flowing a predetermined current, and whether the current is supplied to the pixel or not is controlled by the switch 101 (signal current control switch).

For the structure of the current source circuit 420, the structure of the current source circuit shown in, for example, FIG. 6, 7, 39, 40, or 42 can be arbitrarily used. For the current source circuits 420, not only one structure but also a plurality of structures may be employed.

The setting signal input from the terminal a corresponds to the video signal supplied from the second latch circuit 413. However, since the video signal is also used for control of the pixel, the video signal is not directly input to the current source circuit 420, and is input thereto via a logical operator. Specifically, the setting signal input from the terminal a corresponds to the signal supplied from an output terminal of the logical operator that is connected to a setting control line. In the present invention, setting of the current source circuit 420 is performed in accordance with the signal input from the output terminal of the logical operator connected to the setting control line.

One of two input terminals of the logical operator is input with the signal (corresponding to the video signal) supplied from the second latch circuit and the other terminal is input with the signal from the setting control line. The logical operator performs a logic operation of the input two signals, and outputs a signal from the output terminal. Then, in the current source circuit, a setting operation or an input operation is performed in accordance with the signal supplied from the output terminal of the logical operator.

Note that, in the case where the structure shown in either FIG. 6(A) or 7(A) is used for the current source circuit 420, the setting operation cannot be performed while the input operation is performed, as described above. Therefore, the setting operation needs to be performed in a period during which the input operation is not performed. However, a case can occur where periods during which the input operation is not performed do not exist continuously but are dotted in one frame period. In this case, it is preferable to allow random selection for an arbitrary column instead of sequential selection for respective columns.

In the present invention, the video signal is used to specify the current source circuit when performing the setting operation of the current source circuit. Therefore, the setting operation of the current source circuit can also be not performed sequentially from the first to last columns but performed at random. Specifically, the video signal is inherently a signal containing image information. Thus, it can be easily realized that image information related to a certain column is set to have the same value as that of image information related to another column, and that image information related to only a certain column is set to have a unique value and pieces of image information related to other columns are set to have identical values. That is, the value of the video signal of each column can be set arbitrarily. Therefore, when a video signal of only a certain column is set to have a unique value, only the column can be set to a selected state. When performing the setting operation for the subsequent current source circuit, a video signal of only a completely different column is to have a unique value so that only the column can be set to the selected state. In this way, an arbitrary column can be selected without sequentially selecting respective columns.

Moreover, the time length for performing the setting operation can be set arbitrarily long. Specifically, using the video signal, a current source circuit in a certain column is specified to start the setting operation and then, arbitrarily setting can be performed as to when to perform the setting operation for a current source circuit in the subsequent column. Accordingly, for example, when one period exists during which the setting operation can be performed, the period may be fully used either to perform the setting operation for a current source circuit only in a certain column or to perform the setting operation for current source circuits in a plurality of columns. Thus, the time length for performing the setting operation can be set long.

When the setting operation can be performed at random for the current source circuit as described above, various advantages are exhibited. For example, in the case where periods during which the setting operation can be performed are dotted in one frame, when an arbitrary column can be selected, the degree of freedom is increased, and the setting operation period can be set long. Even if periods during which the setting operation can be performed are dotted in one frame, in the case where an arbitrary column cannot be selected, and the columns need to be sequentially performed from the first column, one of the periods during which the setting operation can be performed and which are dotted in one frame needs to be used to sequentially select the columns from the first column. Consequently, the setting operation period per column is short.

Another advantage is that the influence of charge leakage in the capacitor element (corresponding to, for example, a capacitor element 103 in FIG. 6(A), a capacitor element 123 in FIG. 6(B), or a capacitor element 107 in FIG. 6(C)) disposed in the current source circuit 420 can be made inconspicuous. Thus, when a defect has occurred in association with the setting operation, the defect can be made inconspicuous.

Thus, the capacitor element is disposed in the current source circuit 420. However, the capacitor element may be substituted by a gate capacitance of the transistor. A predetermined charge is accumulated in the capacitor element through the setting operation for the current source circuit. Ideally, the setting operation for the current source circuit may be performed only once when the power source is input. Specifically, when the signal line driver circuit is operated, the setting operation may be performed only once during the initial period of the operation. This is because the amount of charge accumulated in the capacitor element does not need to be varied depending on, for example, the operation state and the time, and is not varied. In practice, however, various noises may enter the capacitor element, or a leak current flows from the transistor connected to the capacitor element. As a result, the amount of charge accumulated in the capacitor element may gradually vary as time passes. When the charge amount varies, the current to be output from the current source circuit varies. As a result, the current to be input to the pixel varies. This varies the luminance of the pixel. To prevent the variation in the charge accumulated in the capacitor element, there arises a need that the setting operation for the current source circuit is periodically performed in a certain cycle, the charge is refreshed, the varied charge is returned to the original state, and the proper amount of charge is restored.

Suppose, in the case where the amount of charge accumulated in the capacitor element is large, the setting operation for the current source circuit is performed, the charge is refreshed, the varied charge is returned to the original state, and the proper amount of charge is restored. In association with this, the variation is increased in the amount of the current output from the current source circuit. Thus, when the setting operation is sequentially performed from the first column, a case may occur in which there develops a display disturbance at a degree that the variation in the amount of the current output from the current source circuit is recognizable by the human eye. That is, a case may occur in which there develops a display disturbance at a degree that the variation in the luminance of the pixel, which is caused sequentially from the first column, is recognizable by the human eye. In this case, when the setting operation is not sequentially performed from the first column but performed at random, the variation in the amount of current output from the current source circuit can be made inconspicuous. As described above, the random selection for the plurality of wirings produces various advantages.

With reference to FIG. 3(B), although the setting operation is performed in for each column, the present invention is not limited to this. As shown in FIG. 44, the setting operation may be simultaneously performed for a plurality of columns. Hereinafter, "to perform the setting operation for a plurality of columns at a time" is referred to as "to make multi phases". Referring to FIG. 44, while two reference constant current sources 109 are disposed, the setting operation may be performed for the two reference constant current sources through differently disposed reference constant current sources.

A detailed structure of the constant current circuit 414 shown in FIG. 3(B) is shown in FIGS. 45 and 46. FIG. 45 shows the circuit in the case where FIG. 6(C) is applied to the portion of the current source circuit. FIG. 46 shows the circuit in the case where FIG. 6(A) is applied to the portion of the current source circuit.

The video signal is used not only for specification of the current source circuit but for the original use, that is, the pixel control. Thus, the video signal is not directly input to a current source circuit 420, and is input thereto via a logical operator. In addition, the signal is also input to the logical operator from the setting control line. The logical operator performs a logic operation of the two signals, namely, the video signal and the signal input from the setting control line, and output a signal through the output terminal. According to the signal that has been output from the logical operator, the setting operation is controlled for the current source circuit.

In this way, the logical operator performs control to switch between the pixel control (image display) and the current source circuit control for the video signal. Therefore, the circuit is not limited to the logical operator, and may be any circuit as long as the circuit is capable of conducting switching between the pixel control and the current source circuit control. As an example, as shown in FIG. 45, 46, or the like, a switch may be provided to perform switching.

So far, the case of line-sequential drive has been described. Next, the case of dot-sequential drive will be described.

Referring to FIG. 47(A), a video signal supplied from a video line is sampled in accordance with the timing of a sampling pulse supplied from a shift register 411. Further, the setting operation for a current source circuit 420 is performed in accordance with the video signal. Thus, the dot-sequential drive is performed for the case of the structure shown in FIG. FIG. 47(A).

Note that, in the case where: only in the period during which the sampling pulse is output, and the video signal is supplied from the video line, a switch 101 (signal current control switch) is turned to the ON state; and no sampling pulse is output, no video signal is supplied from the video line, and then, the switch 101 (signal current control switch) is turned to the OFF state, operation is not conducted precisely. This is because the switch for inputting a current remains in the ON state. In this state, when the switch 101 (signal current control switch) is set to the OFF state, since the current is not input to the pixel, the signal cannot be input precisely.

A latch circuit 452 is disposed so that the video signal supplied from the video line can be retained and that the state of the switch 101 (signal current control switch) can be retained. The latch circuit 452 may either be constituted only by a capacitor element and a switch or be constituted by an SRAM circuit. In this way, the sampling pulse is output, the video signal is supplied from the video line for each column, the switch 101 (signal current control switch) is set to the ON state or the OFF state in accordance with the video signal, and the supply of the current to the pixel is controlled. Thus, the dot-sequential drive can be implemented.

An output (video signal) of the latch circuit 452 is used for the pixel control but is also used for the setting operation for the current source circuit. Since switching is conducted for each usage, the output (video signal) of the latch circuit 452 is not directly input to the current source circuit 420, but is input thereto via a logical operator 262. The logical operator 262 enables the switching between the case of using the video signal for the pixel control (image display) and the case of using the video signal for the current source circuit control.

However, when selection is sequentially performed from the first column to the last column, a period for inputting the signal to the pixel is relatively long in a column on the side of the first column. On the other hand, when the video signal is input, the subsequent column pixel is immediately selected on the side of the last column. As a result, a period for inputting the signal to the pixel becomes short. In this case, as shown in FIG. 47(B), the period for inputting the signal to the pixel can be prolonged by dividing the scanning line disposed in a pixel portion 402 at the center. In this case, one scanning line driver circuit is disposed on each of the left and right sides of the pixel portion 402, and the scanning line driver circuit is used to drive the pixel. In this way, periods for inputting the signal to the right pixel and the left pixel can be differentiated from each other. FIG. 47(C) shows output waveforms of the scanning line driver circuits disposed left and right in the first and second lines, and a start pulse (S-SP) for the shift register 411. According to the operations thus performed, the period for inputting the signal even to the left pixel can be prolonged, and the dot-sequential drive is thus facilitated.

Regardless of whether the line-sequential drive or the dot-sequential drive is performed, the setting operation for the current source circuit 420 may be performed for the current source circuit disposed in an arbitrary column with an arbitrary timing and for an arbitrary number of times. Ideally, however, only the setting-dedicated setting operation may be performed only once as long as a predetermined charge is stored in the capacitor element connected between the gate and the source of the transistor disposed in the current source circuit 420. Alternatively, the setting operation may be performed when the predetermined charge retained in the capacitor element has discharged (varied). Further, as to the setting operation for the current source circuit, the setting operation may be performed for the current source circuits 420 in all the columns using time. That is, the setting operation may be performed for the current source circuits 420 in all the columns within one frame period. Alternatively, it may be such that the setting operation is performed only for the current source circuits 420 in several columns within one frame period, as a result of which the setting operation is performed for all the current source circuits 420 in all the columns.

As above, while the case where one current source circuit is disposed in each column has been described, the present invention is not limited to this, and a plurality of current source circuits may be disposed.

As an example, a case where FIG. 2 is applied to the portion of the current source circuit of FIG. 3(B) is considered. The structure of the constant current circuit 414 in the above case is shown in FIG. 48 in detail. FIG. 48 shows the circuit in the case where FIG. 6(A) is applied to the potion of the current source circuit. Under the control of a control line, the setting operation can be performed for one of the current source, and the input operation can be simultaneously performed for the other current source.

Furthermore, regarding the current source circuit in the signal line driver circuit according to the present invention, a layout diagram is shown in FIG. 87, and a corresponding circuit diagram is shown in FIG. 88.

Note that this embodiment mode may be arbitrarily combined with Embodiment Modes 1 to 3.

Embodiment Mode 5

In this embodiment mode, the detailed structure and operation of the signal line driver circuit 403 shown in FIG. 15(A) will be described. In this embodiment mode, a description is made of the signal line driver circuit 403 used in the case of performing 3-bit digital gradation display.

FIG. 4 is a schematic view of the signal line driver circuit 403 in the case of performing the 3-bit digital gradation display. The signal line driver circuit 403 includes a shift register 411, a first latch circuit 412, a second latch circuit 413, and a constant current circuit 414.

The operation will be briefly described below. The shift register 411 is formed using, for example, a plurality of flip-flop circuits (FF), and is input with a clock signal (S-CLK), a start pulse (S-SP), and an inverted clock signal (S-CLKb). In accordance with the timing of these signals, sampling pulses are sequentially output therefrom.

The sampling pulses, which have been output from the shift register 411, are input to the first latch circuit 412. 3-bit digital video signals (Digital Data 1 to Digital Data 3) have been input to the first latch circuit 412, and a video signal is retained in each column in accordance with the timing at which the sampling pulse is input.

In the first latch circuit 412, upon completion of video-signal retaining in columns to the last column, during a horizontal return period, a latch pulse is input to the second latch circuit 413, and the 3-bit digital video signals (Digital Data 1 to Digital Data 3) retained in the first latch circuit 412 are transferred in batch to the second latch circuit 413. Then, the 3-bit digital video signals (Digital Data 1 to Digital Data 3) for one line, which are retained in the second latch circuit 413, are input to the constant current circuit 414 at a time.

While the 3-bit digital video signals (Digital Data 1 to Digital Data 3) retained in the second latch circuit 413 are input to the constant current circuit 414, sampling pulses are again output in the shift register 411. Thereafter, the operation is iterated, and video signals for one frame are thus processed.

There is a case where the constant current circuit 414 plays a role of converting a digital signal into an analog signal. In the constant current circuit 414, a plurality of current source circuits 420 are provided. FIG. 5 is a schematic view of the signal line driver circuit related to the three signal lines in i-th to (i+2)-th columns.

Note that FIG. 5 shows the case where a reference constant current source 109 corresponding to each bit is arranged.

Each current source circuit 420 has a terminal a, a terminal b, and a terminal c. The current source circuit 420 is controlled by a signal input from the terminal a. Further, current is supplied via a terminal b from a reference constant current source 109 connected to a current line. Switches (signal current control switches) 111 to 113 are provided between the current source circuit 420 and a pixel connected to a signal line Sn, and the switches (signal current control switches) 111 to 113 are controlled by 1-bit to 3-bit video signals. In the case where the video signal is a bright signal, a current is supplied from the current source circuit to the pixel. On the contrary, in the case where the video signal is a dark signal, the switches (signal current control switches) 111 to 113 are controlled not to supply current to the pixel. That is, the current source circuit 420 has a capability of flowing a predetermined current, and the switches (signal current control switches) 111 to 113 control whether the current is supplied to the pixel or not.

Referring to FIG. 5, the current lines and the reference constant current sources are disposed in correspondence with respective bits. The sum of the values of currents supplied from the current sources of the respective bits is supplied to the signal lines. That is, the constant current circuit 414 also has a function of digital-analog conversion.

Note that the setting signal input from the terminal a corresponds to the video signal supplied from the second latch circuit 413. However, since the video signal is also used to control the pixel, the video signal is not directly input to the current source circuit 420, but input thereto via a logical operator. That is, the setting signal input from the terminal a corresponds to the signal supplied from an output terminal of the logical operator that is connected to a setting control line. In the present invention, setting of the current source circuit 420 is performed in accordance with the signal input from the output terminal of the logical operator that is connected to the setting control line.

One of two input terminals of the logical operator is input with the signal (corresponding to the video signal) supplied from the second latch circuit, and the other terminal is input with the signal from the setting control line. The logical operator performs a logic operation of the input two signals, and outputs a signal from the output terminal. That is, the current source circuit 420 performs the setting operation or the input operation in accordance with the signal supplied from the output terminal of the logical operator connected to the setting control line.

In this embodiment mode, because of a description with reference to an example of the case of performing 3-bit digital gradation display, three current source circuits 420 are provided for each column. When signal currents supplied from the three current source circuits 420 connected to one signal line are set to a ratio of 1:2:4, the current magnitude can be controlled at $2^3=8$ levels.

For the structure of the current source circuit 420, the structure of the current source circuit 420 shown in, for example, FIG. 6, 7, 39, 40, or 42 can be arbitrarily used. For the current source circuits 420, not only one structure but also a plurality of structures may be employed.

In the signal line driver circuit shown in FIG. 5, although dedicated reference constant current sources 109 are respectively disposed for the 1-bit to 3-bit, the present invention is not limited to this. As shown in FIG. 49, reference constant current sources 109 the number of which is smaller than the number of bits may be disposed. For example, it may be such that only the reference constant current source 109 for the most significant bit (3-bit in this case) is disposed; one current source circuit selected from a plurality of current source circuits disposed in one column is set; and using the current source circuit for which the setting operation has already been performed, the operation is performed for other current source circuits. In other words, the current source circuit for which the setting operation has already been performed may be used to share setting information.

For example, a setting operation is performed only for a 3-bit current source circuit 420. Then, using the current source circuit 420 for which the setting operation has been performed, information is shared among other 1-bit and 2-bit current source circuits 420. More specifically, among current source circuits 420, the gate terminal of each current-supplying transistor (corresponding to a transistor 102 in FIG. 6(A)) is connected, and also the source terminal is connected. As a result, gate-source voltages of information-sharing transistors (current-supplying transistors) become identical.

Referring to FIG. 49, the setting operation is performed not for the current source circuits of the least significant bit (1-bit in this case), but for the current source circuits of the most significant bit (3-bit in this case). Thus, when the setting operation is performed for the current source circuits of a greater-value bit, the influence of variation in characteristics of inter-bit current source circuits can be reduced. Suppose the setting operation is performed for the current source circuits of the least significant bit (1-bit in this case), information related to the setting operation performed for the current source circuits of the least significant bit is shared among the current source circuits of the upper bits. In this case, when the characteristics of the respective current source circuits vary, the values of currents of the upper bits lack precision. This is because since upper-bit current source circuits produce outputs having great current values, even when a small variation has occurred in their characteristics, the influence of the variation is magnified, and also output current values are also varied great. In contrast, in the case where the setting operation is performed for the current source circuits of the most significant bit (3-bit in this case), information related thereto is shared among the current source circuits of the lower bits. Even when the characteristics of the respective current source circuits have varied, since output current values are small, differences in the current value due to variation are small, and the influence is small.

Hereinafter, as an example, the structure of the constant current circuit 414 in FIGS. 4, 5, and 49 is shown in FIGS. 23, 24, and 50 in more detail. In a current source circuit 420 provided in each of FIGS. 23, 24, and 50, whether or not a predetermined signal current is output to a signal line Si ($1 \leqq i \leqq n$) is controlled according to information contained in a digital video signal input from a second latch circuit 413.

Meanwhile, as shown in FIG. 6(C), when the current source circuit 420 is comprised of the structure having a current mirror circuit, the structure may be alternatively such that the gate electrodes of transistors in the current source circuit 420 are commonly connected, as shown in FIGS. 23 and 24.

FIG. 50 is a circuit diagram in the case where the current source circuit of FIG. 6(A) is disposed in the signal line driver circuit shown in FIG. 5. In FIG. 50, the setting operation is performed with transistors A to C being turned OFF. This is for preventing a current leakage. Alternatively, switches may be disposed in series with the transistors A to C, in which the switches are turned OFF in the setting operation.

Illustrated in FIGS. 23 and 24 are cases where the reference constant current sources 109 the number of which is fewer than the number of bits are disposed. FIG. 23 is a circuit diagram in the case where the current source circuit of FIG. 6(C) is disposed in the signal line driver circuit shown in FIG. 49. FIG. 24 is a circuit diagram in the case where the current source circuit of FIG. 6(A) is disposed in the signal line driver circuit of FIG. 49.

Referring to FIG. 23, in a current source circuit 420 provided in each column, whether or not a predetermined signal current $I_{data}$ is output to the signal line Si ($1 \leqq i \leqq n$) is controlled according to High or Low information contained in a 3-bit digital video signal (Digital Data 1 to Digital Data 3) input from a second latch circuit 413.

The current source circuit 420 includes transistors 180 to 188 and a capacitor element 188. In this embodiment mode, the transistors 180 to 188 are all of n-channel type.

A 1-bit digital video signal is input to a gate electrode of the transistor 180 from the second latch circuit 413. One of a source region and a drain region of the transistor 180 is connected to the source signal line (Si), and the other is connected to one of a source region and a drain region of the transistor 183.

A 2-bit digital video signal is input to a gate electrode of the transistor 181 from the second latch circuit 413. One of a source region and a drain region of the transistor 181 is connected to the source signal line (Si), and the other is connected to one of a source region and a drain region of the transistor 184.

A 3-bit digital video signal is input to a gate electrode of the transistor 182 from the second latch circuit 413. One of a source region and a drain region of the transistor 182 is connected to the source signal line (Si), and the other is connected to one of a source region and a drain region of the transistor 185.

One of the source region and the drain region of each of the transistors 183 to 185 is connected to Vss, and the other is connected to one of the source region and the drain region of each of the transistors 180 to 182. One of a source region and a drain region of the transistor 186 is connected Vss, and the other is connected to one of a source region and a drain region of the transistor 188.

A signal is input from an output terminal of an AND 193 to the gate electrodes of the transistors 187 and 188. One of input terminals of the AND 193 is connected to a control line, and the other is connected to the second latch circuit 413. In FIG. 23, the one input terminal of the AND 193 is connected to the control line, and the other is connected to the 1-bit latch circuit (1st Bit). However, the present invention is not limited to this. One of the input terminals of the AND 193 may be connected to any one of the 1-bit latch circuit (1st Bit), a 2-bit latch circuit (2nd Bit), and a 3-bit latch circuit (3rd Bit).

One of the source region and the drain region of the transistor 187 is connected to one of the source region and the drain region of the transistor 186, and the other is connected to one of electrodes of a capacitor element 189. One of the source region and the drain region of the transistor 188 is connected to a current line 190, and the other is connected to one of the source region and the drain region of the transistor 186.

One of the electrodes of the capacitor element 189 is connected to the gate electrodes of the transistors 183 to 186, and the other electrode is connected to Vss. The capacitor element 189 plays a role of retaining the gate-source voltages of the transistors 183 to 186.

In the current source circuit 420, when the transistor 187 and the transistor 188 are turned ON, a current flows to the capacitor element 189 from a reference constant current source (not shown) connected to the current line 190. At this time, the transistors 180 to 182 are OFF.

Charge is then gradually accumulated in the capacitor element 189, and an potential difference begins to occur between both the electrodes. When the potential difference between both the electrodes has reached $V_{th}$, the transistors 183 to 186 are turned ON.

The charge accumulation continues until the potential difference between both the electrodes, that is, each gate-source voltage of the transistors 183 to 186 increases up to a desired voltage. In other words, the charge accumulation continues until the transistors 183 and 186 each reach a voltage that allows to the signal current to flow.

Upon completion of the charge accumulation, the transistors 183 and 186 are fully turned ON.

Subsequently, in the current source circuit 420, conductivity/non-conductivity of the transistors 180 to 182 is selected according to the 3-bit digital video signal. For example, when all the transistors 180 to 182 are turned to the conductive state, the current supplied to the signal line (Si) corresponds to the sum of the drain current of the transistor 183, the drain current of the transistor 184, and the drain current of the transistor 185. When only the transistor 180 has been turned to the conductive state, only the drain current of the transistor 183 flows to the signal line (Si).

As described above, the gate terminals of the transistors 183 to 185 are connected, whereby setting-operation information can be shared.

Here, the setting-operation information is shared among the transistors disposed in the same column, but the present invention is not limited to this. For example, the setting-operation information may be shared also with transistors in a different column. That is, the transistor gate terminals may be connected to the different column transistors. Thus, the number of current source circuits to be set can be reduced. Consequently, time required for the setting operation can be reduced. In addition, since the number of circuits can be reduced, the layout area can be made small.

In FIG. 24, the setting operation is performed for the current source circuit with the transistors 182 being turned OFF. This is for preventing a current leakage. Further, FIG. 51 is a circuit diagram of a current source circuit in the case where a switch 203 is disposed in series with the transistor 182 in the structure of FIG. 24. Referring to FIG. 51, the switch 203 is turned OFF in the setting operation, and is turned ON in other time.

At this event, in FIGS. 23, 24, and 51, when the drain current of the transistor 183, the drain current of the transistor 184, and the drain current of the transistor 185 are set to a ratio of 1:2:4, the current magnitude can be controlled at $2^3=8$ levels. Thus, when design is performed with the values of W (channel width)/L (channel length) of the transistors 183 to 185 set to 1:2:4, the respective ON currents are set to 1:2:4.

As described above, since the video signal is used in two uses for the pixel control and the current source circuit control, the signal is not directly input to the current source circuit 420, but input thereto via a logical operator. In FIG. 23, the logical operator corresponds to the AND 193.

One of the input terminals of the AND 193 is connected to the setting control line, and the other is connected to the second latch circuit 413. In FIG. 23, the one input terminal of the AND 193 is connected to the setting control line, and the other is connected to the 1-bit latch circuit. However, the present invention is not limited to this. One of the input terminals of the AND 193 may be connected to any one of the 1-bit to 3-bit latch circuits.

FIG. 24 shows the current source circuit 420 having a circuit structure different from that of FIG. 23. The current source circuit 420 in FIG. 24 is structured such that a switch 191 and a switch 192 are disposed to replace the transistors 186 to 188.

A signal is input from the output terminal of the AND 193 to each of the switches 191 and 192. One of the input terminals of the AND 193 is connected to the control line, and the other is connected to the second latch circuit 413. In FIG. 23, the one input terminal of the AND 193 is connected to the control line, and the other is connected to the 3-bit latch circuit (3rd Bit) via an inverter 194. However, the present invention is not limited to this. One of the input terminals of the AND 193 may be connected to any one of the 1-bit latch circuit (1st Bit), the 2-bit latch circuit (2nd Bit), and the 3-bit latch circuit (3rd Bit).

In FIG. 24, although one of the terminals of the switch 191 is connected to the drain region of the transistor 185, the present invention is not limited to this. One of the terminals of the switch 191 may be connected to one of the drain regions of the transistors 183 to 185. In this case, however, as shown in FIG. 24, when the input terminal of the AND 193 is connected to the latch circuit (3-bit latch circuit (3rd Bit) in FIG. 24) that retains the video signal that controls the transistor 185 to which one of the terminals of the switch 191 is connected, the terminal needs to be connected to the latch circuit via the inverter 194.

The current source circuit 420 shown in FIG. 24 is similar in operation to the current source circuit 420 shown in FIG. 23 except the point in that when the switches 191 and 192 are turned ON, a current flows to the capacitor element 189 via the transistor 185 from the reference constant current source (not shown) connected to the current line 190. Thus, a description thereof will be omitted in this embodiment mode.

Meanwhile, in this embodiment mode, while all the transistors contained in the current source circuit 420 shown in FIG. 23 or 24 are of n-channel type, the present invention is not limited to this. P-channel transistors may also be used. Operation of the current source circuit 420 in the case of using the p-channel transistors is similar to the operation described above except the point in that the direction in which a current flows is changed and the point in that the capacitor element is connected to not Vss but Vdd. Thus, a description thereof will be omitted.

When using the p-channel transistors, the case where Vss is not replaced with Vdd, that is, the case where the current-flow direction is not changed can be easily applied with the comparison between FIG. 6 and FIG. 7.

Note that, in this embodiment mode, the description has been made of the structures and operations of the signal line driver circuits in the case where the 3-bit digital gradation display is carried out. However, the present invention is not limited to the 3-bit. It is possible that signal line driver circuits corresponding to arbitrary number of bits are designed with reference to this embodiment mode, thereby performing display with an arbitrary number of bits. In addition, this embodiment mode may be arbitrarily combined with Embodiment Modes 1 to 4.

Further, with reference to this embodiment mode, for example, multi phases and dot-sequential drive can be easily realized when performing display with an arbitrary number of bits.

One current source circuit for each bit is disposed for each signal line in FIG. 5. However, as shown in FIG. 2, a plurality of current source circuits may be disposed for each signal line. The diagram at this time is shown in FIG. 52. Similarly, although one constant current source 109 is disposed for each bit in the structure of FIG. 49, the constant current source 109 may be shared by the plurality of bits, as shown in FIG. 53.

Embodiment Mode 6

In the present invention, it has been described that the setting signal input from the terminal a shown in FIGS. 1 and 2 refers to the signal input from the output terminal of the logical operator connected to the setting control line (not shown). Although the control line is shown in FIG. 2, the line is a different wiring from the setting control line. A signal input from the output terminal of the logical operator connected to the setting control line is used as the setting signal.

One of the two input terminals of the logical operator is input with the signal (corresponding to the video signal) that is output from the second latch circuit 413, and the other input terminal is input with the signal supplied from the setting control line. The logical operator performs a logic operation of the input two signals and outputs a signal through the output terminal. According to the signal input from the output terminal of the logical operator, the current source circuit conducts either a setting operation or an input operation.

In this embodiment mode, the timing of the setting operation of the current source circuit will be described using FIGS. 25 to 31.

In this embodiment mode, a description will be made in broad classification: a driving method (referred to as full-frame method) with which one frame period is not divided, as shown in FIG. 25(B), and a driving method (referred to as subframe method) with which one frame period is divided into a plurality of subframe periods, as shown in FIG. 26(A).

Hereinafter, the full-frame method will first be described using FIG. 25, and the subframe method will then be described.

In ordinary display devices such as liquid crystal display devices and light emitting devices, a frame frequency is about 60 (Hz). That is, as shown in FIG. 25(A), the device performs screen renderings about 60 times per second. Thus, flickers (flickering of a screen) can be made unrecognizable by the human eye. A period during which one screen rendering is performed is referred to as one frame period.

In the case of the full-frame method, as shown in FIG. 25(B), a period represented by Tc is provided after scanning lines are selected from the first line to the last line in one frame period. The period during which the scanning lines are selected from the first line to the last line corresponds to a period during which signals are input to pixels. FIGS. 25(C) and 25(E) each show a video signal waveform in the period Tc. The video signal waveform is variable among frames. As examples, the video signal waveforms in three frames are shown. The length of the setting period Tc is not specifically limited, but is preferably set identical to a one-gate selection period (one horizontal scan period).

As an example, FIG. 25(C) shows a video signal waveform in a period Tc1 of the first frame. At this time, the video signal waveform is controlled such that an output from the second latch circuit 413 to the current source circuit provided in an i-th column becomes High. FIG. 25(D) shows a video signal waveform in a period Tc2 of the second frame. At this time, the video signal waveform is controlled such that an output from the second latch circuit 413 to the current source circuit provided in a j-th column becomes High. FIG. 25(E) shows a video signal waveform in a period Tc3 of the third frame. At this time, the video signal waveform is controlled such that an output from the second latch circuit 413 to the current source circuit provided in a k-th column become High.

The setting period Tc corresponds to a period during which the current source circuit for which a setting operation is performed is specified among a plurality of current source circuits contained in the signal line driver circuit. That is, in the setting period Tc, a video signal waveform is controlled so that a video signal in a column of a current source circuit for which a setting operation is performed becomes High. As shown in FIGS. 25(C) to 25(E), in the setting period Tc, the current source circuit for which a setting operation is performed is specified for each frame period.

In one frame period, not only one setting period Tc, but also a plurality of setting periods Tc may be provided. In addition, the setting period Tc may not be provided to a border portion of frame periods, and may be provided elsewhere within one frame period. In addition, in FIGS. 25(C) to 25(E), it may be such that video signal waveforms in any one of the first to last columns are not controlled to become High, and that video signal waveforms of current source circuits in a plurality of columns of the first to last columns are controlled to become High.

In the case where the setting operation and the input operation can be performed simultaneously for current source circuits of the signal line driver circuit, the current source circuits for which the setting operation is performed are specified in the setting period Tc, and the setting operation is performed in the other period. The input operation is also performed at the same time.

On the other hand, in the case where the setting operation and the input operation cannot be performed simultaneously for current source circuits, current source circuits for which the setting operation is performed are specified in the setting period Tc, and also the setting operation is performed in the setting period Tc. For this reason, in this case, the setting period Tc needs to be a period sufficient for the setting operation of the current source circuits to be performed. However, the setting operation does not need to be performed for all the current source circuits within one frame period, and the setting operation may be performed for all the current source circuits by using several frame periods.

Even in the case where the setting operation and the input operation can be performed simultaneously for current source circuits, it may be such that current source circuit for which the setting operation is performed are specified in the setting period Tc, and the setting operation is performed in the setting period Tc.

Next, the subframe method will be described using FIG. 26. In the subframe method, as shown in FIG. 26(A), one frame period is divided into a plurality of subframe periods having mutually different lengths. In many cases, the number of divisions is identical to the number of gradation bits. FIG. 26 shows, an example, a case where a frame period is divided into three subframe periods SF1 to SF3.

Each of the subframe periods includes an address period (Ta) and a sustain period (Ts). The address period is a period during which a signal is written to a pixel, and the length thereof is the same in respective subframe periods. The sustain period (Ts) is a period during which the light emitting element emits light in response to the signal written in the address period (Ta).

According to the subframe method, when providing the period Tc, the period Tc may be disposed either only one time after completion of the address period (Ta) set in a certain subframe period SF as shown in FIG. 26(B) or a plurality of times in one frame period, as shown in FIG. 26(C). As a matter of course, the period Tc may be disposed after completion of address periods in all subframe periods, be disposed in an address period, or be disposed for each arbitrary frame period.

According to the subframe method, when providing the period Tc, the period Tc may be disposed either only one time after completion of the address period set in a certain subframe period SF as shown in FIG. 26(B) or a plurality of times in one frame period, as shown in FIG. 26(C). As a matter of course, the period Tc may be disposed after completion of address periods in all subframe periods, or be disposed in an address period. Further, the period Tc may be disposed for each arbitrary frame period.

It has been described that the setting signal input from the terminal a refers to the signal input from the output terminal of the logical operator connected to the setting control line in FIGS. 1 and 2. Also described in the above is that the signal (corresponding to the video signal) output from the second latch circuit is input to one of the two input terminals of the logical operator, and the signal is input to the other terminal from the setting control line. In this connection, while the setting control line is not shown in FIGS. 1 and 2, FIGS. 26(B) and 26(C) show signal waveforms that are output from the setting control line connected with the input terminal of the logical operator that outputs the setting signal.

FIGS. 26(B) and 26(C) show the waveforms of the setting control line. Setting is performed such that the waveform of the setting control line in each of FIGS. 26(B) and 26(C) becomes High in the period (shown as a setting period Tb) from the completion of the setting period Tc to the commencement of a subsequent address period. In FIGS. 26(B), setting is performed such that the waveform of the setting control line becomes High in the period (setting period Tb1) from the completion of the setting period Tc to the commencement of an address period Ta2. In FIG. 26(C), setting is performed such that the waveform of the setting control line becomes High in the period (setting period Tb1) from the completion of the setting period Tc to the commencement of an address period Ta1 and in the period (setting period Tb2) from the completion of the setting period Tc to the commencement of an address period Ta2.

From the above, when a current source circuit is not engaged in an input operation (output of a current to a pixel), a setting operation can be performed for the current source circuit disposed in the signal line driver circuit in the setting period Tb1 or the setting period Tb2. If a period for performing an input operation occurs, the setting control line may be temporarily set to Low so that a setting operation is not performed only in that period. However, in the case where the setting operation and the input operation can be performed at the same time with the current source circuit disposed in the signal line driver circuit, the setting operation can be performed for the current source circuit even while the current source circuit is engaged in the input operation (input of a current to a pixel).

As described above, in the setting period Tc, a current source circuit for which the setting operation is performed is specified among current source circuits contained in the signal line driver circuit. If a current source circuit 420 provided in the i-th column is specified, the setting operation can be performed therefor by setting the wavelength of the setting control line in the period Th from the completion of the setting period Tc to the commencement of a subsequent address period High.

Next, referring to FIGS. 27 to 31, a description will be made of setting-operation timings of current source circuits in a signal line driver circuit having a structure that, dissimilar to the above-described structure, includes storage circuits 451 in addition to current source circuits 420.

FIG. 27 shows a case in which one current source circuit 420 is arranged in each column. FIG. 28 shows a case in which two current source circuits 420 are disposed in each column. In the structure of FIG. 27, when there is a period during which the setting operation and the input operation are performed simultaneously, current source circuits 420 capable of simultaneously performing the setting operation and the input operation need to be used. On the other hand, in the structure of FIG. 28, the two current source circuits 420 are provided in each column, the one being capable of performing the setting operation, and the other being capable of the input operation. Thus, the structure of the current source circuit 420 used in FIG. 28 is not particularly limited. Note that, for the storage circuits 451 shown in FIGS. 27 and 28, known circuits may be used as long as they are circuits including means of storing data.

Signal waveforms of a storage control line shown in FIGS. 27 and 28 will be described using FIG. 29. First, the signal waveform of the storage control line in the full-frame method will be described using FIG. 29(A), and then, the signal waveform of the storage control line in the subframe method will be described using FIGS. 29(B) and 29(C).

As shown in FIGS. 29(A) to 29(C), according to both the full-frame method and the subframe method, the waveform of the storage control line is set to become High in the setting period Tc. Thus, in the current source circuit 420, the setting operation can be performed in the period from the completion of the setting period Tc to the commencement of the subsequent setting period Tc.

Note that, when the waveform of the storage control line has become High, switches 450 are turned ON to allow data (video signal) to enter the storage circuits 451. When the waveform of the storage control line has become Low, the switches 450 are turned OFF to allow data (video signal) to be continuously retained in the storage circuits 451.

Therefore, even when a video signal varies while the setting operation is performed for a current source circuit, since information related to the specified current source is stored in the storage circuit 451, the operation is not influenced by the variation in the video signal. Note that the period during which the video signal varies corresponds to, for example, an address period. In the case where the setting operation and the input operation can be performed simultaneously for the current source circuit in the signal line driver circuit, the setting operation can be performed for the current source circuit even while the current source circuit is engaged in the input operation (output of a current to the pixel). The period during which the input operation (output of a current to the pixel) is performed for the current source circuit corresponds to, for example, an address period as an example.

In one frame period, either one setting period Tc, or a plurality of setting periods Tc may be provided. Further, the setting period Tc may be provided anywhere within one frame period. In addition, it may be such that video signal waveforms in any one of the first to last columns are not controlled to become High, and that video signal waveforms in a plurality of columns of the first to last columns are controlled to become High.

Next, referring to FIG. 30, a description will be made of, as a different example from that in the above, a case in which one current source circuit 420 is provided in each column. In the structure shown in FIG. 30, one current source circuit 420 is disposed in each column. In the current source circuit, there occurs a case where the setting operation and the input operation cannot be performed simultaneously. Thus, a case occurs in which the setting operation needs to be performed while the input operation is not being performed, and the input operation needs to be performed while the setting operation is not being performed.

In the structure shown in FIG. 30, logical operators 452 are disposed, an output of the storage circuit 451 is input to one of input terminals of the logical operator 452 (AND in FIG. 30), and a signal that is output from a second storage control line is input to the other input terminal. A signal that is output from the output terminal of the logical operator corresponds to the setting signal for the current source circuit 420.

Also in FIG. 30, the logical operators may be replaced by switches, as shown in, FIG. 45 or 46.

With the logical operator 452 being disposed, a signal input to a terminal a of the current source circuit 420 is controlled by the second storage control line, regardless of the data contained in the storage circuit 451. Accordingly, the current source circuit 420 is set such that either the setting operation or the input operation is implemented.

FIGS. 31(A) to 31(C) each show a signal waveform of the first storage control line and a signal waveform of the second storage control line. First, the waveforms of the first and second storage control lines in the full-frame method will be described using FIG. 31(A); and then, the waveforms of the first and second storage control lines in the subframe method will be described using FIGS. 31(B) and 31(C). In both the full-frame method and the subframe method, as shown in FIGS. 31(A) to 31(C), the waveform of the first storage control line is set to become High in the setting period Tc. In addition, the waveform of the second storage control line is set to become Low in the address period.

An address period corresponds to a period during which the current source circuit 420 supplies a predetermined current to the pixel in many cases. Hence, in the address period, the waveform of the second storage control line is set to become Low. Thus, the current source circuit 420 is set to allow either the setting operation or the input operation to be performed.

In specific, by controlling the second storage control line, the setting operation of the current source circuit disposed in the signal line driver circuit can be terminated. The setting operation of the current source circuit in the signal line driver circuit needs to be terminated when the input operation of the current source circuit needs to be performed in the case where the setting operation and the input operation for the current source circuit cannot be performed simultaneously. The input operation (output of a current to the pixel) of the current source circuit is frequently performed in an address period. At this time, the waveform of the second storage control line is preferably set to Low during the address period. If the input operation (output of a current to the pixel) of the current source circuit is performed during a period other than the address period, the waveform of the second storage control line is preferably set Low in the period.

This embodiment mode may be arbitrarily combined with Embodiment Modes 1 to 5.

Embodiment Mode 7

The reference constant current source 109 for supplying a current to the current source circuit may either be integrally formed with a signal line driver circuit on a substrate or be disposed on the outside of the substrate by using, for example, an IC. When integrally forming the current source on the substrate, it may be formed using any one of the current source circuits shown in, for example, FIGS. 6 to 8, 39, 40, and 42. Alternatively, it may be such that only one transistor is disposed, and the current value is controlled in accordance with a voltage applied to a gate. In this embodiment mode, the structure and the operation of the reference constant current source 109 will be described.

As an example, FIG. 32 shows the simplest case, that is, the method of applying a voltage to the gate. A case where three current lines are necessary is shown here. If only one current line is sufficient, transistors 1840 and 1850 and the corresponding current lines may be simply eliminated from the structure of FIG. 32. In FIG. 32, the magnitude of a current is controlled by adjusting the gate voltages applied to a transistor 1830 and the transistors 1840 and 1850 from the outside via a terminal f. When the transistors 1830, 1840, and 1850 are designed to attain the values of W/L to be set to 1:2:4, respective ON currents are set to 1:2:4.

Next, a description will be made of the case where a current is supplied from the terminal f in FIG. 33(A). As shown FIG. 32, in the case where a voltage is applied to the gate to perform adjustment, the current value of the transistor may be varied in accordance with temperature characteristics and the like. However, when the current is input as shown in FIG. 33(A), the influence of the variation can be suppressed.

In the structures shown in FIGS. 32 and 33(A), while a current is flowing through the current lines, a voltage or current needs to be kept flowing from the terminal f. However, when a current does not need to be flown through the current lines, a voltage or current does not need to be kept inputting from the terminal f.

In addition, as shown in FIG. 33(B), switches 1870 and 1880 and a capacitor element 1890 may be added to the structure of FIG. 33(A). In this case, even while a current is supplied to the current lines, the current supply from the reference IC (supply of a current or voltage that is input from the terminal f) can be terminated, and power consumption is therefore reduced.

In the structures shown in FIGS. 32 and 33, information is shared with other current source transistors disposed in the reference current source circuit. Specifically, the gate terminals of the transistors 1830, 1840, and 1850 are mutually connected.

FIG. 34 shows a case where the setting operation is performed for each current source circuit. In FIG. 34, a current is input from a terminal f, and the timing is controlled with a terminal e. Note that, any one of the structures shown in, for example, FIGS. 6, 7, 39, 40, and 42 may be applied to the current source circuit.

The circuit shown in FIG. 34 corresponds to an example in which the circuit of FIG. 6(A) is applied. Thus, the setting operation and the input operation cannot be performed simultaneously. Therefore, in the case of this circuit, the setting operation for the reference current source circuit needs to be performed with a timing at which a current does not need to be flown through the current line.

FIG. 35 shows an example of a polyphased case. Specifically, the example corresponds to the reference constant current source 109 to which the structure of FIG. 44 is applied. In the polyphased case, circuits of FIGS. 32 to 34 may also be applied. However, since the value of current supplied to the current line is the same, the setting operation is performed for respective current source circuits by using the single current, thereby enabling a reduction in the number of currents that are to be input from the outside.

This embodiment mode may be arbitrarily combined with Embodiment Modes 1 to 6.

Embodiment Mode 8

An embodiment mode of the present invention will be described using FIG. 54. Referring to FIG. 54(A), a signal line driver circuit is disposed above a pixel portion, a constant current circuit is disposed below the pixel portion, a current source A is disposed in the signal line driver circuit, and a current source B is disposed in the constant current circuit. $IA=IB+I_{data}$ is established, where IA and IB represent currents supplied from the respective current sources A and B, and $I_{data}$ represents a signal current supplied to pixels. In writing the signal current to the pixel, setting is performed to supply a current thereto from both the current sources A and B. At this time, when IA and IB are increased in magnitude, the speed for writing a signal current to the pixel can be increased.

At this time, the setting operation of the current source B is performed by using the current source A. A current formed by subtracting a current from the current source B from a current from the current source A flows to the pixel. Thus, the setting operation of the current source B is performed using the current source A, whereby influences of various noises and the like can be reduced.

Referring to FIG. 54(B), reference constant current sources (hereinafter referred to as constant current source) C and E are disposed above and below the pixel portion. The current sources C and E are used to perform the setting operation for the current source circuits provided in the signal line driver circuit and the constant current circuit. A current source D corresponds to a current source for setting the current sources C and E, and is supplied with a reference current from the outside.

In FIG. 54(B), the constant current circuit disposed in the lower portion may be replaced by a signal line driver circuit. Thus, the signal line driver circuits can be disposed in both the upper and lower portions. Then, the respective signal line driver circuits control the upper and lower halves of a screen (the entire pixel portion). This enables two lines of pixels to be controlled at the same time. Consequently, it is possible to secure a sufficient time for the setting operation (signal inputting operation) to, for example, the current source of the signal line driver circuit, the pixel, and the current source for the pixel. Accordingly, the setting can be performed with more precision.

This embodiment mode may be arbitrarily combined with Embodiment Modes 1 to 7.

Embodiment Mode 9

In the above embodiment modes, primarily, the case where the signal current control switch exist has been described. In this embodiment mode, a description will be made of a case where the signal current control switch is not provided, that is, a case where a current (constant current) disproportional to a video signal is supplied to a wiring different from a signal line. In this case, the switch 101 (signal current control switch) does not need to be disposed.

Note that the case where the signal current control switch does not exist is similar to the case where the signal current control switch exists, except for the absence of the signal current control switch. Thus, the case will be briefly described, and descriptions of the similar portions will be omitted here.

For comparison with the case where the signal current control switch is disposed, FIG. 36 shows a structure corresponding to FIG. 1, and FIG. 37 shows a structure corresponding to FIG. 2. FIG. 55(A) shows a structure corresponding to FIG. 3(B). According to the embodiment modes described above, the signal current control switch is controlled by the video signal to output the current to the signal line. In this embodiment mode, however, the current is output to a pixel current line, and the video signal is output to the signal line.

A schematic view of the pixel structure in the above case is shown in FIG. 55(B). Next, a pixel operating method will be briefly described. First, when a switching transistor is ON, a video signal is passed through a signal line, is input to a pixel, and is then stored into a capacitor element. A driving transistor is turned ON or OFF depending on the value of the video signal. On the other hand, a current source circuit has a capability of flowing a constant current. Hence, when the driving transistor is ON, the constant current flows to a light emitting element, and the light emitting element emits light. When the driving transistor is OFF, since no current flows to the light emitting element, the light emitting element does not emit light. In this manner, an image is displayed. In this case, however, only two states, namely, emission or non-emission, can be displayed. For this reason, multi-gradation is implemented using, for example, a time gradation method and area gradation method.

Note that, for the portion of the current source circuit, any one of circuits of, for example, FIGS. 6, 7, 39, 40, and 42 is used. The setting operation may be performed to enable the current source circuit to be flown with a constant current. When performing the setting operation for the current source circuit of the pixel, the operation is performed by inputting the current through a pixel current line. The setting operation for the current source circuit of the pixel may be performed an arbitrary number of times at arbitrary time and an arbitrary timing. The setting operation for the current source circuit of the pixel can be performed completely independent of an operation for displaying an image. Preferably, the setting operation is performed when charge stored in the capacitor element provided in the current source circuit leaks.

Next, the detailed structure of a constant current circuit 414 of FIG. 55(A) is shown in FIGS. 56 and 57. Shown in FIG. 56 is the circuit in the case where FIG. 6(A) is applied to the portion of a current source circuit. Shown in FIG. 57 is the circuit in the case where FIG. 6(E) is applied to the portion of a current source circuit.

In addition, a case is considered in which FIG. 37 is applied to the portion of the current source circuit of FIG. 55(A). The detailed structure of the constant current circuit 414 in the above case is shown in FIG. 58. Here, FIG. 58 shows a circuit in the case where FIG. 6(A) is applied to the portion of the current source circuit. The setting operation is performed for one of the current sources by controlling a control line, and the input operation can be simultaneously performed with the other current source.

In connection with the structure including the storage circuits 451 in addition to the current source circuits 420, under comparison between the case of disposing a signal current control switch and the case of not disposing a signal current control switch, FIG. 59 shows a structure corresponding to FIG. 27, FIG. 60 shows a structure corresponding to FIG. 28, and FIG. 61 shows a structure corresponding to FIG. 30.

Note that the case where the signal current control switch does not exist is similar to the case where the signal current control switch exists, except for the absence of the signal current control switch. Thus, a detailed description thereof will be omitted.

This embodiment mode may be arbitrarily combined with Embodiment Modes 1 to 8.

Embodiment Mode 10

In this embodiment mode, a detailed description will be made of a signal line driver circuit 403 in the case where storage circuits 451 are disposed.

First, a description will be made of a case where a signal current control switch exists, that is, a case where a current proportional to a video signal is supplied to a signal line.

Further detailed structures of the structure shown in FIG. 27 are shown in FIGS. 62 and 63. The circuit shown in FIG. 62 corresponds to an example in which the circuit of FIG. 6(E) is applied. The circuit shown in FIG. 63 corresponds to an example in which the circuit of FIG. 6(A) is applied.

According to FIG. 62, while the setting operation is being performed for the current source circuit, the input operation (output of a current to the pixel) can be performed at the same time. Accordingly, the setting operation can be performed in an address period during which the input operation is performed. Since information related to the specified current source circuit that performs the setting operation is stored in the storage circuit 451, it is not influenced by variation in the video signal.

Next, a further detailed structure of FIG. 28 is shown in FIG. 64. The circuit shown in FIG. 64 corresponds to an example in which the circuit of FIG. 6(A) is applied.

According to FIG. 64, the operation of the current source circuit can be switched in accordance with a signal supplied via a control line. Thus, the setting operation and the input operation (output of a current to the pixel) can be performed simultaneously. Accordingly, in the address period during which the input operation is performed, the setting operation can be performed for the current source circuit to which the input operation is not performed. Since information related to the specified current source circuit that performs the setting operation is stored in the storage circuit 451, it is not influenced by variation in the video signal.

Next, a further detailed structure of FIG. 30 is shown in FIG. 65. The circuit shown in FIG. 65 corresponds to an example in which the circuit of FIG. 6(A) is applied. According to FIG. 65, switching between the setting operation for the current source circuit and the input operation (output of a current to the pixel) can be arbitrarily performed according to a signal supplied from the logical operator 452.

Next, a case where 3-bit digital gradation display is performed will be described.

A further detailed structure of the structure of FIG. 27 is shown in FIG. 66. The circuit shown in FIG. 66 corresponds to an example in which the circuit of FIG. 6(C) is applied. According to FIG. 66, even while the setting operation is being performed for the current source circuit, the input operation (output of a current to the pixel) can be performed at the same time. Accordingly, the setting operation can be performed in an address period during which the input operation is performed. Since information related to the specified current source circuit that performs the setting operation is stored in the storage circuit 451, it is not influenced by variation in the video signal.

A further detailed structure of the structure of FIG. 28 is shown in FIG. 67. The circuit shown in FIG. 67 corresponds to an example in which the circuit of FIG. 6(A) is applied. According to FIG. 67, even while the setting operation is being performed for the current source circuit, the operation of the current source circuit can be switched in accordance with a signal supplied via the control line. Thus, the setting operation and the input operation (output of a current to the pixel) can be performed simultaneously. Accordingly, the setting operation can be performed for the current source circuit not being engaged in the input operation in an address period during which the input operation is to be performed. Since specification for the current source circuit that performs the setting operation is stored in the storage circuit 451, it is not influenced by variation in the video signal.

Note that FIG. 67 shows a case where the number of reference constant current sources is smaller than the number of display bits. That is, there is shown a case where a transistor gate is connected, and the set information is shared. Note that it may be such that the same number of reference current sources as the number of display bits are disposed and that the setting operation is performed for current source circuits of each bit.

A further detailed structure of the structure of FIG. 30 is shown in FIG. 68. The circuit shown in FIG. 68 corresponds to an example in which the circuit of FIG. 6(A) is applied. According to FIG. 68, switching between the setting operation for the current source circuit and the input operation (output of a current to the pixel) can be arbitrarily performed in accordance with a signal supplied from the logical operator 452. Note that FIG. 68 shows a case where the number of reference constant current sources is the same as the number of display bits. That is, the setting operation is performed for current source circuits of each bit. It may be such that the number of reference current sources is made smaller than the number of display bits, and that information related to the already set current source circuit is shared. That is, the gates of transistors disposed in current source circuits that mutually share the information may be connected.

The cases where the signal current control switch is disposed have been described so far. Next, a description will be made of a case where no signal current control switch is provided, that is, a case where a current (constant current) disproportional to the video signal is supplied to a wiring different from the signal line. In this case, the switch 101 (signal current control switch) is not disposed.

Further detailed structures of the structure shown in FIG. 59 are shown in FIGS. 69 and 70. The circuit shown in FIG. 69 corresponds to an example in which the circuit of FIG. 6(E) is applied. The circuit shown in FIG. 70 corresponds to an example in which the circuit of FIG. 6(A) is applied.

According to the structure of FIG. 69, even while the setting operation is being performed for the current source circuit, the input operation (output of a current to the pixel) can be performed at the same time. Accordingly, the setting operation can be performed for the current source circuit disposed in the signal line driver circuit even in the period during which the input operation is performed, that is, in the setting operation for the current source circuit arranged in the pixel. Since information related to the specified current source circuit that performs the setting operation is stored in the storage circuit 451, it is not influenced by variation in the video signal.

In the case of the above structure, the address period during which the video signal is input to the pixel is not identical to the period during which the current source circuit in the signal line driver circuit performs the input operation (output of a current to the pixel). Accordingly, even in the period during which the video signal is varying, since the setting operation can be performed for the current source circuit in the signal line driver circuit, the provision of the storage circuit 451 is very effective.

A further detailed structure of that of FIG. 60 is shown in FIG. 71. The circuit shown in FIG. 71 corresponds to an example in which the circuit of FIG. 6(A) is applied.

According to FIG. 71, even while the setting operation is being performed for the current source circuit, the operation of the current source circuit can be switched according to a signal supplied from the control line. Thus, the setting operation and the input operation (output of a current to the pixel) can be performed simultaneously. Accordingly, the setting operation can be performed for the current source circuit for which the input operation is not performed in the address period during which the input operation is performed. Since specification for the current source circuit that performs the setting operation is stored in the storage circuit 451, it is not influenced by variation in the video signal.

A further detailed structure of that of FIG. 61 is shown in FIG. 72. The circuit shown in FIG. 72 corresponds to an example in which the circuit of FIG. 6(A) is applied.

According to FIG. 72, switching between the setting operation for the current source circuit and the input operation (output of a current to the pixel) can be arbitrarily performed by the logical operator 452. Note that, in the case where the signal current control switch is not disposed, that is, in the case where a current (constant current) disproportional to the video signal is supplied to a wiring different from the signal line, the address period during which the video signal is input to the pixel is not identical to the period during which the current source circuit in the signal line driver circuit performs the input operation (output of a current to the pixel). Accordingly, even in the period during which the video signal is varying, since the setting operation can be performed for the current source circuit in the signal line driver circuit, the provision of the storage circuit 451 is very effective.

Any one of the structures of, for example, FIGS. 6, 7, 39, 40, and 42 can be applied to the current source circuit.

This embodiment mode may be arbitrarily combined with Embodiment Modes 1 to 9.

Embodiment 1

In this embodiment, the time gradation method will be described in detail with reference to FIG. 14. In display devices such as liquid crystal display devices and light emitting devices, a frame frequency is about 60 (Hz). That is, as shown in FIG. 14(A), screen rendering is performed about 60 times per second. This enables flickers (flickering of a screen) not to be recognized by the human eye. At this time, a period during which screen rendering is performed once is called one frame period.

As an example, in this embodiment, a description will be made of a time gradation method disclosed in the publication as Patent Document 1. In the time gradation method, one frame period is divided into a plurality of subframe periods. In many cases, the number of divisions is identical to the number of gradation bits. For the sake of a simple description, a case where the number of divisions is identical to the number of gradation bits. Specifically, since the 3-bit gradation is employed in this embodiment, an example is shown in which one frame period is divided into three subframe periods SF1 to SF3 (FIG. 14(B)).

Each of the subframe periods includes an address (writing) period Ta and a sustain (light emission) period (Ts). The address period is a period during which a video signal is written to a pixel, and the length thereof is the same among respective subframe periods. The sustain period is a period during which the light emitting element emits light or does not emit light in response to the video signal written in the address period Ta. At this time, the sustain periods Ts1 to Ts3 are set at a length ratio of Ts1:Ts2:Ts3=4:2:1. More specifically, the length ratio of n sustain periods is set to $2^{(n-1)}$: $2^{(n-2)}$: . . . :$2^1$:$2^0$. Depending on whether a light emitting element performs emission or non-emission in which one of the sustain periods, the length of the period during which each pixel emits light in one frame period is determined, and the gradation representation is thus performed.

Next, a specific operation of a pixel employing the time gradation method will be described. In this embodiment, a description thereof will be made referring to the pixel shown in FIG. 16(B). A current input method is applied to the pixel shown in FIG. 16(B).

First, the following operation is performed during the address period Ta. A first scanning line 602 and a second scanning line 603 are selected, and TFTs 606 and 607 are turned ON. A current flowing through a signal line 601 at this time is used as a signal current $I_{data}$. Then, when a predetermined charge has been accumulated in a capacitor element 610, selection of the first and second scanning lines 602 and 603 is terminated, and the TFTs 606 and 607 are turned OFF.

Subsequently, the following operation is performed in the sustain period Ts. A scanning line 604 is selected, and a TFT 609 is turned ON. Since the predetermined charge that has been written is stored in the capacitor element 610, the TFT 608 is already turned ON, and a current identical with the signal current $I_{data}$ flows thereto from a current line 605. Thus, a light emitting element 611 emits light.

The operations described above are performed in each subframe period, thereby forming one frame period. According to this method, the number of divisions for subframe periods may be increased to increase the number of display gradations. The order of the subframe periods does not necessarily need to be the order from an upper bit to a lower bit as shown in FIGS. 14(B) and 14(C), and the subframe periods may be disposed at random within one frame period. In addition, the order may be variable within each frame period.

Further, a subframe period SF2 of an m-th scanning line is shown in FIG. 14(D). As shown in FIG. 14(D), in the pixel, upon termination of an address period Ta2, a sustain period Ts2 is immediately started.

Next, a timing chart of a portion related to the current source circuit in the signal line driver circuit will be described. More specifically, a timing chart of a portion related to the setting operation for the current source circuit will be described.

Basic timings are as described below. First, an address period terminates. Then, in a period Tc during which no scanning line has been selected during a sustain period, selection is performed for a current source circuit for which a setting operation is performed. Subsequently, the setting operation for the current source circuit of the signal line driver circuit starts. The setting operation terminates immediately before the start of the address period. Meanwhile, it may be such that the period Tc is provided again; a selection is performed for a current source circuit for which the setting operation is performed; and the setting operation is performed for the selected current source circuit. Thus, the setting operation may be performed between address periods.

However, there is a case where the setting operation cannot be performed during the period described above. This is a case where, in the period, the current source circuit of the signal line driver circuit is engaged in an input operation (output of a current to the pixel), and also, the current source circuit of the signal line driver circuit is not capable of simultaneously performing the setting operation and the input operation. A case where the current source circuit of the signal line driver circuit performs the input operation (output of a current to the pixel) between address periods often corresponds to a case where the pixel with the structure shown in FIG. 55(B) is provided.

In contrast, there is a case where the setting operation can be performed for the current source circuit of the signal line driver circuit during the address period. The case corresponds to a case where the storage circuits 451 is provided as in any one of, for example, FIGS. 27, 28, and 30. In this case, even during the address period, the current source circuit of the signal line driver circuit can be simultaneously engaged in a setting operation and an input operation. In addition, when the current source circuit of the signal line driver circuit is not engaged in the input operation during the address period, the current source circuit of the signal line driver circuit can perform the setting operation even with a current source circuit of any structure.

The reason for this is that since the storage circuit 451 contains the information related to the current source circuit for which the setting operation is performed, the operations are not influenced by variation in the video signal during the address period. Thus, in the case where the setting operation and the input operation of the current source circuit of the signal line driver circuit can be implemented simultaneously, the setting operation and the input operation of the current source circuit of the signal line driver circuit can be implemented simultaneously even during the address period. Even if the case where the setting operation and the input operation of the current source circuit of the signal line driver circuit cannot be performed simultaneously, when the current source circuit of the signal line driver circuit is not engaged in the input operation (output of a current to the pixel) in the address period, the setting operation of the current source circuit of the signal line driver circuit can be implemented.

According to the present invention, the setting operation for the current source circuits may be performed either sequentially by each or at random. Further, in the case where the periods during which the setting operation is performed are dotted in one frame, the setting operation may be performed by effectively using the periods. Further, the setting operation for all the current source circuits may be not performed within one frame period, but performed in several frame periods or more. Thus, the setting operation for the current source circuits can be precisely performed using a sufficient time.

This embodiment may be arbitrarily combined with Embodiment Modes 1 to 10.

Embodiment 2

In this embodiment, example structures of pixel circuits provided in the pixel portion will be described with reference to FIGS. 13 and 73.

Note that the present invention may be applied to a pixel of any structure as long as the structure includes a current input portion.

A pixel shown in FIG. 13(A) includes a signal line 1101, first and second scanning lines 1102 and 1103, a current line (power supply line) 1104, a switching TFT 1105, a holding TFT 1106, a driving TFT 1107, a conversion driving TFT 1108, a capacitor element 1109, and a light emitting element 1110. The signal line 1101 is connected to a current source circuit 1111.

Note that the current source circuit 1111 corresponds to the current source circuit 420 disposed in the signal line driver circuit 403.

In the pixel of FIG. 13(A), the gate electrode of the switching TFT 1105 is connected to the first scanning line 1102, a first electrode thereof is connected to the signal line 1101, and a second electrode thereof is connected to a first electrode of the driving TFT 1107 and a first electrode of the conversion driving TFT 1108. The gate electrode of the holding TFT 1106 is connected to the second scanning line 1103, a first electrode thereof is connected to the signal line 1102, and a second electrode thereof is connected to the gate electrode of the driving TFT 1107 and the gate electrode of the conversion driving TFT 1108. A second electrode of the driving TFT 1107 is connected to the current line (power supply line) 1104, and a second electrode of the conversion driving TFT 1108 is connected to one of the electrodes of the light emitting element 1110. The capacitor element 1109 is connected between the gate electrode of the conversion driving TFT 1108 and a second electrode thereof, and retains a gate-source voltage of the conversion driving TFT 1108. The current line (power supply line) 1104 and the other electrode of the light emitting element 1110 are respectively input with predetermined potentials and have mutually different potentials.

The pixel of FIG. 13(A) corresponds to the case where a circuit of FIG. 40(B) is applied to a pixel. However, since the current-flow direction is different, the transistor polarity is reverse. The driving TFT 1107 of FIG. 13(A) corresponds to a TFT 126 of FIG. 40(B), the conversion driving TFT 1108 of FIG. 13(A) corresponds to a TFT 122 of FIG. 40(B), and the holding TFT 1106 of FIG. 13(A) corresponds to the TFT 124 of FIG. 40(B).

A pixel shown in FIG. 13(B) includes a signal line 1151, first and second scanning lines 1142 and 1143, a current line (power supply line) 1144, a switching TFT 1145, a holding TFT 1146, a conversion driving TFT 1147, a driving TFT 1148, a capacitor element 1149, and a light emitting element 1140. The signal line 1151 is connected to a current source circuit 1141.

Note that the current source circuit 1141 corresponds to the current source circuit 420 disposed in the signal line driver circuit 403.

In the pixel of FIG. 13(B), the gate electrode of the switching TFT 1145 is connected to the first scanning line 1142, a first electrode thereof is connected to the signal line 1151, and a second electrode thereof is connected to a first electrode of the driving TFT 1148 and a first electrode of the conversion driving TFT 1148. The gate electrode of the holding TFT 1146 is connected to the second scanning line 1143, a first electrode thereof is connected to the first electrode of the driver TFT 1148, and a second electrode thereof is connected to the gate electrode of the driving TFT 1148 and the gate electrode of the conversion driving TFT 1147. A second electrode of the conversion driving TFT 1147 is connected to the current line (power supply line) 1144, and a second electrode of the conversion driving TFT 1147 is connected to one of the electrodes of the light emitting element 1140. The capacitor element 1149 is connected between the gate electrode of the conversion driving TFT 1147 and a second electrode thereof, and retains a gate-source voltage of the conversion driving TFT 1147. The current line (power supply line) 1144 and the other electrode of the light emitting element 1140 are respectively input with predetermined potentials and have mutually different potentials.

Note that the pixel of FIG. 13(B) corresponds to the case where a circuit of FIG. 6(B) is applied to a pixel. However, since the current-flow direction is different, the transistor polarity is reverse. The conversion driving TFT 1147 of FIG. 13(B) corresponds to a TFT 122 of FIG. 6(B), the driving TFT 1148 of FIG. 13(B) corresponds to a TFT 126 of FIG. 6(B), and the holding TFT 1146 of FIG. 13(B) corresponds to the TFT 124 of FIG. 6(B).

A pixel shown in FIG. 13(C) includes a signal line 1121, a first scanning line 1122, a second scanning line 1123, a third scanning line 1135, a current line (power supply line) 1124, a switching TFT 1125, a pixel current line 1138, an erasing TFT 1126, a driving TFT 1127, a capacitor element 1128, a current-supply TFT 1129, a mirror TFT 1130, a capacitor element 1131, a current-input TFT 1132, a holding TFT 1133, and a light emitting element 1136. The pixel current line 1138 is connected to a current source circuit 1137.

In the pixel of FIG. 13(C), the gate electrode of the switching TFT 1125 is connected to the first scanning line 1122, a first electrode of the switching TFT 1125 is connected to the signal line 1121, and a second electrode of the switching TFT 1125 is connected to the gate electrode of the driving TFT 1127 and a first electrode of the erasing TFT 1126. The gate electrode of the erasing TFT 1126 is connected to the second scanning line 1123, and a second electrode of the erasing TFT 1126 is connected to the current line (power supply line) 1124. A first electrode of the driving TFT 1127 is connected to one of the electrodes of the light emitting element 1136, and a second electrode of the driving TFT 1127 is connected to a first electrode of the current-supply TFT 1129. A second electrode of the current-supply TFT 1129 is connected to the current line (power supply line) 1124. One of the electrodes of the capacitor element 1131 is connected to the gate electrode of the current-supply TFT 1129 and the gate electrode of the mirror TFT 1130 and the other electrode thereof is connected to the current line (power supply line) 1124. A first electrode of the mirror TFT 1130 is connected to the current line 1124, and a second electrode of the mirror TFT 1130 is connected to a first electrode of the current-input TFT 1132. A second electrode of the current-input TFT 1132 is connected to the current line (power supply line) 1124, and the gate electrode of the current-input TFT 1132 is connected to the third scanning line 1135. The gate electrode of the current holding TFT 1133 is connected to the third scanning line 1135, a first electrode of the current holding TFT 1133 is connected to the pixel current line 1138, a second electrode of the current holding TFT 1133 is connected to the gate electrode of the current-supply TFT 1129 and the gate electrode of the mirror TFT 1130. The current line (power supply line) 1124 and the other electrode of light emitting element 1136 are input with predetermined potentials and have mutually different potentials.

In this case, the current source circuit 1137 corresponds to the current source circuit 420 disposed in the signal line driver circuit 403.

Note that the pixel of FIG. 13(C) corresponds to the case where the circuit of FIG. 6(E) is applied to the pixel of FIG. 55(B). However, since the current-flow direction is different, the transistor polarity is opposite. As described above, the erasing TFT 1126 is additionally provided in the pixel of FIG. 13(C). The disposition of the erasing TFT 1126 enables the length of the lightening period to be arbitrarily controlled.

The switching TFT 1125 serves to control the supply of the video signal to the pixel. The erasing TFT 1126 serves to cause charge retained in the capacitor element 1131 to be discharged. The conductivity/non-conductivity of the driving TFT 1127 is controlled according to the charge retained in the capacitor element 1131. The current-supply TFT 1129 and the mirror TFT 1130 together form a current mirror circuit. The current line 1124 and the other electrode of the light emitting element 1136 are input with predetermined potentials and mutually have potential differences.

To be more specific, when the switching TFT 1125 is turned ON, a video signal is input to the pixel through the signal line 1121 and is held in the capacitor element 1128. The driving TFT 1127 is turned ON or OFF depending on the value of the video signal. Thus, when the driving TFT 1127 is ON, a constant current flows to the light emitting element, and the light emitting element emits light. When the driving TFT 1127 is OFF, no current flows to the light emitting element, and the light emitting element does not emit light. In this manner, an image is displayed. In addition, the current source circuit is formed of, for example, the current-supply TFT 1129, the mirror TFT 1130, the capacitor element 1131, the current-input TFT 1132, and the holding TFT 1133. The current source circuit includes a capacity of flowing a constant current. Current is passed through the pixel current line 1138 and is then input to the current source circuit, and the setting operation is performed. Thus, even when variation occurs in the characteristics of the transistors constituting the current source circuit, variation does not occur in the magnitude of current that flows from the current source circuit to the light emitting element. The setting operation for the current source circuit of the pixel can be performed independent of the operations of, for example, the switching TFT 1125 and the driving TFT 1127.

A pixel of FIG. 73(A) corresponds to the case where the circuit of FIG. 6(A) is applied to the pixel of FIG. 55(B). However, since the current-flow direction is different, the transistor polarity is opposite.

The pixel of FIG. 73(A) includes, for example, a current-supply TFT 1129, a capacitor element 1131, a holding TFT 1133, and a pixel current line 1138 (Ci). The pixel current line 1138 (Ci) is connected to a current source circuit 1137. Note that the current source circuit 1137 corresponds to the current source circuit 420 disposed in the signal line driver circuit 403.

A pixel of FIG. 73(B) corresponds to the case where the circuit of FIG. 7(A) is applied to the pixel of FIG. 55(B). However, since the current-flow direction is different, the transistor polarity is opposite.

The pixel of FIG. 73(B) includes, for example, a current-supply TFT 1129, a capacitor element 1131, a holding TFT 1133, and a pixel current line 1138 (Ci). The pixel current line 1138 (Ci) is connected to a current source circuit 1137. Note that the current source circuit 1137 corresponds to the current source circuit 420 disposed in the signal line driver circuit 403.

The pixel of FIG. 73(A) and the pixel of FIG. 73(B) are mutually different in the polarities of the respective current-supply TFTs 1129. Because of the difference in the polarities, connections of the capacitor element 1131 and the holding TFT 1133 are different.

As described above, pixels have various structures. Here, the pixels described above can be broadly classified into two types. The first type inputs a current corresponding to the video signal to the signal line. This type corresponds to, for example, the structures of FIGS. 13(A) and 13(B). In the respective structures, the signal line driver circuit includes the signal current control switch, as shown in FIGS. 1 and 2. The other type inputs a video signal to the signal line, and inputs to the pixel current line a constant current unrelated to the video signal, that is, the pixel as shown in FIG. 55(B). The structure corresponds to, for example, FIGS. 13(C), 73(A), and 73(B). In this case, the signal line driver circuit, as those of FIGS. 36 and 37, does not include the signal current control switch.

Hereinafter, timing charts corresponding to the above-described pixel types will be described. First, cases where digital gradation and time gradation are combined. However, it is variable depending on, for example, the pixel type or the structure of the signal line driver circuit. Thus, timing charts for the respective structures will be described.

First, the pixel type that inputs the current corresponding to the video signal to the signal line will be described hereinafter. The pixel is assumed to have the structure of FIG. 13(A) or 13(B). The signal line driver circuit is assumed to take the structure of FIG. 3(A) or 3(B). The timing chart in that case is shown in FIG. 74.

Also assumed are that 4-bit gradations are represented, and that the number of subframes is four for the convenience of simplifying the description. First, a first subframe period SF1 starts. A scanning line (such as the first scanning line 1102 shown in FIG. 13(A), or the first scanning line 1132 shown in FIG. 13(B)) is selected on a line basis, and current is input through a signal line (such as the signal line 1101 in FIG. 13(A) or the capacitor element 1131 in FIG. 13(B)). The current has a value corresponding to that of the video signal. Upon termination of a lightening period Ts1, a subsequent subframe period SF2 starts, and scanning is performed similar to the case of the subframe period SF1. Then, a subsequent subframe period SF3 starts, and scanning is performed similarly. However, since the length of a lightening period Ts3 is shorter than an address period Ta3, light is forced not to be emitted. That is, the input video signal is erased or current is controlled not to flow to the light emitting element. To erase the video signal, the second scanning line (such as the second scanning line 1103 in FIG. 13(A) or the second scanning line 1133 in FIG. 13(B)) is selected on a line basis. As a result, the video signal is erased to cause the light emitting element to be in the non-emission state. Then, a subsequent subframe period SF4 starts. Also in this stage, scanning is performed similar to the case of the subframe period SF3; and the light emitting element is brought into the non-emission state similarly.

Described above is the timing chart relevant to the image display operation, that is, pixel operation. Next, described hereinafter is a timing chart of the setting operation for the current source circuit disposed in the signal line driver circuit. In this case, during the setting period Tc, the video signal is used to specify a current source circuit for which the setting operation should be performed among the plurality of current source circuits. Thus, the setting operation cannot be performed while the video signal is varying, that is, during the address period. The reason is that, while the setting operation is attempted during the address period, the video signal is varying in manners different depending on the image.

To be more specific, the input operation of the current source circuit of the signal line driver circuit is performed between the address periods (such as Ta1 and Ta2) in each subframe period. Hence, the setting operation of the current source circuit of the signal line driver circuit should be performed during a period other than the address period. Accordingly, the setting operation for the current source circuit disposed in the signal line driver circuit should be performed during setting operation periods Tb1 to Tb4 other than the address period, as shown in FIG. 74. In this case, the setting operation may be performed during a period between the address period Ta1 and the address period Ta2, or may be performed during a period between the address period Ta2 and the address period Ta3, or may be performed by using both the periods. In addition, while the plurality of setting operation periods Tb are disposed in the period between the address period Ta1 and Ta2, only one setting operation period Tb may be disposed. Further, instead of providing one setting operation periods Tb, a plurality of setting operation periods Tb may be disposed in the period between the address periods Ta2 and Ta3.

Next, the pixel has supposedly the structure of either FIG. 13(A) or FIG. 13(B), and the signal line driver circuit includes supposedly the storage circuit 451 as in the structures of FIGS. 27 and 28. Since timing chart relevant to the image display operation, that is, the pixel operation, is similar to that described above, a description thereof will be omitted here. FIG. 75 shows timing of the setting operation for the current source circuit disposed in the signal line driver circuit. In the shown case, even when the video signal is varying, information related to a current source circuit in a column for which the setting operation is performed is held in the storage circuit 451. Thus, in the case where the current source circuit is capable of simultaneously performing the setting operation and the input operation, the setting operation can be performed even in the address period. Thus, setting periods Tc are respectively provided before, for example, setting operation periods Tb5, Tb7, Tb8, and Tb1. During the setting period Tc, a current source circuit for which the setting operation is performed is selected, and the setting operation period is then commenced. Thus, in the structure where the current source circuit of the signal line driver circuit can simultaneously perform the setting operation and the input operation (output of current to the pixel), a setting operation period Tb5 can be provided even in the address period.

Thus, according to the timing charts of FIGS. 74 and 75, many setting operation periods can be provided. Accordingly, the period during which all the current source circuits disposed in the signal line driver circuit respectively perform the setting operation can be reduced. Alternatively, the period during which the setting operation is performed for the current source circuit can be prolonged. Consequently, the setting operation can be performed with even higher precision.

Next, a description will be given of the pixel type that inputs a video signal to the signal line and then inputs a constant current unrelated to the video signal to the pixel current line. The signal line driver circuit is assumed to have the structure of FIG. 55(A). The pixel is assumed to have the structure of, for example, FIG. 13(C), 55(B), 73(A), or 73(B). In the aforementioned pixel, however, the setting operation needs to be performed also for the current source circuit disposed in the pixel. Thus, the operation of the current source circuit of the pixel is variable depending on whether the current source circuit is capable of simultaneously performing the setting operation and the input operation. FIG. 76 shows a timing chart in the case where the setting operation and the input operation of the current source circuit of the pixel can be performed simultaneously, that is, a timing chart in the case where the pixel has the structure of FIG. 13(C).

First, the image display operation, that is, operations related to the switching transistor of the pixel, the driving transistor, and the like will be described below. Since the operations are almost the same as those described above, they will be briefly described. First, a first subframe period SF1 starts. A scanning line (first scanning line 1122 in FIG. 13(C)) is selected on a line basis, and a video signal is input through a signal line (signal line 1121 in FIG. 13(C)). The video signal is ordinarily a voltage, but it may be a current. Upon termination of a lightening period Ts1, a subsequent subframe period SF2 starts, and scanning is performed similar to the case of the first subframe period SF1. Then, a subsequent subframe period SF3 starts, and scanning is performed similarly. However, since the length of a lightening period Ts3 is shorter than an address period Ta3, light is forced not to be emitted. That is, the input video signal is erased or current is controlled not to flow to the light emitting element. To erase the input video signal, the second scanning line (the second scanning line 1123 in FIG. 13(C)) is selected on a line basis. As a result, the video signal is erased, and the driving TFT 1127 is brought into the OFF state. Thus, the light emitting elements can be brought into the non-emission state. Then, a subsequent subframe period SF4 starts. Also in this stage, scanning is performed as in the case of the subframe period SF3 and light emitting elements are brought into the non-emission state similarly.

Next, the setting operation for the current source circuit of the pixel will be described. In the structure of FIG. 13(C), the setting operation and the input operation of the current source circuit of the pixel can be performed simultaneously. Accordingly, the setting operation for the current source circuit of the pixel can be performed with an arbitrary timing.

During the setting period Tc, the video signal is used to specify a current source circuit for which the setting operation should be performed. Thus, the setting operation cannot be performed while the video signal is varying, that is, during the address period. The reason is that, while the setting operation is attempted during the address period, the video signal is varying in manners different depending on the image. Hence, in the case the setting operation and the input operation (output of current to the pixel) of the current source circuit of the signal line driver circuit cannot be performed simultaneously, as shown in FIG. 76, the setting operation of the current source circuit of the signal line driver circuit should be performed during a period between address periods, and concurrently, the setting operation for the current source of the pixel (input operation of the current source circuit of the signal line driver circuit) is not performed. On the other hand, in the case the setting operation and the input operation (output of current to the pixel) of the current source circuit of the signal line driver circuit can be performed simultaneously, as shown in FIG. 77, the setting operation of the current source circuit of the signal line driver circuit should be performed during a period between address periods. According to the timing charts of FIGS. 76 and 77, while the plurality of setting operation periods Tb are disposed in the period between the address periods Ta1 and Ta2, only one setting operation period Tb may be disposed.

Next, the pixel has supposedly the structure of FIG. 13(C), and the signal line driver circuit includes supposedly the storage circuit 451 as in the structures of FIGS. 59 and 60. Since a timing chart related to the image display operation, that is, the pixel operation, is similar to that described above, a description thereof will be omitted here. Referring to FIGS. 78 and 79, timings of the setting operations for the current source circuit disposed in the signal line driver circuit will be described below. In the shown case, since information related to a current source circuit for which the setting operation is performed is held in the storage circuit 451, even when the video signal is varying, the setting operation of the current source circuit can be performed. Thus, in this structure, setting periods Tc are respectively provided before, for example, setting operation periods Tb1 and Tb5. During the setting period Tc, a current source circuit for which the setting operation is performed is selected, and the setting operation period is then commenced. Thus, the setting operation period Tb5 and the like can be provided even in the address period.

In the structure where the setting operation and the input operation cannot be performed simultaneously, as shown in FIG. 78, while the setting operation is being performed for the current source of the pixel, the setting operation cannot be performed for the current source circuit disposed in the signal line driver circuit. In this case, the arrangement needs to be made such that a setting period Tc is provided before the setting operation is performed for the current source of the pixel, and data in the storage circuit 451 is modified during the setting period Tc so that no current source circuit does not perform the setting operation. Thus, as shown in FIG. 78, for example, setting periods Tc need to be provided after the setting operation period Tb5. On the other hand, in the structure where the setting operation and the input operation of the current source circuit can be performed simultaneously, as shown in FIG. 79, the setting operation can be performed for the current source circuit of the signal line driver circuit even while the setting operation is being performed for the current source of the pixel. According to the timing chart shown in FIG. 79, many setting operation periods can be provided. Accordingly, the period during which all the current source circuits disposed in the signal line driver circuit respectively perform the setting operation can be reduced. Alternatively, the period during which the setting operation is performed for each current source circuit can be prolonged. Consequently, the setting operation can be performed even more precisely.

Next, the pixel has supposedly the structure of FIG. 13(C), and the signal line driver circuit includes supposedly the storage circuit 451 as in the structure of FIG. 61. Since a timing chart related to the image display operation, that is, the pixel operation, is similar to that described above, a description thereof will be omitted here. FIG. 80 shows the timing of the setting operation for the current source circuit disposed in the signal line driver circuit. In the shown case, even when the video signal is varying, since predetermined information is held in the storage circuit 451, the setting operation of the current source circuit can be performed. Hence, the setting operation can be performed even in the address period. In addition, use of the logical operator 452 enables the setting operation to terminate during an arbitrarily period and the like. Thus, setting periods Tc need not to be provided before the setting operation of the current source circuit disposed in the pixel is performed. The setting operation can also be terminated even during the address period by controlling the second storage control line. According to this structure, arbitrary adjustment can be performed for length of the period during which the setting operation of the current source circuit of the pixel is performed and the length of the period during which the setting operation of the current source circuit of the signal line driver circuit is performed.

Next, FIG. 81 shows a timing chart in the case where the pixel is of the type that inputs a video signal to the signal line and then inputs a constant current unrelated to the video signal to the pixel current line, and concurrently, the setting operation and the input operation of the current source circuit of the pixel cannot be performed simultaneously, that is, in the case where the pixel has the structure of FIG. 73(A) or 73(B). First, since the image display operation, that is, operations related to the switching transistor and the driving transistor of the pixel, and the like are substantially the same as those in the above-described case shown in FIG. 76, they will be briefly described. First, a first subframe period SF1 starts. A scanning line (first scanning line 1122 in either of FIGS. 73(A) and 73(B)) is selected on a line basis, and a video signal is input through a signal line (signal line 1121 in FIGS. 73(A) and 73(B)). The video signal is ordinarily a voltage, but it may be a current. Upon termination of a lightening period Ts1, a subsequent subframe period SF2 starts, and scanning is performed similar to the case of the subframe period SF1. Then, a subsequent subframe period SF3 starts, and scanning is performed similarly. However, since the length of a lightening period Ts3 is shorter than that of an address period Ta3, light is forced not to be emitted. That is, the input video signal is erased or current is controlled not to flow to the light emitting element. In order to prevent current from flowing in the light emitting element, the second scanning line (the second scanning line 1123 in FIG. 13(C)) is put into a non-selected state on a line basis. As a result, the easing TFT 1127 is brought into the OFF state. Thus, current-flow paths are blocked, and the light emitting elements can be brought into the non-emission state. Then, a subsequent subframe period SF4 starts. Also in this stage, scanning is performed as in the case of the subframe period SF3 and light emitting elements are brought into the non-emission state similarly.

Next, the setting operation for the current source circuit of the pixel will be described. In the structures of FIGS. 73(A) and 73(B), the setting operation and the input operation of the current source circuit disposed in the pixel cannot be performed simultaneously. Accordingly, the setting operation for the current source circuit of the pixel should be performed while the current source circuit of the pixel is not engaged in the input operation, that is, while no current is flowing to the light emitting element. In addition, the setting operation of the current source circuit disposed in the signal line driver circuit should be performed during a period other than a period during which the current source circuit of the pixel is performing the setting operation and performed between the address periods.

Since the case is as described above, the setting operation for the current source circuit of the pixel should be performed during a non-lightening period (Td3 or Td4); and the setting operation of the current source circuit of the signal line driver circuit should be performed between address periods. FIG. 81 shows a timing chart in the case where setting operations are performed for the current source circuit disposed in the pixel during non-lightening periods (Td3 and Td4) of subframe periods SF3 and SF4, and in addition, the setting operation is performed for current source circuit of the signal line driver circuit during a period between the address periods Ta1 and Ta2 or between the address periods Ta2 and Ta3.

Note that there is a case in which it is difficult to precisely perform the setting operation for the current source circuit disposed in the pixel since the period during which the setting operation is performed for the current source circuit disposed in the pixel is short only with the non-lightening period. In this case, as shown in FIGS. 82 and 83, it may be such that a non-lightening period is forcedly is provided before each address period, and the setting operation is performed for the current source circuit of the pixel in the non-lightening period. Here, FIG. 82 shows a case where the setting operation for the current source circuit in the signal line driver circuit and the input operation thereof cannot be performed simultaneously. On the other hand, FIG. 83 shows a case where the setting operation for the current source circuit in the signal line driver circuit and the input operation thereof can be performed simultaneously.

Next, a description will be given of a case where the pixel has the structure of FIG. 73(A) or 73(B), and the signal line driver circuit includes the storage circuit 451 as in the structures of FIGS. 59 and 60. Since a timing chart regarding the image display operation, that is, the pixel operation, is similar to that described above, a description thereof will be omitted here. FIGS. 84 and 85 show timings of the setting operations for the current source circuit disposed in the signal line driver circuit. In the shown case, even when the video signal is varying, predetermined information is held in the storage circuit 451. Accordingly, the setting operation can be performed for the current source circuit. Thus, setting periods Tc are respectively provided before, for example, the setting operation periods Tb4. During the setting period Tc, a current source circuit for which the setting operation is performed is selected, and the setting operation period is then commenced. Thus, as shown in FIG. 83, for example, the setting operation period Tb4 can be provided even in the address period.

In the structure where the setting operation and the input operation of the current source circuit cannot be performed simultaneously, as shown in FIG. 84, while the setting operation is being performed for the current source of the pixel, the setting operation cannot be performed for the current source circuit disposed in the signal line driver circuit. In this case, the arrangement needs to be made such that a setting period Tc is provided before the setting operation is performed for the current source of the pixel, and data in the storage circuit 451 is modified during the setting period Tc1 so that no current source circuit does not perform the setting operation. Thus, as shown in FIG. 84, setting periods Tc need to be provided after, as an example, the setting operation period Tb5. On the other hand, in the structure where the setting operation and the input operation of the current source circuit can be performed simultaneously, as shown in FIG. 85, the setting operation can be performed for the current source circuit of the signal line driver circuit even while the setting operation is being performed for the current source of the pixel.

As described above, according to the structures of FIGS. 84 and 85, many setting operation periods can be provided in one frame period. Accordingly, the period during which all the current source circuits disposed in the signal line driver circuit respectively complete the setting operation can be reduced. Alternatively, the period during which the setting operation is performed for the current source circuit can be prolonged. Consequently, the setting operation can be performed even more precisely.

Next, a description will be given of a case where the pixel has the structure of FIG. 73(A) or 73(B), and the signal line driver circuit includes the storage circuit 451 as in the structure of FIG. 61. Since a timing chart regarding the image display operation, that is, the pixel operation, is similar to that described above, a description thereof will be omitted here. FIG. 86 shows a timing chart of the setting operation for the current source circuit disposed in the signal line driver circuit. In the shown case, even when the video signal is varying, predetermined information is held in the storage circuit 451. Accordingly, the setting operation can be performed for the current source circuit. Thus, the setting operation can be also performed for the current source circuit disposed in the signal line driver circuit even in the address period. In addition, control of the logical operator 452 enables the setting operation to terminate during an arbitrarily period. Thus, setting periods Tc need not to be provided before execution of the setting operation of the current source circuit disposed in the pixel. The setting operation can also be terminated even at a halfway point of the address period by controlling the second storage control line. According to this structure, arbitrary adjustment can be performed for length of the period during which the setting operation of the current source circuit of the pixel is performed and the length of the period during which the setting operation of the current source circuit of the signal line driver circuit is performed.

In the above, the timing charts in the cases where digital gradation and time gradation are combined have been described. Hereinafter, timing charts in the case of analog gradation will be described.

First, the pixel is assumed to have the structure of FIG. 13(A) or 13(B). The signal line driver circuit is assumed to have the structure of any one of FIGS. 5, 49, and 50. The timing chart in that case is shown in FIG. 9. A scanning line (the first scanning line 1102 shown in FIG. 13(A) or the first scanning line 1132 shown in FIG. 13(B)) is selected on a line basis, and current is input through a signal line (1101 in FIG. 13(A) or 1131 in FIG. 13(B)). The current has a value corresponding to that of the video signal. The operations of selection made on a line bases and input of the current from the signal line are performed through one frame period.

The timing chart related to the image display operation, that is, the pixel operation is as described above. Next, the timing of the setting operation of the current source circuit disposed in the signal line driver circuit will be described. Ordinarily, the input operation of the current source circuit disposed in the signal line driver circuit is performed through one frame period. Hence, as in the conventional ones, the setting operation of the current source circuit disposed in the signal line driver circuit cannot be performed. Thus, as shown in FIG. 9, a setting period Tc and a setting operation period Tb are provided at the initial portion of each horizontal scanning period. Then, a current source circuit for which the setting operation is performed is selected in the setting period Tc, and the setting operation is then performed in the setting operation period Tb. In this case, the period may be set identical with a return period. Thereafter, the input operation of the current source circuit of the signal line driver circuit is performed.

Next, a description will be given of a case where the pixel has the structure of FIG. 13(A) or 13(B), and the signal line driver circuit includes the storage circuit 451 as in the structure of FIG. 10. In the case where the setting operation and the input operation can be performed in the current source circuit disposed in the signal line driver circuit simultaneously, the setting operation periods Tb can be set long, as shown in FIG. 11. In this case, the setting operation of the current source circuit disposed in the signal line driver circuit needs to be performed in a state where, for example, current does not leak, and a different current is not input. For this reason, for example, the transistor 182 of FIG. 24 and the transistors A, B, and C of FIG. 50 need to be set to the OFF state before execution of the setting operation of the current source circuit of the signal line driver circuit. However, as in the structure of FIG. 51, when a structure that does not cause, for example, current leakage or input of a different current is employed, such currents need not be taken into account.

This embodiment may be arbitrarily combined with Embodiment Modes 1 to 10 and Embodiment 1.

Embodiment 3

In this embodiment, technical devices when performing color display will be described.

With a light emitting element comprised of an organic EL element, the luminance can be variable depending on the color even though current having the same magnitude is supplied to the light emitting device. In addition, in the case where the light emitting element has deteriorated because of, for example, a time factor, the deterioration degree is variable depending on the color. Thus, when performing color display with a light emitting device using light emitting elements, various technical devices are required to adjust the white balance.

The simplest technique is to change the magnitude of the current that is input to the pixel. To achieve the technique, the magnitude of the reference constant current source should be changed depending on the color.

Another technique is to use circuits as shown in FIGS. 6(C) to 6(E) for the pixel, signal line driver circuit, reference constant current source, and the like. In the circuits as shown in FIGS. 6(C) to 6(E), the W/L ratio of two transistors forming the current mirror circuit is changed depending on the color. Thus, the magnitude of the current to be input to the pixel can be changed depending on the cooler.

Still another technique is to change the length of a lightening period. The technique can be applied to either of the case where the time gradation method is employed and the case where the time gradation method is not employed. According to the technique, the luminance of each pixel can be adjusted.

The white balance can be easily adjusted by using any one of the techniques or a combination thereof.

This embodiment may be arbitrarily combined with Embodiment Modes 1 to 10 and Embodiments 1 and 2.

Embodiment 4

In this embodiment, the appearances of the light emitting devices (semiconductor devices) of the present invention will be described using FIG. 12. FIG. 12 is a top view of a light emitting device formed such that an element substrate on which transistors are formed is sealed with a sealing material; FIG. 12(B) is a cross-sectional view taken along the line A–A' of FIG. 12(A); and FIG. 12(C) is a cross-sectional view taken along the line B–B' of FIG. 12(A).

A sealing material 4009 is provided so as to enclose a pixel portion 4002, a source signal line driver circuit 4003, and gate signal line driver circuits 4004*a* and 4004*b* that are provided on a substrate 4001. In addition, a sealing material 4008 is provided over the pixel portion 4002, the source signal line driver circuit 4003, and the gate signal line driver circuits 4004*a* and 4004*b*. Thus, the pixel portion 4002, the source signal line driver circuit 4003, and the gate signal line driver circuits 4004*a* and 4004*b* are sealed by the substrate 4001, the sealing material 4009, and the sealing material 4008 with a filler material 4210.

The pixel portion 4002, the source signal line driver circuit 4003, and the gate signal line driver circuits 4004*a* and 4004*b*, which are provided over the substrate 4001, include a plurality of TFTs. FIG. 12(B) representatively shows a driving TFT (incidentally, an n-channel TFT and a p-channel TFT are shown in this example) 4201 included in the source signal line driver circuit 4003, and an erasing TFT 4202 included in the pixel portion 4002, which are formed on a base film 4010.

In this embodiment, a p-channel TFT or an n-channel TFT that is manufactured according to a known method is used for the driving TFT 4201, and an n-channel TFT manufactured according to a known method is used for the erasing TFT 4202.

An interlayer insulating film (leveling film) 4301 is formed on the driving TFT 4201 and the erasing TFT 4202, and a pixel electrode (anode) 4203 for being electrically connected to a drain of the erasing TFT 4202 is formed thereon. A transparent conductive film having a large work function is used for the pixel electrode 4203. For the transparent conductive film, a compound of indium oxide and tin oxide, a compound of indium oxide and zinc oxide, zinc oxide, tin oxide, or indium oxide can be used. Alternatively, the transparent conductive film added with gallium may be used.

An insulating film 4302 is formed on the pixel electrode 4203, and the insulating film 4302 is formed with an opening portion formed on the pixel electrode 4203. In the opening portion, a light emitting layer 4204 is formed on the pixel electrode 4203. The light emitting layer 4204 may be formed using a known light emitting material or inorganic light emitting material. As the light emitting material, either of a low molecular weight (monomer) material and a high molecular weight (polymer) material may be used.

As a forming method of the light emitting layer 4204, a known vapor deposition technique or coating technique may be used. The structure of the light emitting layer 4204 may be either a laminate structure, which is formed by arbitrarily combining a hole injection layer, a hole transportation layer, a light-emitting layer, an electron transportation layer, and an electron injection layer, or a single-layer structure.

Formed on the light emitting layer 4204 is a cathode 4205 formed of a conductive film (representatively, a conductive film containing aluminum, copper, or silver as its main constituent, or a laminate film of the conductive film and another conductive film) having a light shielding property. Moisture and oxygen existing on an interface of the cathode 4205 and the light emitting layer 4204 are desirably eliminated as much as possible. For this reason, a technical device is necessary in that the light emitting layer 4204 is formed in an nitrogen or noble gas atmosphere, and the cathode 4205 is formed without being exposed to oxygen, moisture, and the like. In this embodiment, the above-described film deposition is enabled using a multi-chamber method (cluster-tool method) film deposition apparatus. In addition, the cathode 4205 is applied with a predetermined voltage.

In the above-described manner, a light emitting element 4303 constituted by the pixel electrode (anode) 4203, the light emitting layer 4204, and the cathode 4205 is formed. A protective film is formed on the insulating film so as to cover the light emitting element 4303. The protective film is effective for preventing, for example, oxygen and moisture, from entering the light emitting element 4303.

Reference numeral 4005*a* denotes a drawing wiring that is connected to a power supply line and that is electrically connected to a source region of the erasing TFT 4202. The drawing wiring 4005*a* is passed between the sealing material 4009 and the substrate 4001 and is then electrically connected to an FPC wiring 4301 of an FPC 4006 via an anisotropic conductive film 4300.

As the sealing material 4008, a glass material, a metal material (representatively, a stainless steel material), ceramics material, or a plastic material (including a plastic film) may be used. As the plastic material, an FRP (fiberglass reinforced plastics) plate, a PVF (polyvinyl fluoride) film, a Mylar film, a polyester film, or an acrylic resin film may be used. Alternatively, a sheet having a structure in which an aluminum foil is sandwiched by the PVF film or the Mylar film may be used.

However, a cover material needs to be transparent when light emission is directed from the light emitting layer to the cover material. In this case, a transparent substance such as a glass plate, a plastic plate, a polyester film, or an acrylic film, is used.

Further, for the filler material 4210, ultraviolet curing resin or a thermosetting resin may be used in addition to an inactive gas, such as nitrogen or argon; and PVC (polyvinyl chloride), acrylic, polyimide, epoxy resin, silicon resin, PVB (polyvinyl butyral), or EVA (ethylene vinyl acetate) may be used. In this embodiment, nitrogen was used for the filler material.

To keep the filler material 4210 to be exposed to a hygroscopic substance (preferably, barium oxide) or an oxygen-absorbable substance, a concave portion 4007 is provided on the surface of the sealing material 4008 on the side of the substrate 4001, and a hygroscopic substance or oxygen-absorbable substance 4207 is disposed. The hygroscopic substance or oxygen-absorbable substance 4207 is held in the concave portion 4007 via a concave-portion cover material 4208 such that the hygroscopic substance or oxygen-absorbable substance 4207 does not diffuse. The concave-portion cover material 4208 is in a fine mesh state and is formed to allow air and moisture to pass through and not to allow the hygroscopic substance or oxygen-absorbable substance 4207 to pass through. The provision of the hygroscopic substance or oxygen-absorbable substance 4207 enables the suppression of deterioration of the light emitting element 4303.

As shown in FIG. 12(C), simultaneously with the formation of the pixel electrode 4203, a conductive film 4203*a* is formed so as to be contact with an upper portion of the drawing wiring 4005*a*.

In addition, the anisotropic conductive film 4300 includes a conductive filler 4300*a*. The substrate 4001 and the FPC 4006 are thermally press-bonded, whereby the conductive film 4203*a* on the substrate 4001 and the FPC wiring 4301 on the FPC 4006 are electrically connected via the conductive filler 4300*a*.

This embodiment may be arbitrarily combined with Embodiment Modes 1 to 10 and Embodiments 1 to 3.

Embodiment 5

A light emitting device using light emitting elements is of self-light emitting type, so that in comparison to a liquid crystal display, the light emitting device offers a better visibility in bright portions and a wider view angle. Hence, the light emitting device can be used in display portions of various electronic devices.

Electronic devices using the light emitting device of the present invention include, there are given, for example, video cameras, digital cameras, goggle type displays (head mount displays), navigation systems, audio reproducing devices (such as car audio and audio components), notebook personal computers, game machines, mobile information terminals (such as mobile computers, mobile telephones, portable game machines, and electronic books), and image reproducing devices provided with a recording medium (specifically, devices for reproducing a recording medium such as a digital versatile disc (DVD), which includes a display capable of displaying images). In particular, in the case of mobile information terminals, since the degree of the view angle is appreciated important, the terminals preferably use the light emitting device. Practical examples are shown in FIG. 22.

FIG. 22(A) shows a light emitting element, which contains a casing 2001, a support base 2002, a display portion 2003, a speaker portion 2004, a video input terminal 2005, and the like. The light emitting element of the present invention can be applied to the display portion 2003. Further, the light emitting element shown in FIG. 22(A) is completed with the present invention. Since the light emitting element is of self-light emitting type, it does not need a back light, and therefore a display portion that is thinner than a liquid crystal display can be obtained. Note that light emitting elements include all information display devices, for example, personal computers, television broadcast transmitter-receivers, and advertisement displays.

FIG. 22(B) shows a digital still camera, which contains a main body 2101, a display portion 2102, an image receiving portion 2103, operation keys 2104, an external connection port 2105, a shutter 2106, and the like. The light emitting element of the present invention can be applied to the display portion 2102. Further, the digital still camera shown in FIG. 22(B) is completed with the present invention.

FIG. 22(C) shows a notebook personal computer, which contains a main body 2201, a casing 2202, a display portion 2203, a keyboard 2204, external connection ports 2205, a pointing mouse 2206, and the like. The light emitting element of the present invention can be applied to the display portion 2203. Further, the light emitting element shown in FIG. 22(C) is completed with the present invention.

FIG. 22(D) shows a mobile computer, which contains a main body 2301, a display portion 2302, a switch 2303, operation keys 2304, an infrared port 2305, and the like. The light emitting element of present invention can be applied to the display portion 2303. Further, the mobile computer shown in FIG. 22(D) is completed with the present invention.

FIG. 22(E) shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information. The light emitting element of the present invention can be used in the display portion A 2403 and in the display portion B 2404. Note that family game machines and the like are included in the image reproducing devices provided with a recording medium. Further, the DVD reproducing device shown in FIG. 22(E) is completed with the present invention.

FIG. 22(F) shows a goggle type display (head mounted display), which contains a main body 2501, a display portion 2502, an arm portion 2503, and the like. The light emitting element of the present invention can be used in the display portion 2502. The goggle type display shown in FIG. 22(F) is completed with the present invention.

FIG. 22(G) shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The light emitting element of the present invention can be used in the display portion 2602. The video camera shown in FIG. 22(G) is completed with the present invention.

Here, FIG. 22(H) shows a mobile telephone, which contains a main body 2701, a casing 2702, a display portion 2703, an audio input portion 2704, an audio output portion 2705, operation keys 2706, external connection ports 2707, an antenna 2708, and the like. The light emitting element of the present invention can be used in the display portion 2703. Note that, by displaying white characters on a black background, the display portion 2703 can suppress the consumption current of the mobile telephone. Further, the mobile telephone shown in FIG. 22(H) is completed with the present invention.

When the emission luminances of light emitting materials are increased in the future, the light emitting element will be able to be applied to a front or rear type projector by expanding and projecting light containing image information having been output lenses or the like.

Cases are increasing in which the above-described electronic devices display information distributed via electronic communication lines such as the Internet and CATVs (cable TVs). Particularly increased are cases where moving picture information is displayed. Since the response speed of the light emitting material is very high, the light emitting device is preferably used for moving picture display.

Since the light emitting device consumes the power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which primarily displays character information, it is preferable that the character information be formed in the light emitting portions with the non-light emitting portions being used as the background.

As described above, the application range of the present invention is very wide, so that the invention can be used for electronic devices in all of fields. The electronic devices according to this embodiment may use the light emitting device with the structure according to any one of Embodiment Modes 1 to 10 and Embodiments 1 to 4.

The present invention having the structures described above can suppress influences of variation in characteristics of TFTs, which is caused by manufacturing steps and the difference in a substrate used, and can supply a desired signal current to the outside.

Further, in the present invention, when performing the setting operation, a current source circuit disposed in an arbitrary column is specified among the columns from the first column to the last column by using the video signal. In addition, a current source circuit is specified only for an arbitrary period. Thus, the specification can be implemented for the current source circuit that requires the setting operation among the current source circuits disposed in a plurality of columns, and the setting operation can be performed in the specified current source circuit using a sufficient time. Therefore, the setting operation can be precisely performed. Note that the setting operation may be sequentially performed from the fist column to the last column among the current source circuits disposed in the plurality of columns. However, when the setting operation is not be sequentially performed for the current source circuits in the columns from the first column, and the setting operation can be performed at random for the current source circuit, various advantages are exhibited. For example, a sufficient time can be arbitrarily used to perform the setting operation for the current source circuit. In addition, in the case where periods during which the setting operation can be performed are dotted in one frame, when an arbitrary column can be selected, the degree of freedom is increased, and a setting operation period can be sufficiently secured. One of other advantages is that the influence of charge leakage in a capacitor element disposed in the current source circuit can be made inconspicuous. Thus, when a defect has occurred in association with the setting operation, the defect can be made inconspicuous.

In addition, according to the present invention, the video signal is used for the setting operation for the current source circuit, thereby obviating the necessity of dedicated circuits to perform control of the setting operation for the current source circuit and specification of the current source circuit. Consequently, since the number of circuits to be disposed is reduced, the defect-occurrence ratio during manufacture can be minimized. Furthermore, the layout area can be reduced. As a result, the frame area can be reduced, and the device can be miniaturized.

The invention claimed is:

1. A signal line driver circuit comprising:

a constant current circuit, the constant current circuit including a plurality of current source circuits corresponding to a plurality of wirings;

a shift register, the shift register including a plurality of flip-flop circuits, each of the plurality of flip-flop circuits being disposed for each of the plurality of wirings;

a first latch circuit, the first latch circuit being electrically connected to the shift register; and a second latch circuit, the second latch circuit being electrically connected to the first latch circuit and the constant current circuit, wherein, the plurality of current source circuits each comprises capacitor means and supply means; and the plurality of current source circuits each converts a supplied current to a voltage in accordance with a setting signal, and supplies a current corresponding to the converted voltage;

the current is supplied to a pixel portion comprising a plurality of pixels, and the plurality of pixels each includes a thin film transistor, a capacitor and a light emitting element.

2. A signal line driver circuit comprising:

a constant current circuit, the constant current circuit including a plurality of current source circuits corresponding to a plurality of wirings;

a shift register, the shift register including a plurality of flip-flop circuits, each of the plurality of flip-flop circuits being disposed for each of the plurality of wirings;

a first latch circuit, the first latch circuit being electrically connected to the shift register; and a second latch circuit, the second latch circuit being electrically connected to the first latch circuit and the constant current circuit, wherein, n current source circuits (n is a natural number equal to or larger than 2) each comprising capacitor means and supply means are disposed for each wiring;

the n current source circuits each converts a supplied current to a voltage in accordance with a setting signal, and supplies a current corresponding to the converted voltage;

the current is supplied to a pixel portion comprising a plurality of pixels, and the plurality of pixels each includes a thin film transistor, a capacitor and a light emitting element.

3. A signal line driver circuit according to claim 2, wherein, the n current source circuits are connected to n reference constant current sources corresponding to mutually different bits; and the values of currents supplied from the n reference constant current sources are set to $2^0:2^1:\ldots:2^n$ (n is a natural number equal to or larger than 2).

4. A signal line driver circuit according to claim 2, wherein the n current source circuits are connected to one reference constant current source corresponding to the most significant bit.

5. A signal line driver circuit according to any one of claims 1 and 2, wherein the plurality of wirings is either a plurality of signal lines or a plurality of current lines.

6. A signal line driver circuit according to any one of claims 1 and 2, wherein when a drain and a gate of a transistor of the supply means are in a short-circuited state, a voltage generated between the gate and source is retained by the supplied current.

7. A signal line driver circuit according to any one of claims 1 and 2, wherein the supply means comprises a transistor, a first switch for controlling conductivity between a gate and a drain of the transistor, a second switch for controlling conductivity between a reference constant current source and the gate of the transistor, and a third switch for controlling conductivity between the drain of the transistor and a pixel.

8. A signal line driver circuit according to any one of claims 1 and 2, wherein when drains and gates of both first and second transistors of the supply means are in a short-circuited state, the capacitor means retains a voltage generated between the gate and source of the first or second transistor by the supplied current.

9. A signal line driver circuit according to any one of claims 1 and 2, wherein the supply means comprises a current mirror circuit constituted of first and second transistors, a first switch for controlling conductivity between gates and sources of the first and second transistors, and a second switch for controlling conductivity between a reference constant current source and the gates of the first and second transistors.

10. A signal line driver circuit according to any one of claims 1 and 2, wherein when a drain and a gate of one of first and second transistors of the supply means are in a short-circuited state, a voltage generated between the gate and source is retained by the supplied current.

11. A signal line driver circuit according to any one of claims 1 and 2, wherein the supply means comprises:

a current mirror circuit comprising first and second transistors;

a first switch for controlling conductivity between a reference constant current source and a drain of the first transistor; and a second switch for controlling any one selected from conductivity between the drain and gate of the first transistor, conductivity between the gate of the first transistor and a gate of the second transistor, and conductivity between the gates of both the first and second transistors and the reference constant current source.

12. A signal line driver circuit according to claim 9, wherein gate widths and gate lengths of both the first and second transistors are set to identical values.

13. A signal line driver circuit according to claim 9, wherein a gate width and a gate length of the first transistor is set to a value larger than a gate width and a gate length of the second transistor.

14. A signal line driver circuit according to claim 10, wherein gate widths and gate lengths of both the first and second transistors are set to identical values.

15. A signal line driver circuit according to claim 10, wherein a gate width and a gate length of the first transistor is set to a value larger than a gate width and a gate length of the second transistor.

16. A signal line driver circuit according to claim 11, wherein gate widths and gate lengths of both the first and second transistors are set to identical values.

17. A signal line driver circuit according to claim 11, wherein a gate width and a gate length of the first transistor is set to a value larger than a gate width and a gate length of the second transistor.

18. A signal line driver circuit according to any one of claims 1 and 2, wherein, the supply means comprises a transistor, first and second switches for controlling supply of a current to the capacitor means, and a third switch for controlling conductivity between a gate and a drain of the transistor; and the gate of the transistor is connected to the first switch, a source of the transistor is connected to the second switch, and the drain of the transistor is connected to the third switch.

19. A signal line driver circuit according to any one of claims 1 and 2, wherein, the supply means comprises a current mirror circuit comprising m transistors;

gate widths/gate lengths of them transistors are set to $2^0$: $2^1$: . . . :$2^m$; and drain currents of the m transistors are set to $2^0$:$2^1$: . . . :$2^m$ (m is a natural number equal to or larger than 2).

20. A signal line driver circuit according to any one of claims 1 and 2, wherein a transistor constituting the supply means operates in a saturation region.

21. A signal line driver circuit according to any one of claims 1 and 2, wherein an active layer of a transistor constituting the current source circuit comprises polysilicon.

22. A signal line driver circuit according to any one of claims 1 and 2, wherein a switch is provided in each of the plurality of wirings, and the switch switches on and off of the current corresponding to the converted voltage.

23. A signal line driver circuit according to claim 22, wherein the on and off of the current corresponding to the converted voltage is performed by a video signal.

24. A signal line driver circuit according to any one of claims 1 and 2, wherein the signal line driver circuit is incorporated in at least one selected from the group consisting of a digital camera, a personal computer, a mobile computer, an image reproducing device, a goggle type display, a video camera, and a mobile telephone.

25. A signal line driver circuit comprising:

a constant current circuit, the constant current circuit including a plurality of current source circuits corresponding to a plurality of wirings;

a shift register, the shift register including a plurality of flip-flop circuits, each of the plurality of flip-flop circuits being disposed for each of the plurality of wirings;

a first latch circuit, the first latch circuit being electrically connected to the shift register; and a second latch circuit, the second latch circuit being electrically connected to the first latch circuit and the constant current circuit, wherein, the plurality of current source circuits each converts a supplied current to a voltage in accordance with a setting signal, and supply a current corresponding to the converted voltage;

the current is supplied to a pixel portion comprising a plurality of pixels, and the plurality of pixels each includes a thin film transistor, a capacitor and a light emitting element.

26. A signal line driver circuit comprising:

a constant current circuit, the constant current circuit including a plurality of current source circuits corresponding to a plurality of wirings;

a shift register, the shift register including a plurality of flip-flop circuits, each of the plurality of flip-flop circuits being disposed for each of the plurality of wirings;

a first latch circuit, the first latch circuit being electrically connected to the shift register; and a second latch circuit, the second latch circuit being electrically connected to the first latch circuit and the constant current circuit, wherein, n current source circuits each converts a supplied current to a voltage in accordance with a setting signal, and supplies a current corresponding to the converted voltage (n is a natural number equal to or larger than 2);

the current is supplied to a pixel portion comprising a plurality of pixels, and the plurality of pixels each includes a thin film transistor, a capacitor and a light emitting element.

27. A signal line driver circuit according to claim 26, wherein, the n current source circuits are connected to n reference constant current sources corresponding to mutually different bits; and the values of currents supplied from the n reference constant current sources are set to $2^0$:$2^1$: . . . : $2^n$ (n is a natural number equal to or larger than 2).

28. A signal line driver circuit according to claim 26, wherein the n current source circuits are connected to one reference constant current source corresponding to the most significant bit.

29. A signal line driver circuit according to claims 25 and 26, wherein the plurality of wirings is either a plurality of signal lines or a plurality of current lines.

30. A signal line driver circuit according to any one of claims 25 and 26, wherein an active layer of a transistor constituting the current source circuit comprises polysilicon.

31. A signal line driver circuit according to any one of claims 25 and 26, wherein a switch is provided in each of the plurality of wirings, and the switch switches on and off of the current corresponding to the converted voltage.

32. A signal line driver circuit according to claim 31, wherein the on and off of the current corresponding to the converted voltage is performed by a video signal.

33. A signal line driver circuit according to any one of claims 25 and 26, wherein the signal line driver circuit is incorporated in at least one selected from the group consisting of a digital camera, a personal computer, a mobile computer, an image reproducing device, a goggle type display, a video camera, and a mobile telephone.

* * * * *